US010085581B2

(12) United States Patent
Greenberg

(10) Patent No.: US 10,085,581 B2
(45) Date of Patent: Oct. 2, 2018

(54) METHOD OF MANUFACTURING A PHYLACTERY AND A PHYLACTERY MANUFACTURED THEREBY

(71) Applicant: Noah Jeremiah Greenberg, Tzfat (IL)

(72) Inventor: Noah Jeremiah Greenberg, Tzfat (IL)

( * ) Notice: Subject to any disclaimer, the term of this patent is extended or adjusted under 35 U.S.C. 154(b) by 384 days.

(21) Appl. No.: 14/306,850

(22) Filed: Jun. 17, 2014

(65) Prior Publication Data

US 2015/0359373 A1 Dec. 17, 2015

(51) Int. Cl.

| | |
|---|---|
| ***A47G 33/08*** | (2006.01) |
| ***A47G 33/00*** | (2006.01) |
| ***C14B 5/00*** | (2006.01) |
| *B68F 1/00* | (2006.01) |

(52) U.S. Cl.

CPC ..... *A47G 33/008* (2013.01); *C14B 5/00* (2013.01); *B68F 1/00* (2013.01)

(58) Field of Classification Search

CPC ..... A47G 33/008; B68F 1/00

See application file for complete search history.

(56) References Cited

U.S. PATENT DOCUMENTS 1,481,161 A * 1/1924 Tasler ..... A24F 15/18 206/38
2,706,037 A * 4/1955 Feigelman ..... B65D 5/009 206/748
3,258,188 A * 6/1966 Houston ..... B65D 5/48048 229/120.33
5,685,450 A * 11/1997 Uda ..... B65D 88/1625 220/23.9
2004/0182916 A1* 9/2004 Roseth ..... B65D 5/2047 229/155

FOREIGN PATENT DOCUMENTS

WO WO 2012037542 A1 * 3/2012 ..... B65D 71/18

OTHER PUBLICATIONS

Greenberg, N.; "Kesher Tefillin", 2009, p. 1-14, http://www.kesher-tefillin.com/.*
Farmer Jo, "Hiding", 2011, p. 1-7; Accessed on Mar. 20, 2017 at https://farmerjo.wordpress.com/2011/06/07/hiding-3/.*
Kass, S.; "Archive for Tefillin", 2013, p. 1-9; Accessed on Mar. 21, 2017 at http://sofercenter.com/batim/.*
Judaica Guide, "Tefillin (Gasot or Dakot)", 2005, p. 1-2; Accessed at https://web.archive.org/web/20061213083141/http://www.judaica-guide.com/tefillin/.*
Greenberg, Noah, "Kesher Tefillin", retrieved from http://www.kesher-tefillin.com/, Dec. 15, 2009,14 pages total.

* cited by examiner

*Primary Examiner* — Humera Sheikh
*Assistant Examiner* — Julia L Rummel
(74) *Attorney, Agent, or Firm* — Sughrue Mion, PLLC

(57) ABSTRACT

A method of manufacturing a phylactery, the method including providing an initial stage phylactery workpiece formed of animal skin, cutting the initial stage phylactery workpiece to define a second stage phylactery workpiece, the cutting including forming at least outline cut lines, interior cut lines and incised lines, and folding the second stage phylactery workpiece along at least some of the incised lines to define the phylactery.

8 Claims, 168 Drawing Sheets

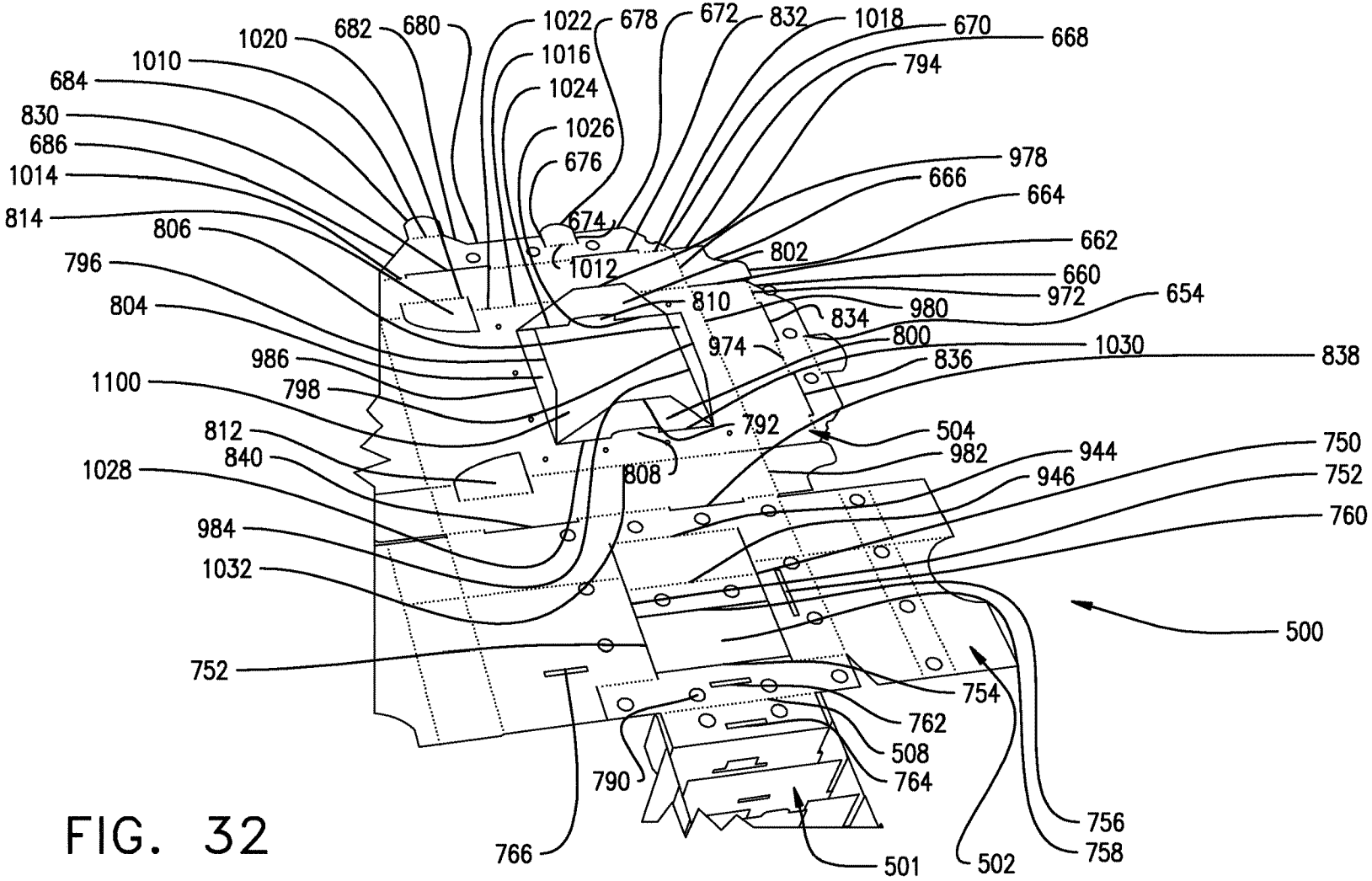
500
501
502
508
510
512
514
516
518
520
522
524
526
528
530
532
534
536
538
540
542
544
546
548
550
552
554
556
558
560
562
564
566
568
570
572
574
576
578
580
582
584
586

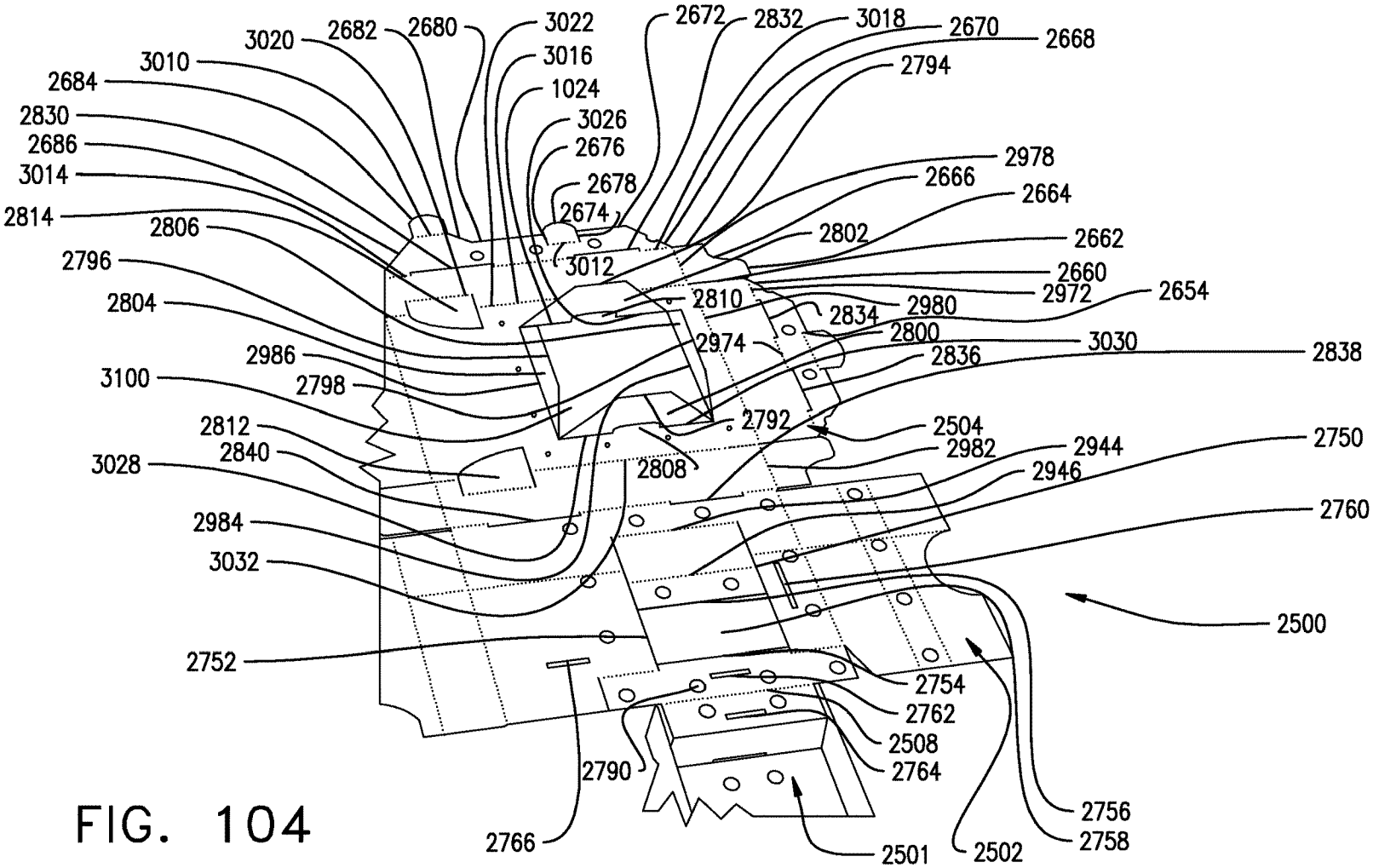
2500
2501
2502
2504
2508
2510
2512
2514
2516
2518
2520
2522
2524
2526
2528
2530
2532
2534
2536
2538
2540
2542
2544
2546
2548
2550
2552
2554
2556
2558
2560
2562
2564
2566
2568
2570
2572
2574
2576
2578
2580
2582
2584
2586

METHOD OF MANUFACTURING A PHYLACTERY AND A PHYLACTERY MANUFACTURED THEREBY

FIELD OF THE INVENTION

The present invention relates to phylacteries generally and more particularly to a method of manufacture of phylacteries and to phylacteries manufactured in accordance with the method.

BACKGROUND OF THE INVENTION

According to Jewish tradition, phylacteries have been in existence for over 3000 years. They are constructed in accordance with specifications that are well established in Jewish law. Manufacture of phylacteries has changed somewhat over the millennia as technology has advanced.

The inventor has in the past, in an educational context, demonstrated making phylacteries by cutting and folding parchment. The phylacteries produced in these educational demonstrations were not suitable for actual use. They were not durable or of a saleable design or quality.

SUMMARY OF THE INVENTION

The present invention seeks to provide a novel method of manufacture of phylacteries and novel phylacteries which are in accordance with the specifications established in Jewish law.

There is thus provided in accordance with a preferred embodiment of the present invention a method of manufacturing a phylactery, the method including:

providing an initial stage phylactery workpiece formed of animal skin;

cutting the initial stage phylactery workpiece to define a second stage phylactery workpiece, the cutting including forming at least outline cut lines, interior cut lines and incised lines; and folding the second stage phylactery workpiece at least along at least some of the incised lines to define the phylactery.

Preferably, the animal skin has a skin outer surface and a skin inner surface, the initial stage phylactery workpiece has an outer surface corresponding to the skin outer surface and an inner surface corresponding to the skin inner surface and the second stage phylactery workpiece has an outer phylactery surface corresponding to the skin outer surface and an inner phylactery surface corresponding to the skin inner surface.

In accordance with a preferred embodiment of the present invention, the animal skin has a skin outer surface and a skin inner surface, the initial stage phylactery workpiece has an outer surface corresponding to the skin inner surface and an inner surface corresponding to the skin outer surface and the second stage phylactery workpiece has an outer phylactery surface corresponding to the skin inner surface and an inner phylactery surface corresponding to the skin outer surface.

Preferably, the incised line is formed on the phylactery outer surface.

In accordance with a preferred embodiment of the present invention, the folding along the incised lines produces an interior fold.

Preferably, the cutting also includes forming at least one perforated line.

In accordance with a preferred embodiment of the present invention, the folding along the perforated lines forms an exterior fold.

Preferably, the folding defines the phylactery having an outer phylactery surface which is entirely defined by one animal skin surface.

In accordance with a preferred embodiment of the present invention, the folding produces a phylactery wherein all visible exterior surfaces thereof are defined by the same surface of the animal skin.

Preferably, folding defines a plurality of adjacent generally rectangular, mutually parallel compartments and also includes insertion of a structural insert into engagement with the compartments for maintaining them in a mutually parallel adjacent relationship.

In accordance with a preferred embodiment of the present invention, the folding defines a plurality of three-dimensional internal structural elements which provide enhanced rigidity and maintenance of dimensions and form.

Preferably, the animal skin has a thickness exceeding 0.3 mm.

In accordance with a preferred embodiment of the present invention, the folding defines a plurality of interlocking flaps and slots which provide enhanced rigidity, registration and precision of external surfaces of the phylactery.

Preferably, the plurality of interlocking flaps include widened end portions which extend through corresponding mutually interlocking slots.

In accordance with a preferred embodiment of the present invention, the widened end portions and other structural elements have a dimension which is generally identical to an interior dimension of a space between a top portion of a top and side portion and a bottom portion of an internal structural portion, when the phylactery is fully folded.

Preferably, the plurality of interlocking flaps include flaps formed with convex cuts to form tabs.

In accordance with a preferred embodiment of the present invention, the plurality of interlocking flaps include flap portions which are positioned between widened end portions of other flaps.

Preferably, the plurality of interlocking flaps include tabs defined by convex cuts which engage respective slots, thereby defining a dimension between respective planes of a top portion of a top and side portion and a bottom portion of an internal structural portion when the phylactery is fully folded.

In accordance with a preferred embodiment of the present invention, the method also includes:

inserting a phylactery parchment scroll into each of a plurality of mutually parallel compartments defined by the folding; and thereafter securing the plurality of mutually parallel compartments by folding retaining flaps into transverse dimension defining and retaining engagement with respective slots.

In accordance with a preferred embodiment of the present invention, there is provided a phylactery including:

a housing, the housing including a piece of animal skin having cut therein at least interior cut lines and incised lines and being folded along at least some of the incised lines;

a strap operatively associated with the housing; and a plurality of biblical passages written on animal parchment, which are located within the housing.

Preferably, the skin also includes perforated lines and is folded along at least some of the perforated lines.

In accordance with a preferred embodiment of the present invention, there is provided a phylactery wherein all visible exterior surfaces thereof are defined by the same surface of the animal skin.

Preferably, the housing includes a plurality of adjacent generally rectangular, mutually parallel compartments and also including a structural insert which engages the interior of the compartments and maintains them in mutually parallel adjacent relationship.

In accordance with a preferred embodiment of the present invention, there is provided a phylactery wherein the housing includes a plurality of three-dimensional internal structural elements which provide enhanced rigidity and maintenance of dimensions and form.

Preferably, the housing includes a plurality of interlocking flaps and slots which provide enhanced rigidity, registration and precision of external surfaces of the phylactery.

In accordance with a preferred embodiment of the present invention the animal skin has a thickness exceeding 0.3 mm.

Preferably, the animal skin is parchment.

In accordance with a preferred embodiment of the present invention, a phylactery workpiece is provided being formed of animal skin and cut to define at least outline cut lines, interior cut lines and incised lines, the phylactery workpiece being foldable to define a phylactery.

Preferably, the phylactery workpiece has interior cut lines which define a plurality of interlocking flaps and slots which provide enhanced rigidity, registration and precision of external surfaces of the phylactery.

BRIEF DESCRIPTION OF THE DRAWINGS

The present invention will be understood and appreciated more fully from the following detailed description, taken in conjunction with the drawings in which:

FIG. 32 is a simplified illustration of the folding four generally trapezoidal flaps in the partially assembled head phylactery subpattern, which, when suitably folded and assembled, defines a base for the subassembly;

FIG. 104 is a simplified illustration of which illustrates folding four generally trapezoidal flaps about respective interior fold lines to define an aperture bordered by the folded flaps;

FIG. 121 is a simplified illustration of an initial stage in folding a part of the internal structural portion about an internal fold line;

FIG. 122 is a simplified illustration of a final stage in folding a portion about an internal fold line such that the portions lie generally perpendicular to the plane of the internal structural portion;

FIG. 123 is a simplified illustration of a folding of an additional portion about an additional internal fold line such that the portion lies generally perpendicular to the plane of an internal structural portion;

FIG. 124 is a simplified illustration of a slight mutual unfolding of flap portions about an internal fold line so that they engage in a tab socket portion defined in mesa shaped slot;

FIG. 125 is a simplified illustration showing partial insertion of additional folded over flap portions in a mesa shaped slot;

FIG. 126 is a simplified illustration showing folding of a portion about an internal fold line such that the portion lies generally perpendicular to the plane of an internal structural portion;

FIG. 127 is a simplified illustration showing the folding of a part of the internal structural portion about an internal fold line such that the portion lines generally perpendicular to the plane of an internal structural portion;

FIG. 128 is a simplified illustration showing slight mutual unfolding of flap portions about internal fold lines so that end tab portions engage respective tab socket portions defined in respective mesa shaped slots;

FIG. 129 is a simplified illustration showing the folding of another part of the internal structural portion about an internal fold line such that the portion lies generally perpendicular to the plane of an internal structural portion;

FIG. 130 is a simplified illustration showing the folding of a yet another part of the internal structural portion about an internal fold line such that the portion lies generally perpendicular to the plane of an internal structural portion;

FIG. 131 is a simplified illustration showing the folding of a further part of the internal structural portion about an internal fold line such that the portion lies generally perpendicular to the plane of an internal structural portion;

FIG. 132 is a simplified illustration showing the folding of yet a further part of the internal structural portion about an internal fold line such that the portion lies generally perpendicular to the plane of an internal structural portion;

Figure 133:
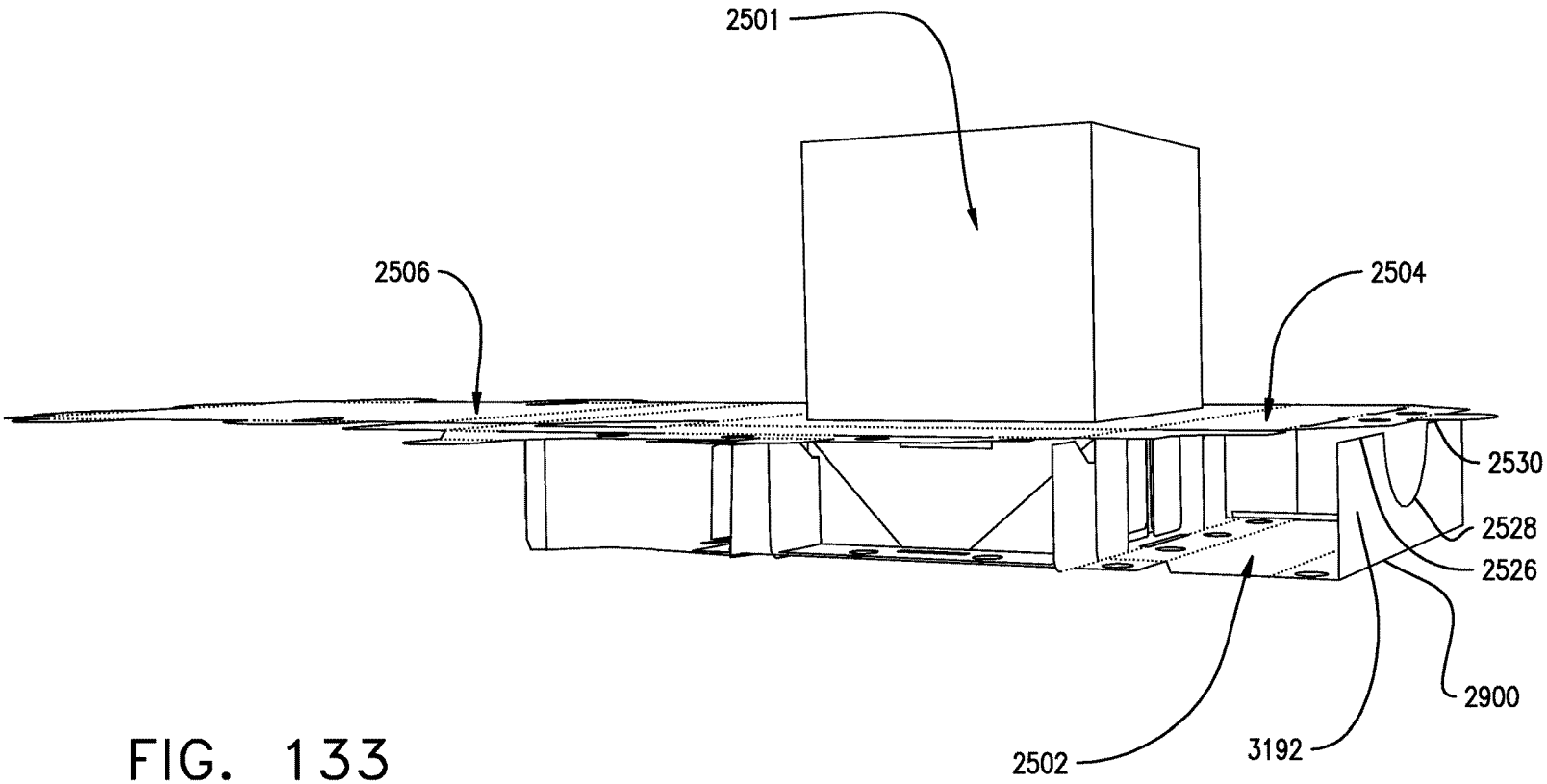
Figure 134:
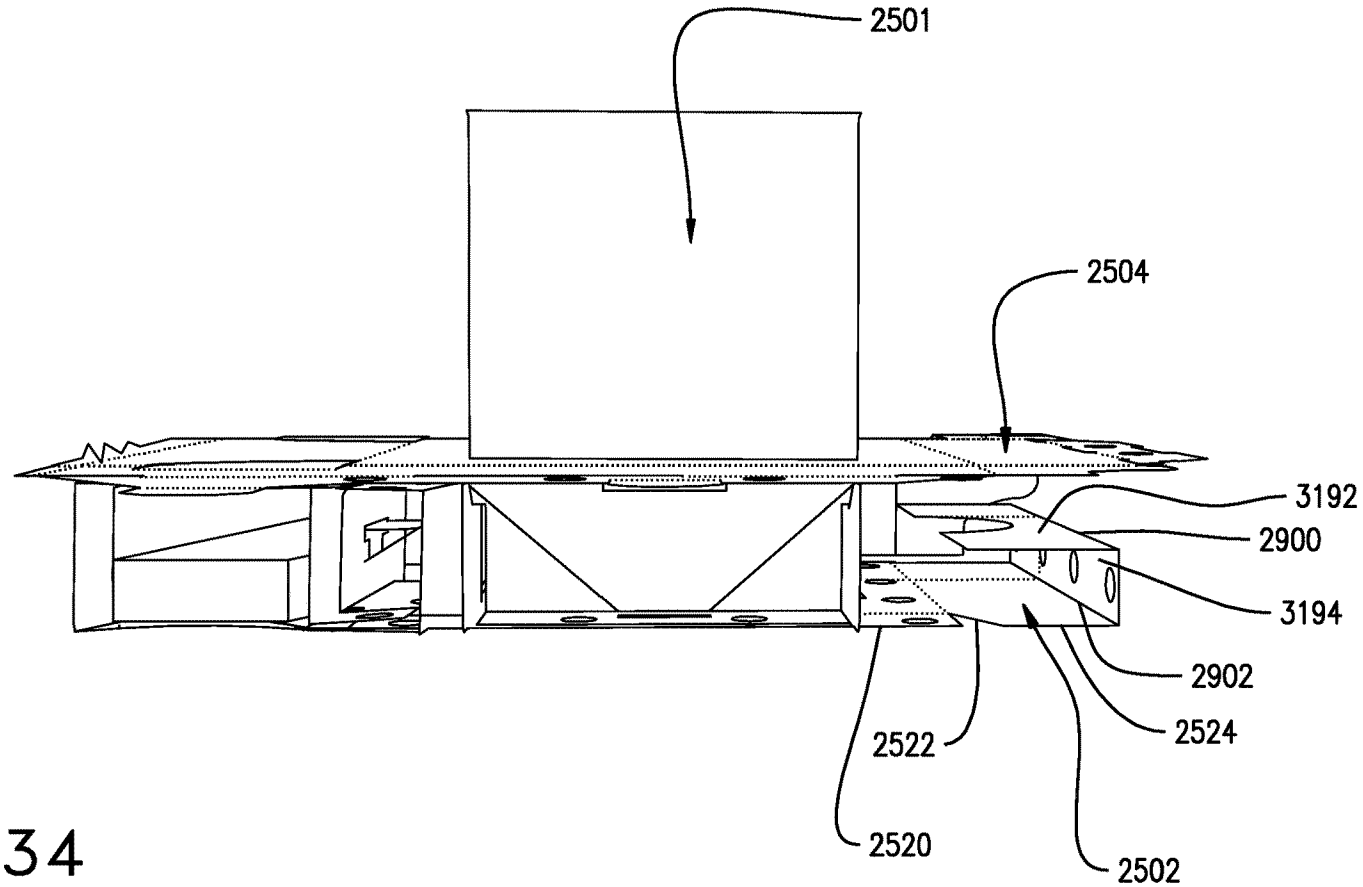
Figure 135:
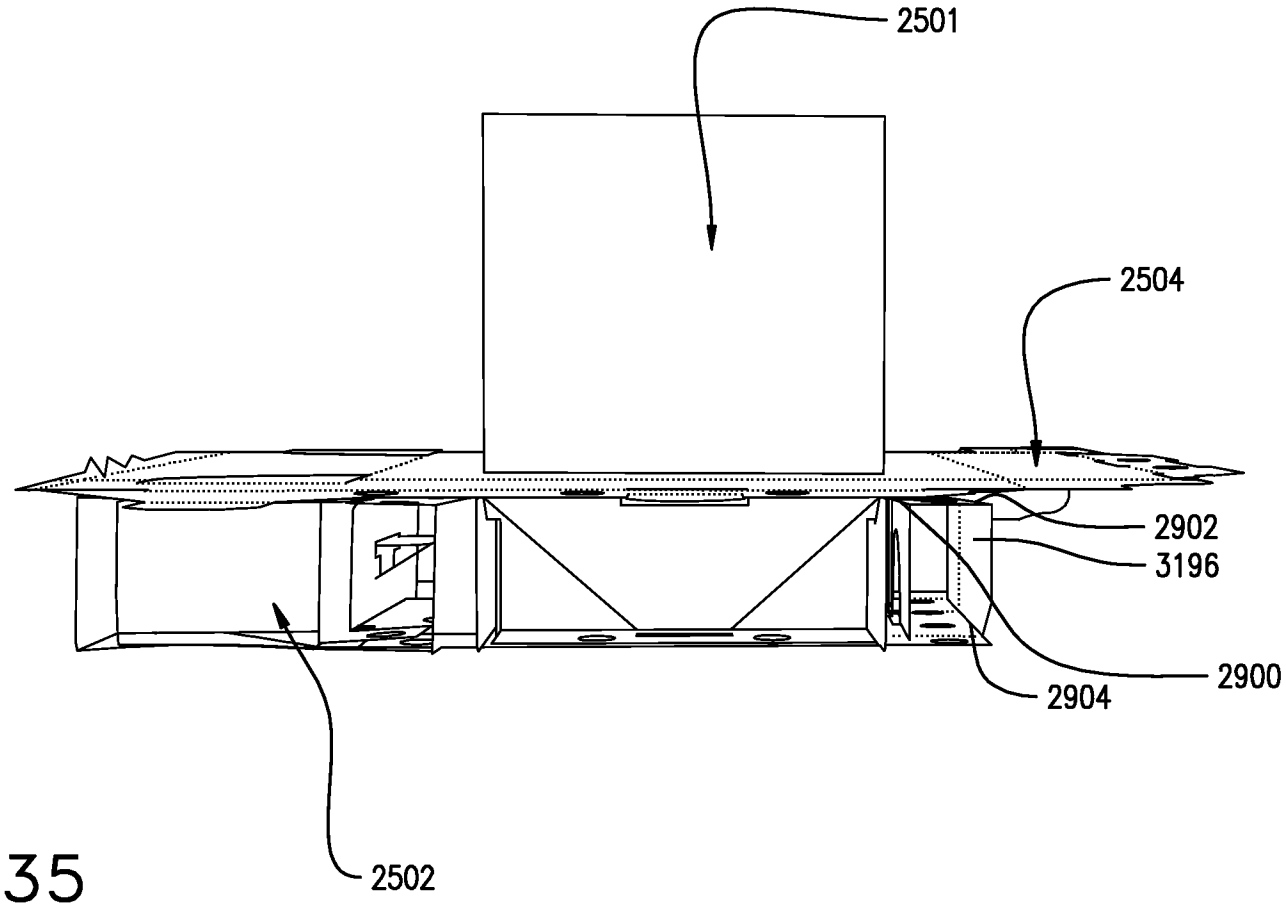
Figure 136:
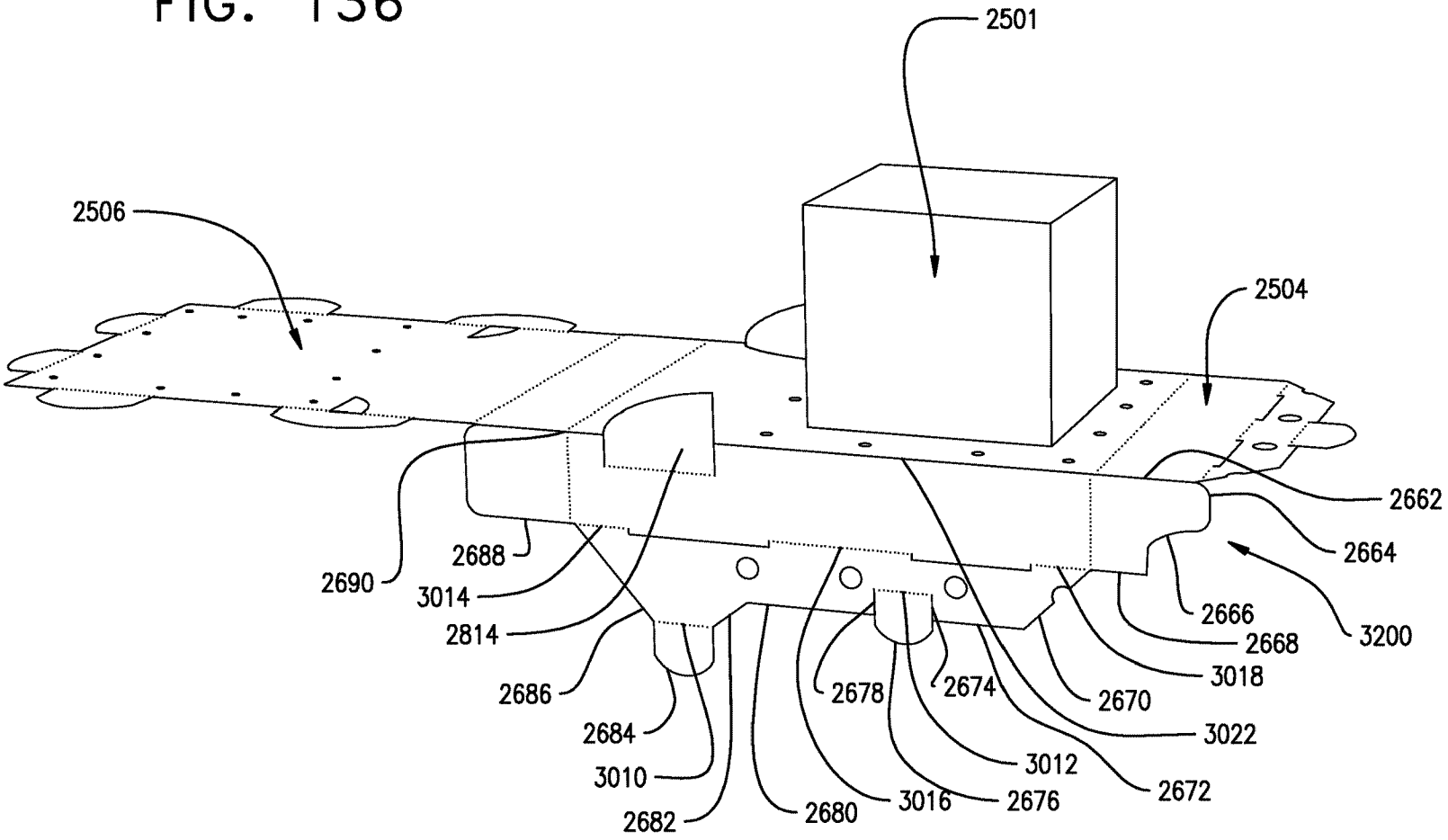
Figure 137:
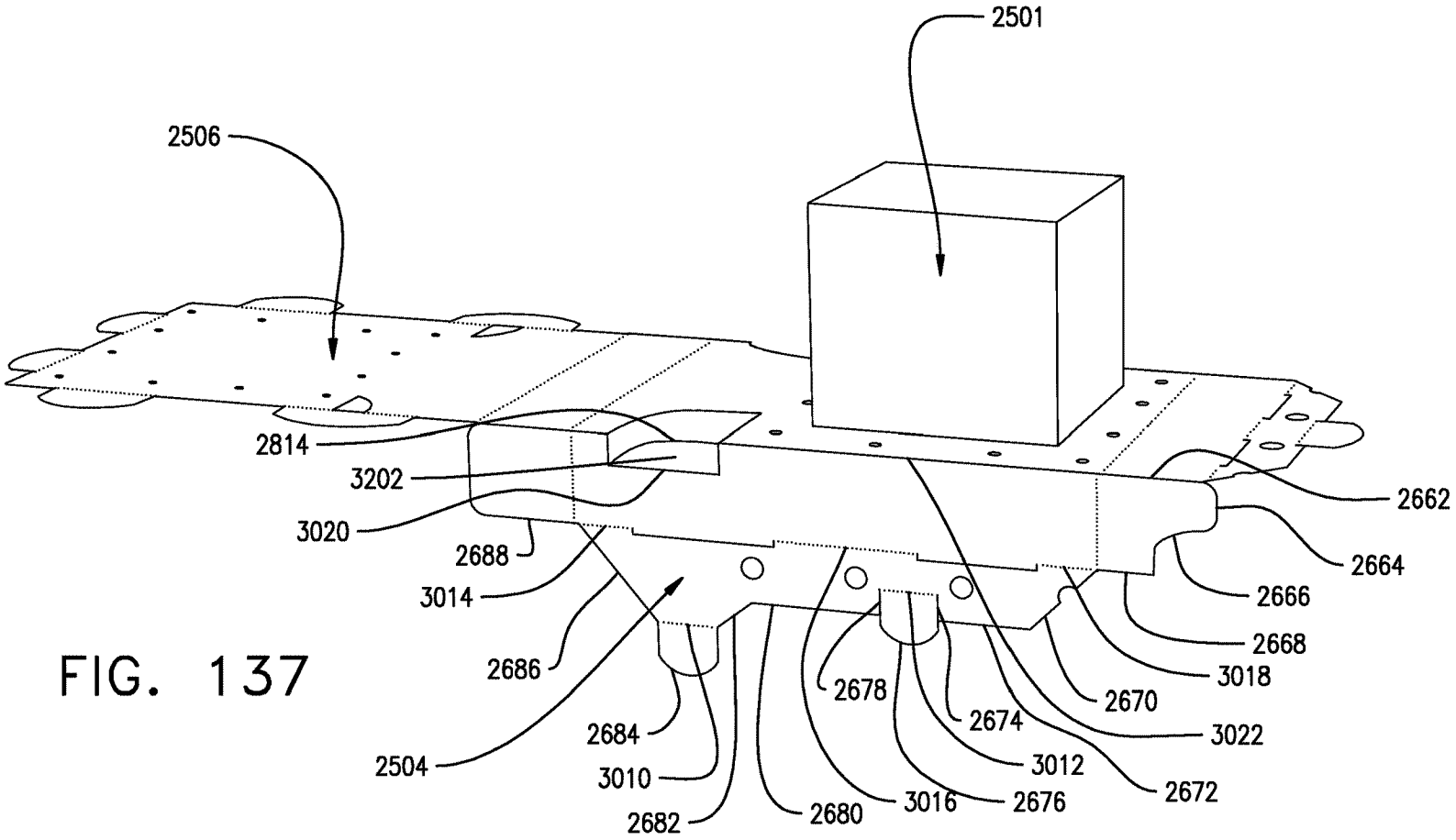
Figure 138:
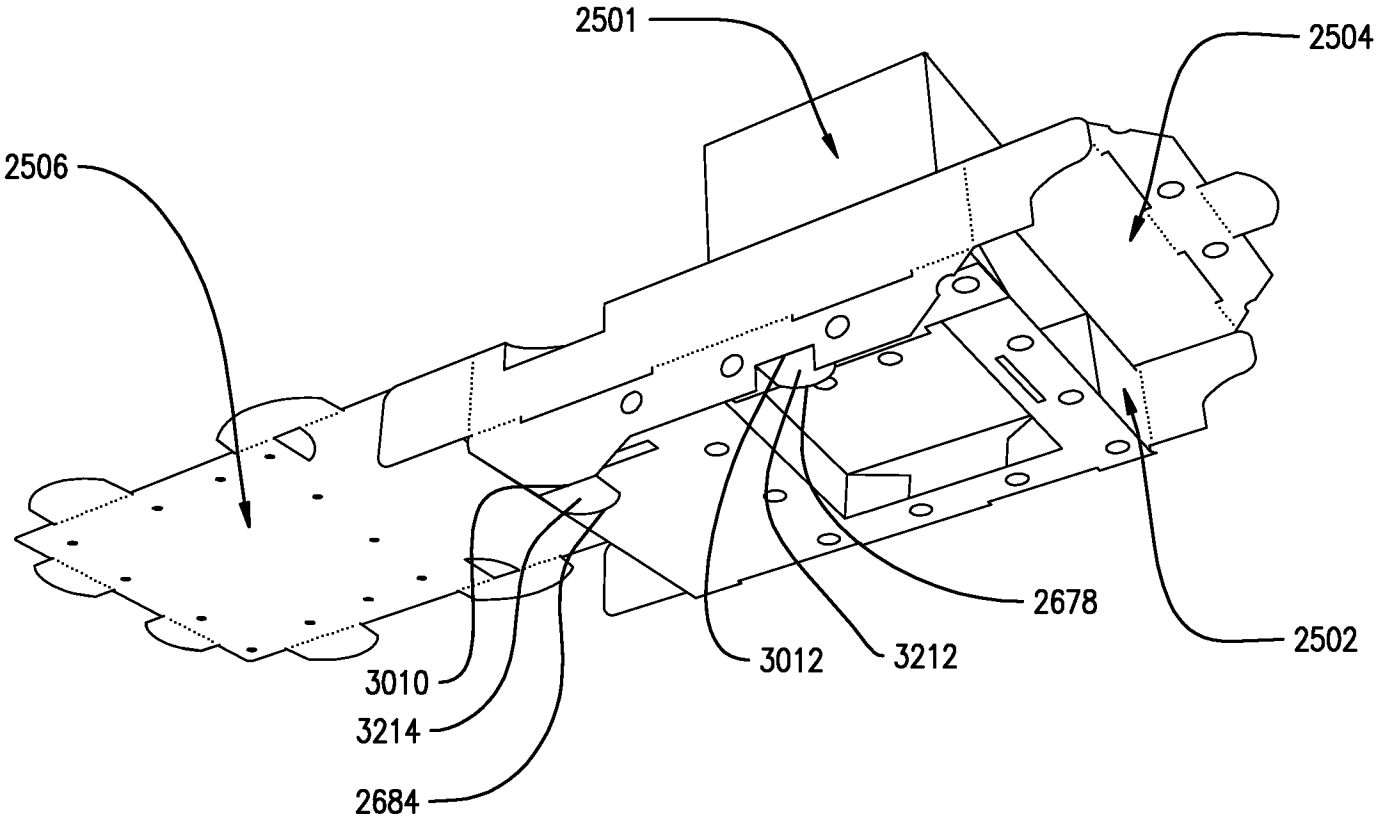
Figure 139:
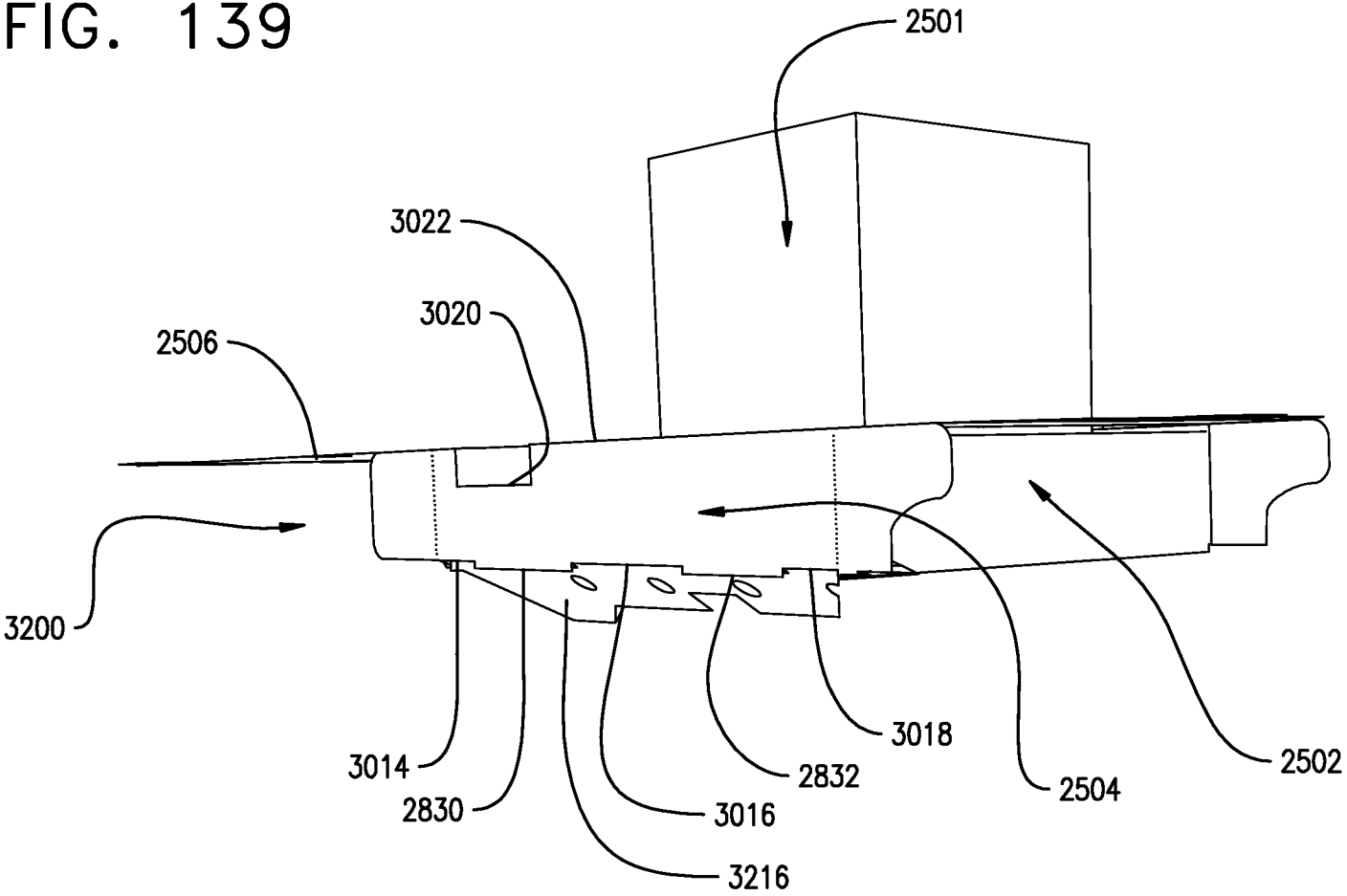
Figure 140:
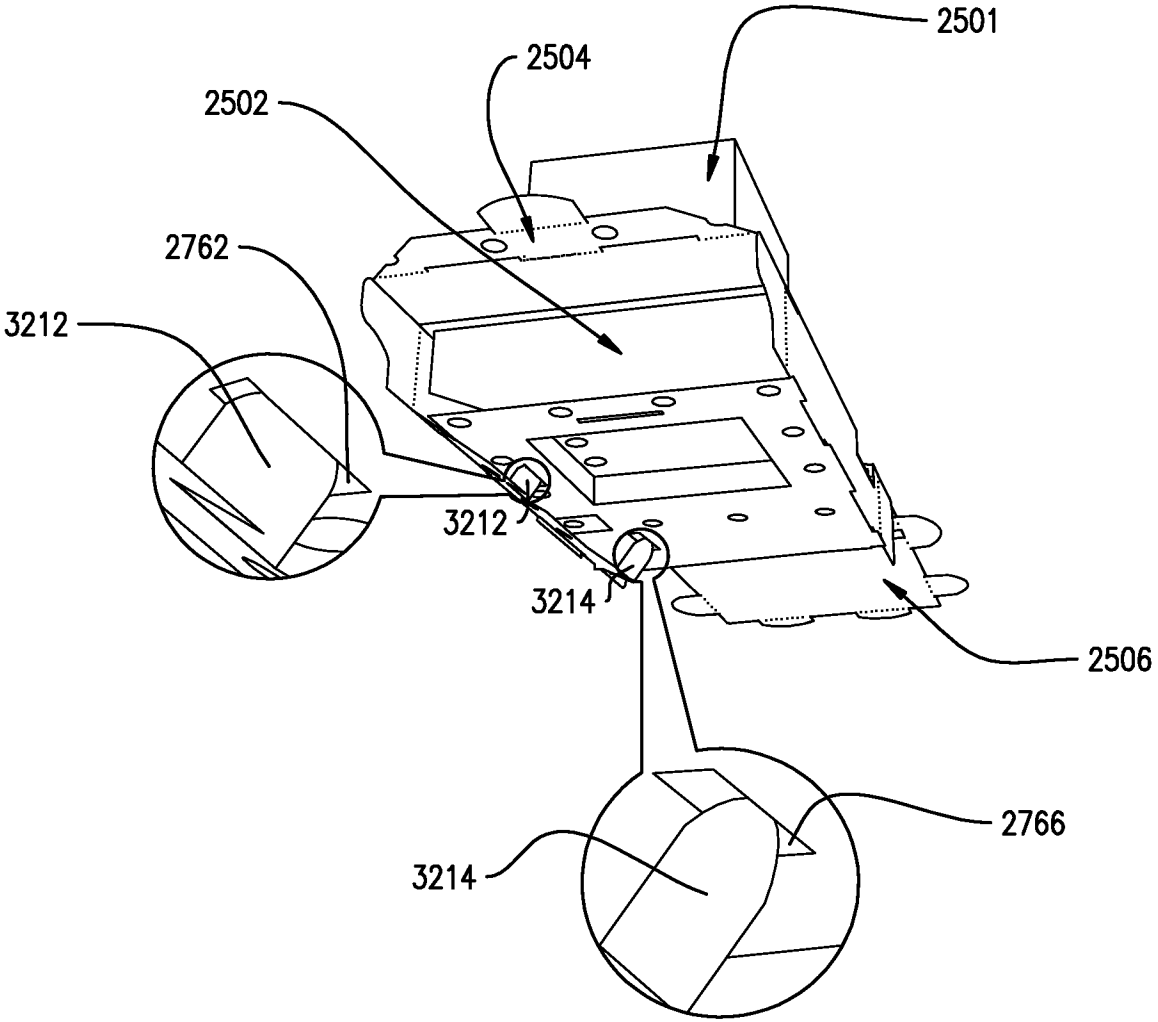
Figure 141:
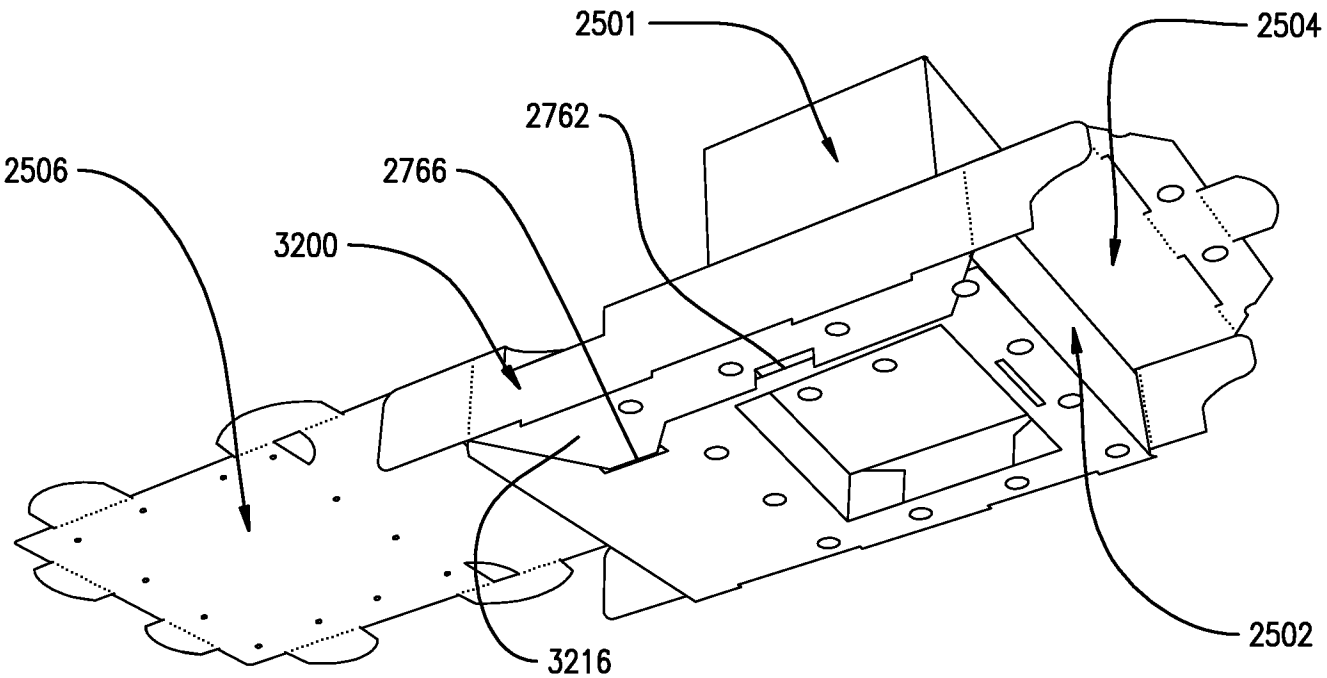
Figure 142:
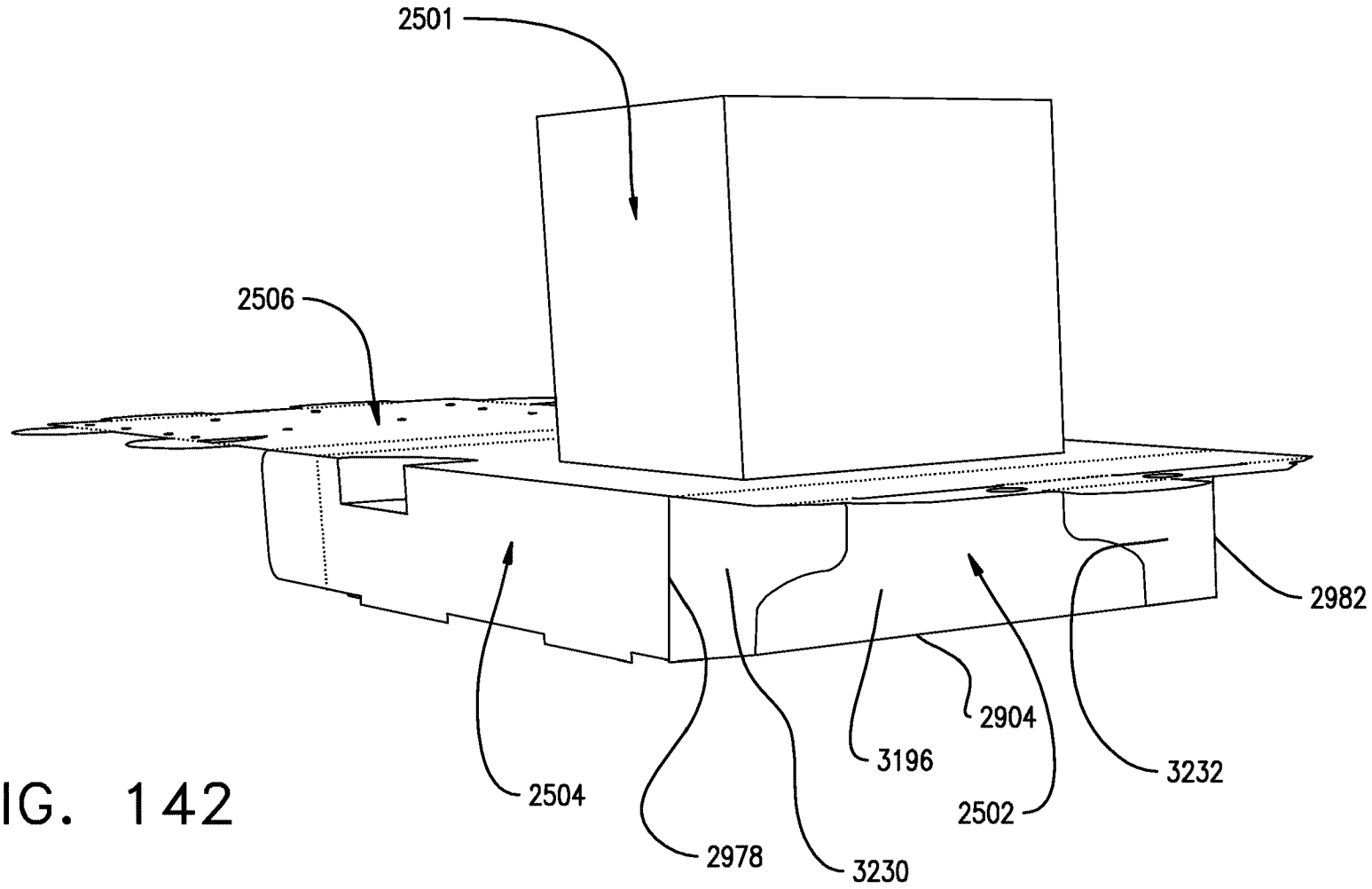
Figure 143:
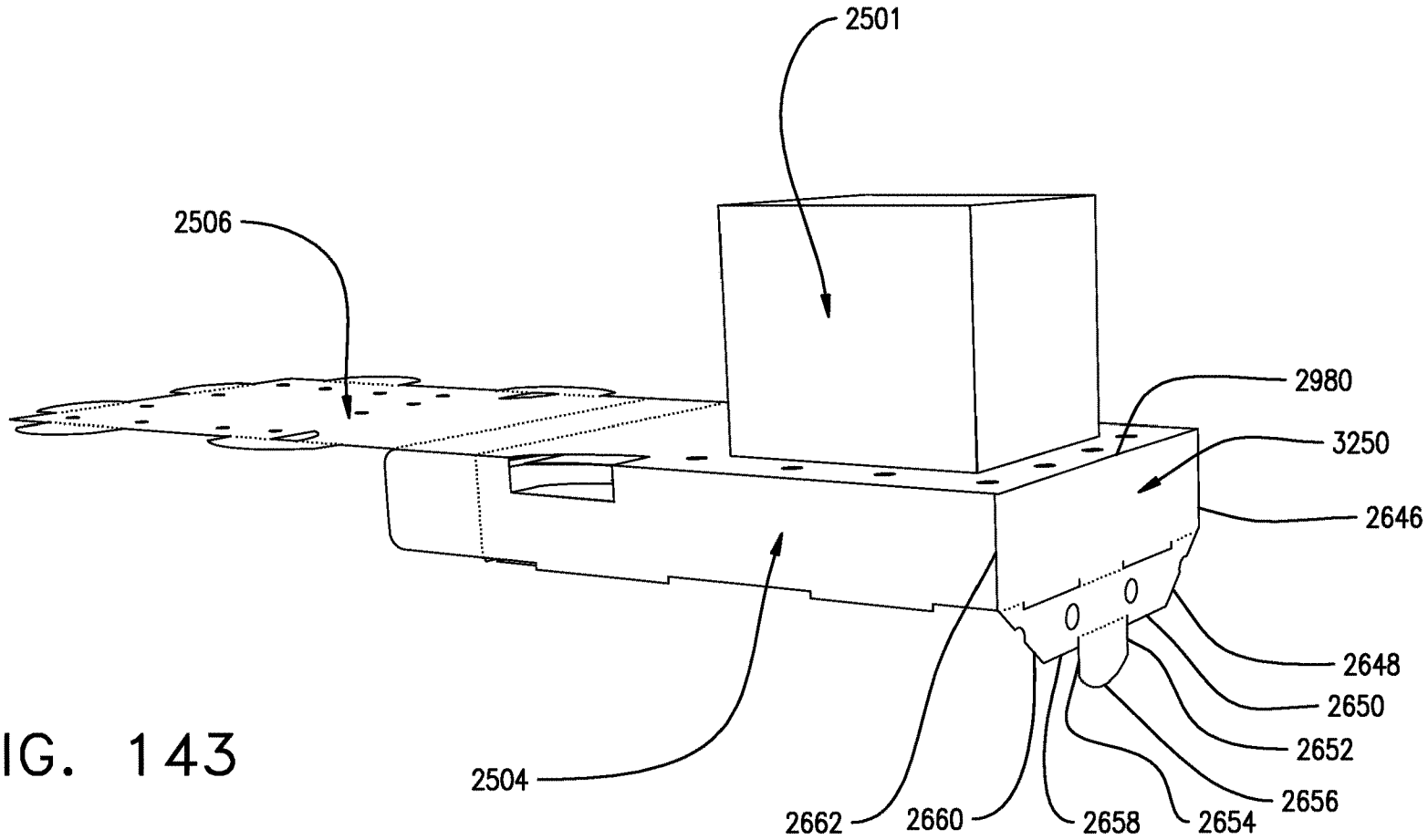
Figure 144:
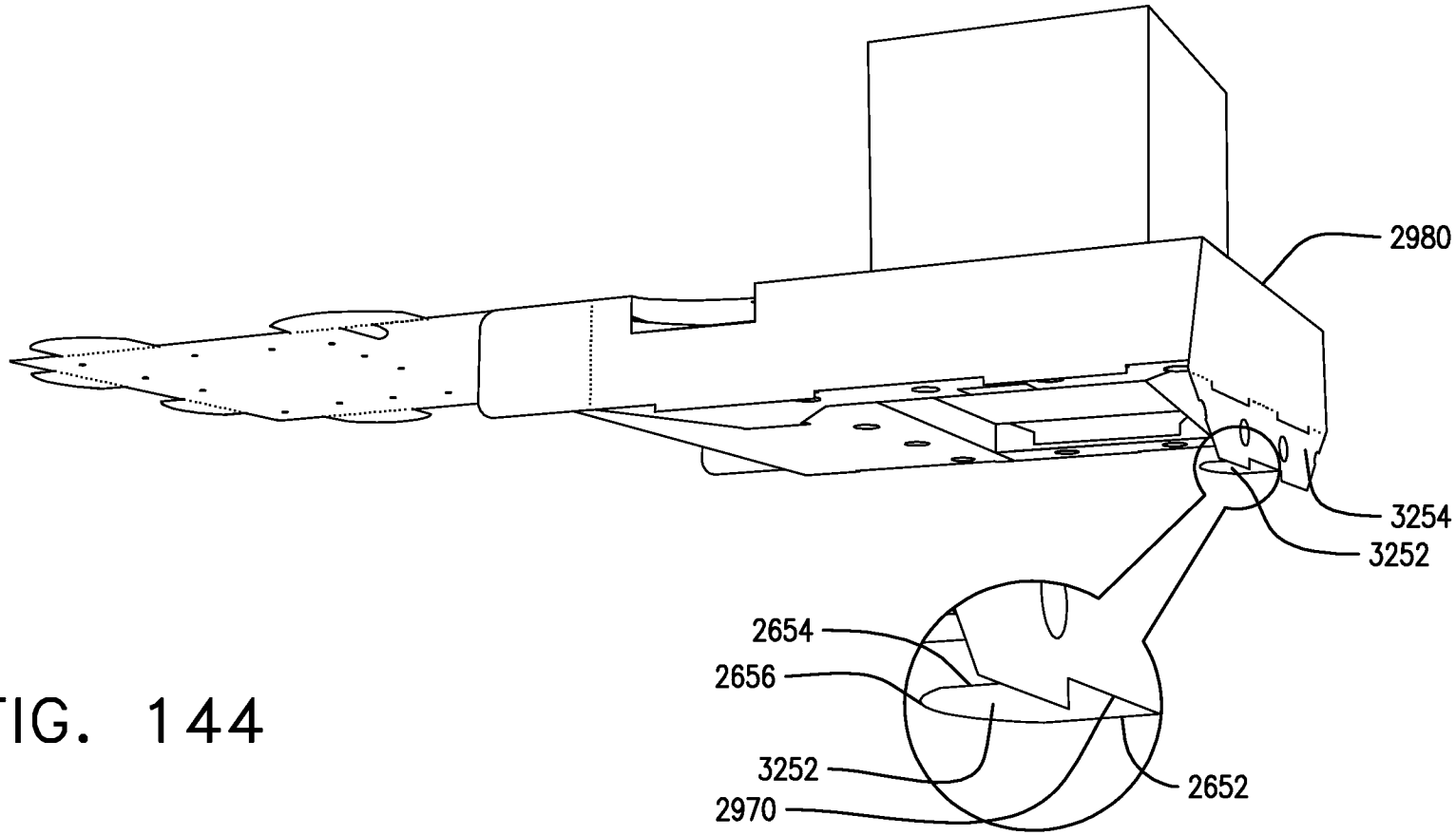
Figure 145:
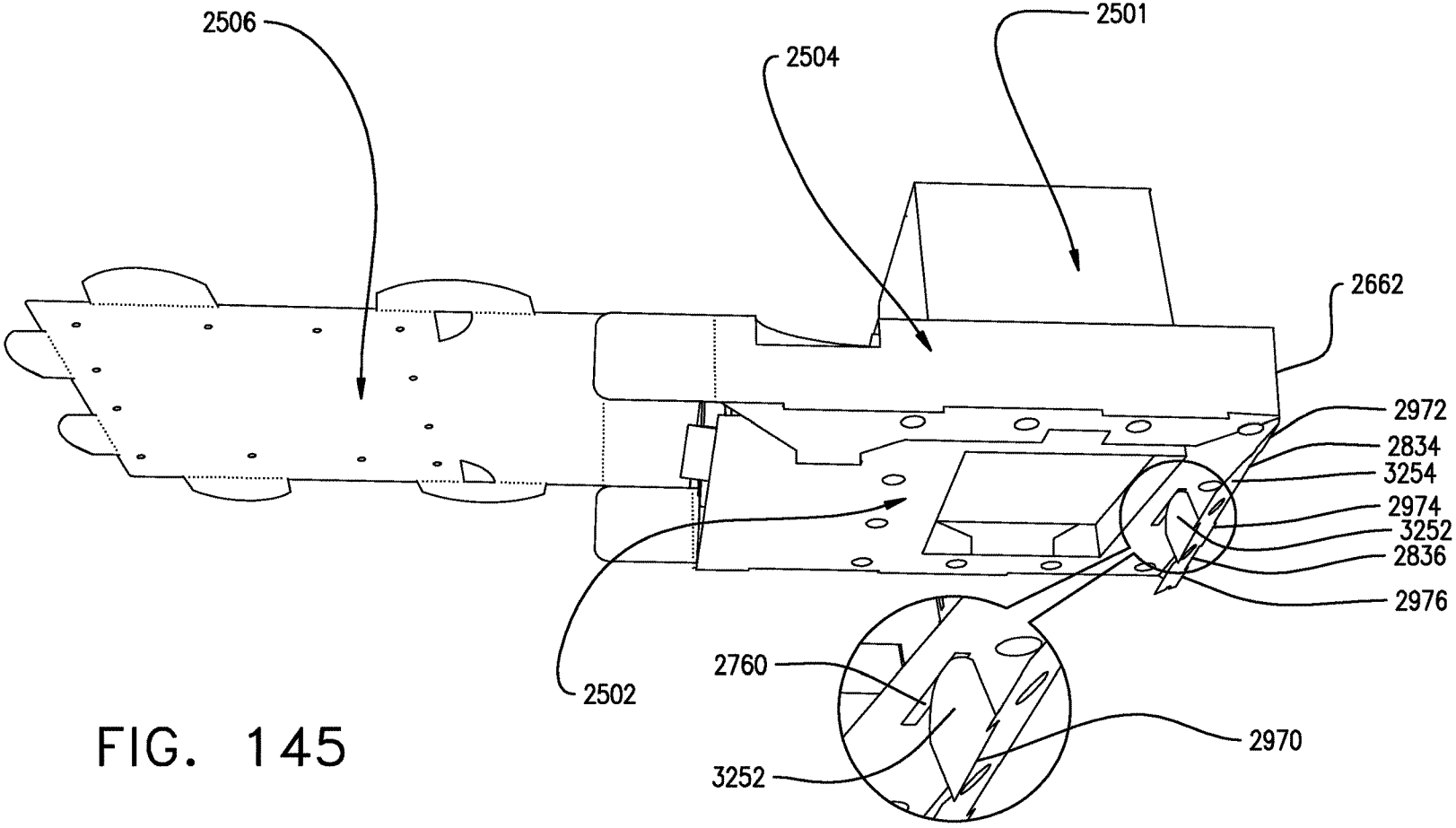
Figure 146:
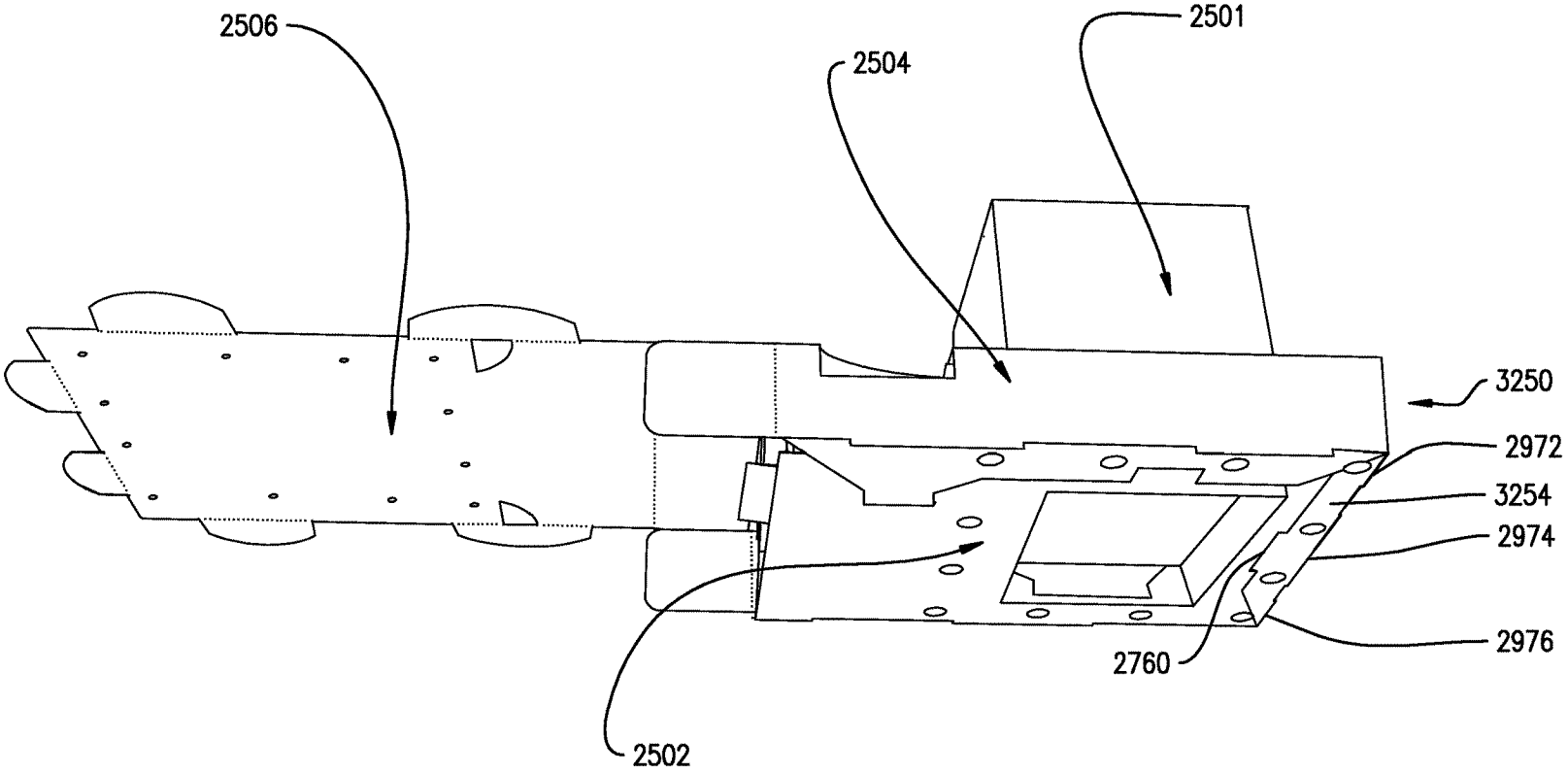
Figure 147:
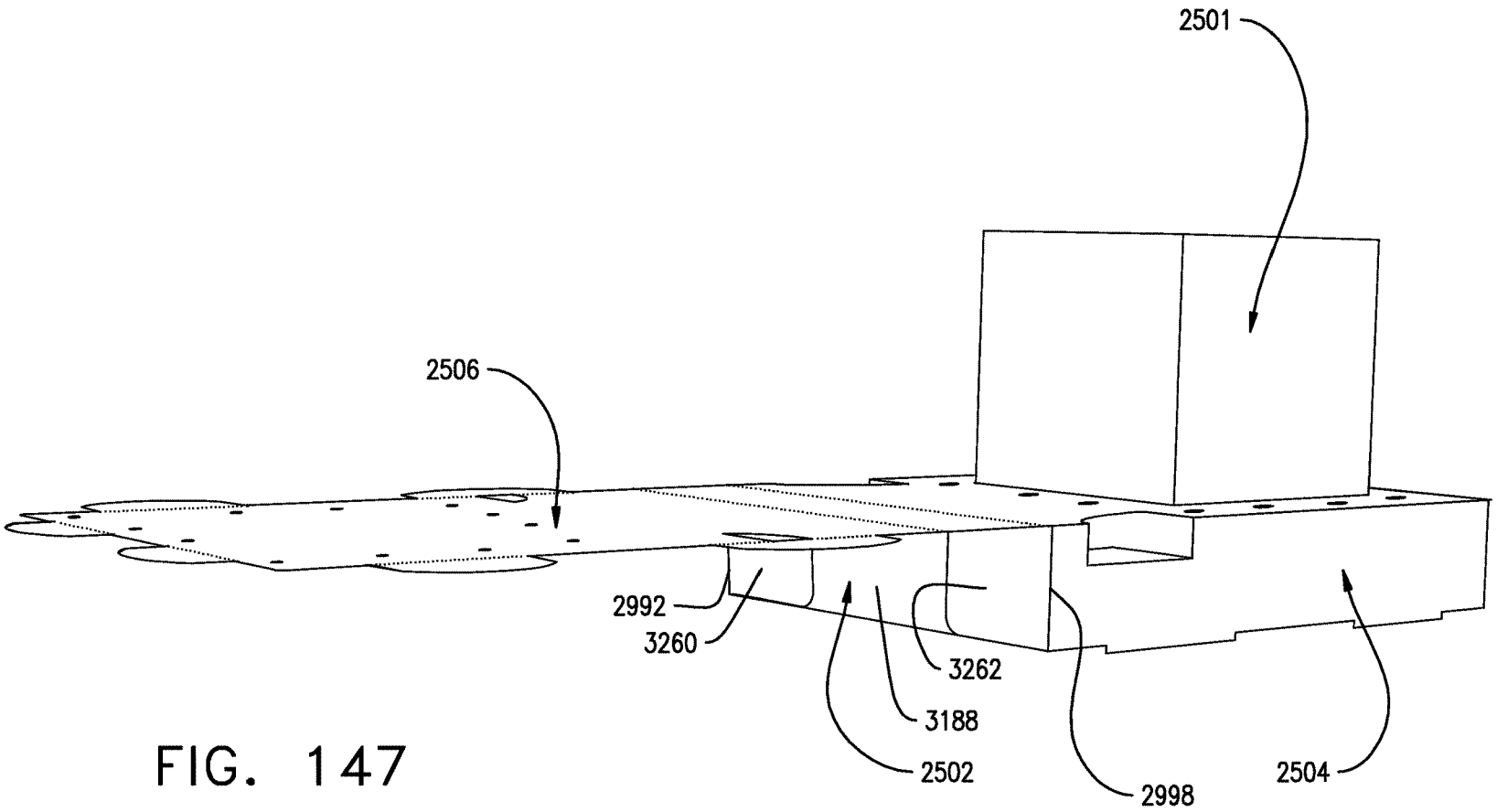
Figure 148:
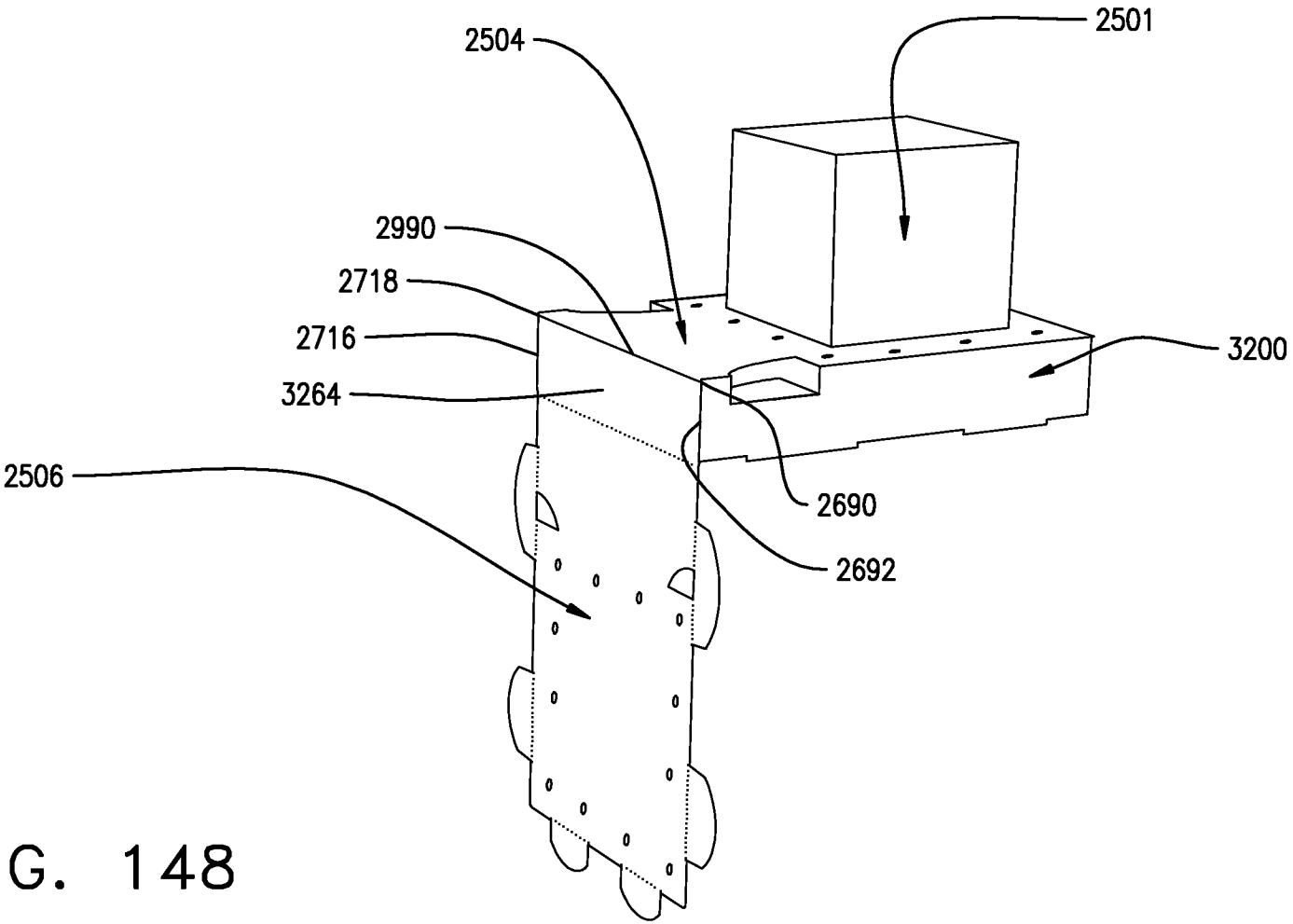
Figure 149:
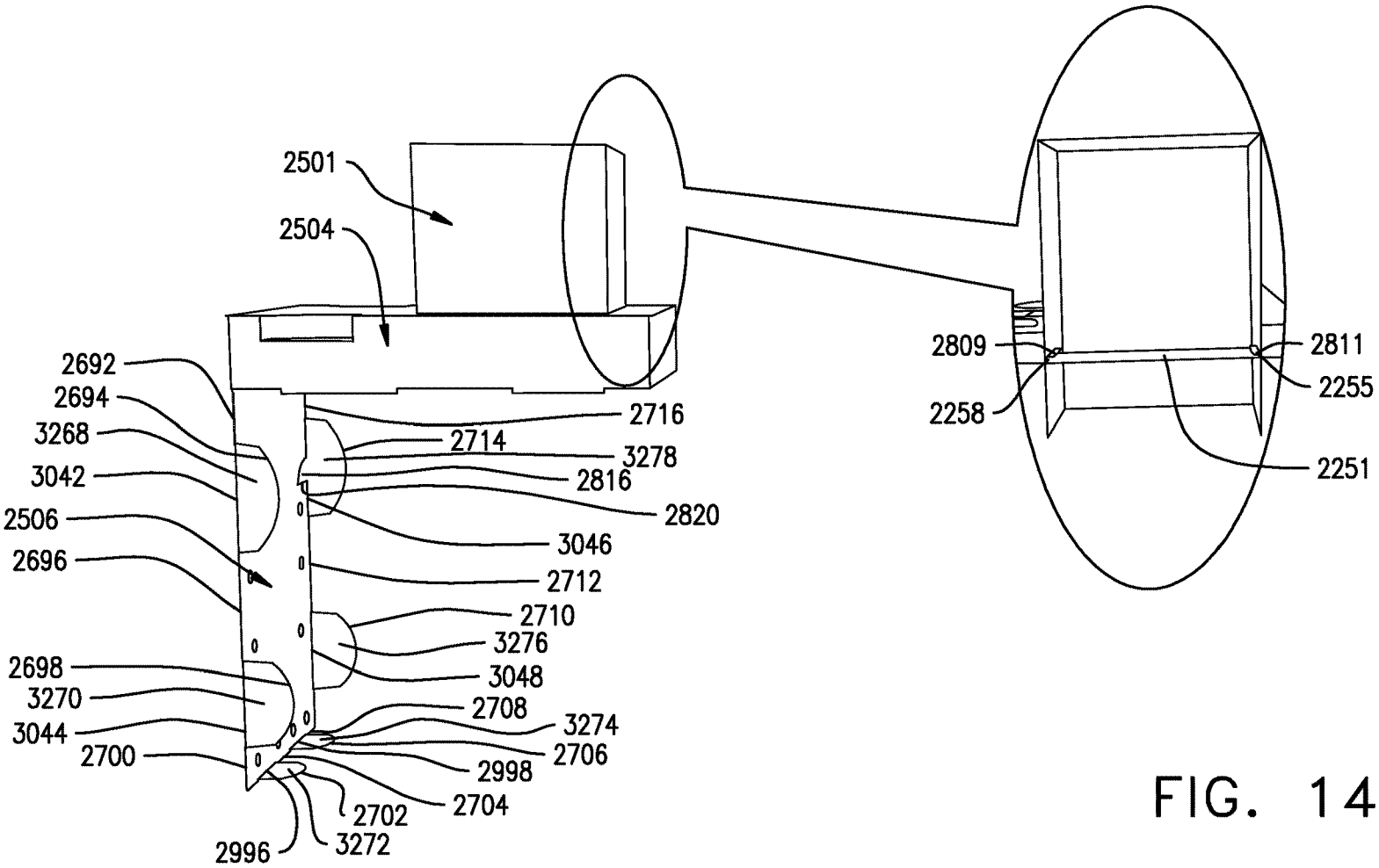
Figure 150:
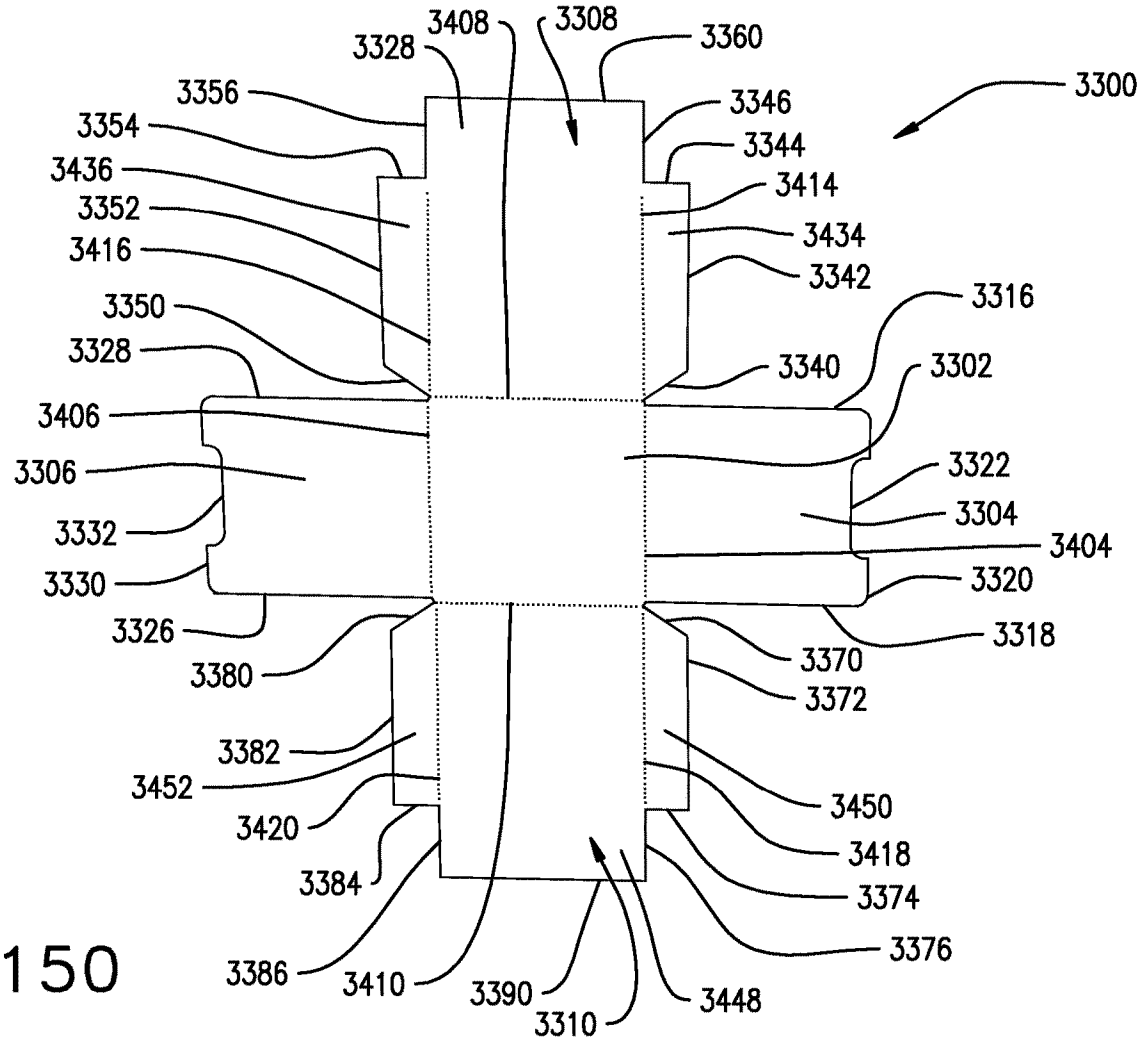
Figure 151:
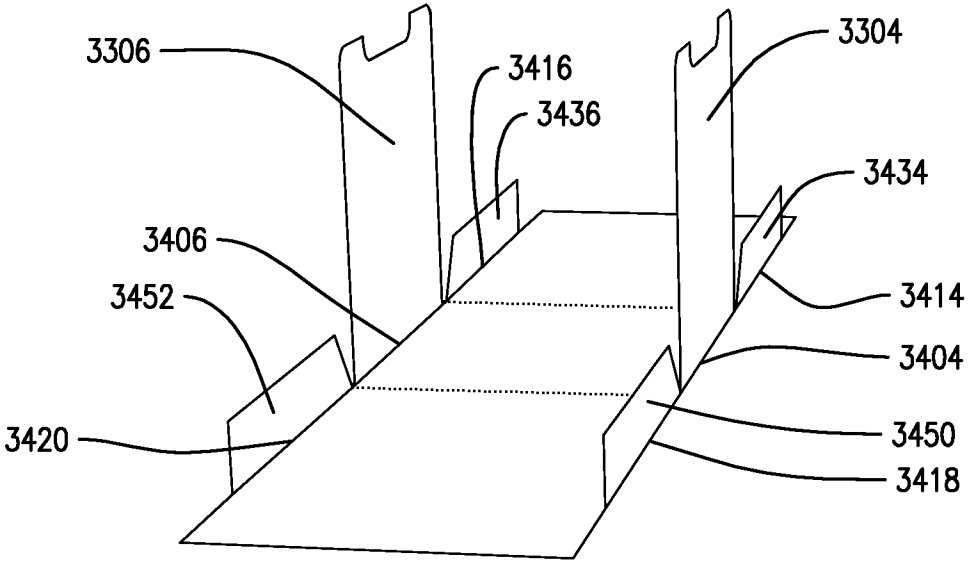
Figure 152:
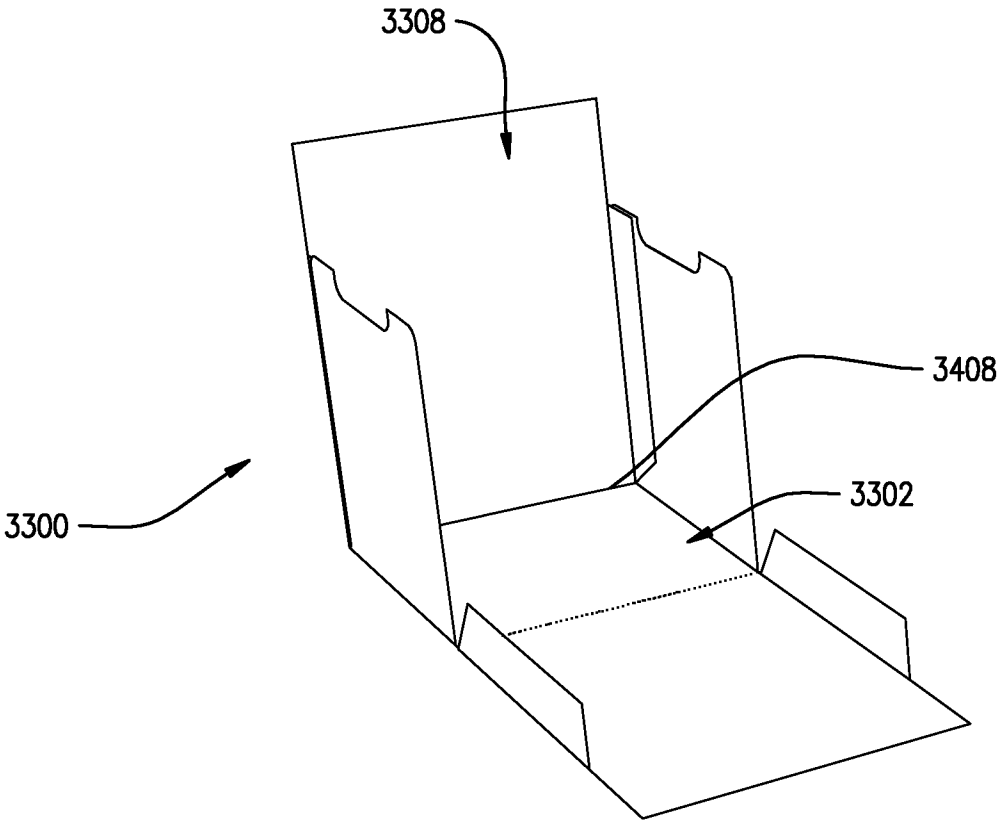
Figure 153:
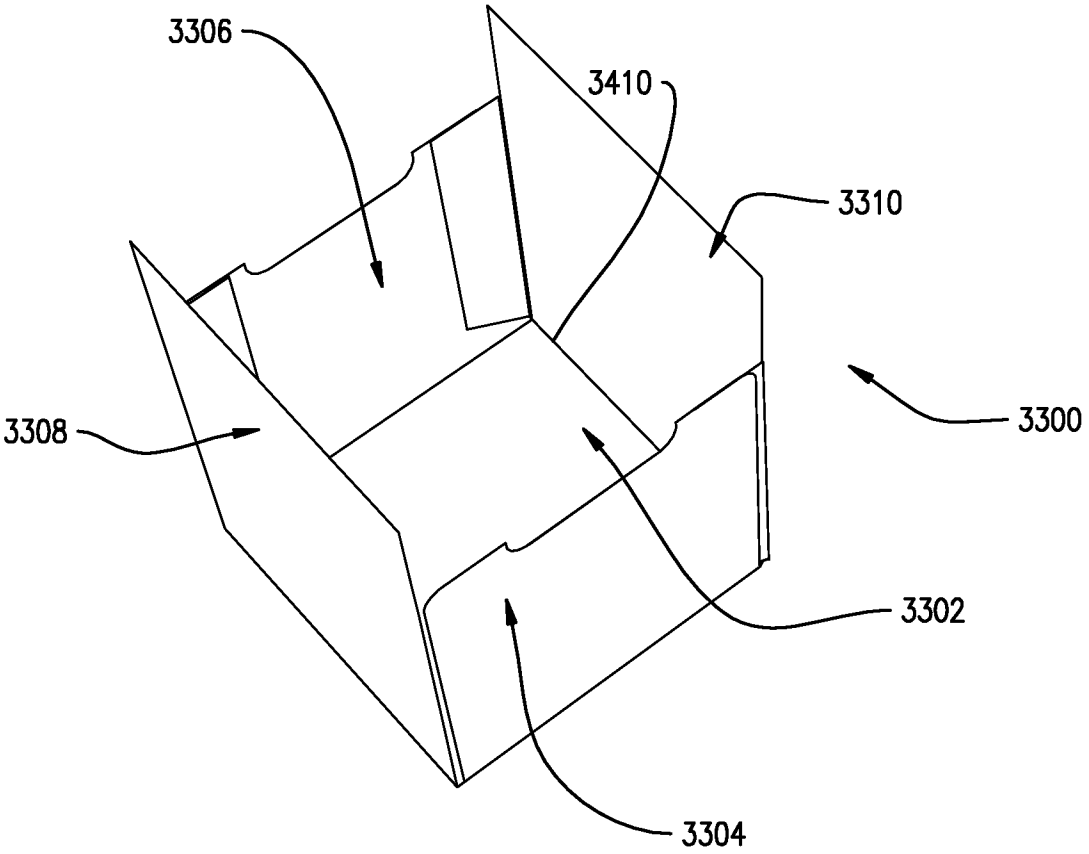
Figure 154:
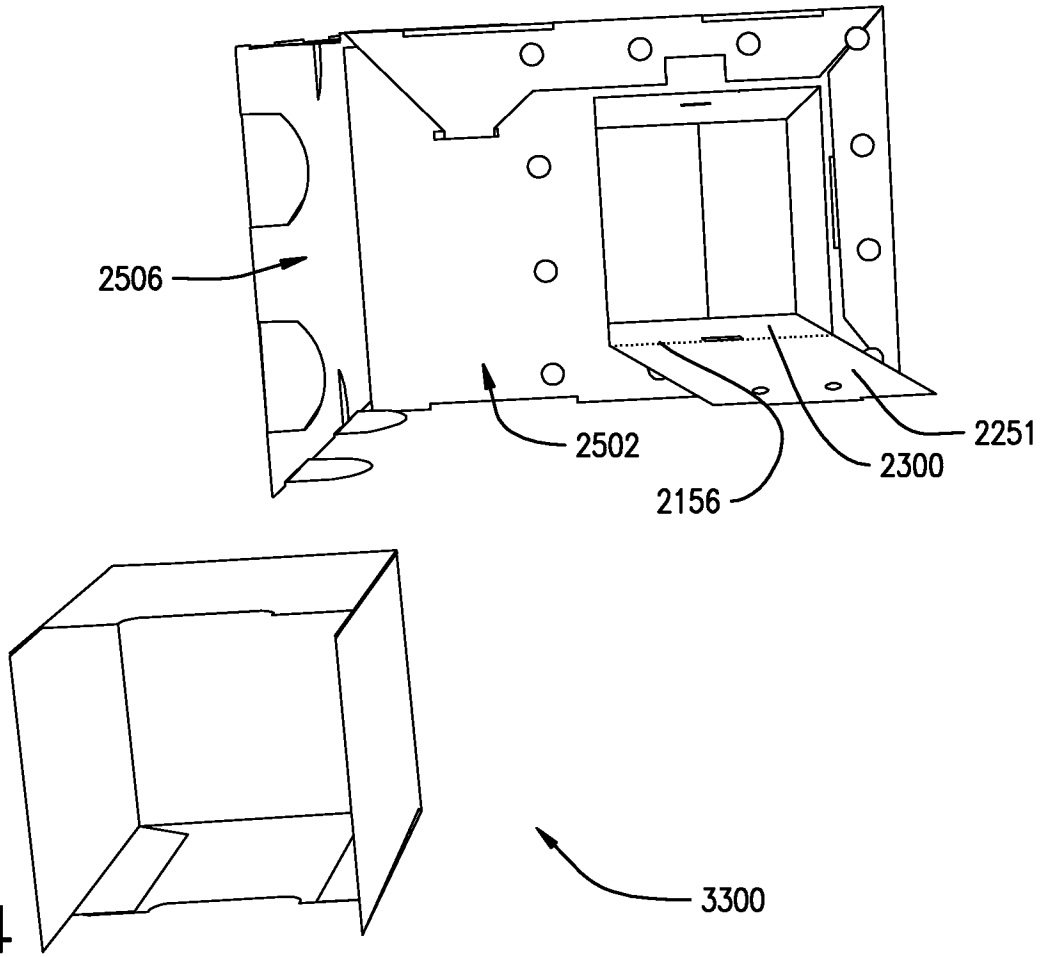
Figure 155:
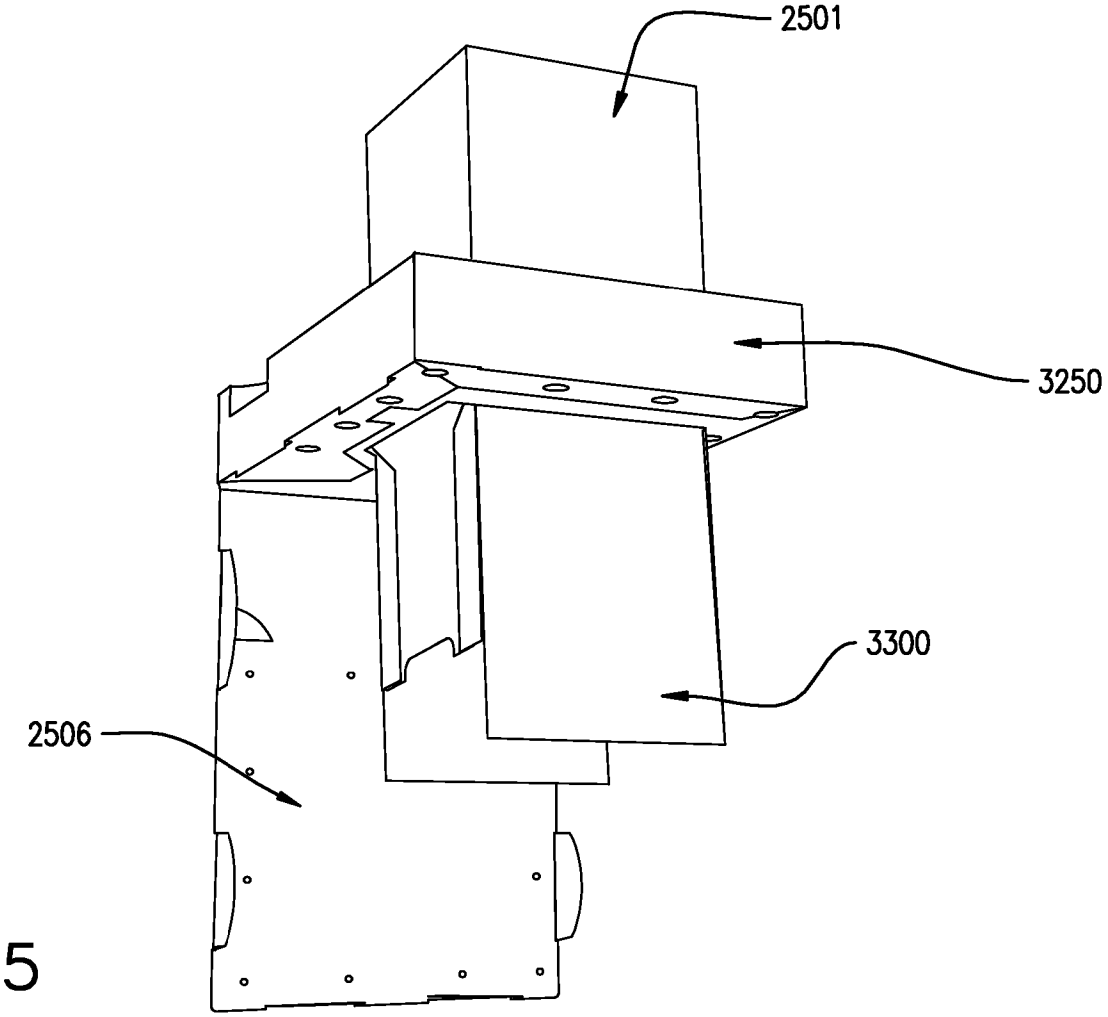
Figure 156:
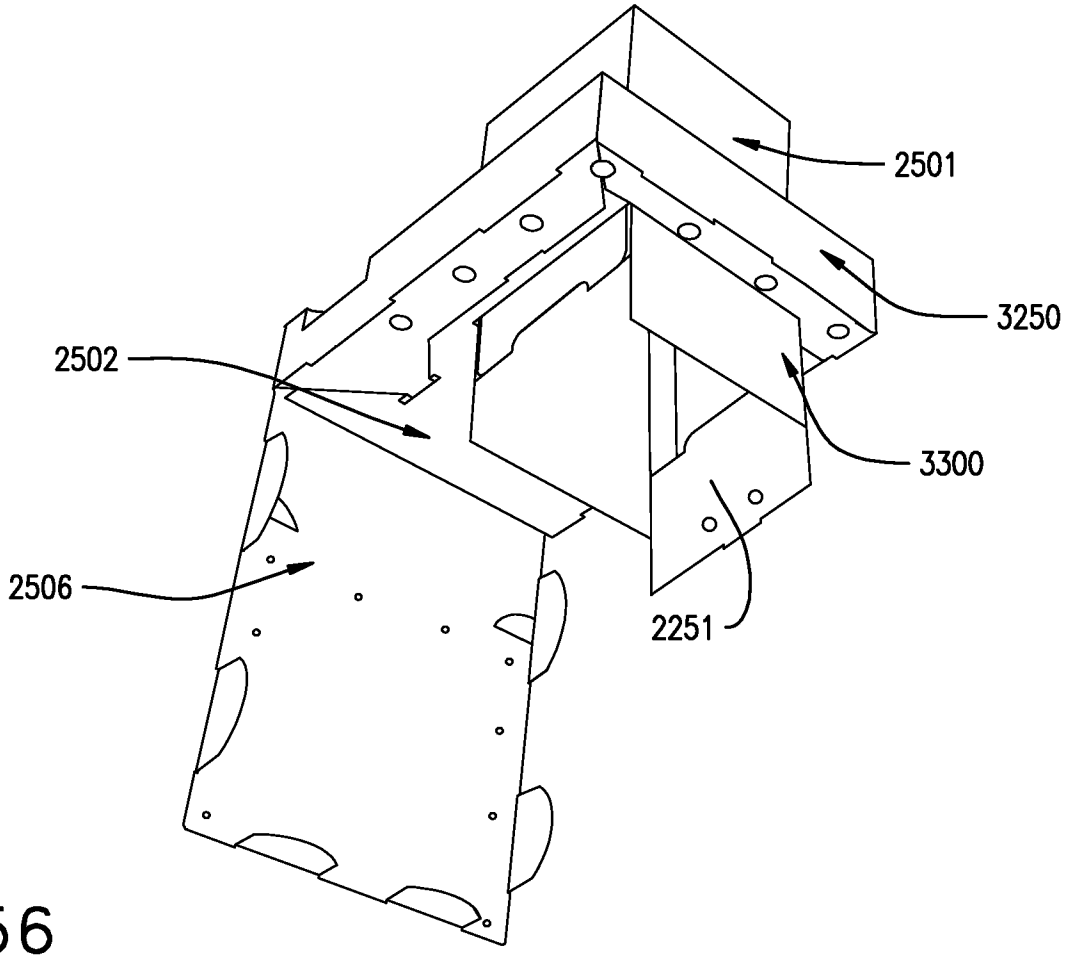
Figure 157:
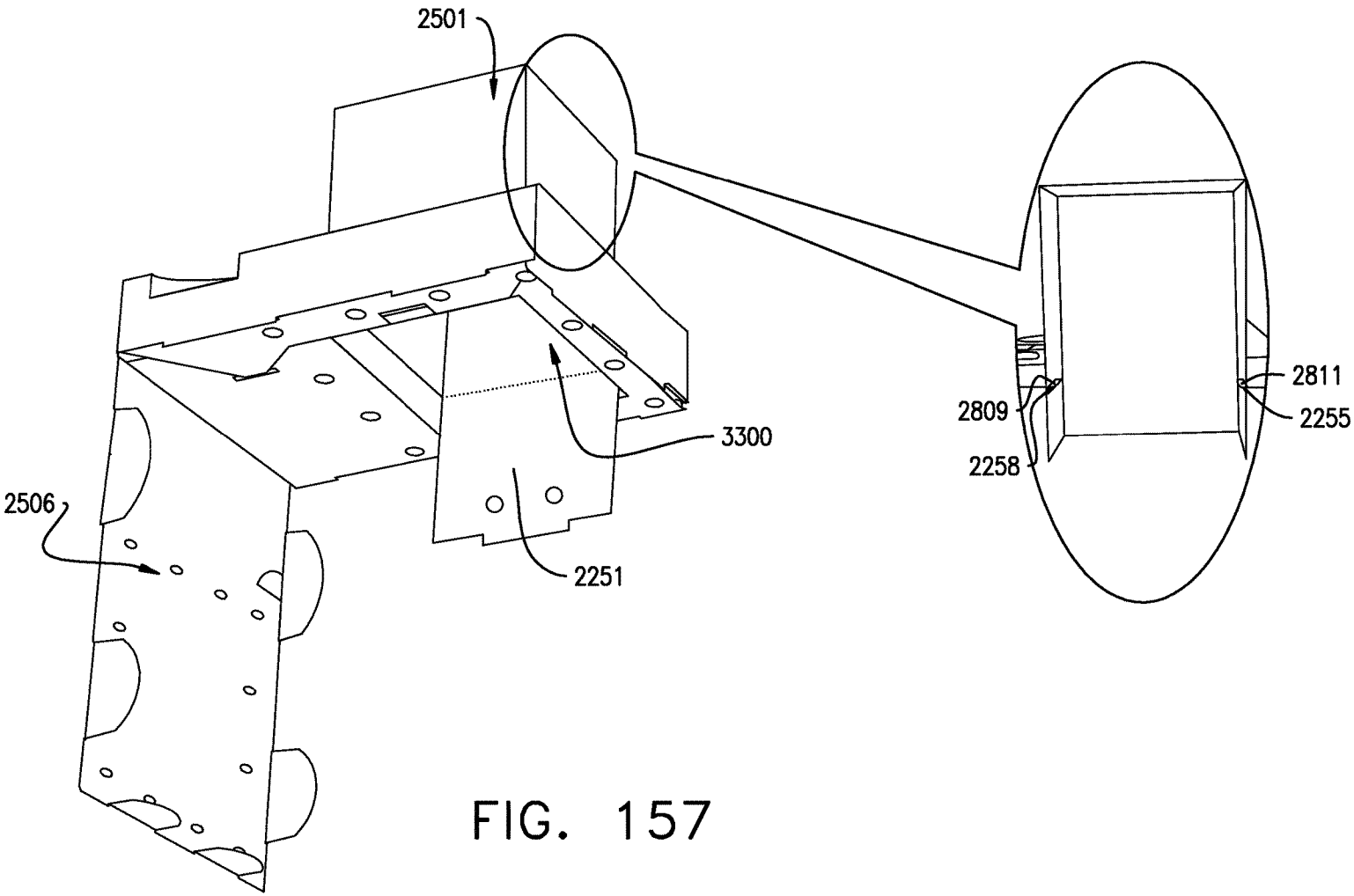
Figure 158:
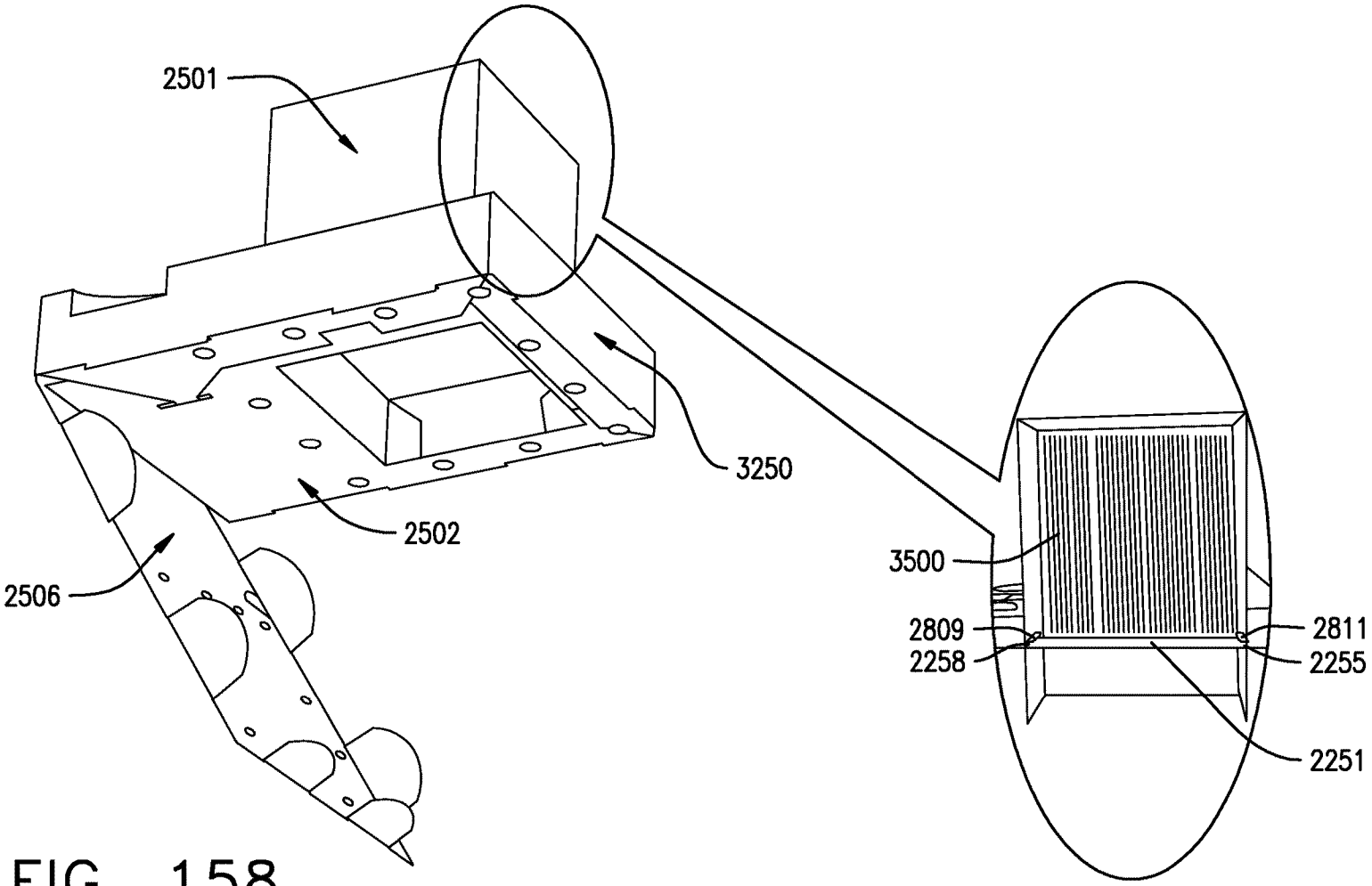
Figure 160:
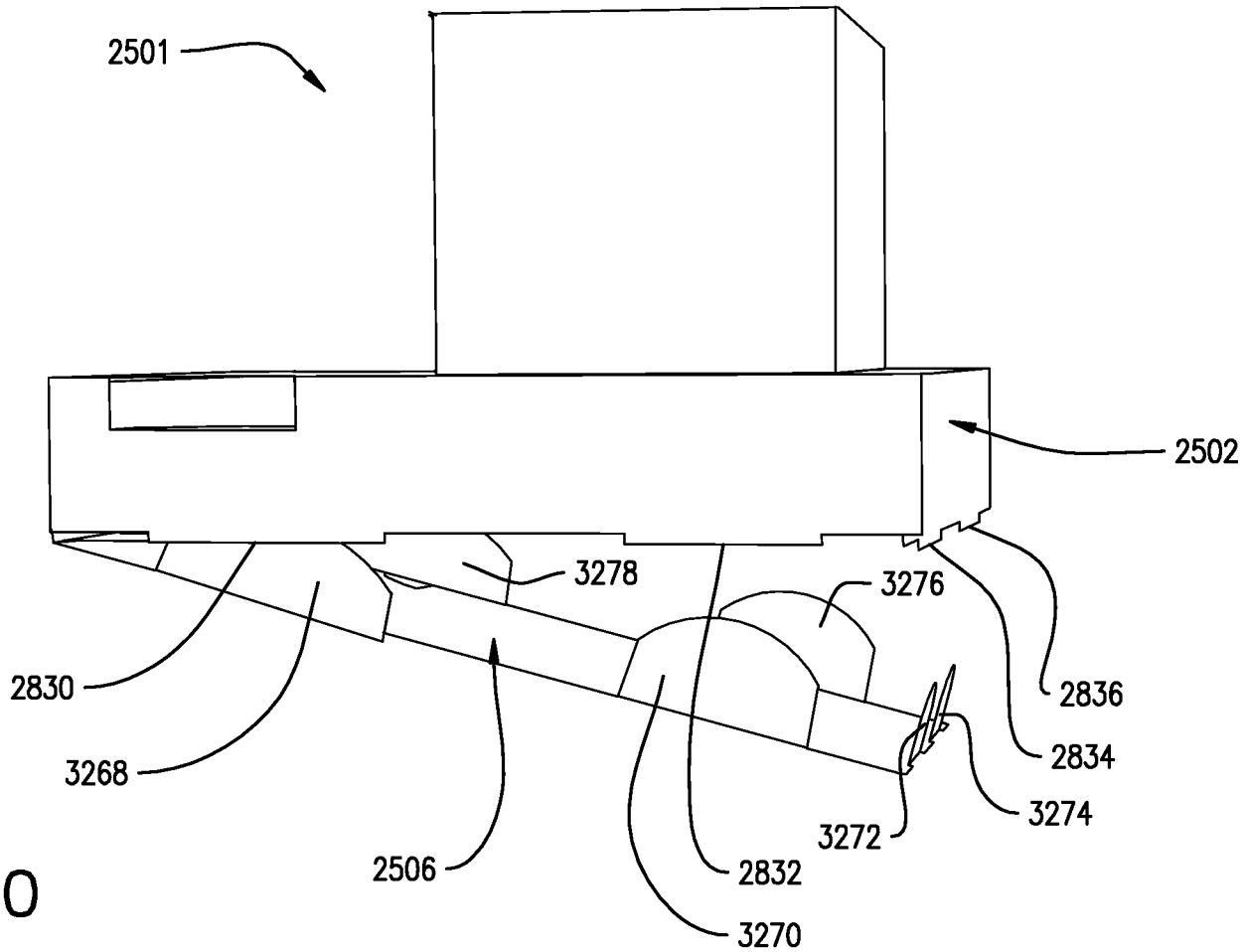
Figure 161A:
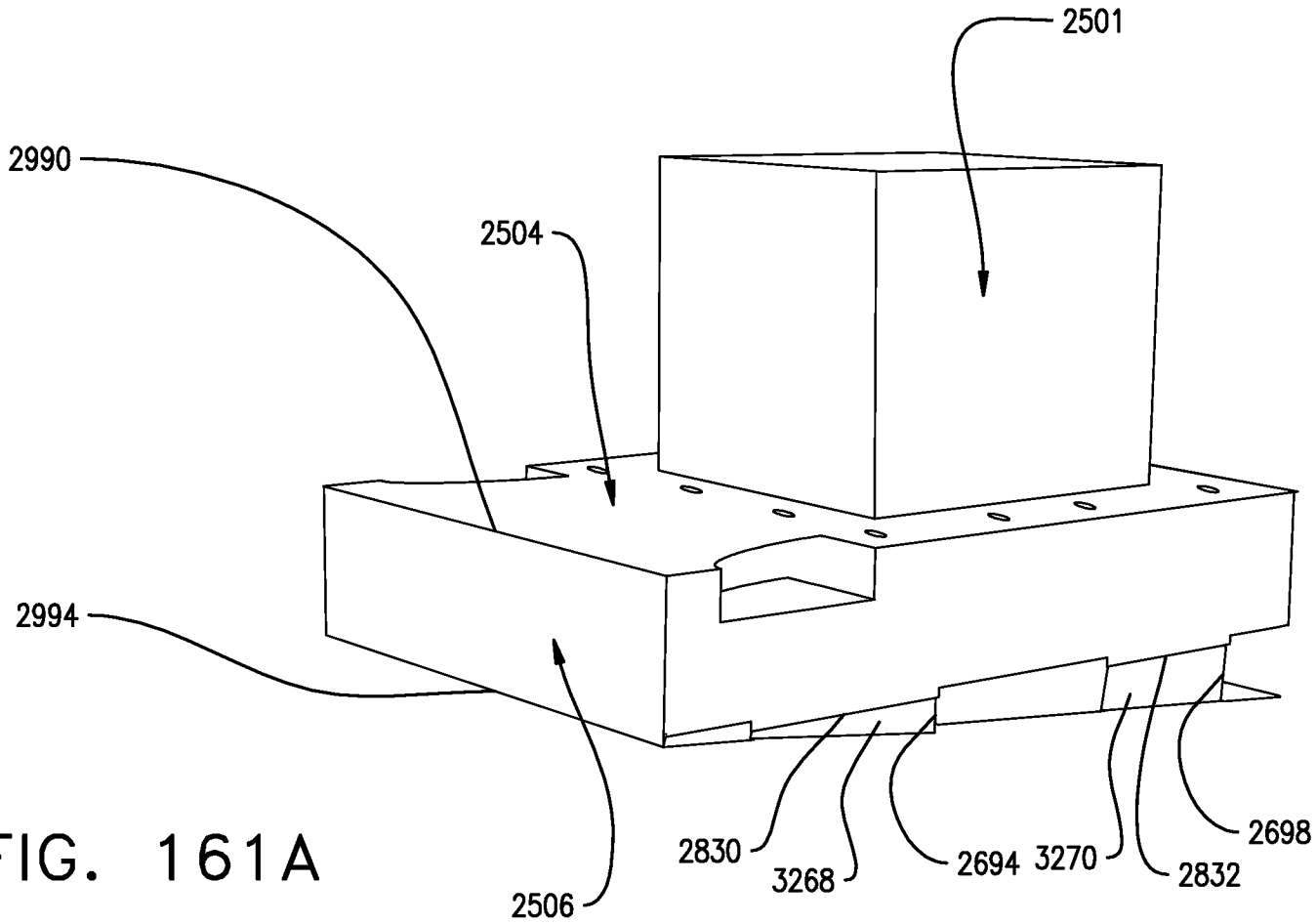
Figure 161B:
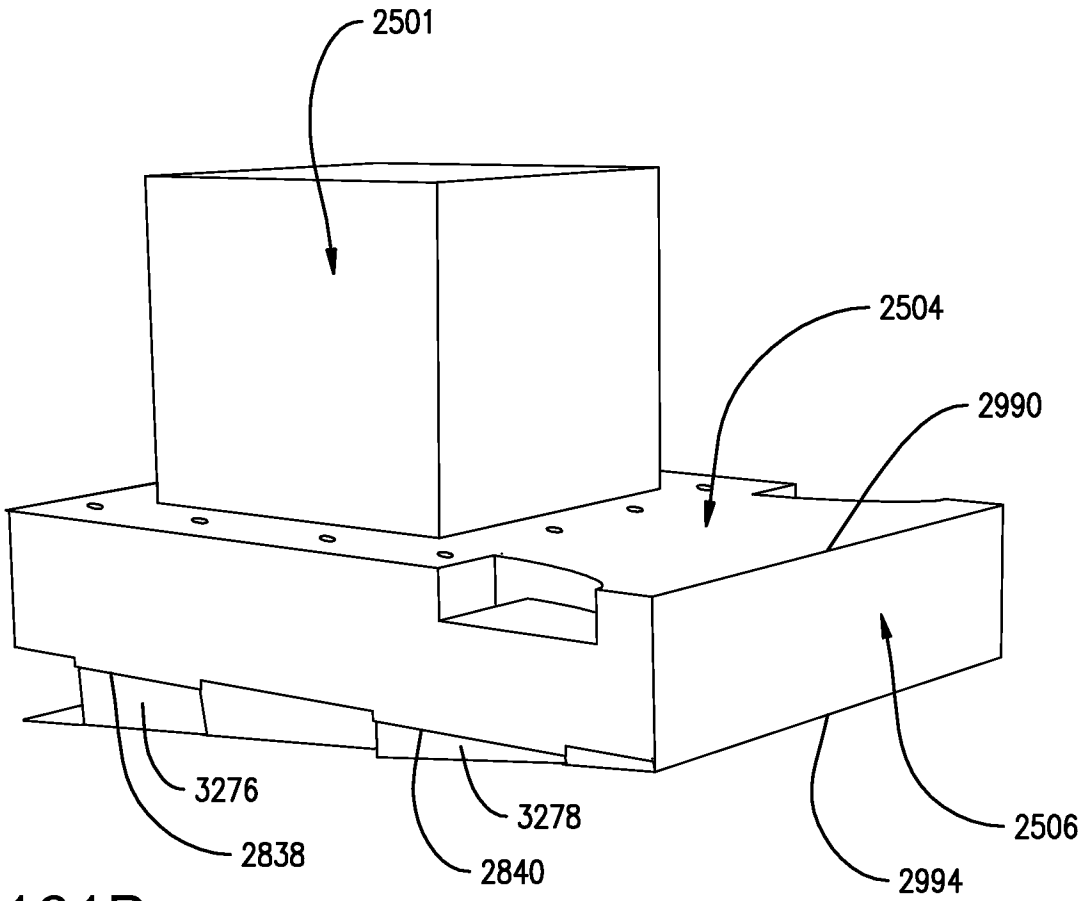
Figure 161C:
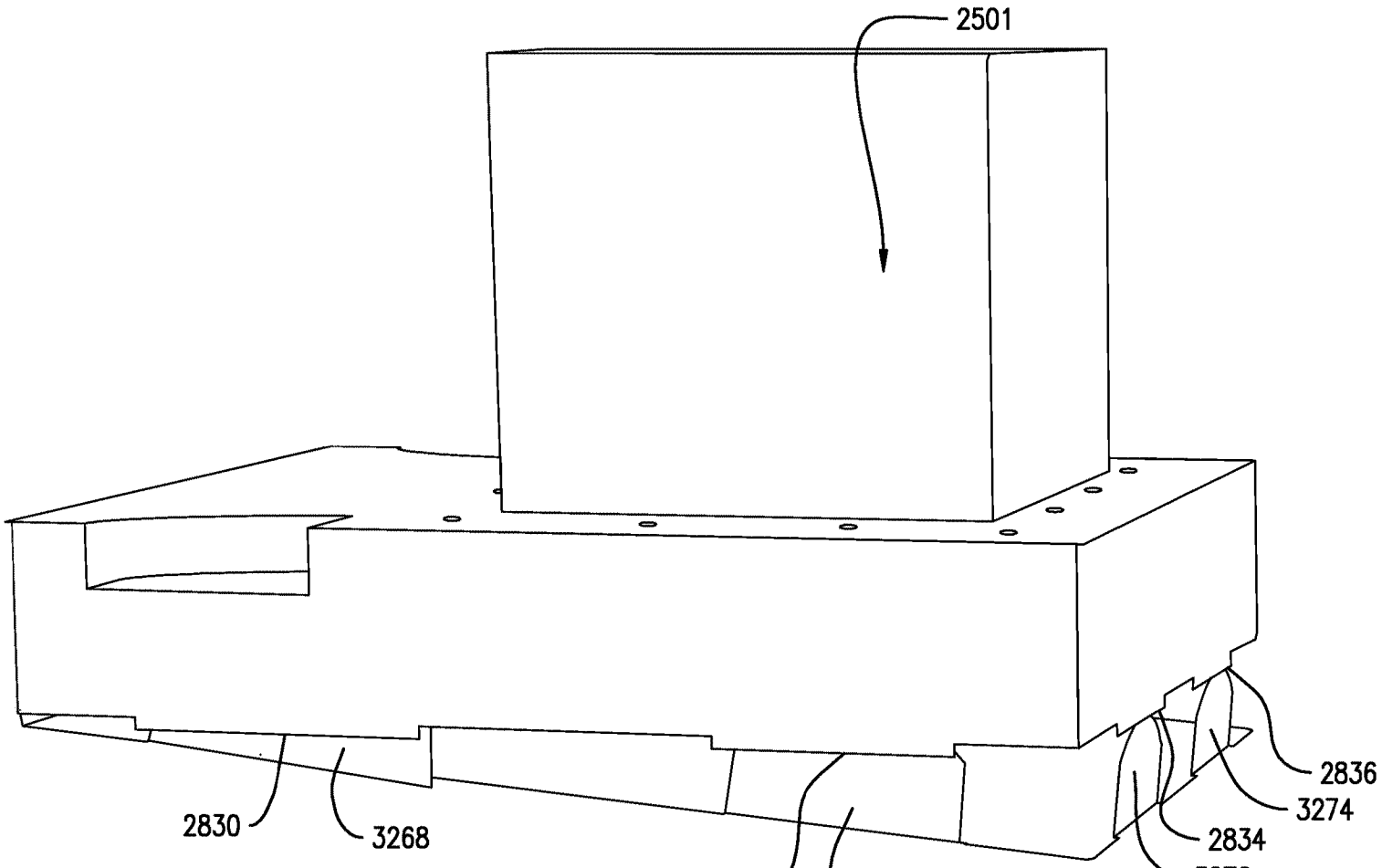
Figure 162:
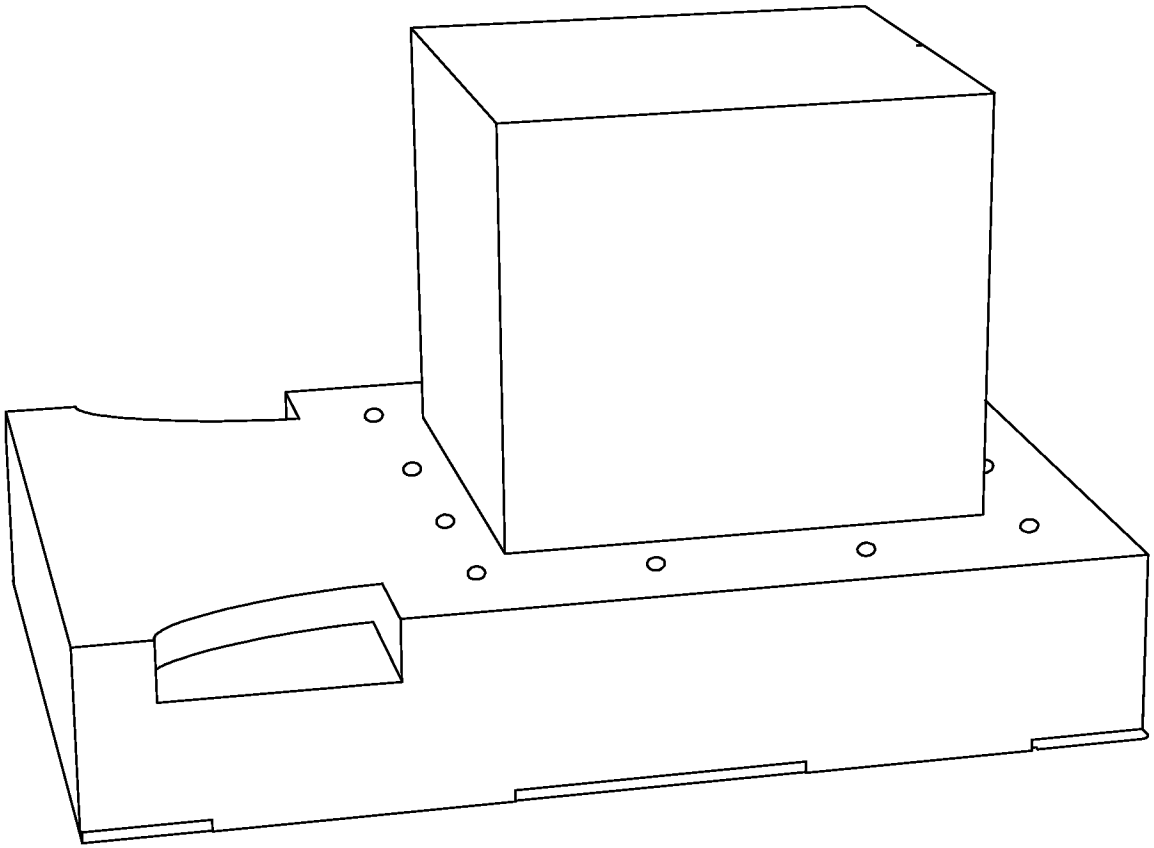

FIG. 133 is a simplified illustration showing the folding of still a further part of the internal structural portion about an internal fold line such that the portion lies generally perpendicular to the plane of an internal structural portion;

FIG. 134 is a simplified illustration showing the folding of still another part of the internal structural portion about an internal fold line such that the portion lies generally perpendicular to the plane of an internal structural portion;

FIG. 135 is a simplified illustration showing the folding of yet another part of the internal structural portion about internal fold line such that the portion lies generally perpendicular to the plane of internal structural portion;

FIG. 136 is a simplified illustration showing the folding of a side section, which forms part of a top and side portion, about an internal fold line such that a side section lies generally perpendicular to the plane of the remainder of the top and side portion;

FIG. 137 is a simplified illustration showing the folding of flaps about respective internal fold lines so that the flaps lie generally parallel to the plane of the remainder of the top and side portion;

FIG. 138 is a simplified illustration showing the folding of tabs about respective internal fold lines so as to lie generally perpendicular to the plane of the remainder of top and side portion;

FIG. 139 is a simplified illustration showing the initial folding of a portion forming part of a side section about mutually coaxial internal fold lines such that the portion lies generally at an angle with respect to the plane of the remainder of the side section;

FIG. 140 is a simplified illustration showing the further folding of a part of the side section about mutually coaxial internal fold lines such that the portion lies generally at a more acute angle with respect to the plane of the remainder of the side section;

FIG. 141 is a simplified illustration showing the showing final folding of the portion forming part of the side section about mutually coaxial internal fold lines such that the portion lies generally perpendicular to the plane of the remainder of the side section;

FIG. 142 is a simplified illustration showing the folding of flaps about respective internal fold lines to lie adjacent and parallel to a part of the internal structural portion;

FIG. 143 is a simplified illustration showing the folding of an end section, forming part of top and side portion about an internal fold line, such that the end section lies generally perpendicular to the plane of the remainder of the top and side portion;

FIG. 144 is a simplified illustration showing the folding of a tab about an internal fold line so as to lie generally parallel to the plane of the remainder of the top and side portion;

FIG. 145 is a simplified illustration showing initial folding of a portion forming part of an end section about mutually coaxial internal fold lines, such that the portion lies generally at an angle with respect to the plane of the remainder of end section;

FIG. 146 is a simplified illustration showing final folding of portion forming part of end section, about mutually coaxial internal fold lines such that the portion lies generally perpendicular to the plane of the remainder of end section;

FIG. 147 is a simplified illustration showing the folding of flaps about respective internal fold lines to lie adjacent and parallel to a portion;

FIG. 148 is a simplified illustration showing the folding of a bottom portion about internal fold line such that a portion thereof lies adjacent and generally parallel to another portion and generally perpendicular to a top and side portion;

FIG. 149 is a simplified illustration showing folding of tabs about respective internal fold lines so as to each lie generally perpendicular to the plane of the remainder of bottom portion;

FIG. 150 is a simplified illustration which shows a structural insert which is preferably die cut from animal skin, preferably parchment which is compliant with the requirements of Jewish law;

FIG. 151 is a simplified illustration which shows folding of flaps about respective internal fold lines to lie generally perpendicular to the plane of the remainder of the structural insert;

FIG. 152 shows folding of an additional flap about an internal fold line to lie generally perpendicular to the plane of the remainder of the structural insert;

FIG. 153 shows folding of a further flap about internal fold line to lie generally perpendicular to the plane of the remainder of the structural insert;

FIG. 154 is a simplified illustration which shows a structural insert fully external to the corresponding interior compartment of subassembly;

FIGS. 155 and 156 are simplified illustrations which show two stages of insertion of structural insert into the interior of the subassembly;

FIG. 157 is a simplified illustration which shows the structural insert fully inserted into the interior of the subassembly;

FIG. 158 is a simplified illustration which shows which shows a phylactery parchment scroll inserted into the compartment in the subassembly and secured by refolding retaining flap to engage with respective slot;

FIGS. 159, 160 and 161A-161C are simplified illustrations which illustrate closure of the base of the hand phylactery; and FIG. 162 is a simplified illustration which illustrates a complete hand phylactery which is ready to be sewn and associated with leather straps.

DETAILED DESCRIPTION OF A PREFERRED EMBODIMENT

Figure 1:
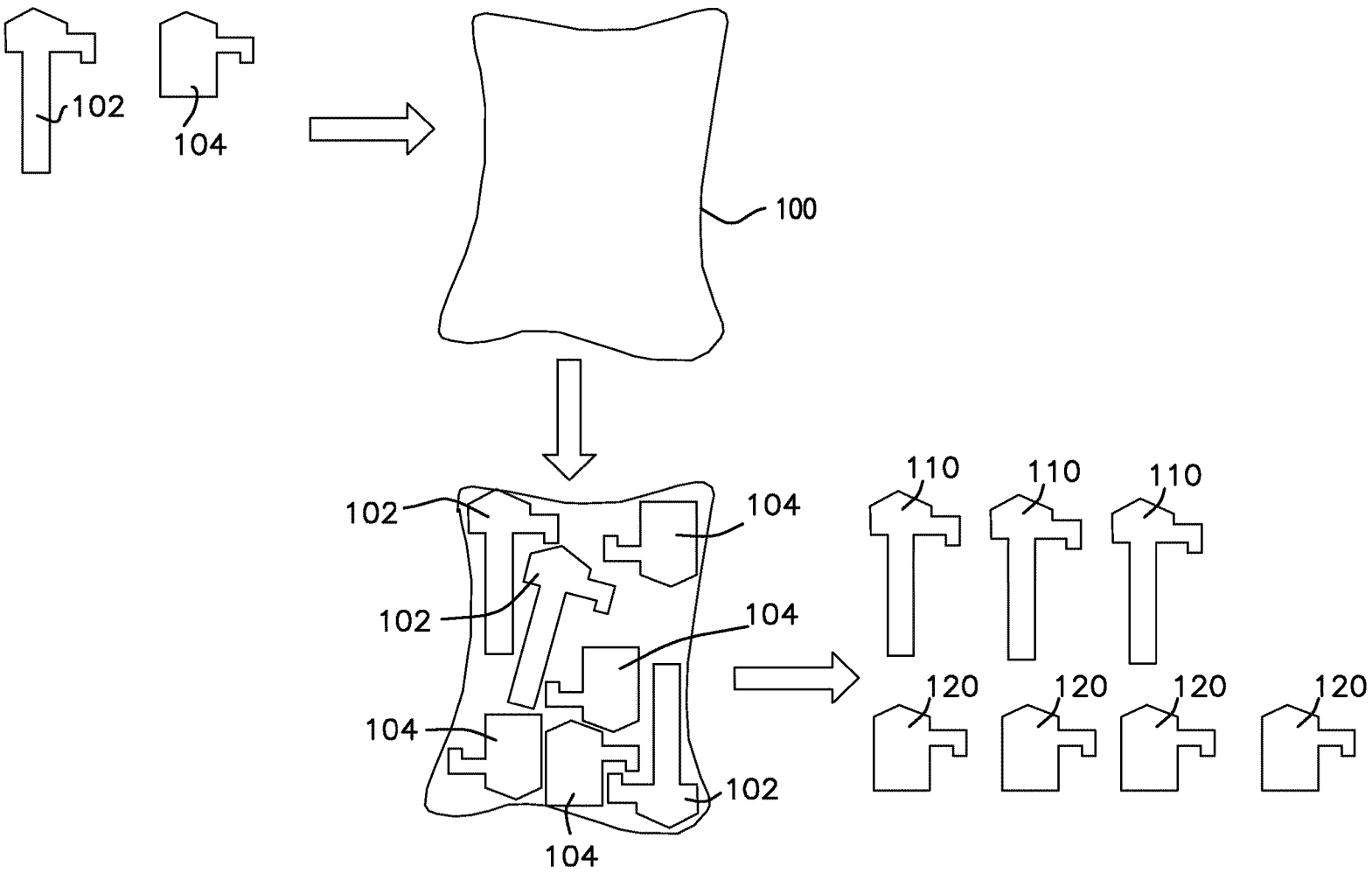
FIG. 1 is a simplified illustration of an initial step in a method of manufacture of phylacteries in accordance with a preferred embodiment of the present invention in which initial stage phylactery workpieces are cut from a full sheet of animal skin.

Reference is now made to FIG. 1, which is a simplified illustration of an initial step in a method of manufacture of phylacteries in accordance with a preferred embodiment of the present invention in which initial stage phylactery workpieces are cut from animal skin which is compliant with Jewish law requirements. Preferably the animal skin is in the form of parchment.

According to the specifications established in Jewish law, phylacteries are made of the skin of a limited set of kosher animals, including, for example, cows, sheep and goats. A typical such skin is illustrated in FIG. 1 and designated by reference numeral 100. The preferred skin preferably has a thickness exceeding 0.3 mm, preferably exceeding 0.4 mm and more preferably exceeding 0.5 mm. Preferably two patterns, here designated by reference numerals 102 and 104, which correspond to the approximate shape of the initial stage phylactery workpieces for the head and hand phylacteries, are employed to cut out as many initial stage phylactery workpieces as possible from each skin, it being appreciated that every skin is unique in its shape and possible defects. The initial stage phylactery workpieces for the head phylacteries are designated by reference numeral 110 and correspond to patterns 102, while the initial stage phylactery workpieces for the hand phylacteries are designated by reference numeral 120 and correspond to patterns 104.

Figure 2:
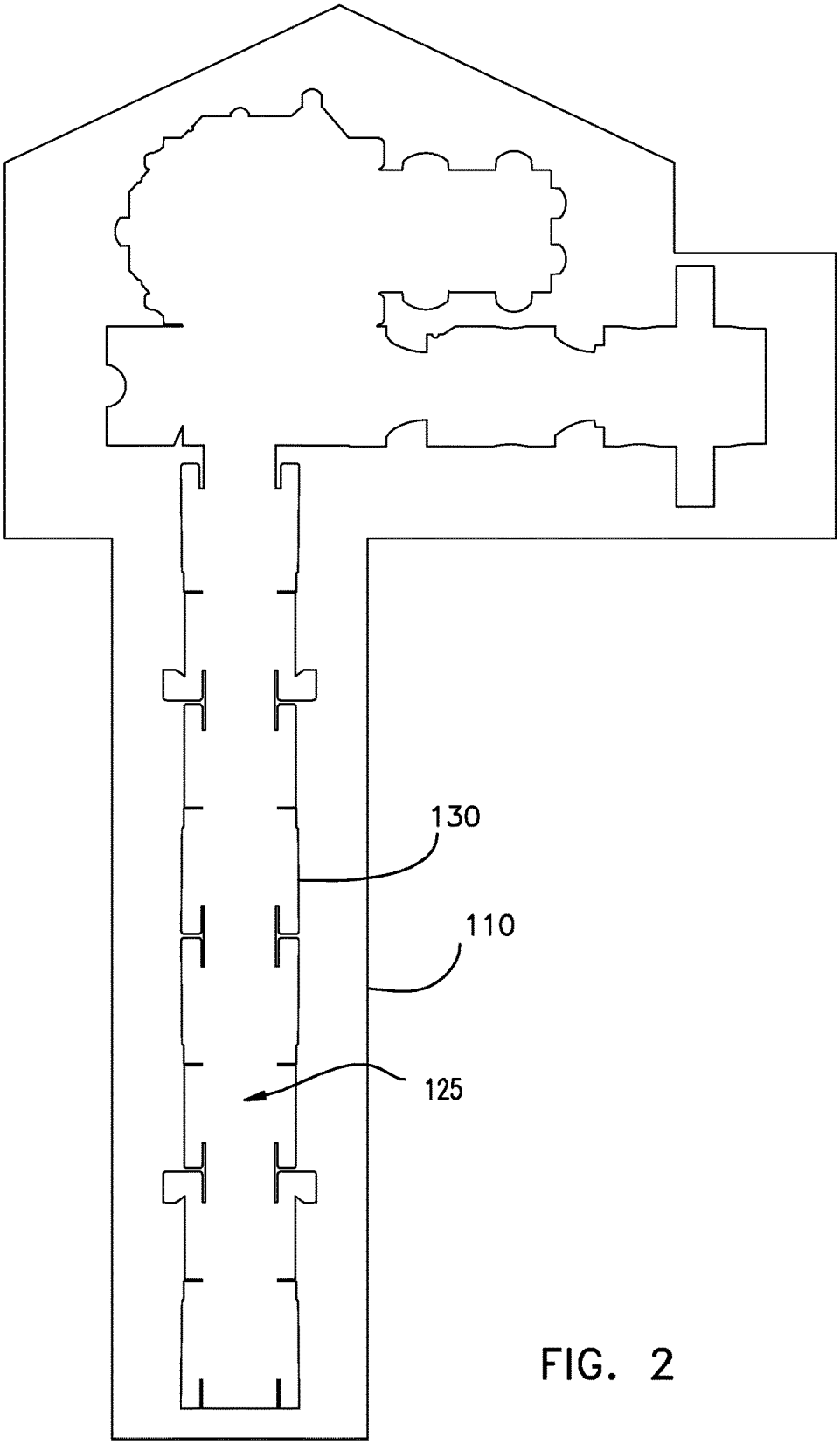
FIG. 2 is a simplified illustration of a second stage head phylactery workpiece following die cutting thereof from an initial stage phylactery workpiece and showing, for simplicity only the outline cut lines.

Reference is now made to FIG. 2, which is a simplified illustration of a second stage head phylactery workpiece 125 following cutting, preferably but not necessarily, die cutting, thereof from the initial stage head phylactery workpiece 110 and showing, for simplicity only the outline cut lines 130.

Figure 3:
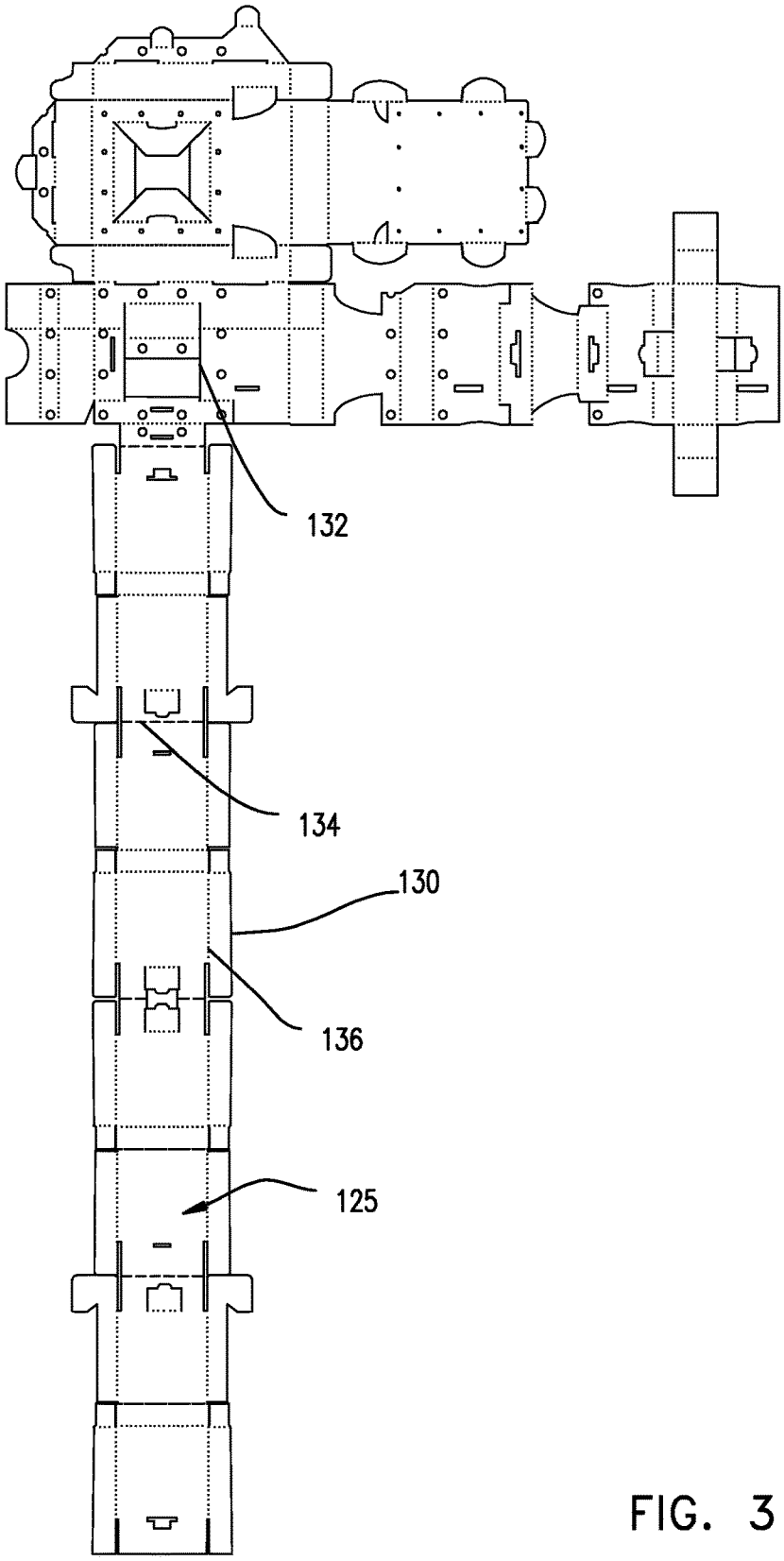
FIG. 3 is a simplified illustration of an exterior side of the secondary stage head phylactery workpiece of FIG. 2 separated from the remainder of the initial stage phylactery workpiece and showing cut lines, perforated lines and incised lines thereon.

Reference is also made to FIG. 3, which is a simplified illustration of an exterior side of the secondary stage head phylactery workpiece 125 of FIG. 2, separated from the remainder of the initial stage head phylactery workpiece 110.

It is a particular feature of an embodiment of the present invention that cutting, preferably die cutting, of the second stage head phylactery workpiece 125 from the initial stage head phylactery workpiece 110 provides in the same cutting step not only outline cut lines 130 but also interior cut lines 132, perforated lines 134 and incised lines 136 which are formed in an exterior surface of the second stage head phylactery workpiece 125, normally corresponding to the exterior-facing surface of the animal skin from which the parchment was made. Alternatively, perforated lines 134 may be replaced by incised lines formed on an interior surface of the second stage head phylactery workpiece.

The outline cut lines 130 and the interior cut lines 132 are shown throughout as solid lines, while the perforated lines 134 are shown throughout as dashed lines, until they are folded, and the incised lines 136 are shown throughout as dotted lines until they are folded. After folding, both the perforated lines 134 and the incised lines 136 are shown as solid lines.

The perforated lines 134 are designed for exterior folds, while the incised lines 136, which are partially cut into the second stage head phylactery workpiece 125 from the exterior and typically extend through about two thirds of the thickness of the second stage head phylactery workpiece 125, are designed for interior folds. It is appreciated that the incised lines 136 are only foldable as interior folds. It is also appreciated that perforated lines 134 are foldable as interior or exterior folds.

It is a particular feature of an embodiment of the present invention that incised lines 136 are employed only for interior folds rather than scribed, perforated, stamped, marked, embossed or otherwise designated lines, which may be folded in both directions.

Figure 4:
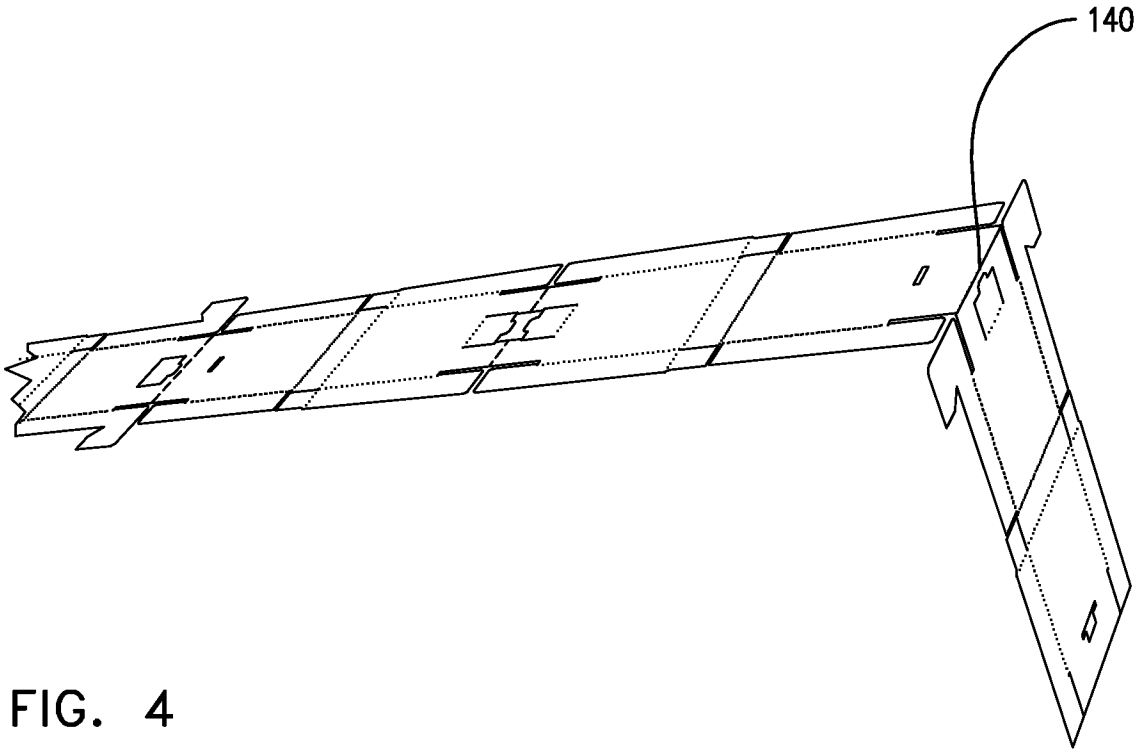
FIG. 4 is a simplified illustration of an initial exterior crease along a first perforated line.

Reference is now made to FIG. 4, which is a simplified illustration of an initial exterior crease along a first perforated line, here designated by reference numeral 140. It is noted that this crease is produced by a temporary fold along line 140. In FIGS. 4-29, the perforated lines 134 are seen and shown throughout as dashed lines and the incised lines 136 are not seen and are nevertheless shown throughout as dotted lines.

Figure 5:
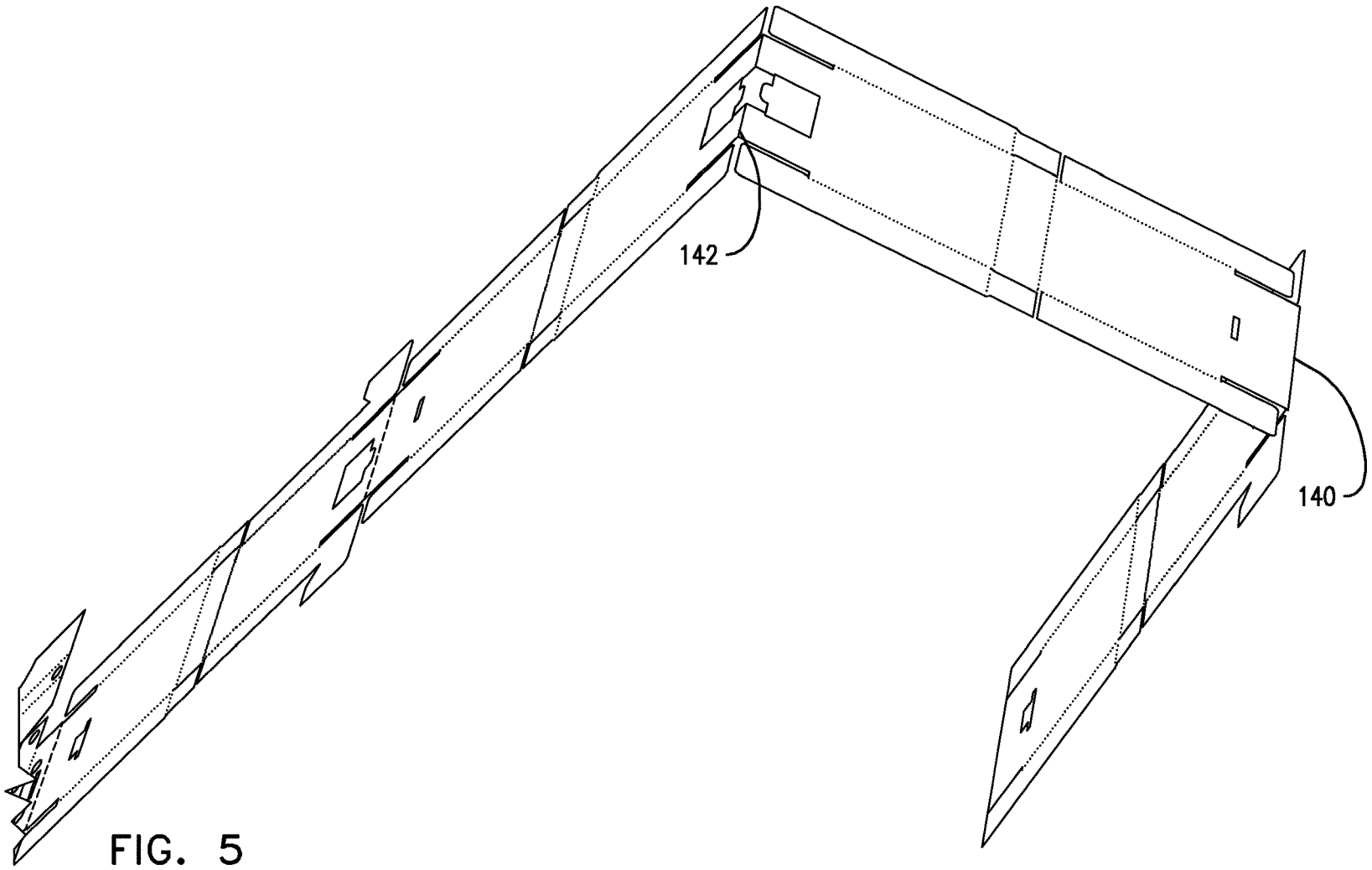
FIG. 5 is a simplified illustration of a second exterior crease along a second perforated line.

Reference is now made to FIG. 5, which is a simplified illustration of a second exterior crease along a second perforated line, here designated by reference numeral 142. It is noted that this crease is produced by a temporary fold along line 142.

Figure 6:
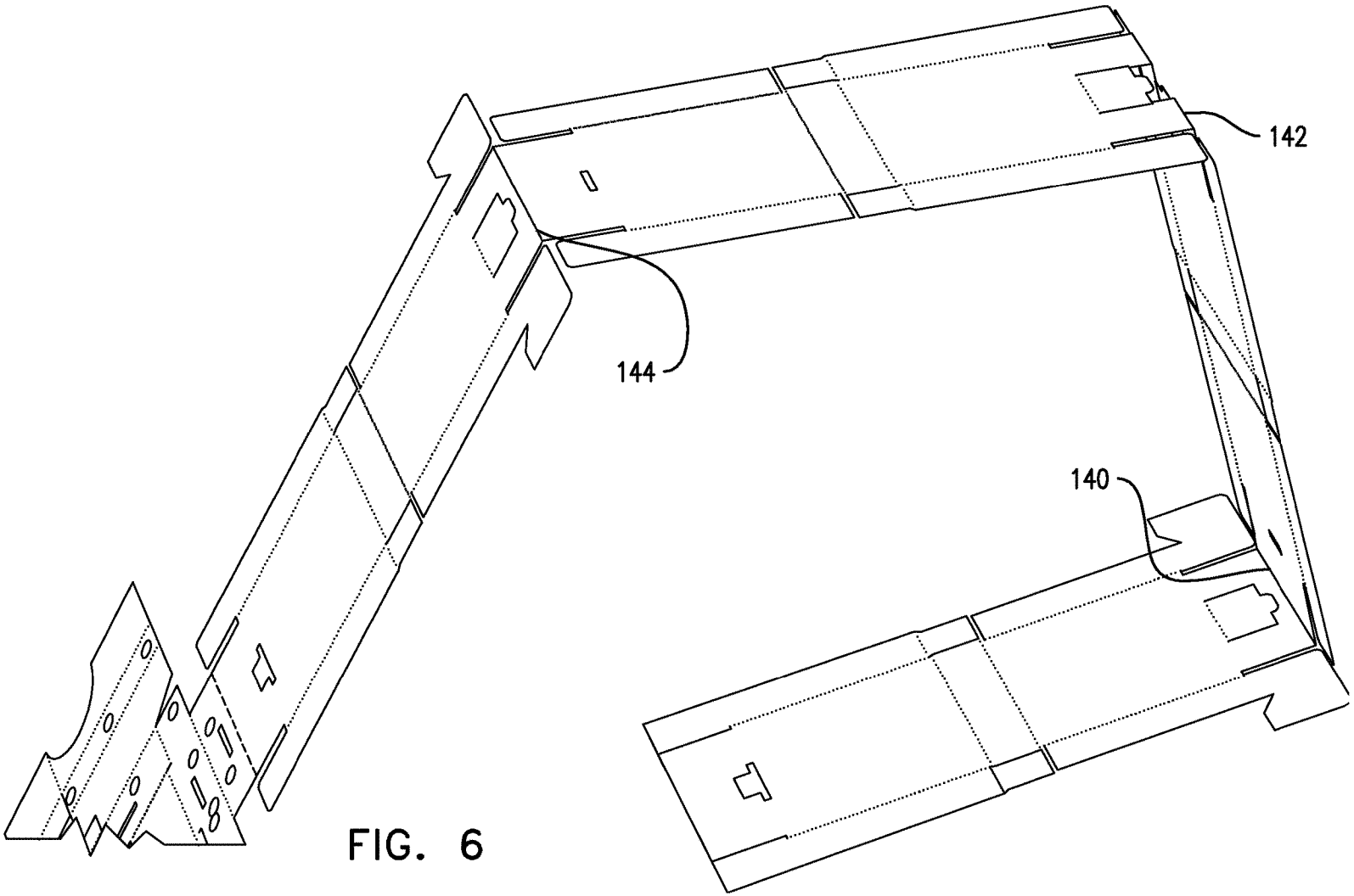
FIG. 6 is a simplified illustration of a third exterior crease along a third perforated line.

Reference is now made to FIG. 6, which is a simplified illustration of an third exterior crease along a third perforated line, here designated by reference numeral 144. It is noted that this crease is produced by a temporary fold along line 144.

Figure 7:
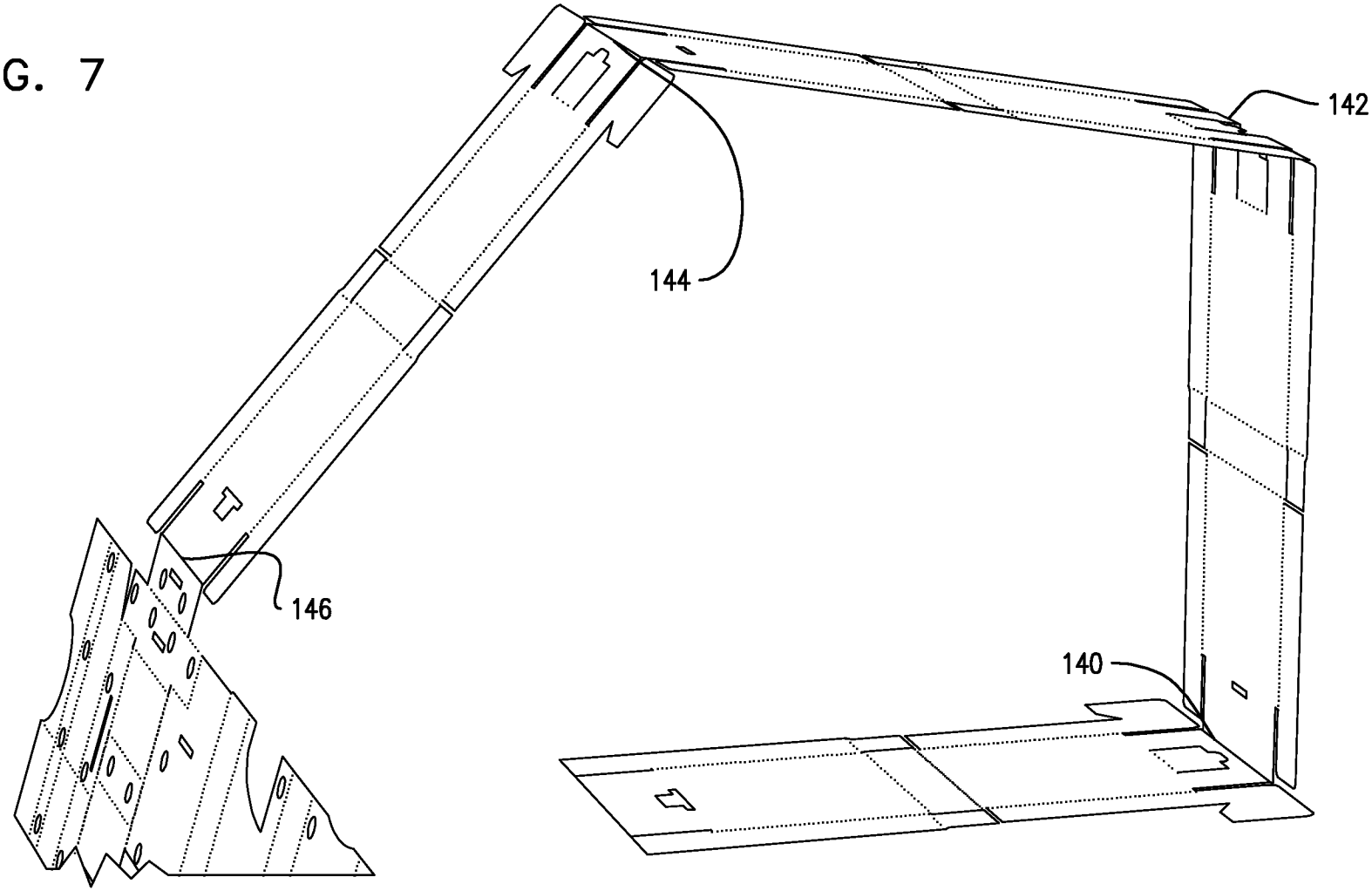
FIG. 7 is a simplified illustration of a fourth exterior crease along a fourth perforated line.

Reference is now made to FIG. 7, which is a simplified illustration of a fourth exterior crease along a fourth perforated line, here designated by reference numeral 146. It is noted that this crease is produced by a temporary fold along line 146.

It is appreciated that following formation of the fourth crease, the second stage head phylactery workpiece 125 is generally straightened out and a series of interior permanent folds are formed.

Figure 8:
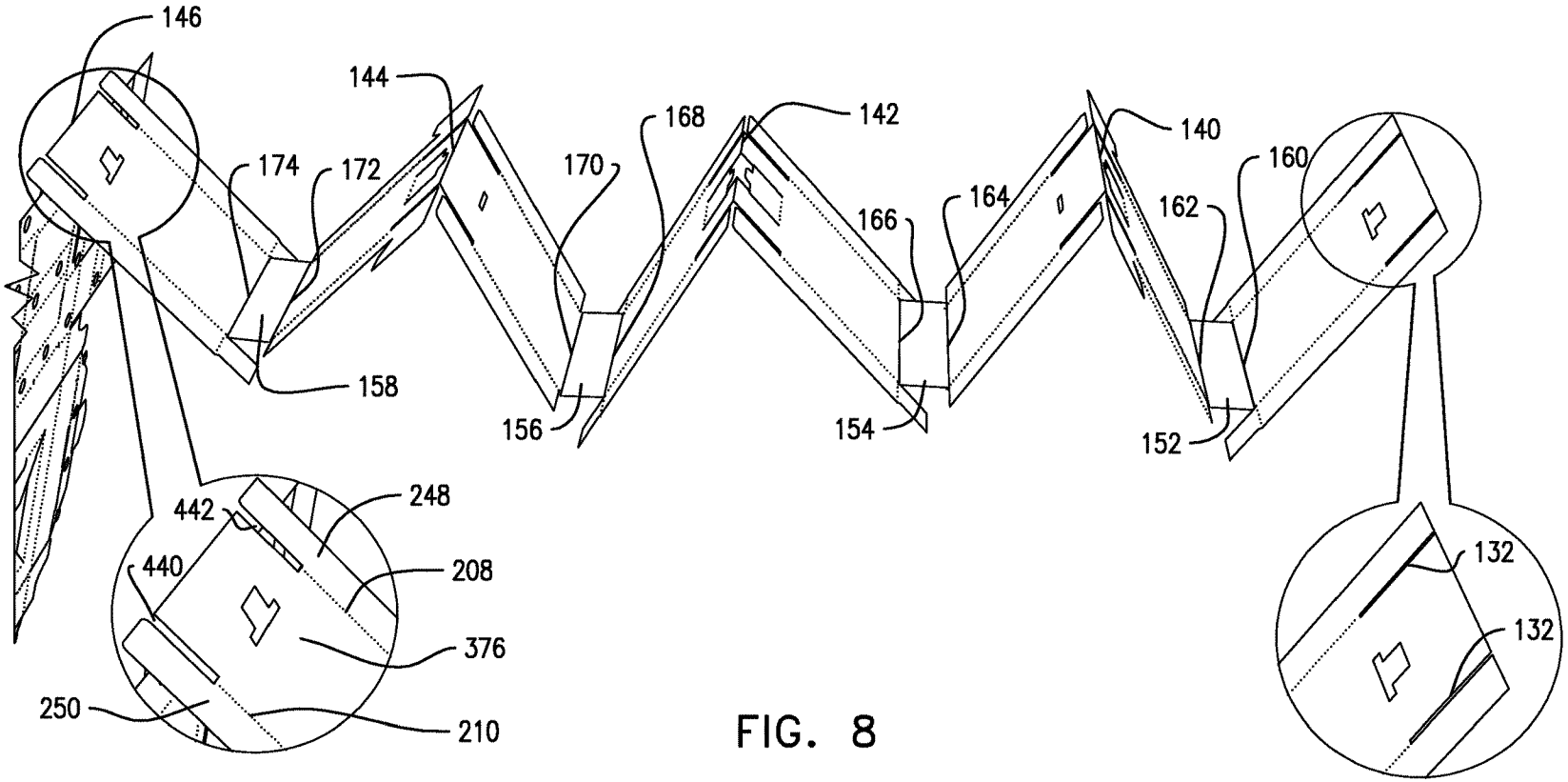
FIG. 8 is a simplified illustration of four double interior folds, each along a pair of incised lines.

Reference is now made to FIG. 8, which is a simplified illustration of four double interior folds, each along a pair of incised lines. The four double interior folds are designated by respective reference numerals 152, 154, 156 and 158. Double interior fold 152 is formed along incised lines 160 and 162. Double interior fold 154 is formed along incised lines 164 and 166. Double interior fold 156 is formed along incised lines 168 and 170. Double interior fold 158 is formed along incised lines 172 and 174.

Figure 9:
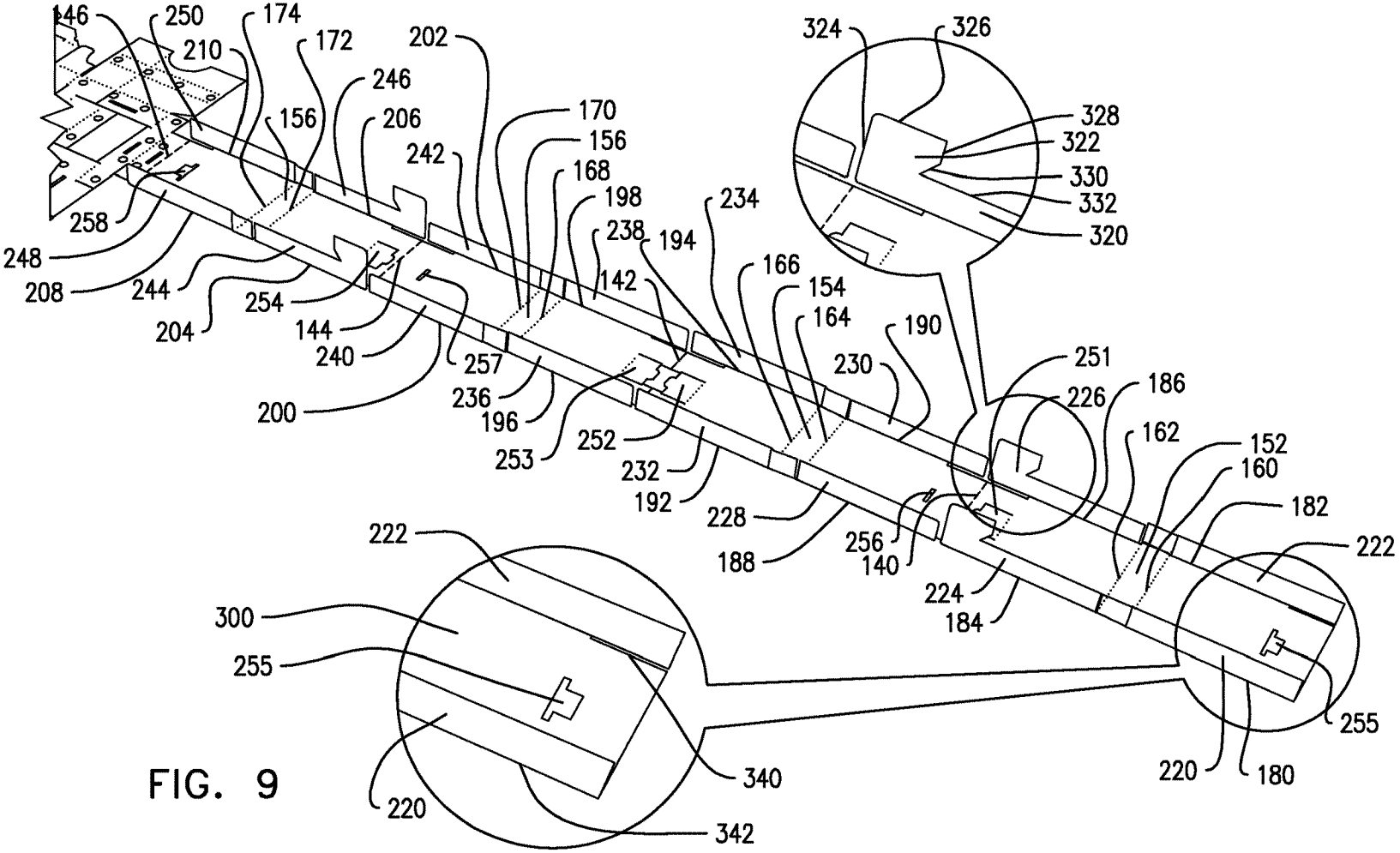
FIG. 9 is a simplified illustration of sixteen side interior folds, each along an incised line.

It is appreciated that following formation of the four double interior folds, the four double interior folds are temporarily unfolded and sixteen side interior folds are formed as illustrated in FIG. 9. The sixteen side interior folds are formed along incised lines 180, 182, 184, 186, 188, 190, 192, 194, 196, 198, 200, 202, 204, 206, 208 and 210 and define respective side flaps 220, 222, 224, 226, 228, 230, 232, 234, 236, 238, 240, 242, 244, 246, 248 and 250. Additionally four retaining flaps 251, 252, 253 and 254 are defined, as are corresponding rectangular flap end receiving slots 256 & 257 and mesa shaped flap end receiving slots 255 & 258.

Figure 10:
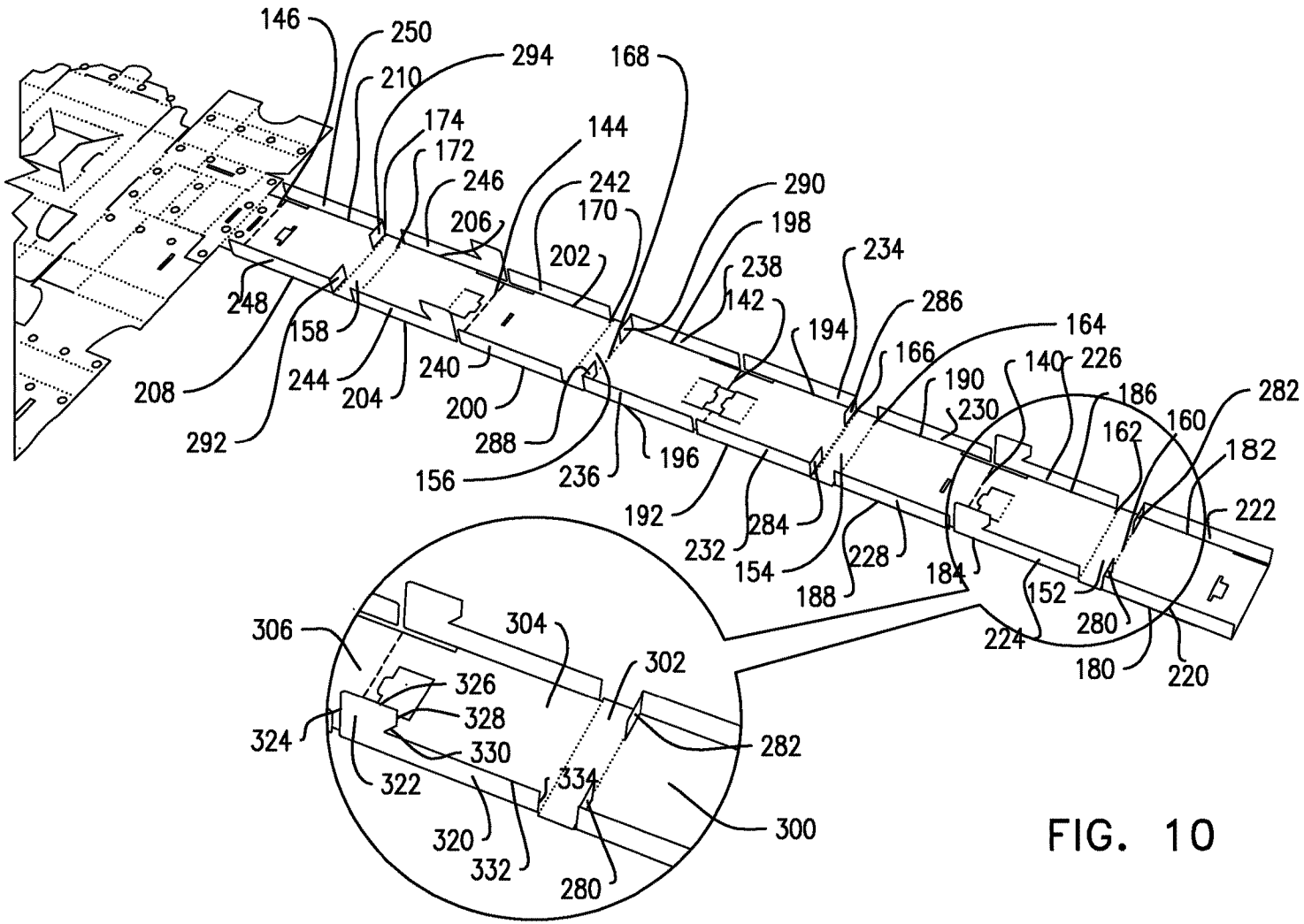
FIG. 10 is a simplified illustration of eight interior flap folds, each along an incised line.

It is further appreciated that following formation of the sixteen side interior folds, eight interior flap folds are formed as illustrated in FIG. 10. The eight interior flap folds are formed along incised lines 260, 262, 264, 266, 268, 270, 272 and 274 and define respective end flaps 280, 282, 284, 286, 288, 290, 292 and 294.

Figure 11:
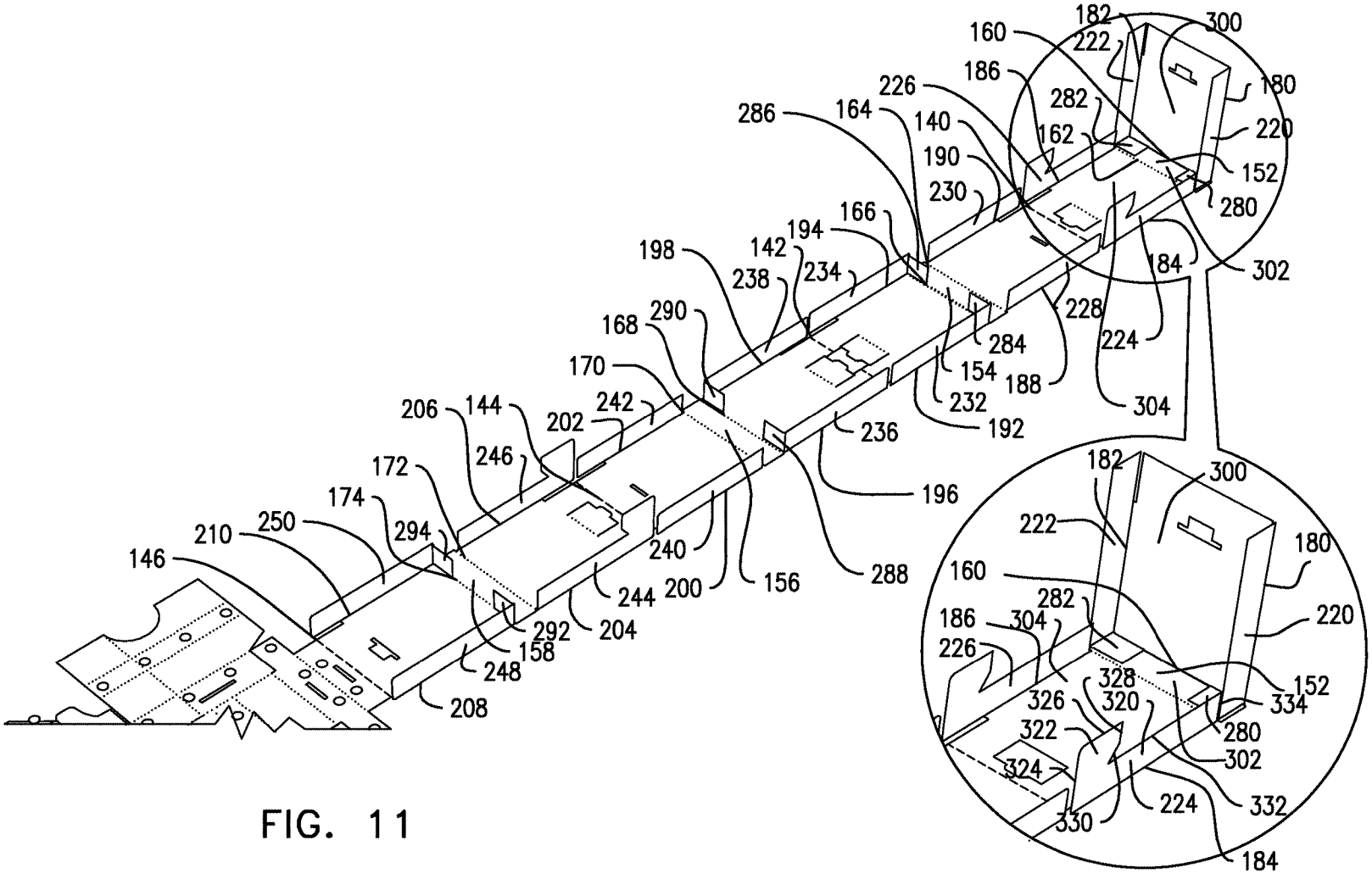
FIG. 11 is a simplified illustration of a first interior fold along an incised line.

It is additionally appreciated that following formation of the eight interior flap folds, a first interior fold is formed along incised line 160 as illustrated in FIG. 11. As seen in FIG. 11, a first interior panel surface 300 lies generally at 90 degrees with respect to a first interior intermediate surface 302 and to a second interior panel surface 304.

Figure 12:
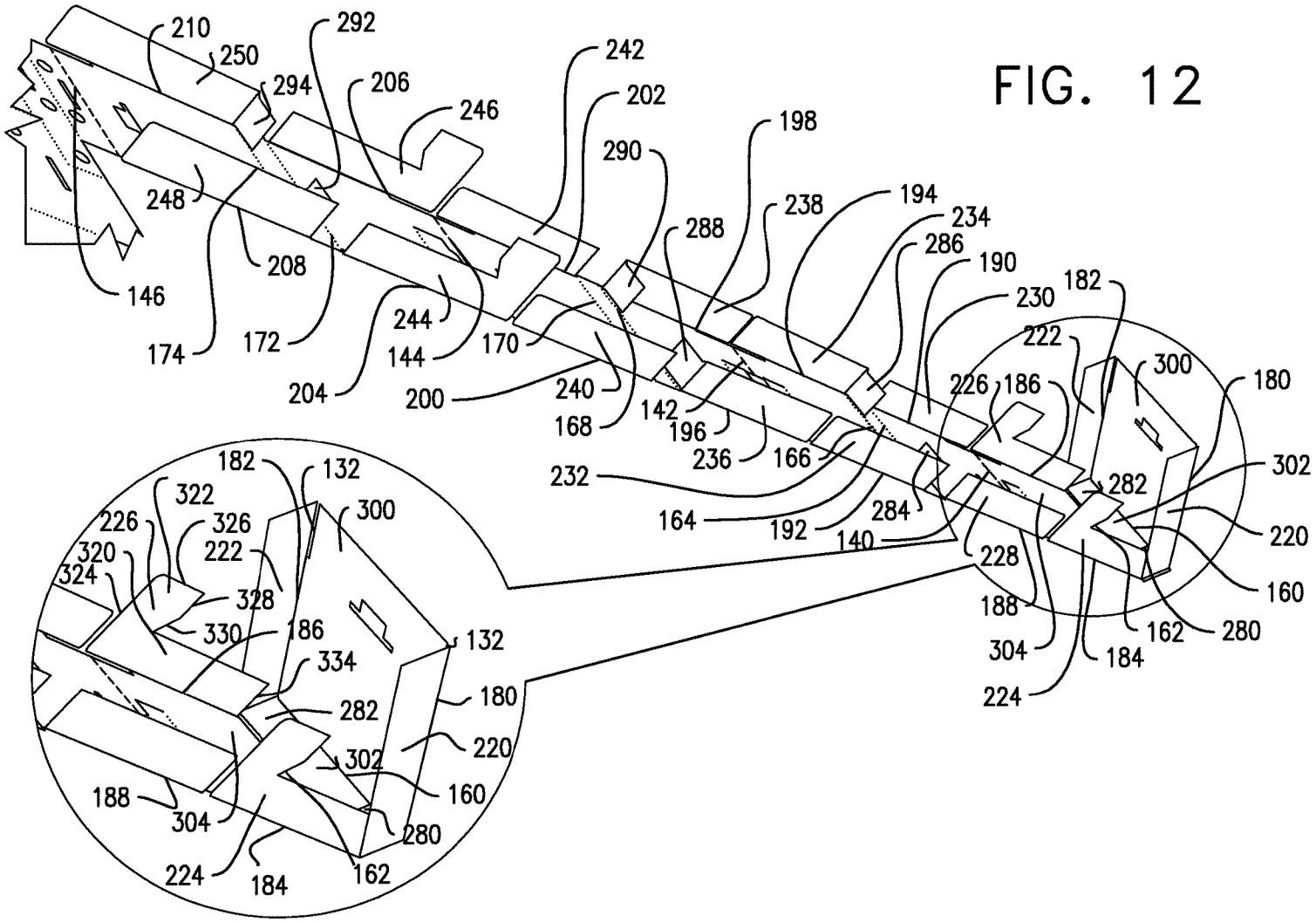
FIG. 12 is a simplified illustration of a partial second interior fold along an incised line.

FIG. 12 is a simplified illustration of a partial second interior fold along incised line 162 and shows first interior intermediate surface 302 angled at about 75 degrees with respect to second interior panel surface 304, such that first interior panel surface 300 is angled at about 45 degrees with respect to the second interior panel surface 304.

Figure 13:
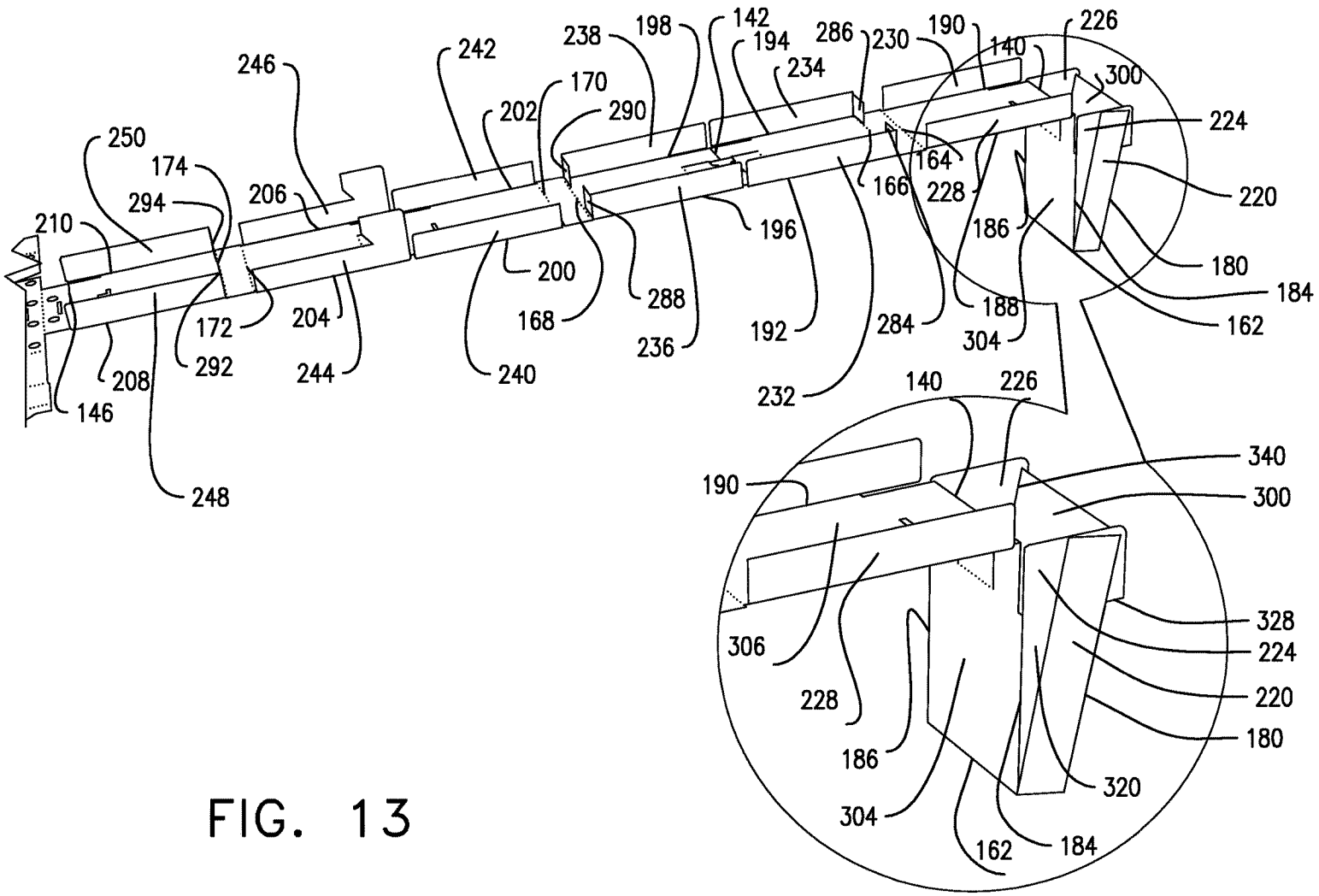
FIG. 13 is a simplified illustration of the partial second interior fold further but not completely folded, together with a partial first exterior fold along the first perforated line.

Reference is now made to FIG. 13, which is a simplified illustration of the partial second interior fold further but not completely folded, together with a partial first exterior fold along the first perforated line 140. FIG. 13 shows first interior intermediate surface 302 angled at about 110 degrees with respect to second interior panel surface 304, such that first interior panel surface 300 is angled at about 15 degrees with respect to the second interior panel surface 304. The first exterior fold causes the second interior panel surface 304 to be angled at about 270 degrees with respect to a third interior panel surface 306.

Figure 14:
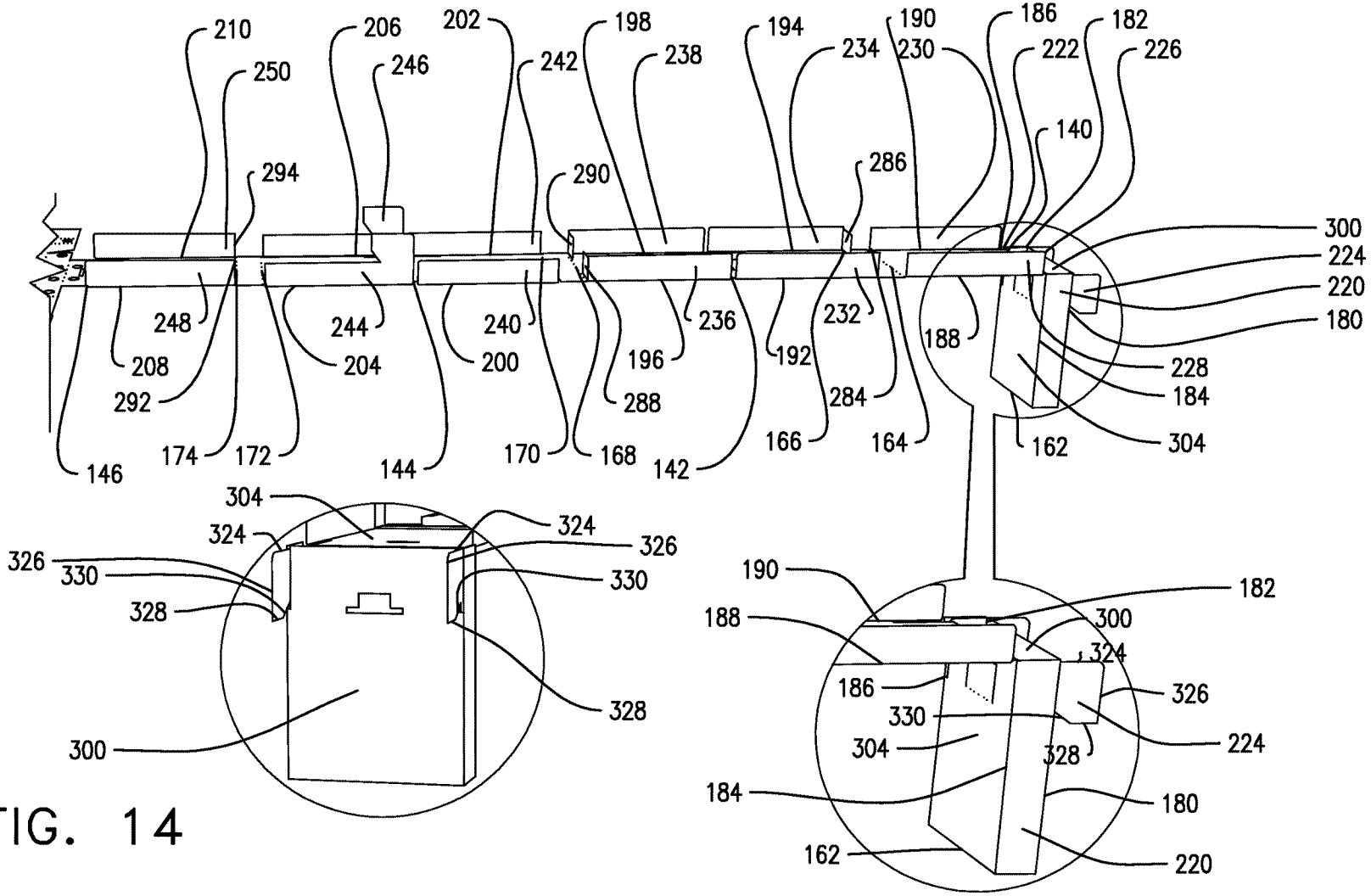
FIG. 14 is a simplified illustration of the second interior fold completely folded in a 90 degree fold.

Reference is now made to FIG. 14, which is a simplified illustration of the second interior fold completely folded such at the first and second interior panel surfaces 300 and 304 are generally mutually parallel and perpendicular to first interior intermediate surface 302.

Returning briefly to FIGS. 9-13, it is noted that side flaps 224 and 226 are each formed with a relatively narrow elongate portion 320 and a widened end portion 322. Widened end portion 322 includes an end edge 324 adjacent to the third interior panel surface 306, a top edge 326 generally perpendicular to end edge 324, a upper side edge 328 generally parallel to end edge 324 and an inclined edge 330 extending from upper side edge 328 to a top edge 332 of elongate portion 320. Elongate portion 320 also has an end edge 334.

It is further noted with reference to FIGS. 8-13 that various interior cut lines 132 define, inter alia, slits 340 and 342 extending partially along fold lines 180 and 182 respectively between first interior panel surface 300 and respective side flaps 220 and 222.

Considering FIGS. 12-14, it is seen that elongate portions 320 of side flaps 224 and 226 are being positioned interiorly of corresponding side flaps 220 and 222. In enlargements appearing in FIG. 12 and FIG. 13, end edge 334 of elongate portion 320 of side flap 226 is seen adjacent and interior of side flap 222.

In an enlargement appearing in FIG. 13, it is seen that top edges 326 of widened end portions 322 of respective side flaps 224 and 226 extend partially through respective slits 340 and 342 of respective side flaps 220 and 222.

Figure 74:
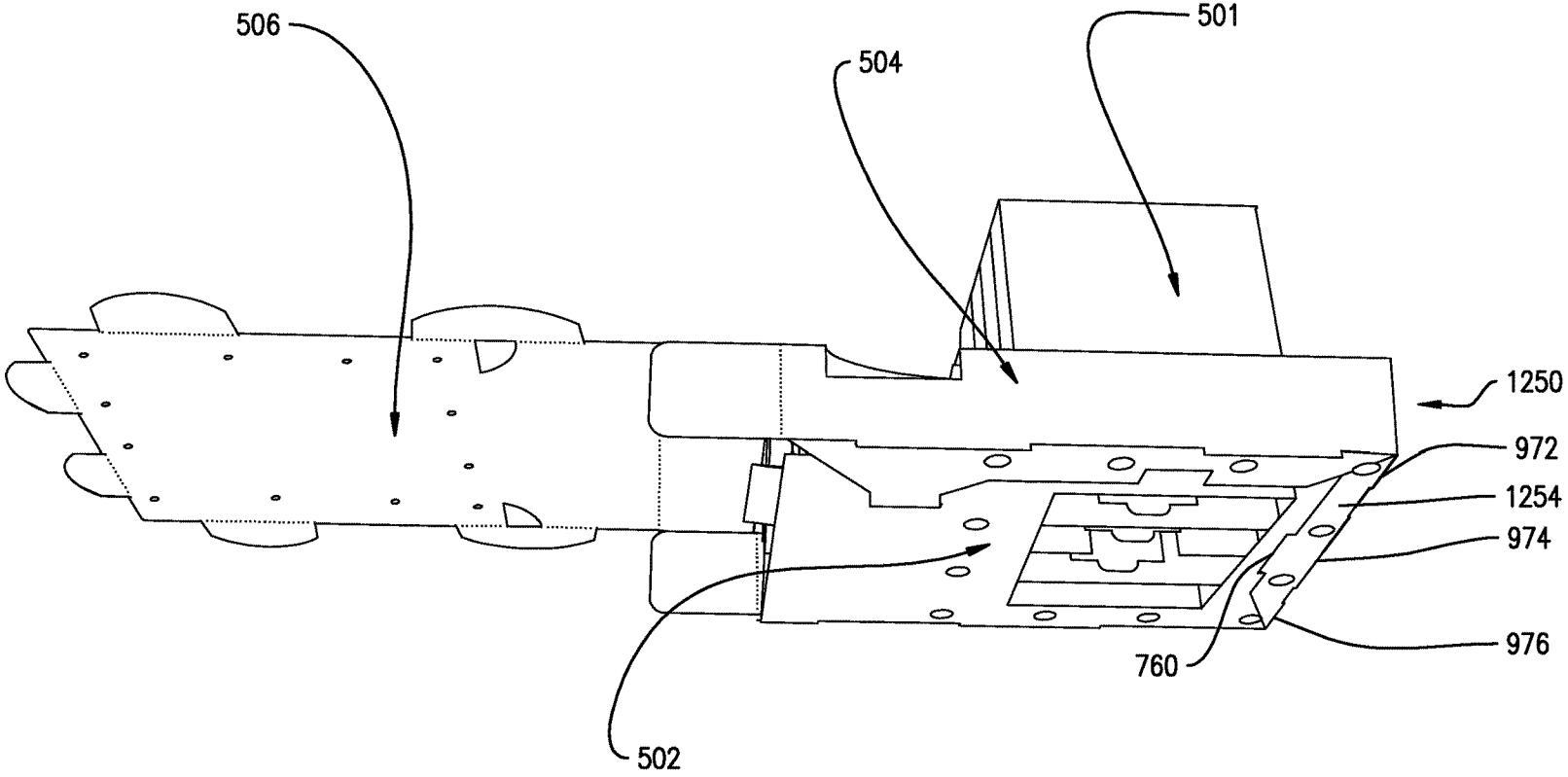
FIG. 74 is a simplified illustration showing final folding of portion forming part of end section, about mutually coaxial internal fold lines such that the portion lies generally perpendicular to the plane of the remainder of end section.

In an enlargement appearing in FIG. 14, it is seen that widened end portions 322 of respective side flaps 224 and 226 extend fully through respective slits 340 and 342 of respective side flaps 220 and 222. It is a particular feature of an embodiment of the present invention that widened end portions 422 each have a dimension which is generally identical to the interior dimension of the space between the top portion of top and side portion 504 and the bottom portions of internal structural portion 502 when fully folded as shown in FIG. 74. This feature contributes significantly to the rigidity of the resulting structure.

Figure 15:
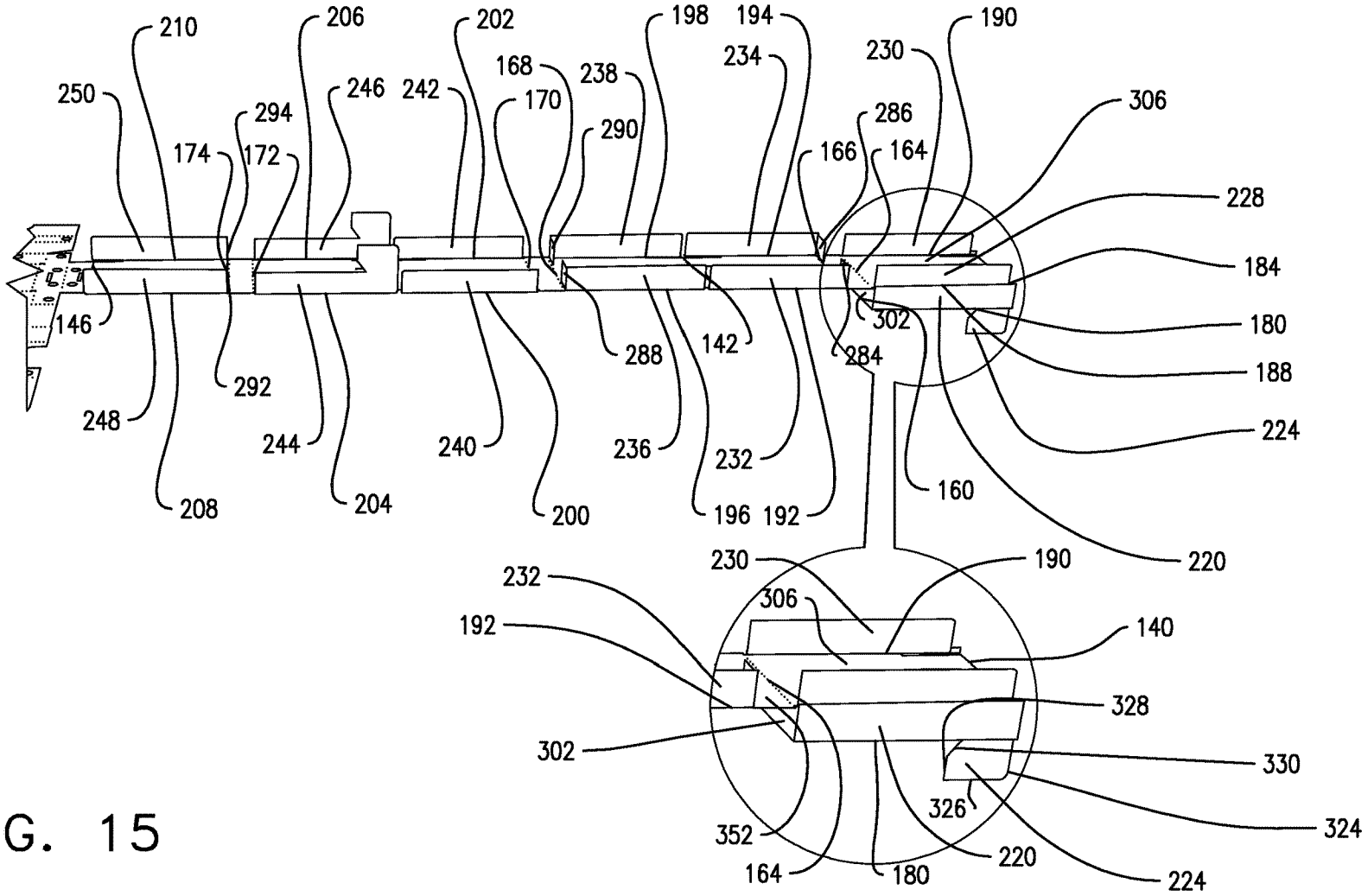
FIG. 15 is a simplified illustration of the first exterior fold completely folded in a 180 degree fold.

FIG. 15 shows the first exterior fold completely folded along perforated exterior fold line 140.

Figure 16:
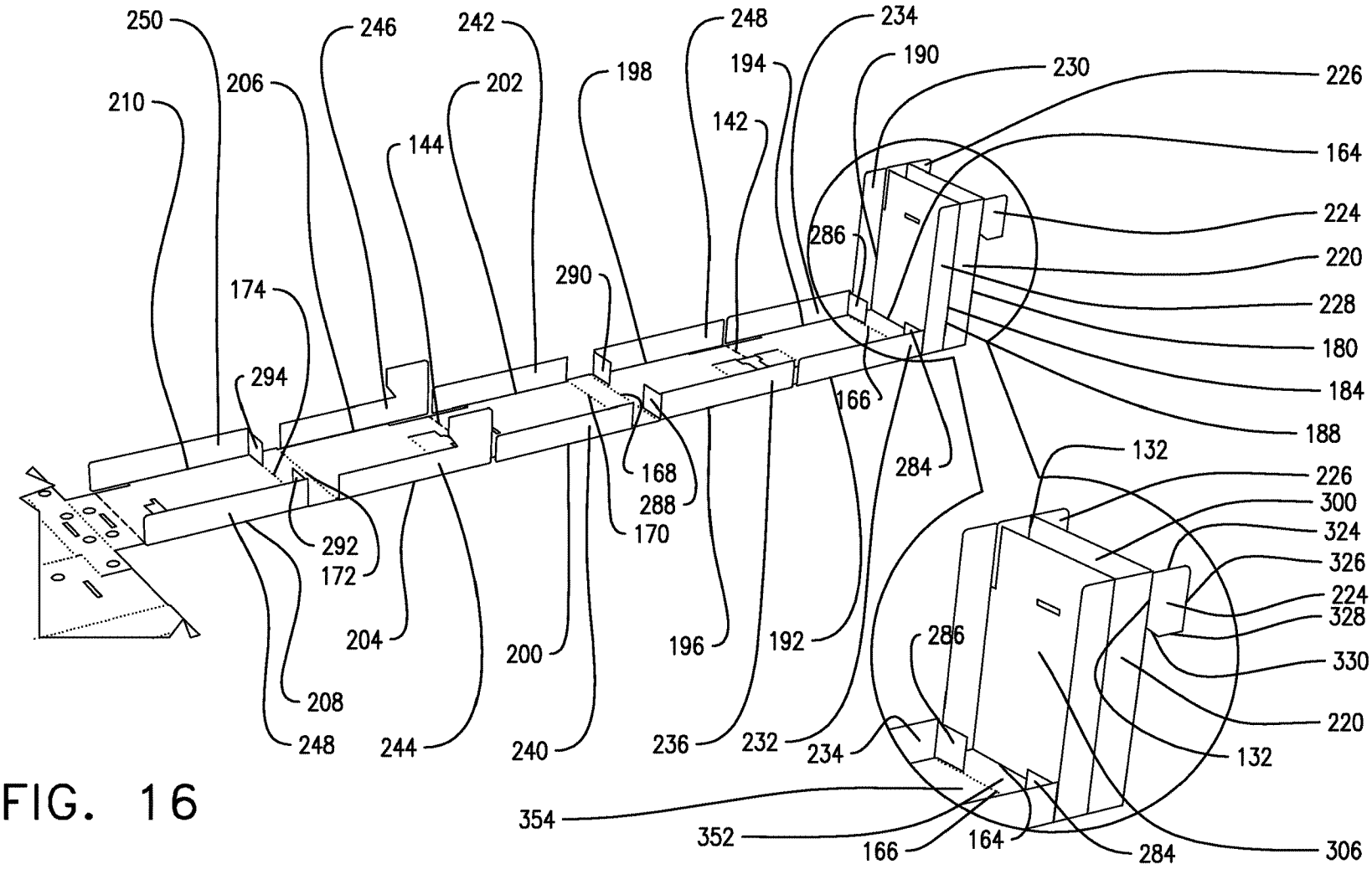
FIG. 16 is a simplified illustration of a third interior fold along an incised line.

Reference is now made to FIG. 16 which shows a third interior fold formed along incised line 164. As seen in FIG. 16, third interior panel surface 306 lies generally at 90 degrees with respect to a second interior intermediate surface 352 and to a fourth interior panel surface 354.

Figure 17:
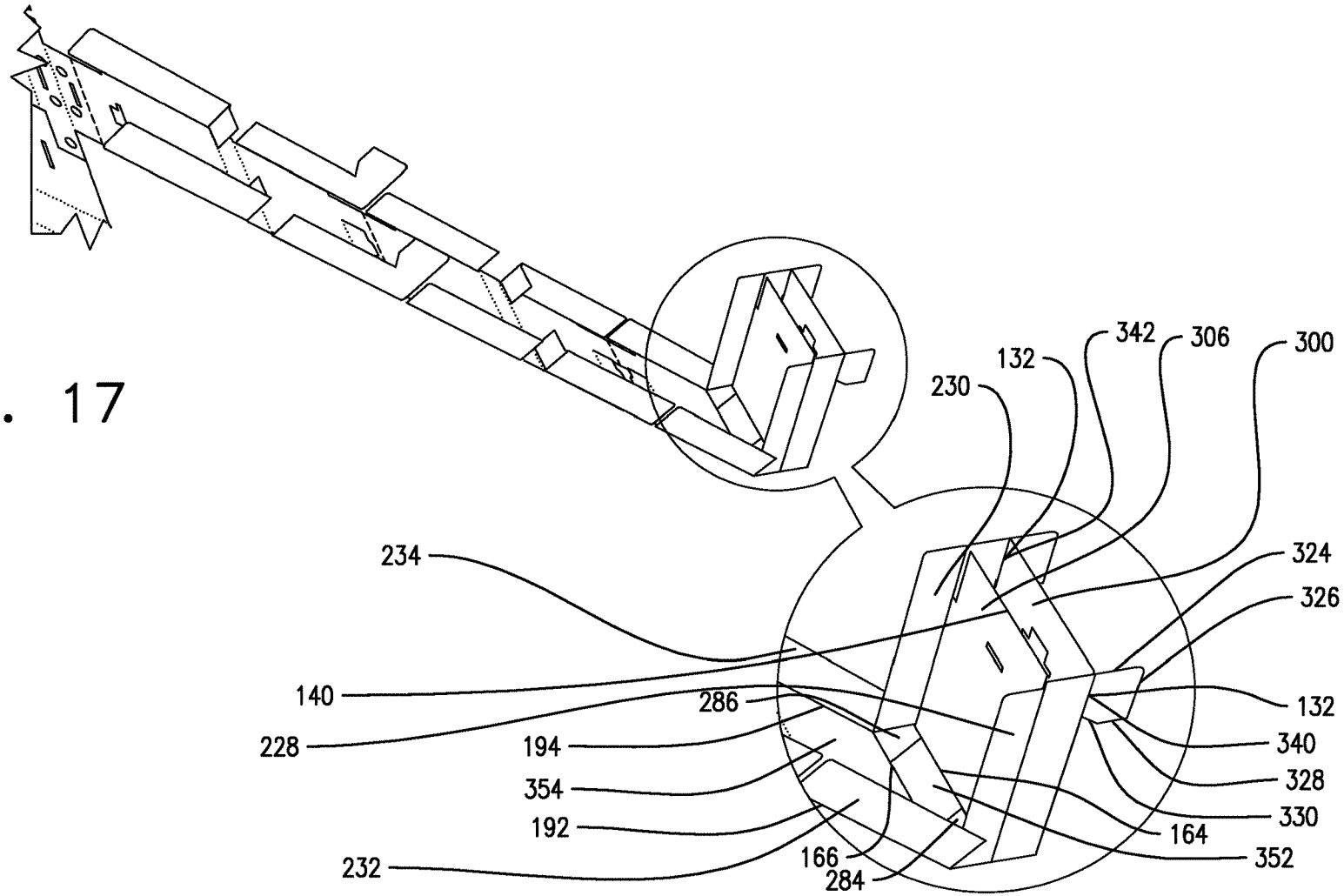
FIG. 17 is a simplified illustration of a partial fourth interior fold along an incised line.

FIG. 17 is a simplified illustration of a partial fourth interior fold along incised line 166 and shows second interior intermediate surface 352 angled at about 75 degrees with respect to fourth interior panel surface 354, such that third interior panel surface 306 is angled at about 45 degrees with respect to the fourth interior panel surface 354.

Figure 18:
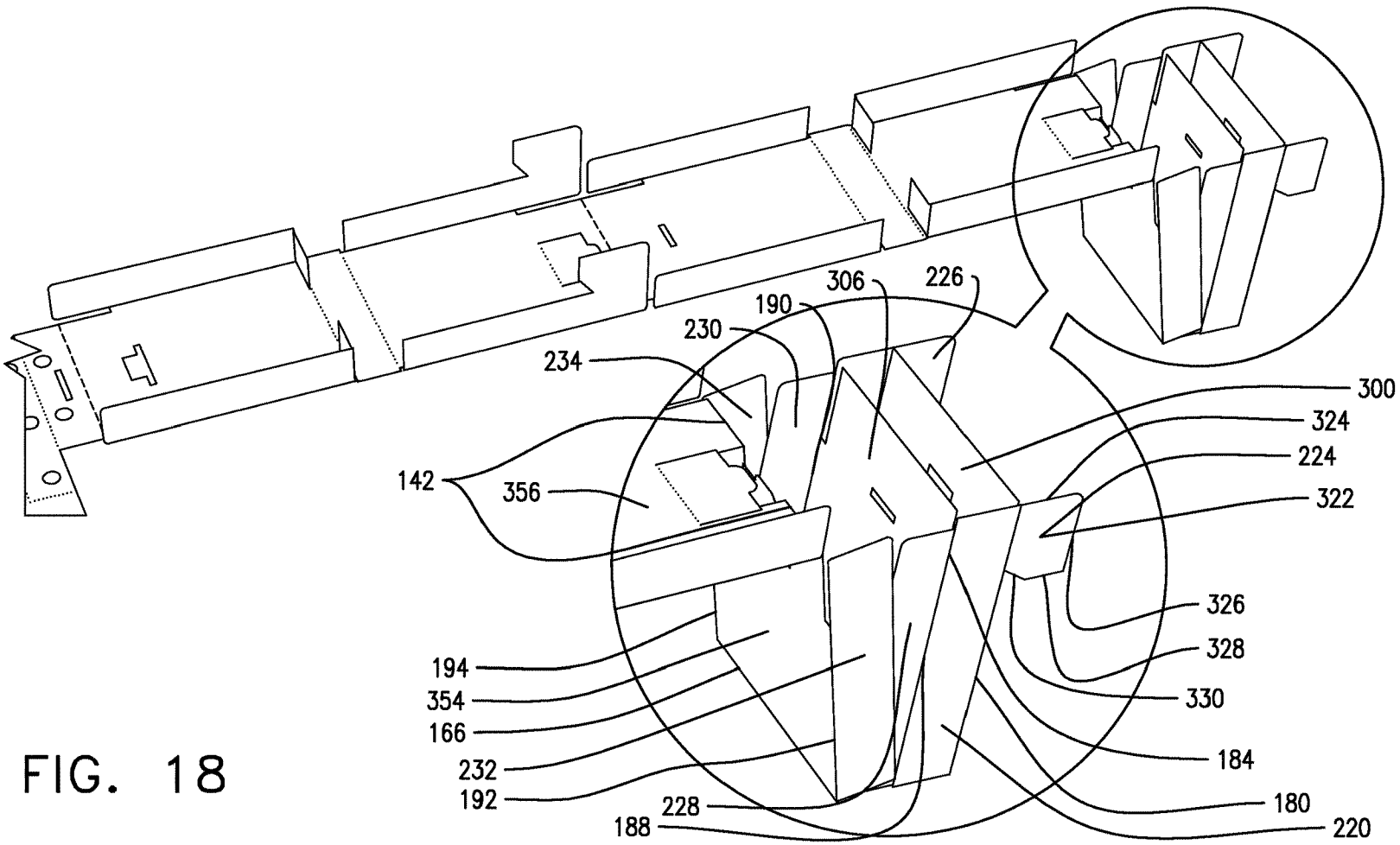
FIG. 18 is a simplified illustration of the partial fourth interior fold further but not completely folded, together with a partial second exterior fold along the second perforated line.

Reference is now made to FIG. 18, which is a simplified illustration of the partial fourth interior fold 166 further but not completely folded, together with a partial second exterior fold along the second perforated exterior fold line 142. FIG. 18 shows second interior intermediate surface 352 angled at about 110 degrees with respect to fourth interior panel surface 354, such that third interior panel surface 306 is angled at about 15 degrees with respect to the fourth interior panel surface 354. The second exterior fold causes the fourth interior panel surface 354 to be angled at about 270 degrees with respect to a fifth interior panel surface 356.

Figure 19:
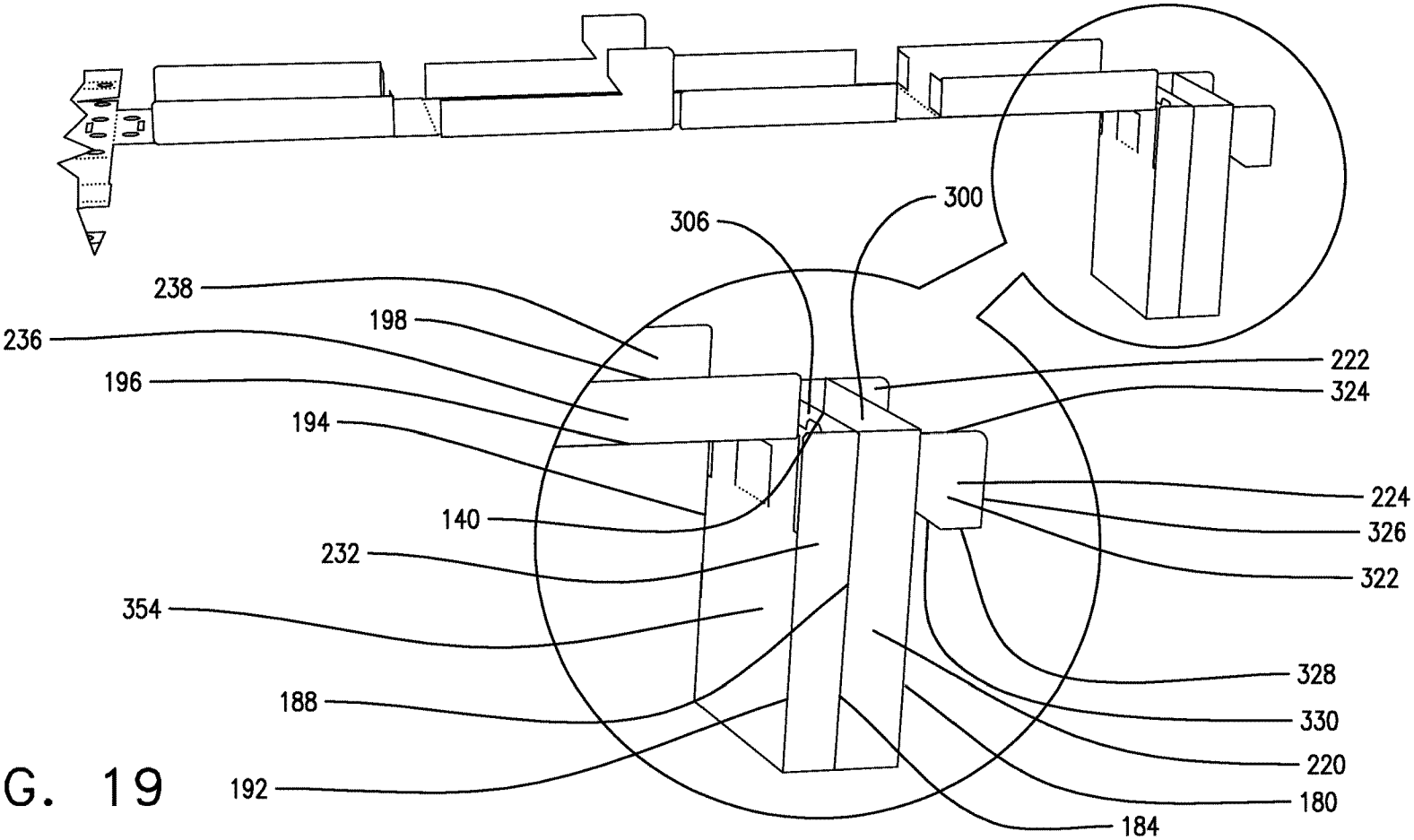
FIG. 19 is a simplified illustration of the fourth interior fold completely folded in a 90 degree fold, together with a partial second exterior fold along the second perforated line.

Reference is now made to FIG. 19, which is a simplified illustration of the fourth interior fold completely folded such at the first, second, third and fourth interior panel surfaces 300, 304, 306 and 354 are generally mutually parallel and perpendicular to first and second interior intermediate surfaces 302 and 352.

Returning briefly to FIGS. 16-19, it is seen that side flaps 228 and 230 are being positioned interiorly of corresponding side flaps 232 and 234.

Figure 20:
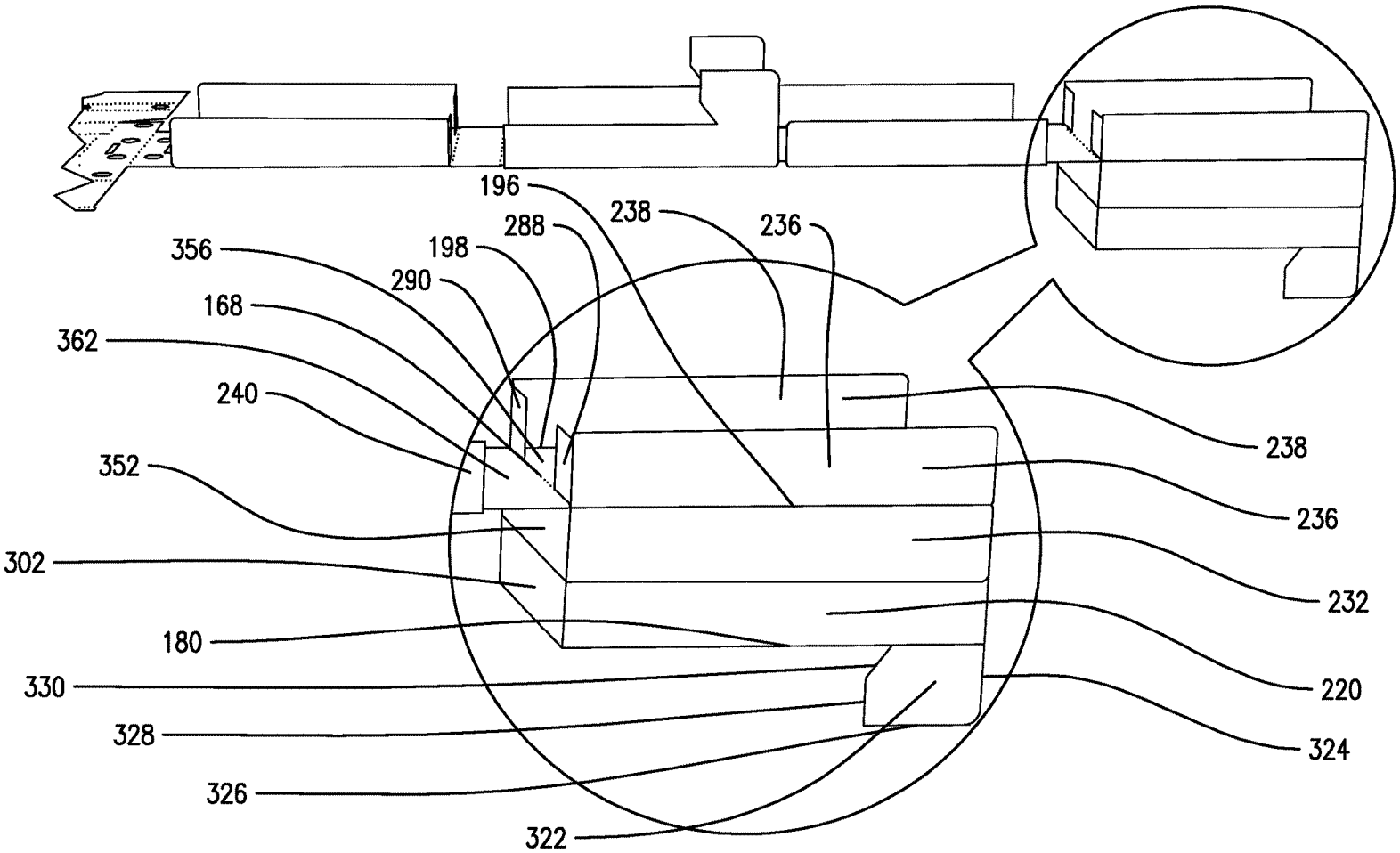
FIG. 20 is a simplified illustration of the second exterior fold completely folded in a 180 degree fold.

FIG. 20 shows the second exterior fold completely folded along a perforated exterior fold line 142.

Figure 21:
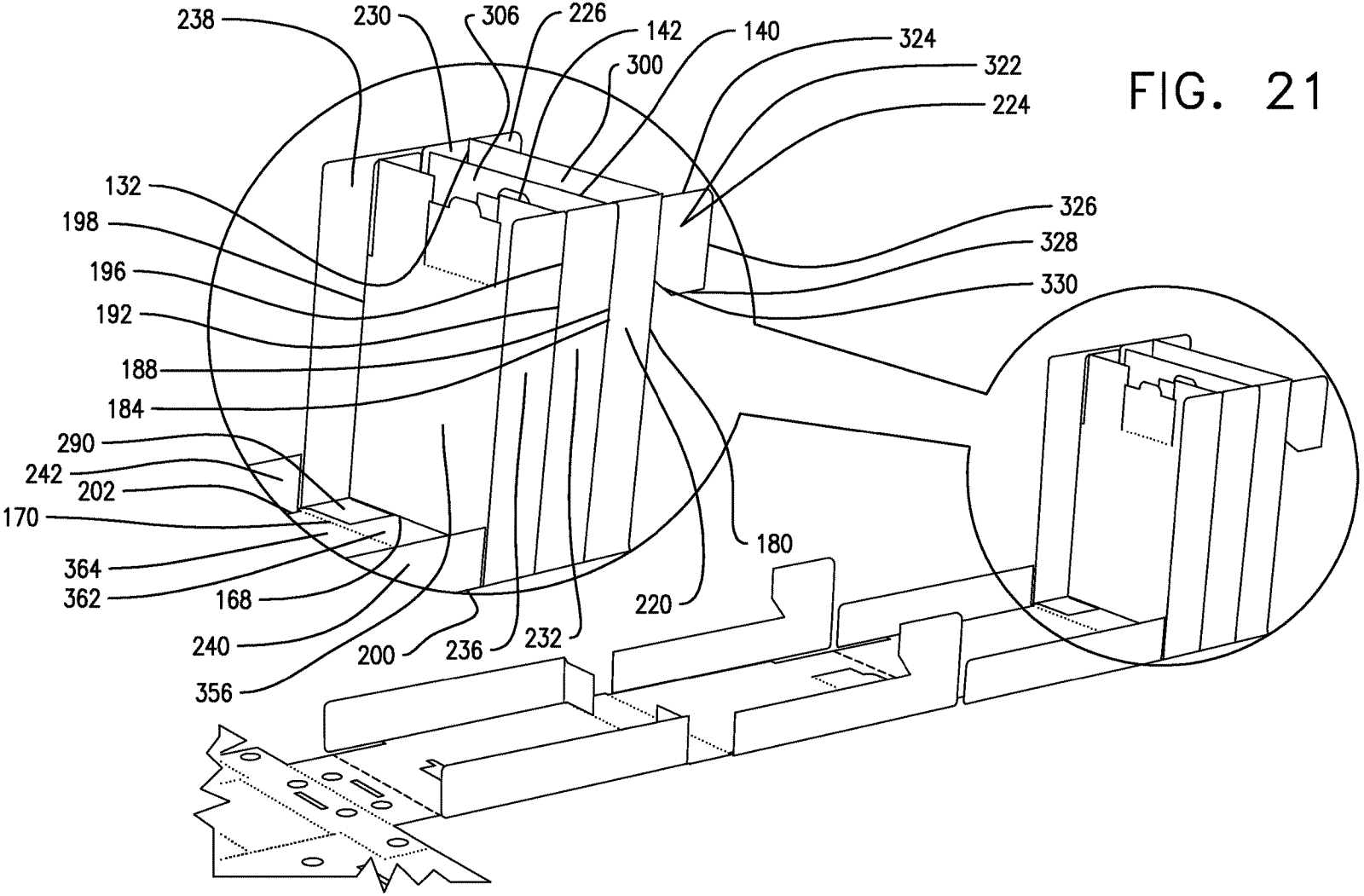
FIG. 21 is a simplified illustration of a partial fifth interior fold along an incised line.

Reference is now made to FIG. 21 which shows a fifth interior fold formed along incised line 168. As seen in FIG. 21, fifth interior panel surface 356 lies generally at 90 degrees with respect to a third interior intermediate surface 362 and to a sixth interior panel surface 364.

Figure 22:
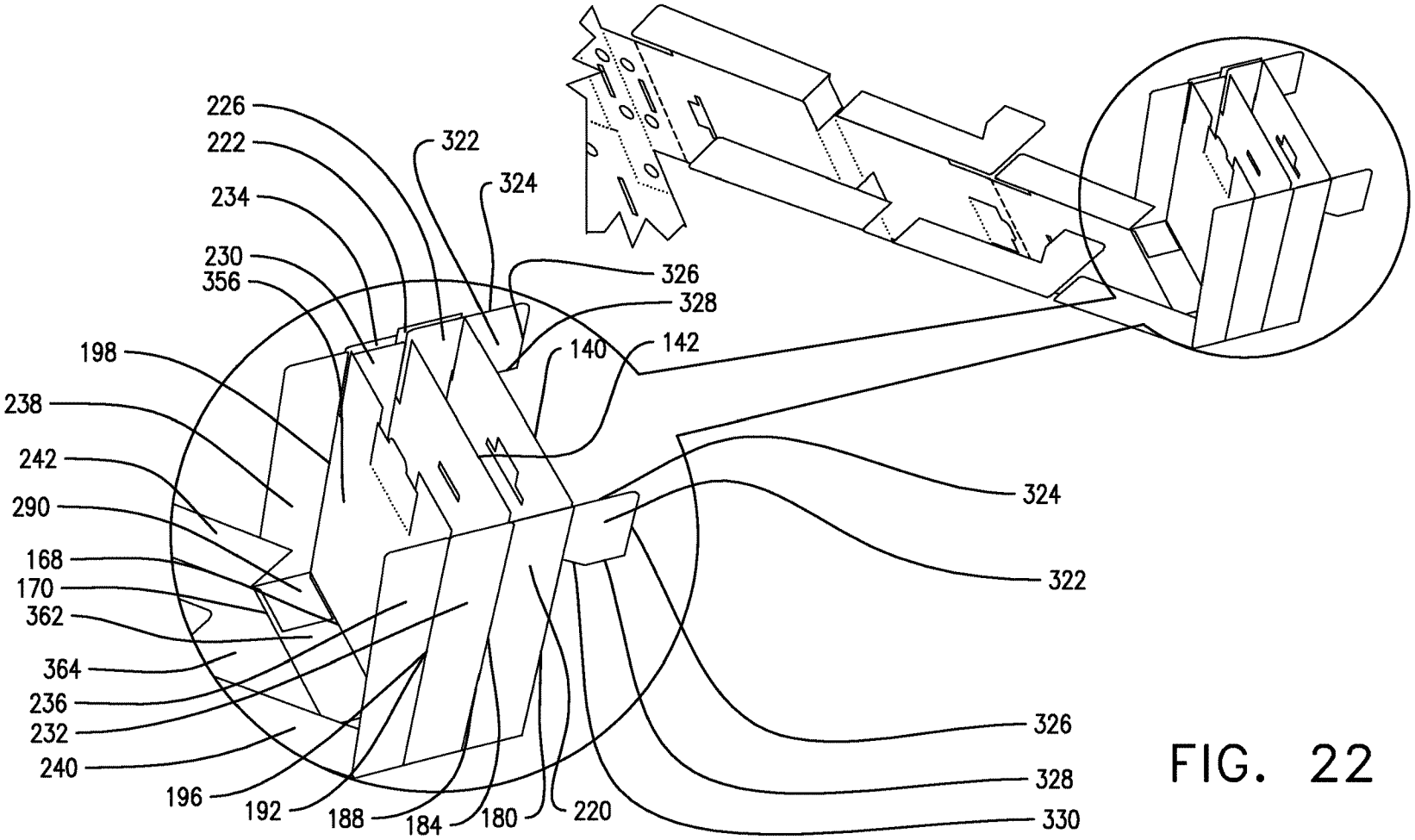
FIG. 22 is a simplified illustration of a partial sixth interior fold along an incised line.

FIG. 22 is a simplified illustration of a partial sixth interior fold along incised line 170 and shows third interior intermediate surface 362 angled at about 75 degrees with respect to sixth interior panel surface 364, such that fifth interior panel surface 356 is angled at about 45 degrees with respect to the sixth interior panel surface 364.

Figure 23:
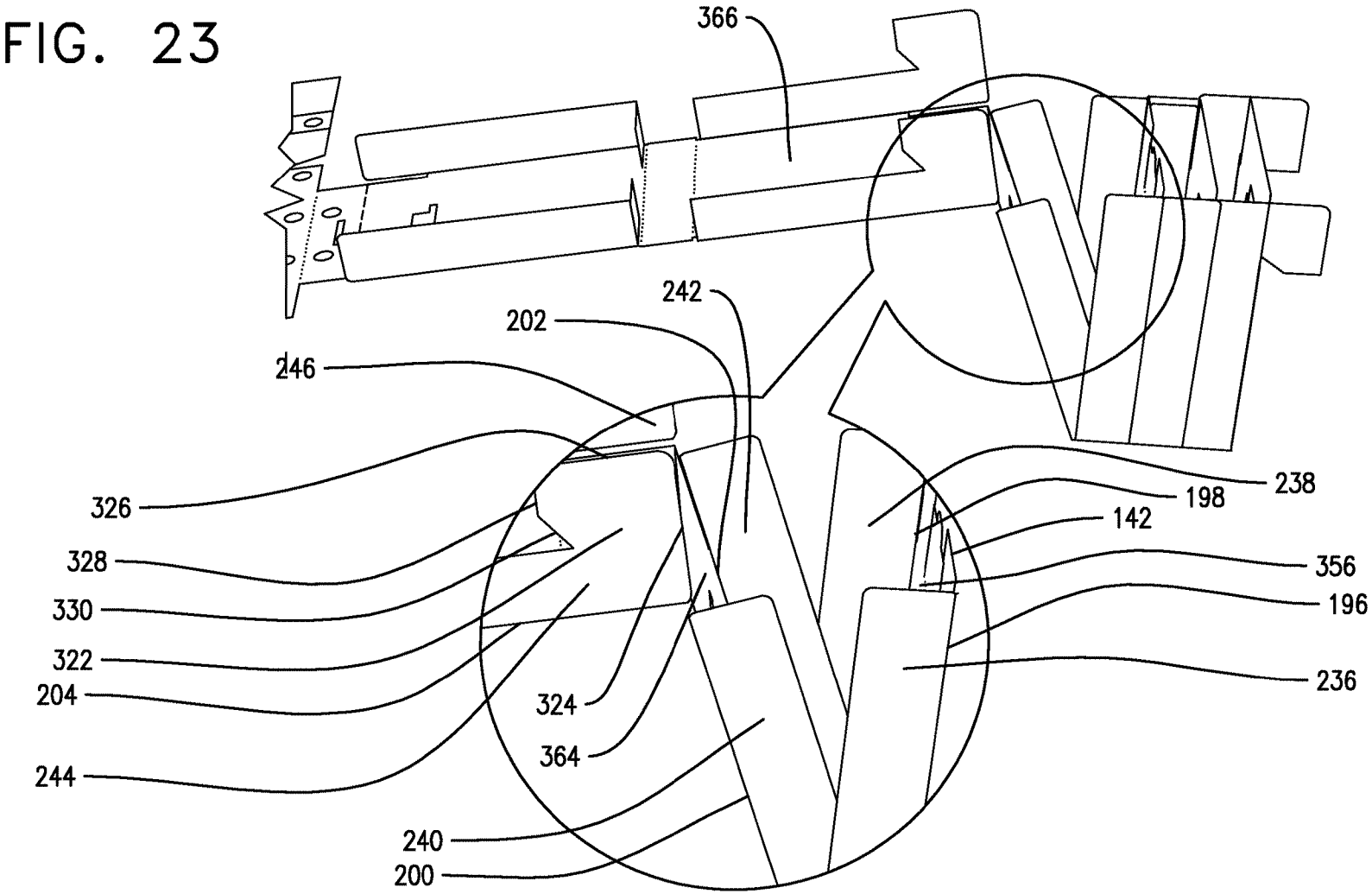
FIG. 23 is a simplified illustration of the partial sixth interior fold further but not completely folded, together with a partial third exterior fold along the third perforated line.

Reference is now made to FIG. 23, which is a simplified illustration of the partial sixth interior fold further but not completely folded, together with a partial third exterior fold along the third perforated line 144. FIG. 23 shows third interior intermediate surface 362 angled at about 110 degrees with respect to sixth interior panel surface 364, such that fifth interior panel surface 356 is angled at about 15 degrees with respect to the sixth interior panel surface 364. The third exterior fold causes the sixth interior panel surface 364 to be angled at about 270 degrees with respect to a seventh interior panel surface 366.

Figure 24:
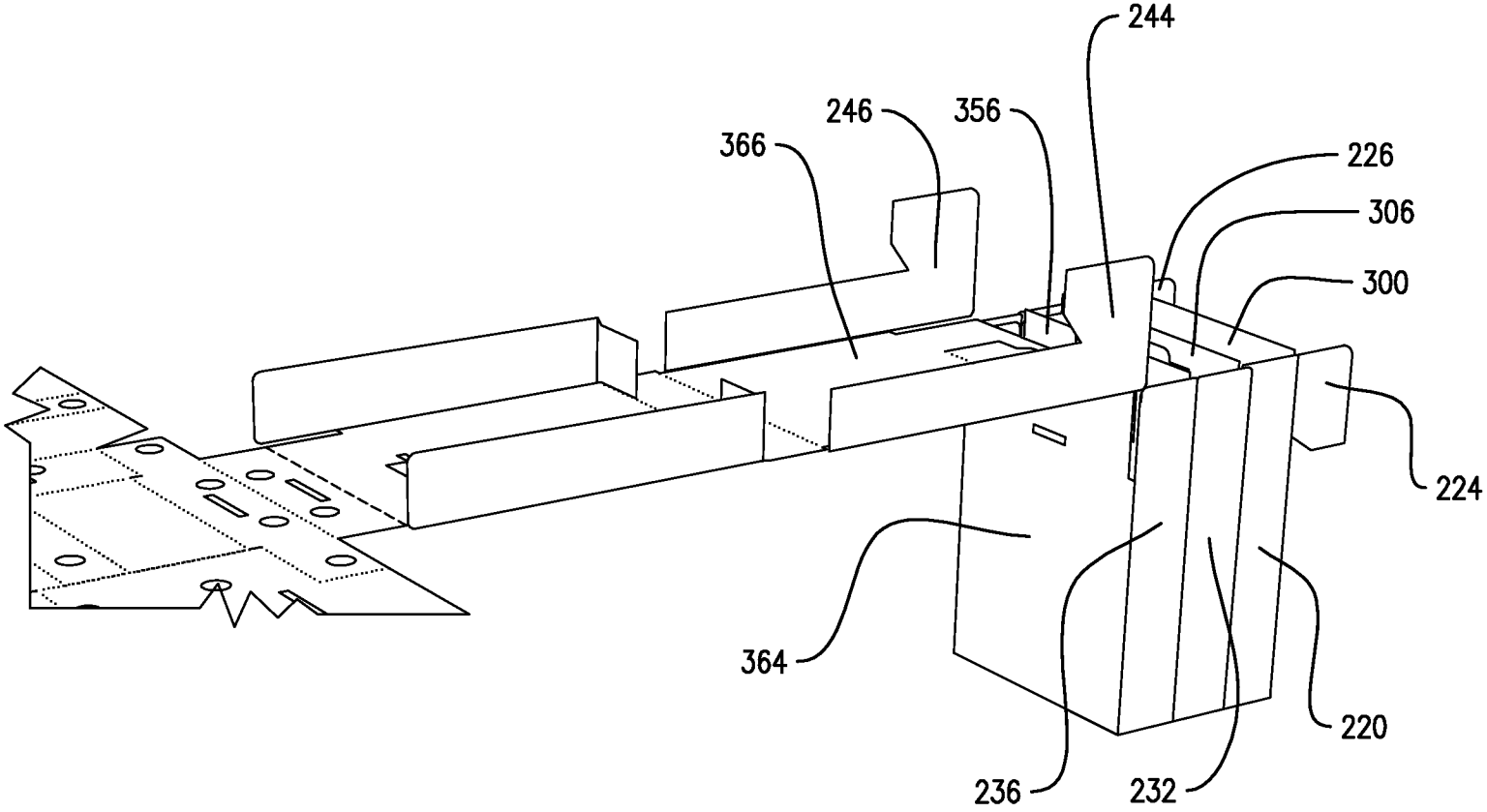
FIG. 24 is a simplified illustration of the sixth interior fold completely folded in a 90 degree fold, together with a partial third exterior fold along the second perforated line.

Reference is now made to FIG. 24, which is a simplified illustration of the sixth interior fold completely folded such at the first, second, third, fourth, fifth and sixth interior panel surfaces 300, 304, 306, 354, 356 and 364 are generally mutually parallel and perpendicular to first, second and third interior intermediate surfaces 302, 352 and 362.

Returning briefly to FIGS. 21-24, it is seen that side flaps 240 and 242 are being positioned interiorly of corresponding side flaps 236 and 238.

Figure 25:
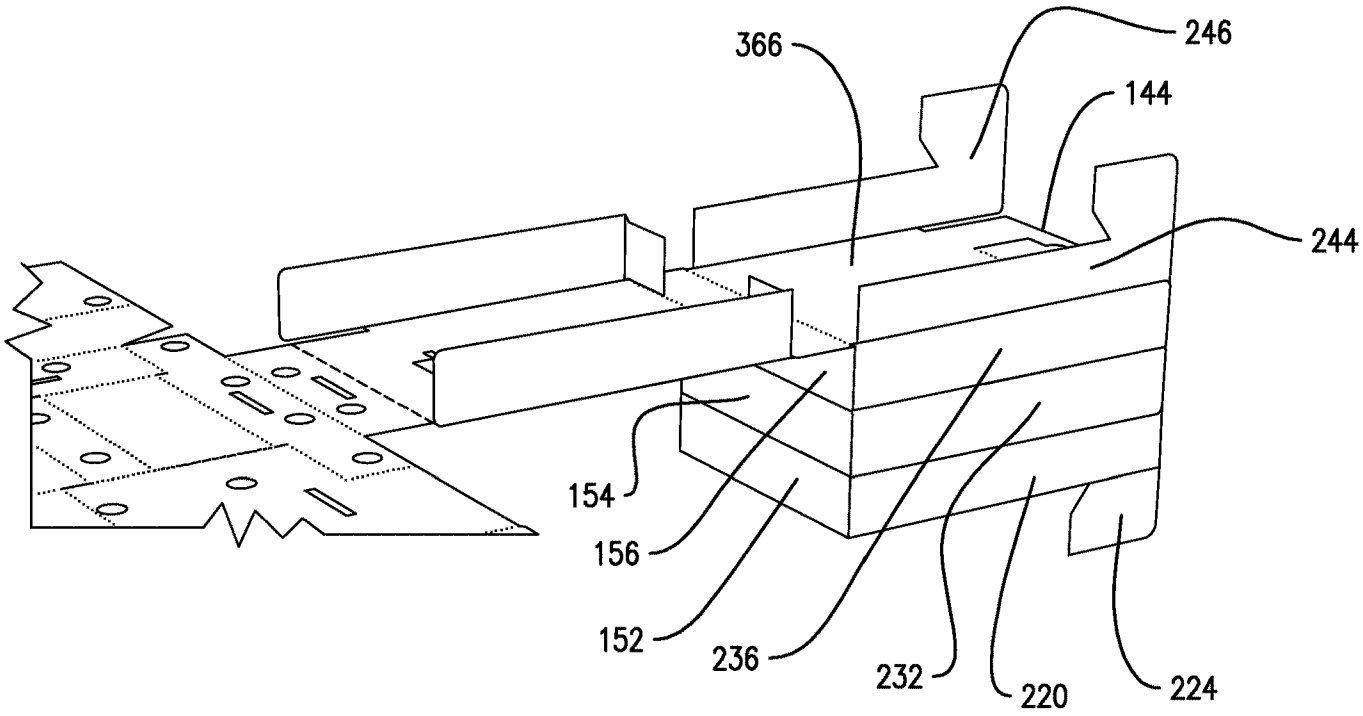
FIG. 25 is a simplified illustration of the third exterior fold completely folded in a 180 degree fold.

FIG. 25 shows the third exterior fold completely folded along a perforated exterior fold line 144.

Figure 26:
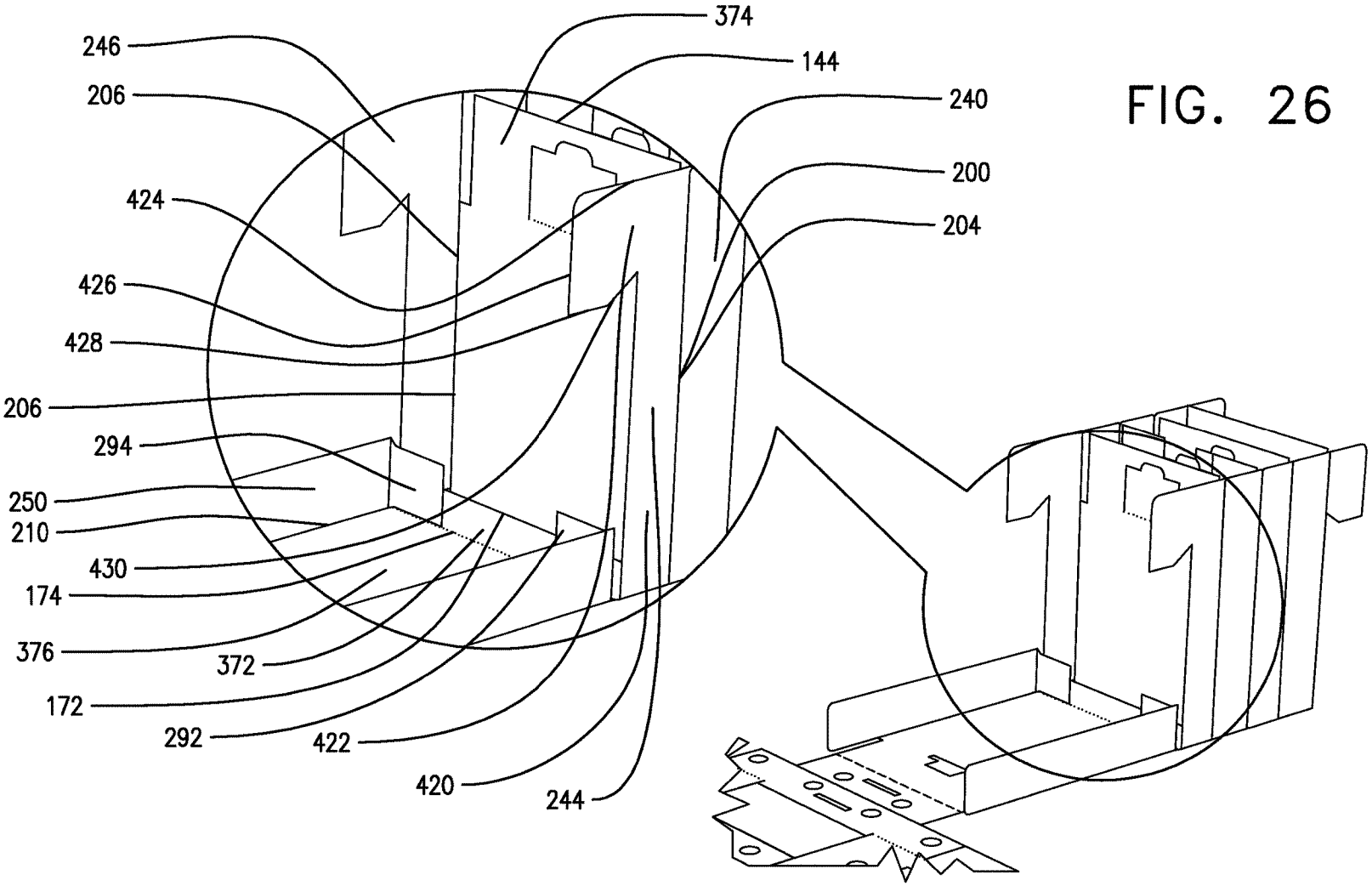
FIG. 26 is a simplified illustration of a seventh interior fold along an incised line.

Reference is now made to FIG. 26, which is a simplified illustration of a seventh interior fold along an incised line 172. As seen in FIG. 26, sixth interior panel surface 364 lies generally at 90 degrees with respect to a fourth interior intermediate surface 372 and to a seventh interior panel surface 374.

Figure 27:
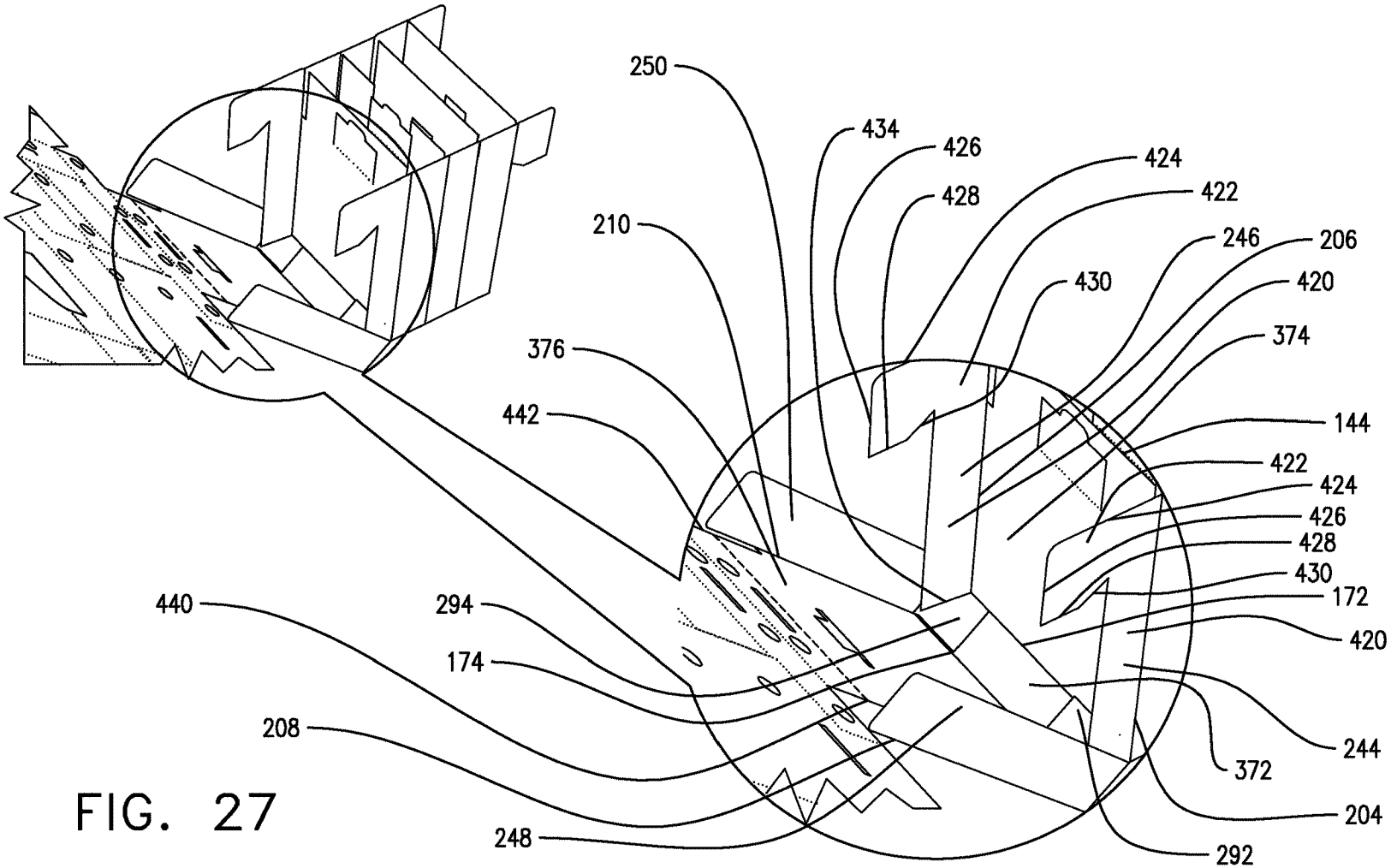
FIG. 27 is a simplified illustration of a partial eighth interior fold along an incised line.

FIG. 27 is a simplified illustration of a partial eighth interior fold along incised line 172 and shows fourth interior intermediate surface 372 angled at about 75 degrees with respect to seventh interior panel surface 374, such that seventh interior panel surface 374 is angled at about 45 degrees with respect to an eight interior panel surface 376.

Figure 28:
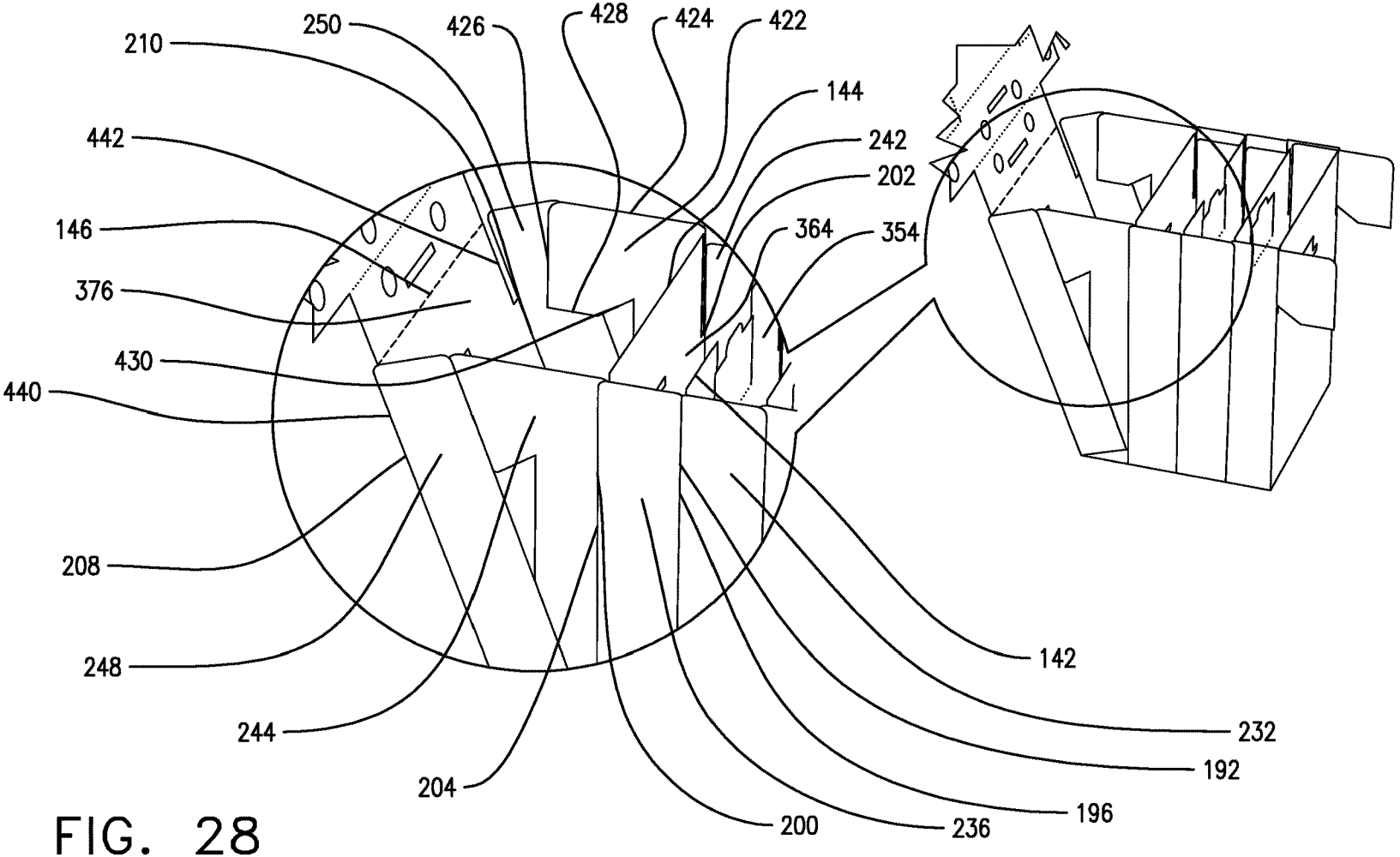
FIG. 28 is a simplified illustration of the partial eighth interior fold further but not completely folded.

Reference is now made to FIG. 28, which is a simplified illustration of the partial eight interior fold further but not completely folded. FIG. 28 shows fourth interior intermediate surface 372 angled at about 110 degrees with respect to eighth interior panel surface 376.

Figure 29:
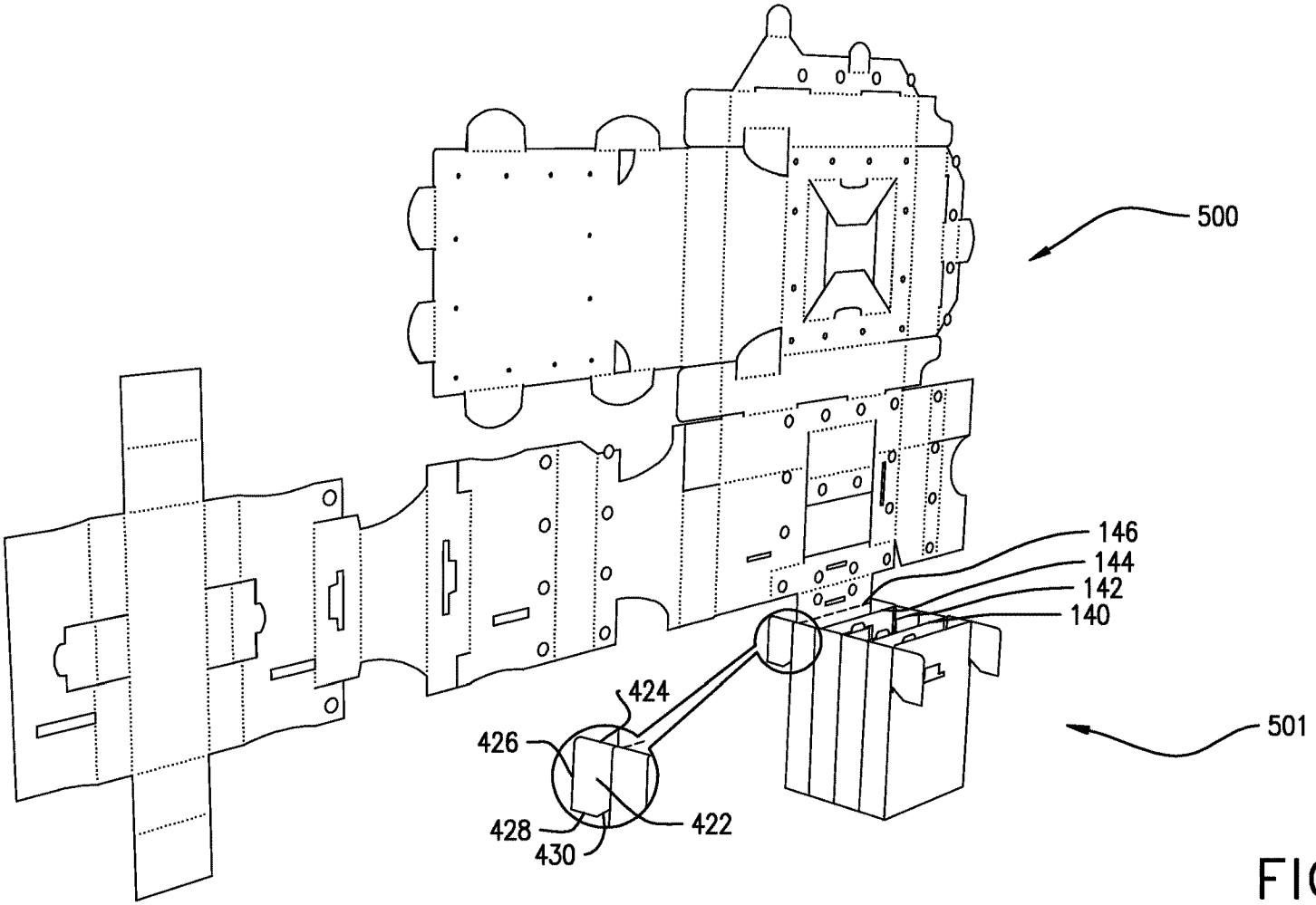
FIG. 29 is a simplified illustration of the eighth interior fold completely folded in a 90 degree fold.

Reference is now made to FIG. 29, which is a simplified illustration of the eighth interior fold 174 completely folded such that the first, second, third, fourth, fifth, sixth, seventh and eighth interior panel surfaces 300, 304, 306, 354, 356, 364, 374 and 376 are generally mutually parallel and perpendicular to first, second, third and fourth interior intermediate surface 302, 352, 362 and 372.

Returning briefly to FIGS. 9, 10 and 26-29, it is noted that side flaps 244 and 246 are each formed with a relatively narrow elongate portion 420 and a widened end portion 422. Widened end portion 422 includes an end edge 424 adjacent to the third interior panel surface 306, a top edge 426 generally perpendicular to end edge 424, a upper side edge 428 generally parallel to end edge 424 and an inclined edge 430 extending from upper side edge 428 to a top edge 432 of elongate portion 420. Elongate portion 420 also has an end edge 434.

It is further noted with reference to FIGS. 8-10 and 26-29 that various interior cut lines 132 define, inter alia, slots 440 and 442 extending partially along fold lines 208 and 210 respectively between eighth interior panel surface 376 and respective side flaps 248 and 250.

Considering FIGS. 26-29, it is seen that elongate portions 420 of side flaps 244 and 246 are being positioned interiorly of corresponding side flaps 248 and 250. In an enlargement appearing in FIG. 27, end edge 434 of elongate portion 420 of side flap 246 is seen adjacent and interior of side flap 250.

In an enlargement appearing in FIG. 28, it is seen that top edges 426 of widened end portions 422 of respective side flaps 244 and 246 extend towards respective slots 440 and 442 of respective side flaps 248 and 250.

In an enlargement appearing in FIG. 29, it is seen that widened end portions 422 of respective side flaps 244 and 246 extend fully through respective slots 440 and 442 of respective side flaps 248 and 250. It is a particular feature of an embodiment of the present invention that widened end portions have a dimension which is generally identical to the interior dimension of the space between the top portion of top and side portion 504 and the bottom portions of internal structural portion 502 when fully folded as shown in FIG. 74. This feature contributes significantly to the rigidity of the resulting structure.

Figure 30:
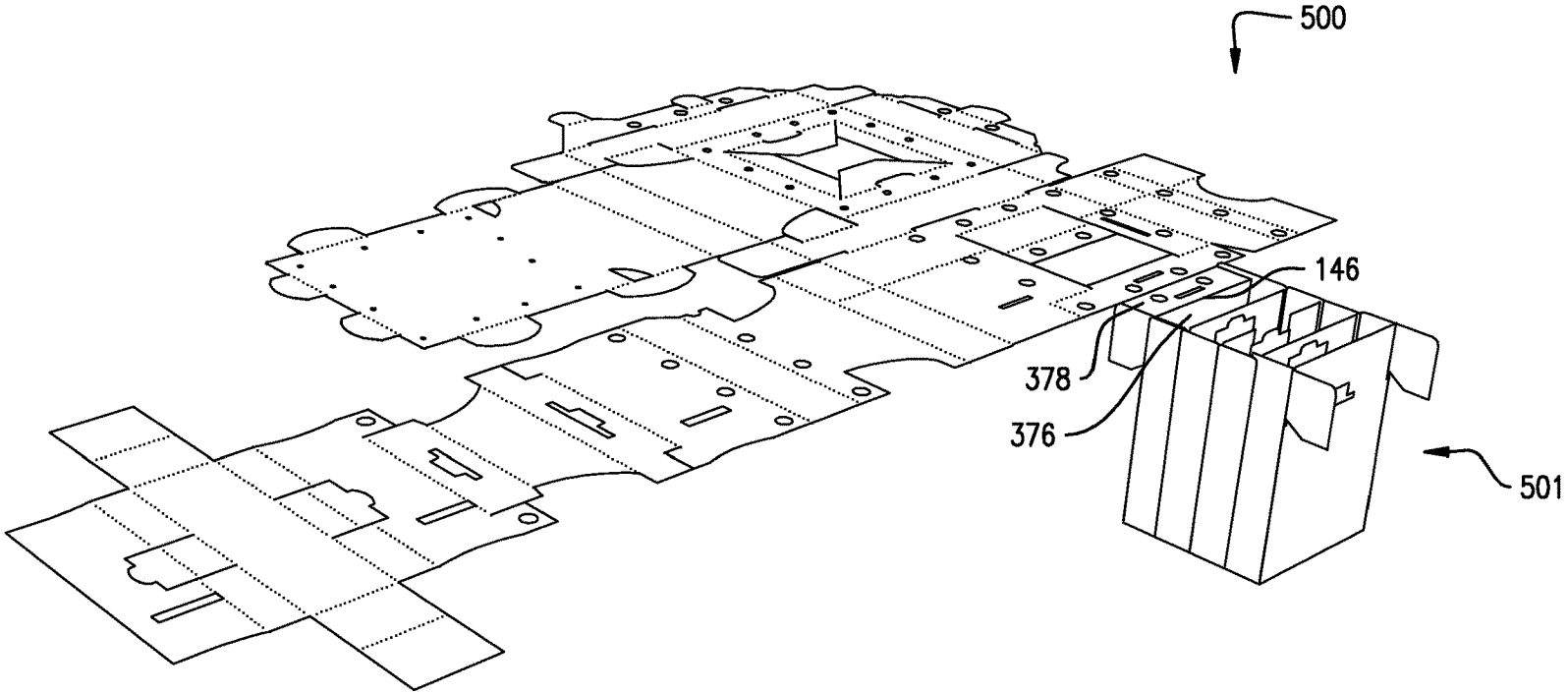
FIG. 30 is a simplified illustration of the fourth exterior fold completely folded in a 90 degree fold.

FIG. 30 shows the fourth exterior fold completely folded in a 90 degree fold along fourth perforated exterior fold line 146 such that fifth interior intermediate surface 378 lies generally perpendicular to eighth interior panel surface 376.

Figure 31A:
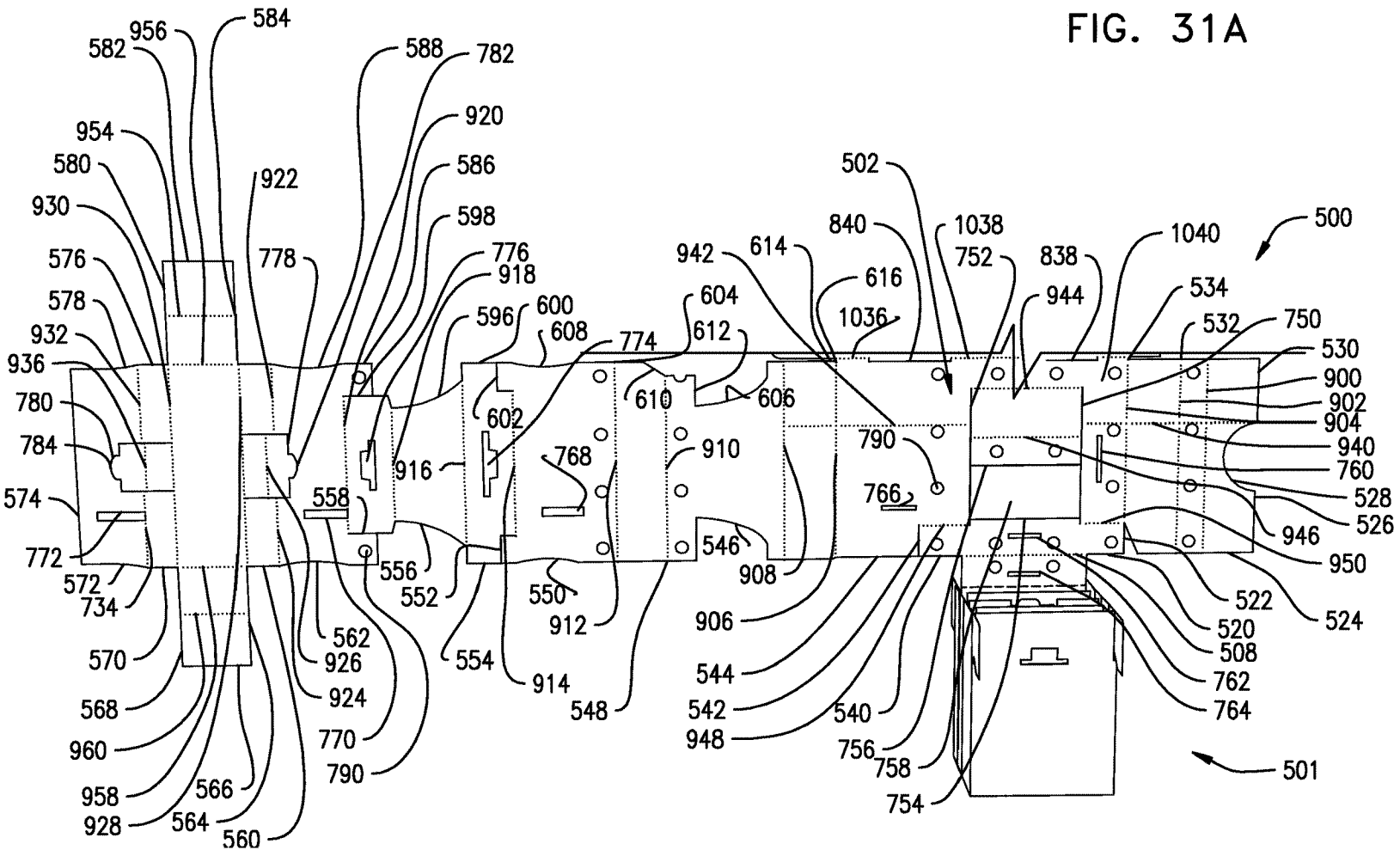
FIGS. 31A and 31B are together a simplified illustration of a partially assembled head phylactery including a subpattern, which, when suitably folded and assembled, defines a base for the subassembly, whose assembly is shown in FIGS. 3-29.
Figure 31B:
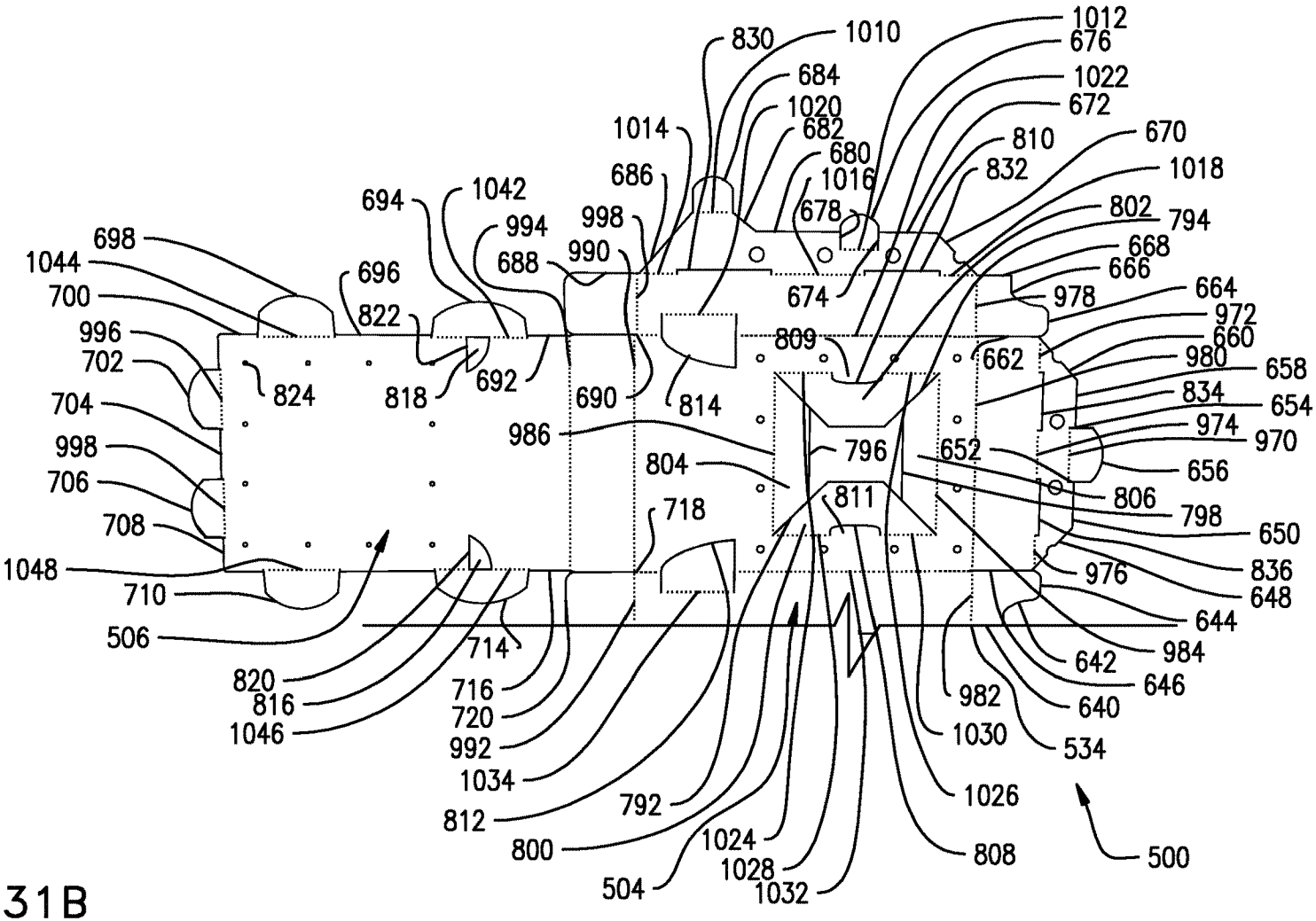

Reference is now made to FIGS. 31A and 31B, which together illustrate a partially assembled head phylactery in which pattern 125 (FIG. 2) also includes a subpattern 500, which, when suitably folded and assembled, defines a base for the subassembly described hereinabove with reference to FIGS. 3-29, which subassembly is hereinafter designated by reference numeral 501.

Subpattern 500 includes an internal structural portion 502, a top and side portion 504, a bottom portion 506. Internal structural portion 502 is joined to fifth interior intermediate surface 378 at an incised interior fold line 508.

It is seen that the outer dimensions of internal structural portion 502 are defined by outline cut lines 130 (FIG. 2) including the following outline cut line portions which will be described in a generally counterclockwise order beginning from the right end of incised interior fold line 508, as seen in FIG. 31A:

The outline cut line portions include a first coaxial cut line portion 520, extending coaxially with incised interior fold line 508 and to the right thereof, as seen in FIG. 31A. First portion 520 extends to a notch cut line portion 522 and thence to a second coaxial cut line portion 524, which, in turn extends to a 90 degree corner. Extending perpendicularly to cut line portions 520 and 524 is a first perpendicular cut line portion 530, which in turn extends to a 90 degree corner. A parallel cut line portion 532 extends perpendicularly to cut line portions 526 and 530 to a termination point 534, which lies generally opposite notch cut line portion 522.

Internal structural portion 502 is also defined by outline cut lines 130 (FIG. 2) including the following outline cut line portions which will be described in a generally clockwise order beginning from the left end of incised interior fold line 508, as seen in FIG. 31A:

The outline cut line portions include a third coaxial cut line portion 540, extending coaxially with incised interior fold line 508 and to the left thereof, as seen in FIG. 31A. Third cut line portion 540 extends to a perpendicular cut line portion 542 and thence to a fourth coaxial cut line portion 544, which, in turn extends to a partially curved cut out portion 546. A fifth generally coaxial cut line portion 548 extends to the left of partially curved cut out portion 546 and includes a very slight concave cut line portion 550. Fifth coaxial portion cut line 548 extends to a generally L-shaped perpendicular cut line portion 552.

A sixth coaxial cut line portion 554 extends from cut line portion 552 to a partially curved, partially stepped cut out portion 556, which includes a cut line portion 558. A seventh generally coaxial cut line portion 560 extends to the left of partially curved, partially stepped cut out portion 556 and includes a very slight concave cut line portion 562. Seventh generally coaxial cut line portion 560 extends to a perpendicular cut line portion 564, which terminates in a 90 degree corner, from which extends a cut line portion 566. Cut line portion 566 terminates in a 90 degree corner, from which extends a cut line portion 568. An eighth generally coaxial cut line portion 570 extends to the left of cut line portion 568 and includes a very slight concave cut line portion 572.

Eighth generally coaxial cut line portion 570 terminates at a 90 degree corner from which extends a perpendicular cut line portion 574. Perpendicular cut line portion 574 terminates at a 90 degree corner from which extends a cut line portion 576 and includes a very slight concave cut line portion 578. Cut line portion 576 extends to a perpendicular cut line portion 580, which terminates in a 90 degree corner, from which extends a cut line portion 582. Cut line portion 582 terminates in a 90 degree corner, from which extends a cut line portion 584. A cut line portion 586 extends to the right of cut line portion 584 and includes a very slight concave portion 588.

Cut line portion 586 extends to a partially curved, partially stepped cut out portion 596, which corresponds in shape to partially curved, partially stepped cut out portion 556 and includes a cut line portion 598. A cut line portion 600 extends from partially curved, partially stepped cut out portion 596 to a generally L-shaped perpendicular cut line portion 602. A cut line portion 604 extends from cut line portion 602 to a partially curved, cut out portion 606 and includes a very slight concave cut line portion 608, an inclined cut line portion 610 and a short cut line portion 612 which connects the inclined cut line portion 610 and partially curved cut out portion 606. A notch cut line 614 extends to the right of partially curved cut out portion 606 to a termination point 616.

It is seen in FIG. 31B that the outer dimensions of top and side portion 504 and bottom portion 506 are defined by outline cut lines 130 (FIG. 2) including the following outline cut line portions which will be described in a generally counterclockwise order beginning from termination point 534:

A cut line portion 640 extends to a concave corner portion 642 and thence to a slightly convex cut line portion 644 and a cut line portion 646. An inclined cut line portion 648 extends to a cut line portion 650, which extends to a cut line portion 652. An additional cut line portion 654 defines together with cut line portion 652 part of a convex cut line portion 656 located therebetween. A cut line portion 658 extends from cut line portion 654 to an inclined cut line portion 660, which extends to a cut line portion 662. A slightly convex cut line portion 664 extends to concave corner cut line portion 666. A cut line portion 668 extends from concave corner cut line portion 666 to an inclined cut line portion 670. Inclined cut line portion 670 extends to a cut line portion 672, which extends to a cut line portion 674. An additional cut line portion 676 defines together with cut line portion 674 part of a convex cut line portion 678 located therebetween.

A cut line portion 680 extends to the left of cut line portion 676 to an inclined cut line portion 682. Cut line portion 682 extends to a convex cut line portion 684 and thence to an inclined cut line portion 686. Inclined cut line portion 686 extends to a slightly rounded 90 degree corner convex cut line portion 688, terminating at a termination point 690.

A cut line portion 692 extends to the left from termination point 690 to a first convex cut line portion 694. A cut line portion 696 extends from first convex cut line portion 694 to a second convex cut line portion 698. A cut line portion 700 extends around a 90 degree corner to a third convex cut line portion 702. A cut line portion 704 extends from third convex cut line portion 702 to a fourth convex cut line portion 706. A cut line portion 708 extends around a 90 degree corner to a fifth convex cut line portion 710. A cut line portion 712 extends from fifth convex cut line portion 710 to a sixth convex cut line portion 714. A cut line portion 716 extends from sixth convex cut line portion 714 to a termination point 718. A slightly rounded 90 degree corner convex cut line portion 720 is defined between termination point 718 and termination point 616.

Returning to FIG. 31A, it is seen that internal structural portion 502 is also defined by a plurality of internal cut lines 132 (FIG. 3). A pair of generally parallel internal cut lines 750 and 752 are joined at one end thereof by a generally perpendicular internal cut line 754 and intermediately therealong by a generally perpendicular internal cut line 756. It is appreciated that internal cut lines 754 & 756 and part of internal cut lines 750 and 752 define a cut out 758.

A slot 760 is defined alongside of internal cut line 750. An additional slot 762 is defined below cut out 758. It is noted that a corresponding slot 764 is formed in fifth interior intermediate surface 378. A further slot 766 is defined alongside of internal cut line 752. Three additional slots, designated by reference numerals 768, 770 and 772 are defined to correspond to slot 766.

First and second generally mesa shaped slots 774 and 776 are also provided. First and second flap defining cuts 778 and 780, having respective convex flap portion defining parts 782 and 784 are also provided. A plurality of sewing apertures, all designated by reference numeral 790, are formed in internal structural portion 502.

Returning to FIG. 31B, it is seen that top and side portion 504 and bottom portion 506 are also defined by a plurality of internal cut lines 132 (FIG. 3). A set of four mutually intersecting and partially overlapping generally partially trapezoidal cuts 792, 794, 796 and 798 define two mutually facing and perpendicularly arranged sets of mutually facing flaps, designated by reference numerals 800, 802, 804 and 806. Flaps 800 and 802 are formed with convex cuts respectively designated by reference numerals 808 and 810 to form respective tabs 811 and 809. It is a particular feature of the present invention that generally trapezoidal flaps 800 and 802 are generally longer than generally trapezoidal flaps 804 and 806. This feature contributes significantly to the rigidity of the resulting structure.

First and second cut out flap defining cuts 812 and 814 are also formed in top and side portion 504. First and second partially curved cut outs 816 and 818 are defined by respective internal cut lines 820 and 822 in bottom portion 506. A plurality of sewing apertures, all designated by reference numeral 824, are formed in top and side portion 504 and bottom portion 506. Additionally six flap receiving cuts 830, 832, 834, 836, 838 and 840 are formed in top and side portion 504.

Returning to FIG. 31A, it is seen that internal structural portion 502 is also defined by a plurality of incised lines 136 (FIG. 3) which, as noted above, are formed in an exterior surface of the second stage head phylactery workpiece 125, normally corresponding to the exterior-facing surface of the animal skin from which the parchment was made. As mentioned above, the incised lines 136 are shown throughout as dotted lines and are partially cut into the second stage head phylactery workpiece 125 from the exterior and typically extend through about two thirds of the thickness of the second stage head phylactery workpiece 125. The incised lines are designed for interior folds and are only foldable as interior folds. After folding, the incised lines 136 are shown as solid lines.

A plurality of mutually parallel incised lines, designated by reference numerals 900, 902, 904, 906, 908, 910, 912, 914, 916, 918, 920, 922, 924, 926, 928 are provided and a plurality of mutually parallel incised lines, which extend generally perpendicularly to incised lines 900-928 are provided and are designated by reference numerals 940, 942, 944, 946, 948, 950, 952, 954, 956, 958, 960 & 962.

Returning to FIG. 31B, it is seen that top and side portion 504 and bottom portion 506 are also defined by a plurality of incised lines 136 (FIG. 3). A plurality of mutually parallel incised lines, designated by reference numerals 970, 972, 974, 976, 978, 980, 982, 984, 986, 988, 990, 992, 994, 996, 998 and 1000 provided and a plurality of mutually parallel incised lines, which extend generally perpendicularly to incised lines 970-1002 are provided and are designated by reference numerals 1010, 1012, 1014, 1016, 1018, 1020, 1022, 1024, 1026, 1028, 1030, 1032, 1034, 1036, 1038, 1040, 1042, 1044, 1046 & 1048.

It is noted with reference to FIG. 3 that, inter alia, in accordance with the specifications established in Jewish law, a Hebrew letter (not illustrated) is embossed in the first and eighth interior panel surfaces 300 and 376 of the second stage head phylactery workpiece 125 such that the convex surface of the embossing is exterior to subassembly 501 when suitably folded and assembled.

Reference is now made to FIG. 32, which illustrates folding four generally trapezoidal flaps 800, 802, 804 and 806 about respective interior fold lines 1028 & 1030, 1024 & 1026, 986 and 984 to lie at approximately 90 degrees with respect to a plane of top and side portion 504 and to define an aperture 1100 bordered by folded flaps 800, 802, 804 and 806.

Figure 33:
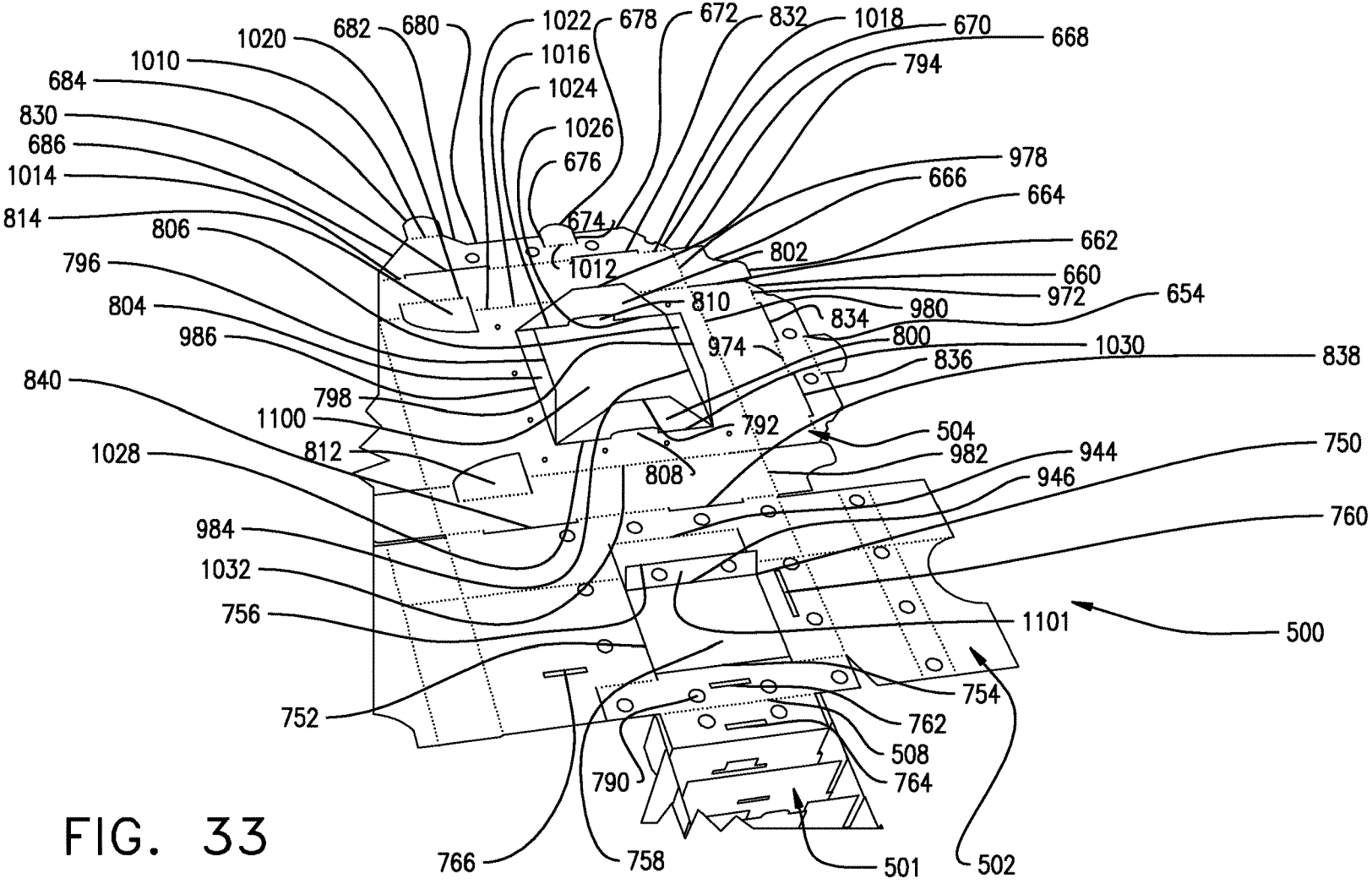
FIG. 33 is a simplified illustration of the folding of an additional flap portion in the partially assembled head phylactery subpattern.

Reference is now made to FIG. 33, which illustrates folding of a flap portion 1101 about an interior fold line 946 to lie at approximately 90 degrees with respect to a plane of top and side portion 504.

Figure 34:
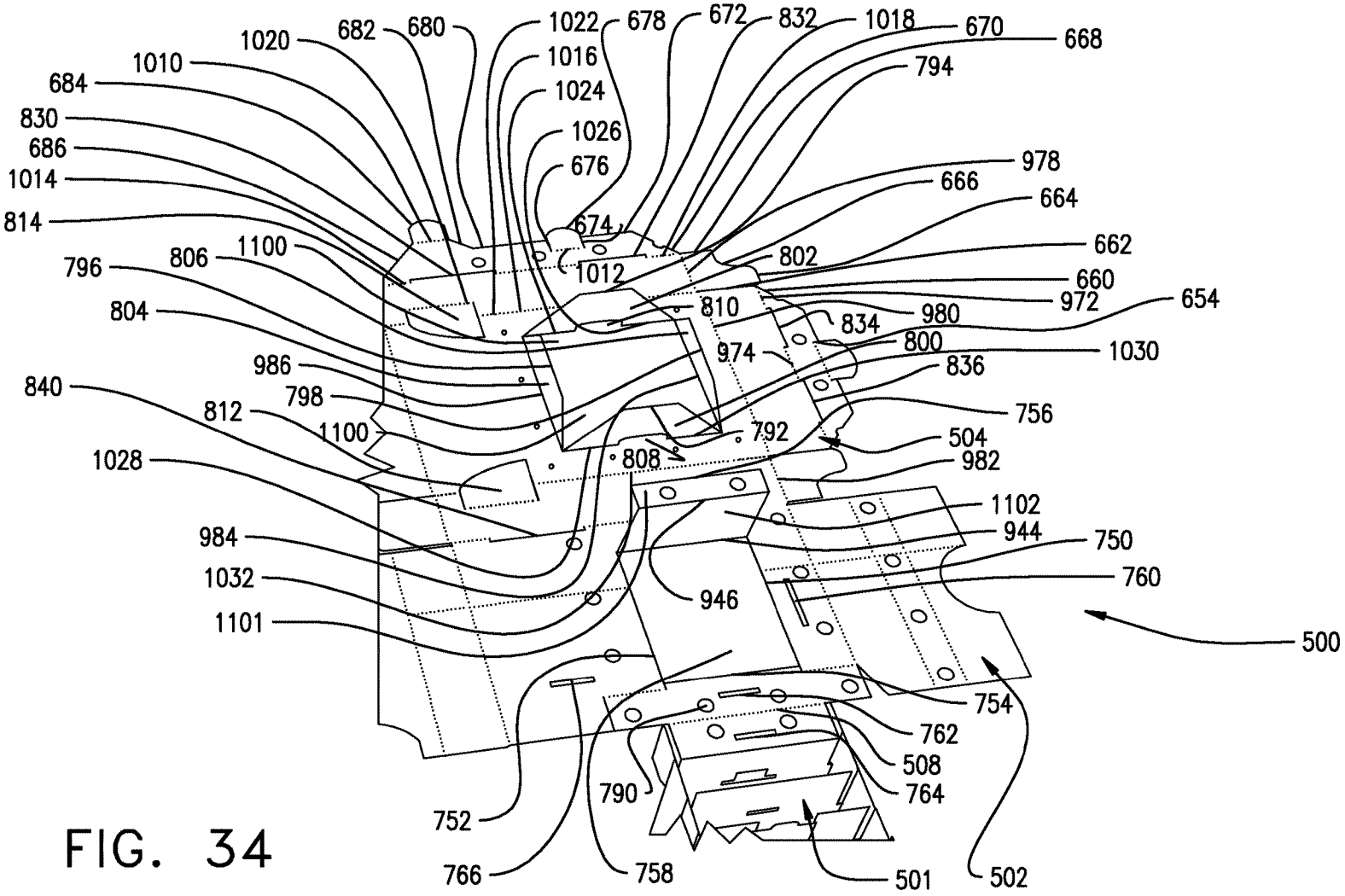
FIG. 34 is a simplified illustration of the folding of a further flap portion in the partially assembled head phylactery subpattern.

Reference is now made to FIG. 34, which illustrates folding of an intermediate flap portion 1102, to which is attached flap 1101, about internal fold line 944, such that intermediate flap portion 1102 lies at approximately 90 degrees with respect to a plane of internal structural portion 502 and flap 1101, which lies generally perpendicular to intermediate flap portion 1102, is generally parallel to plane of internal structural portion 502.

Figure 35:
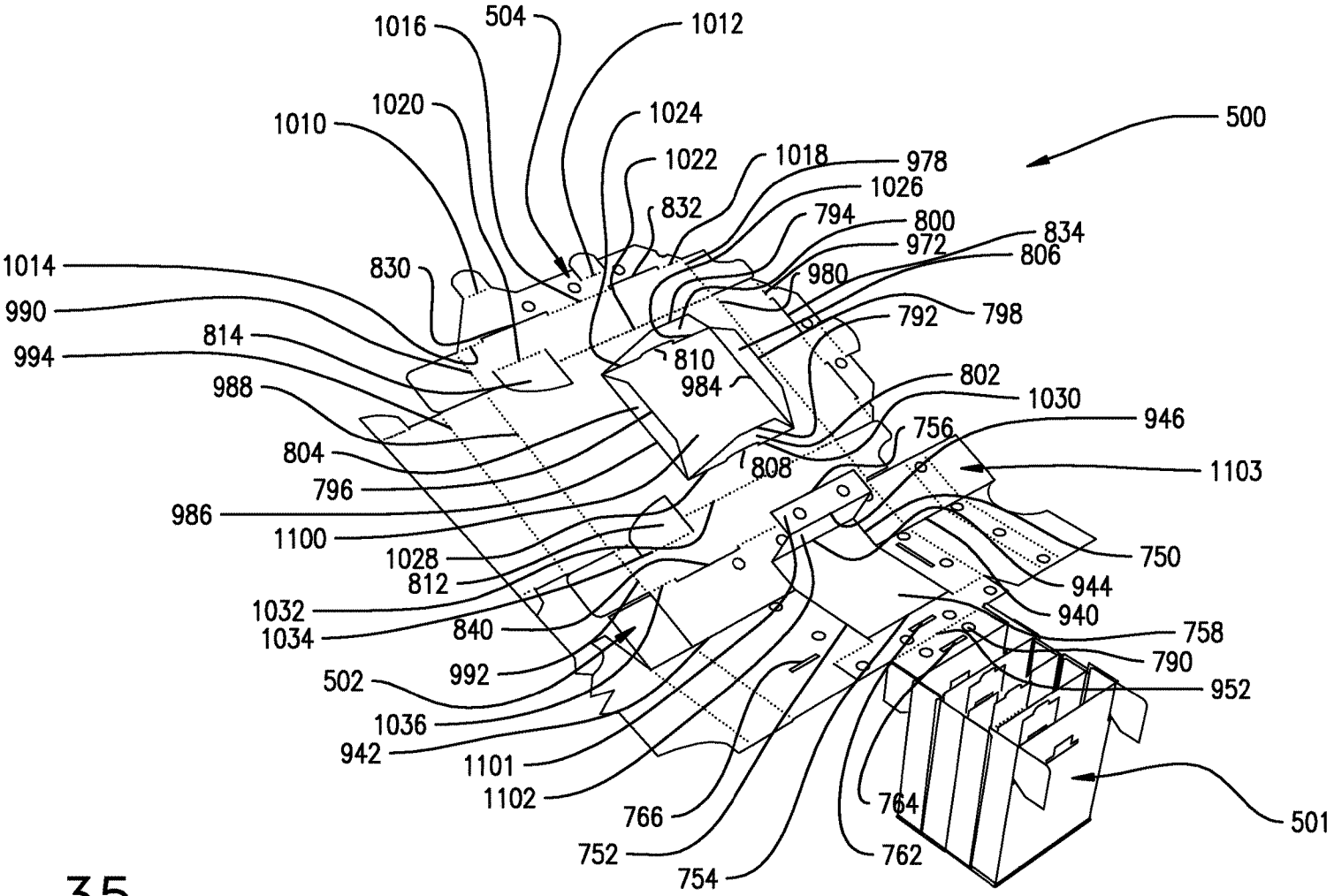
FIG. 35 is a simplified illustration of the temporary folding of a top and side portion and a part of an internal structural portion relative to the plane of the remainder of internal structural portion about an internal fold line.

Reference is now made to FIG. 35, which illustrates temporary folding of top and side portion 504 and a part 1103 of internal structural portion 502 about internal fold lines 940 and 942 to lie generally at about 30 degrees relative to the plane of the remainder of internal structural portion 502.

Figure 36:
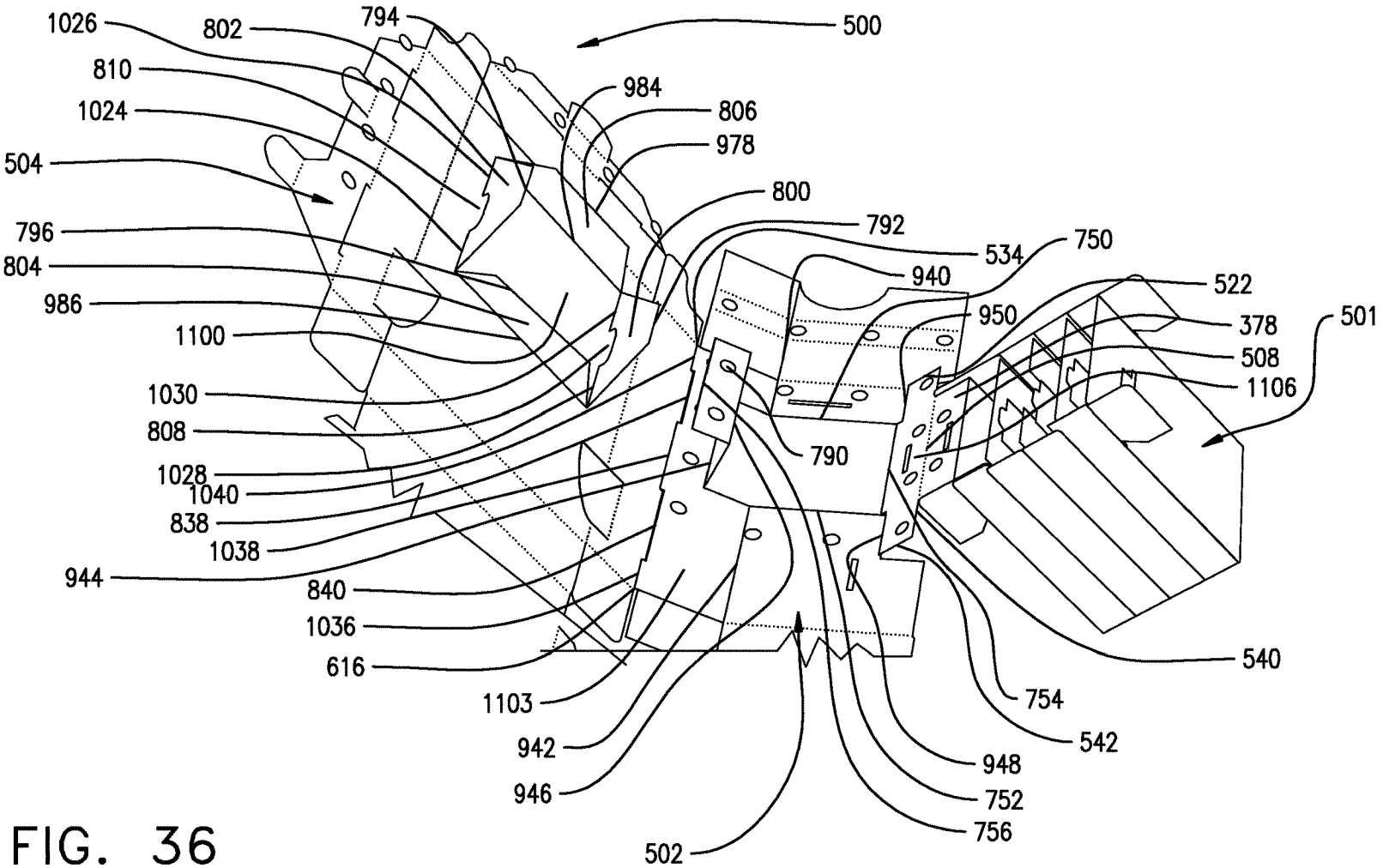
FIG. 36 is a simplified illustration of the temporary partial folding of top and side portion about mutually coaxial internal fold lines and also shows a temporary folding of an internal structural portion about internal fold lines to lie generally at an angle relative to the plane of a connecting flap which is joined to a fifth interior intermediate surface.

Reference is now made to FIG. 36, which illustrates partial folding of top and side portion 504 about mutually coaxial internal fold lines 1036, 1038 and 1040 to lie generally at about 30 degrees relative to the plane of part 1103 of internal structural portion 502. FIG. 36 also shows a temporary folding of internal structural portion 502 about internal fold lines 948 and 950 to lie generally at about 30 degrees relative to the plane of an intermediate connecting surface portion 1106, which is joined to fifth interior intermediate surface 378 via an internal fold line 508.

Figure 37:
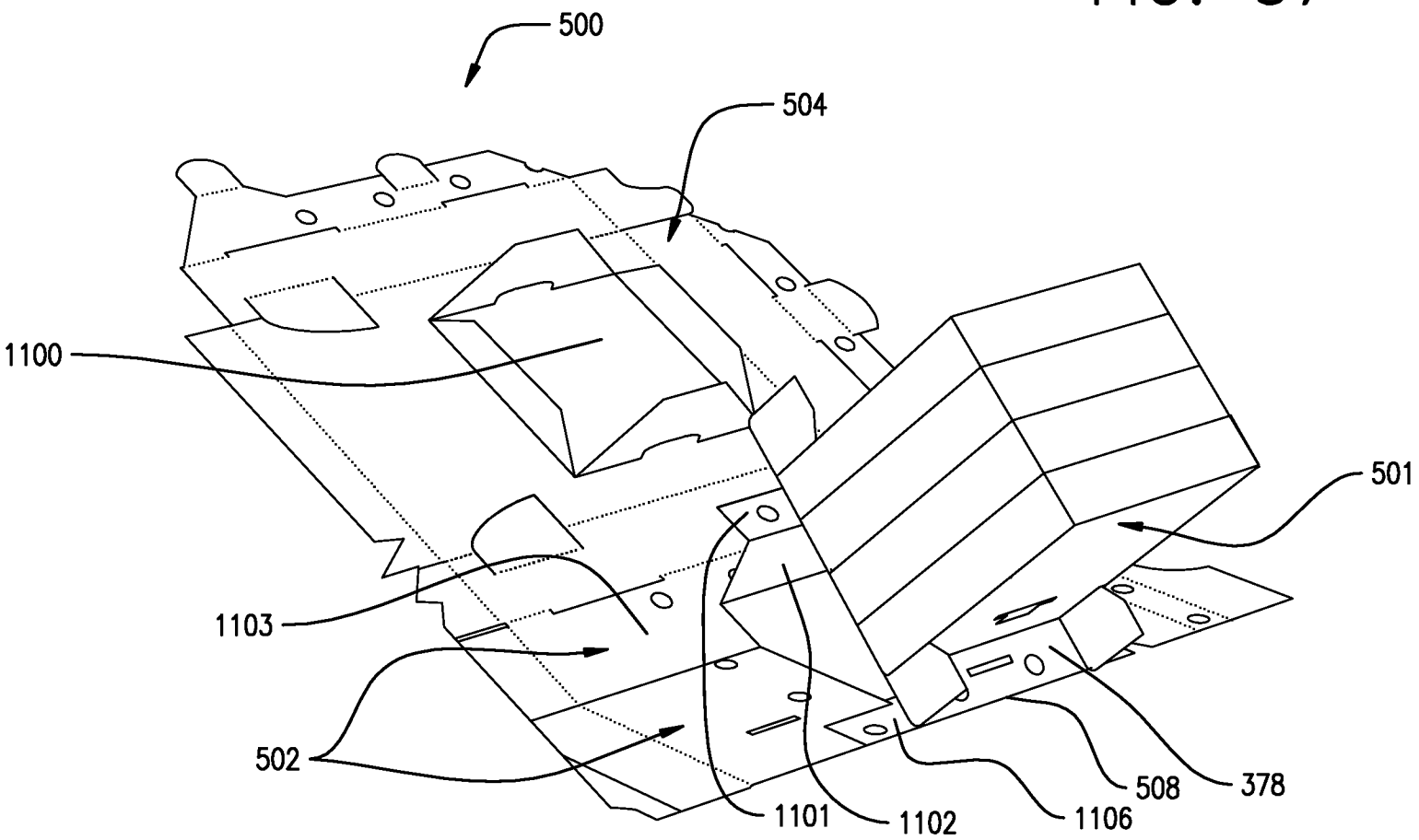
FIG. 37 is a simplified illustration of a partial folding of a subassembly about an internal fold line relative to an internal structural portion.

Reference is now made to FIG. 37, which illustrates partial folding of subassembly 501 about internal fold line 508 to lie generally at about 120 degrees relative to the plane of internal structural portion 502.

Figure 38:
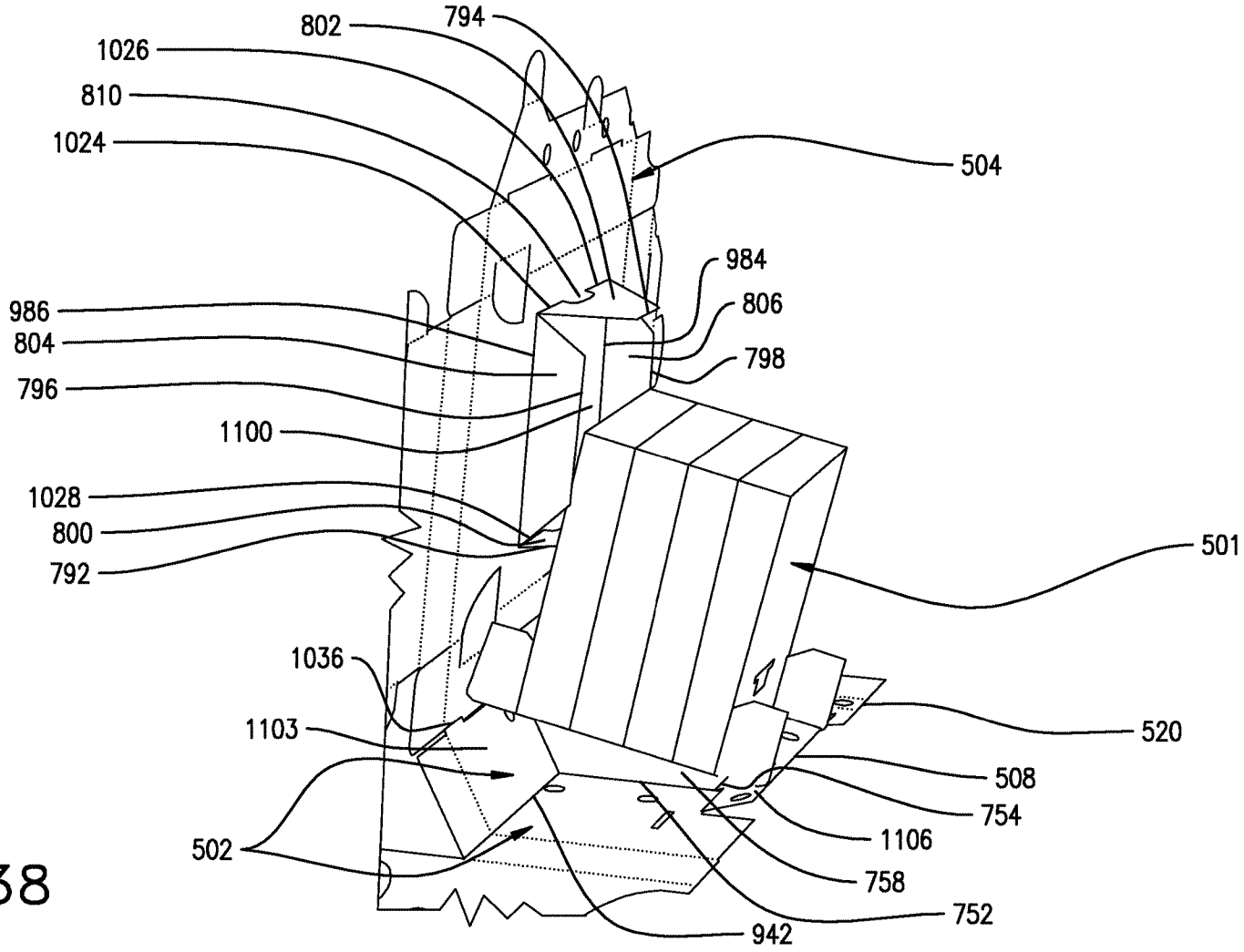
FIG. 38 is a simplified illustration of a further partial folding of a subassembly about an internal fold line so that some of the subassembly lies between upstanding generally trapezoidal flaps in the partially assembled head phylactery subpattern.

Reference is now made to FIG. 38, which illustrates further folding of subassembly 501 about internal fold line 508 to lie generally at about 160 degrees relative to the plane of internal structural portion 502. It is seen that some of subassembly 501 lies between upstanding flaps 804 and 806. It is also noted that the temporary fold about mutually coaxial internal fold lines 940 & 942 is further folded. It is a particular feature of an embodiment of the present invention that intermediate flap portion 1102 and flap 1101 are mutually positioned between widened end portions 322 of respective side flaps 224 and 226 extending from subassembly 501.

Figure 39:
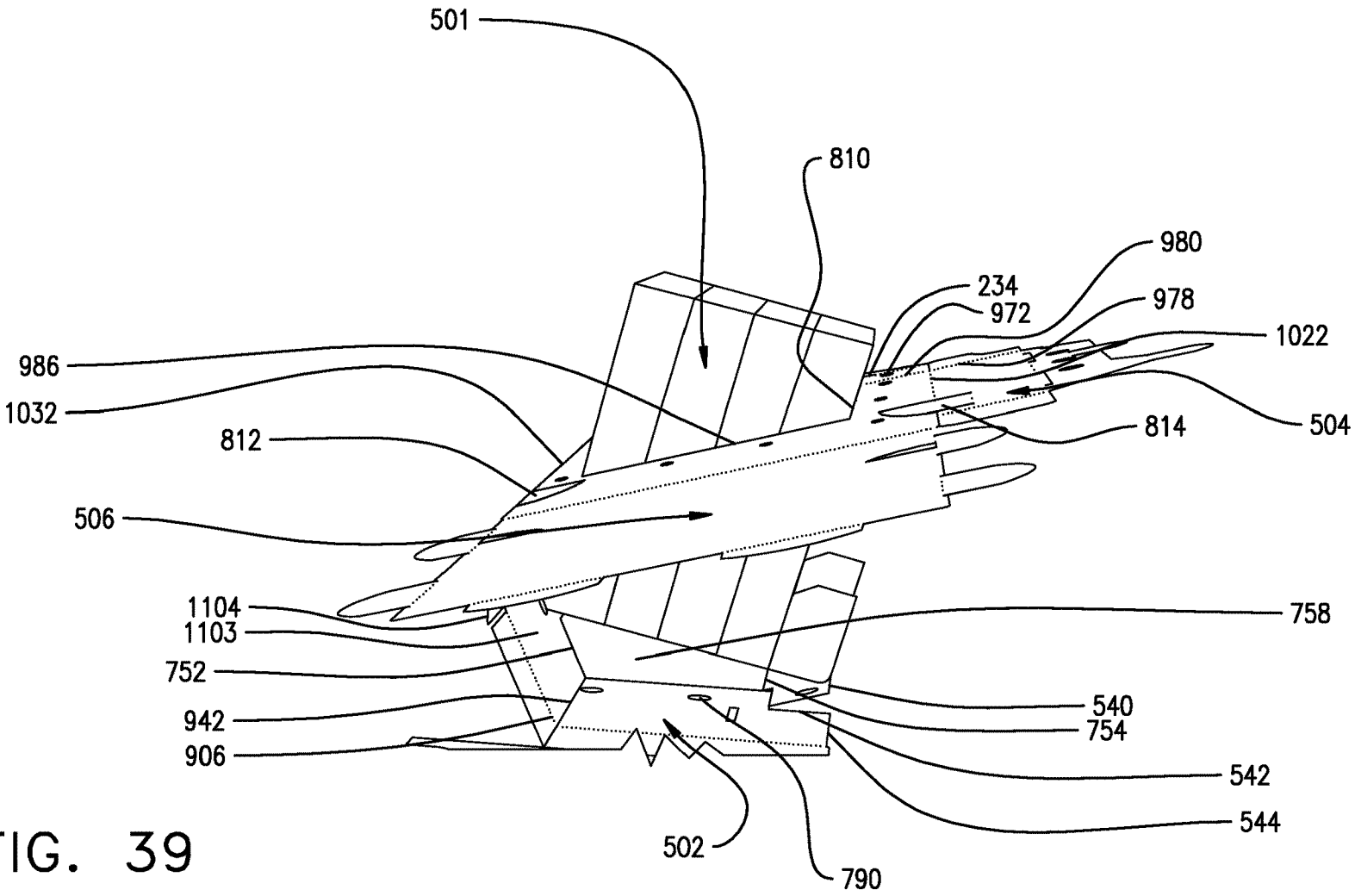
FIG. 39 is a simplified illustration of a further partial folding of a top and side portion about mutually coaxial internal fold lines relative to an internal structural portion.

Reference is now made to FIG. 39, which illustrates further folding of top and side portion 504 about mutually coaxial internal fold lines 1036, 1038 and 1040 to lie generally at about 75 degrees relative to the plane of part 1103 of internal structural portion 502. It is seen that subassembly 501 partially extends through aperture 1100 defined by folding of flaps 800, 802, 804 & 806 and bordered thereby. It is noted that generally trapezoidal flaps 800 and 802 are generally longer than generally trapezoidal flaps 804 and 806.

Figure 40:
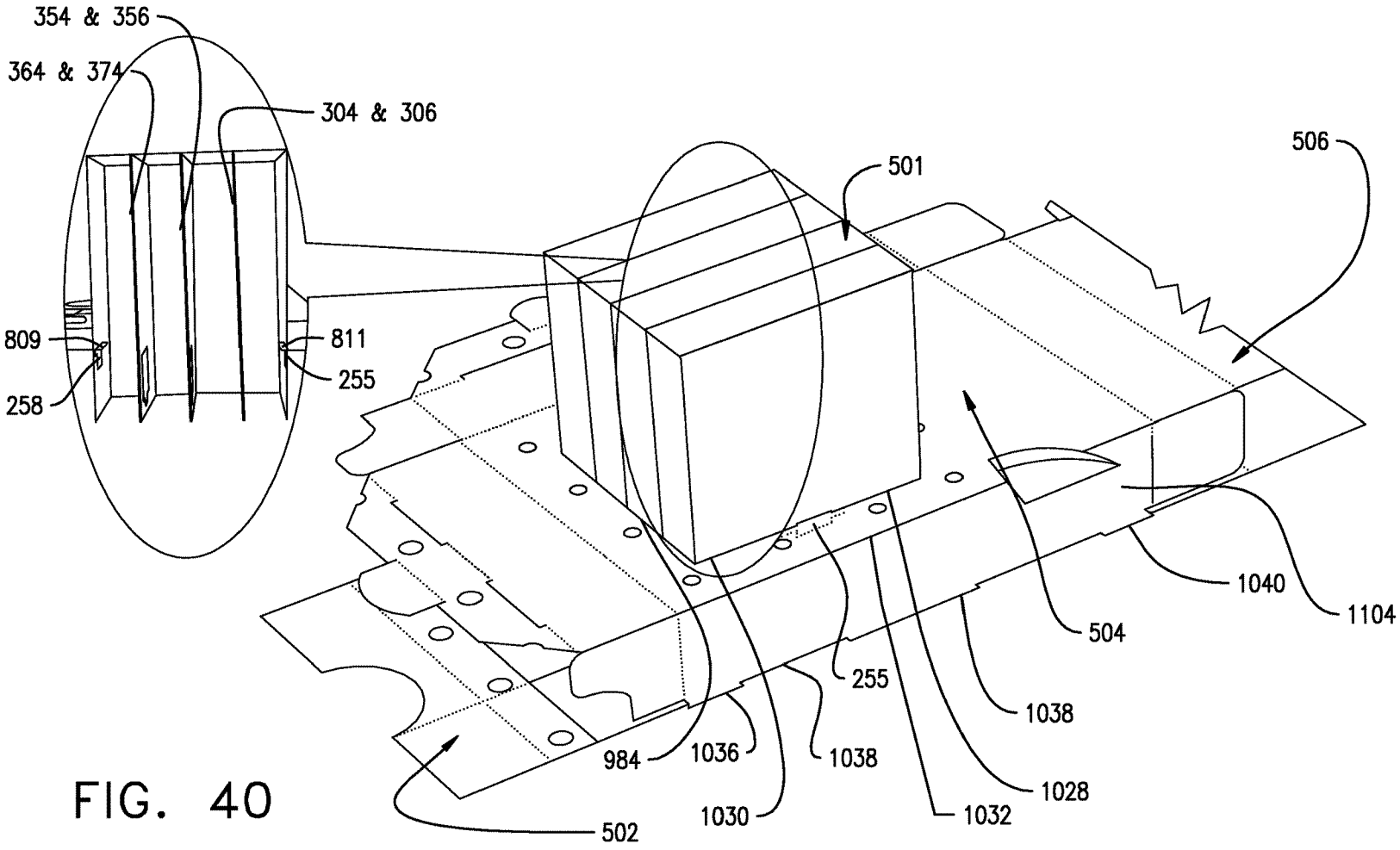
FIG. 40 is a simplified illustration of a complete folding of a top and side portion about an internal fold line.

Reference is now made to FIG. 40, which illustrates complete folding of top and side portion 504 about internal fold line 1032 to lie generally at about 90 degrees relative to the plane of part 1104 of internal structural portion 502. It is seen that subassembly 501 fully extends through aperture 1100, defined by folding of flaps 800, 802, 804 & 806 and bordered thereby.

It is a particular feature of an embodiment of the present invention that a dimension of generally trapezoidal flaps 800 and 802 and intermediate flap portion 1102 is generally the same as the interior dimension of the space between the top portion of top and side portion 504 and the bottom portions of internal structural portion 502, when they are fully folded as shown in FIG. 74. It is a further particular feature of an embodiment of the present invention that tabs 809 and 811, defined by convex cuts respectively designated by reference numerals 810 & 808 engage respective mesa shaped slots 258 & 255. It is an additional particular feature of an embodiment of the present invention that when tabs 808 &

810 respectively engage mesa shaped slots 255 & 258, the dimension between the respective planes of the top portion of top and side portion 504 and the bottom portion of internal structural portion 502 when fully folded is defined and maintained as shown in FIG. 74.

Figure 41:
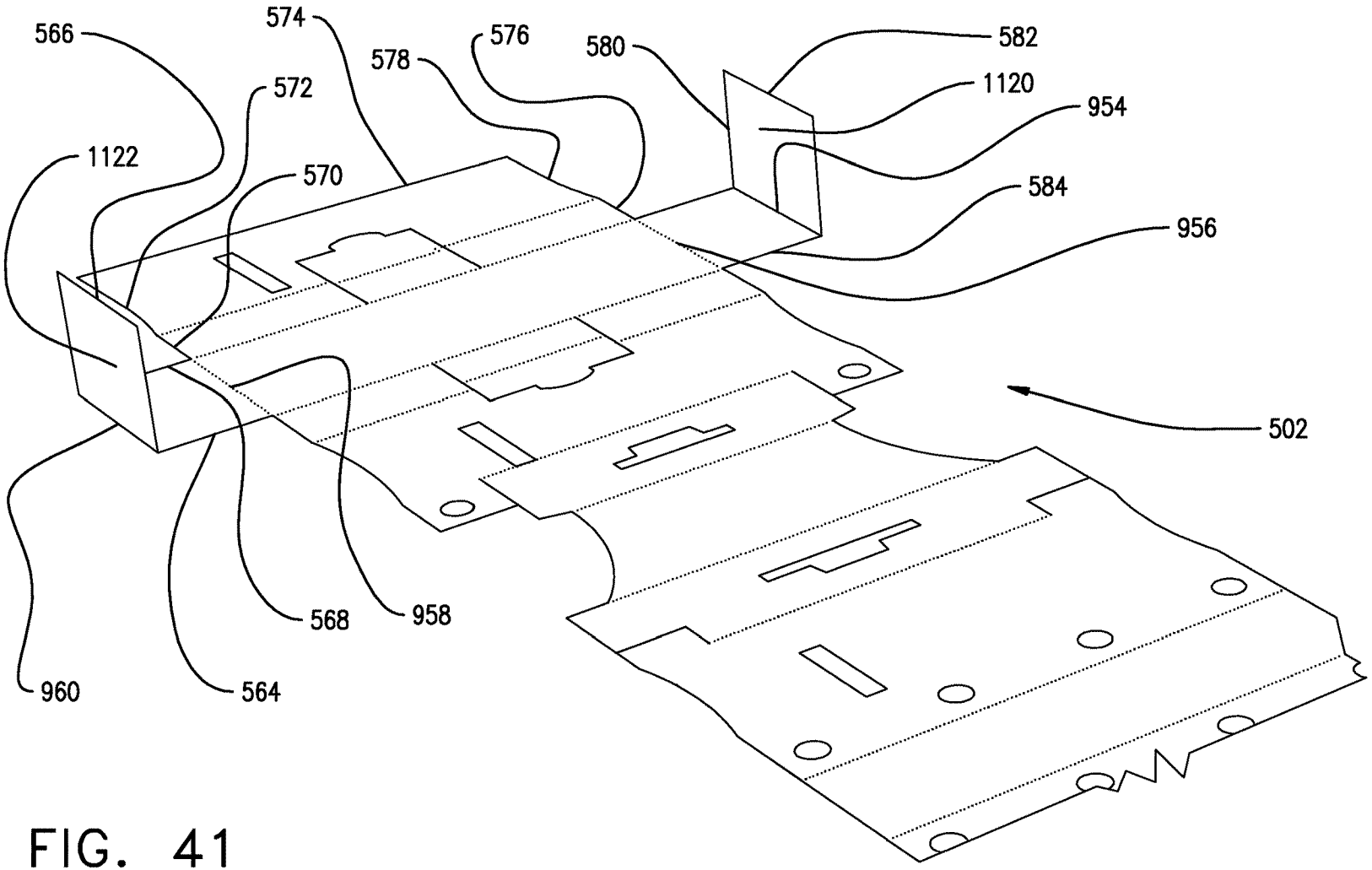
FIG. 41 is a simplified illustration of a partial folding of flap portions of an internal structural portion about respective internal fold lines.

Reference is now made to FIG. 41, which illustrates partial folding of flap portions 1120 and 1122 of internal structural portion 502 about respective internal fold lines 954 and 960 to lie generally at about 90 degrees relative to the plane of internal structural portion 502.

Figure 42:
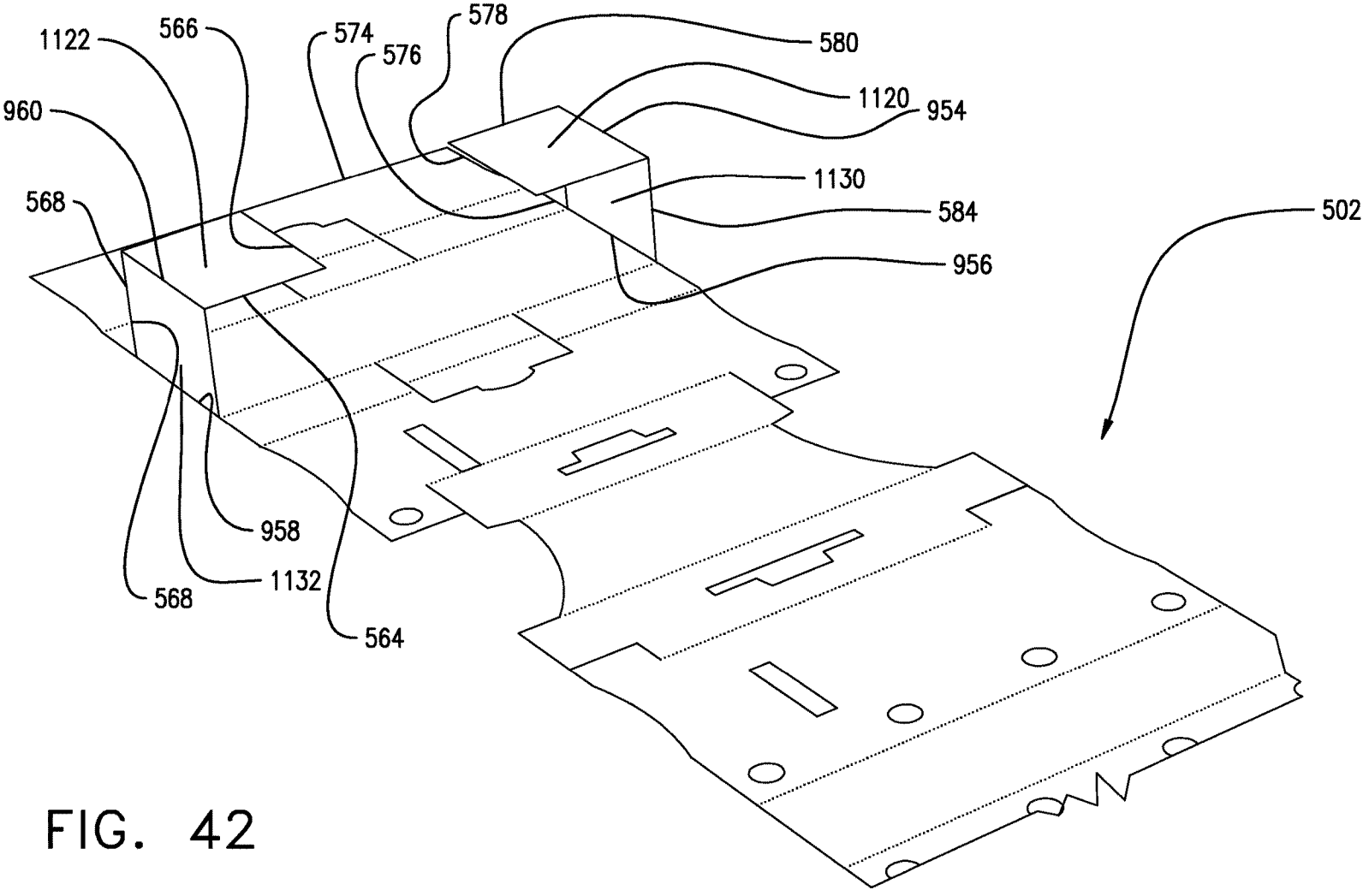
FIG. 42 is a simplified illustration of a partial folding of additional flap portions of an internal structural portion about additional respective internal fold lines.

Reference is now made to FIG. 42, which illustrates partial folding of flap portions 1130 and 1132 to which are attached respective flap portions 1120 and 1122, about respective internal fold lines 956 and 958, such that flaps 1130 and 1132 lie at approximately 75 degrees with respect to the plane of internal structural portion 502 and flaps 1120 and 1122.

Figure 43:
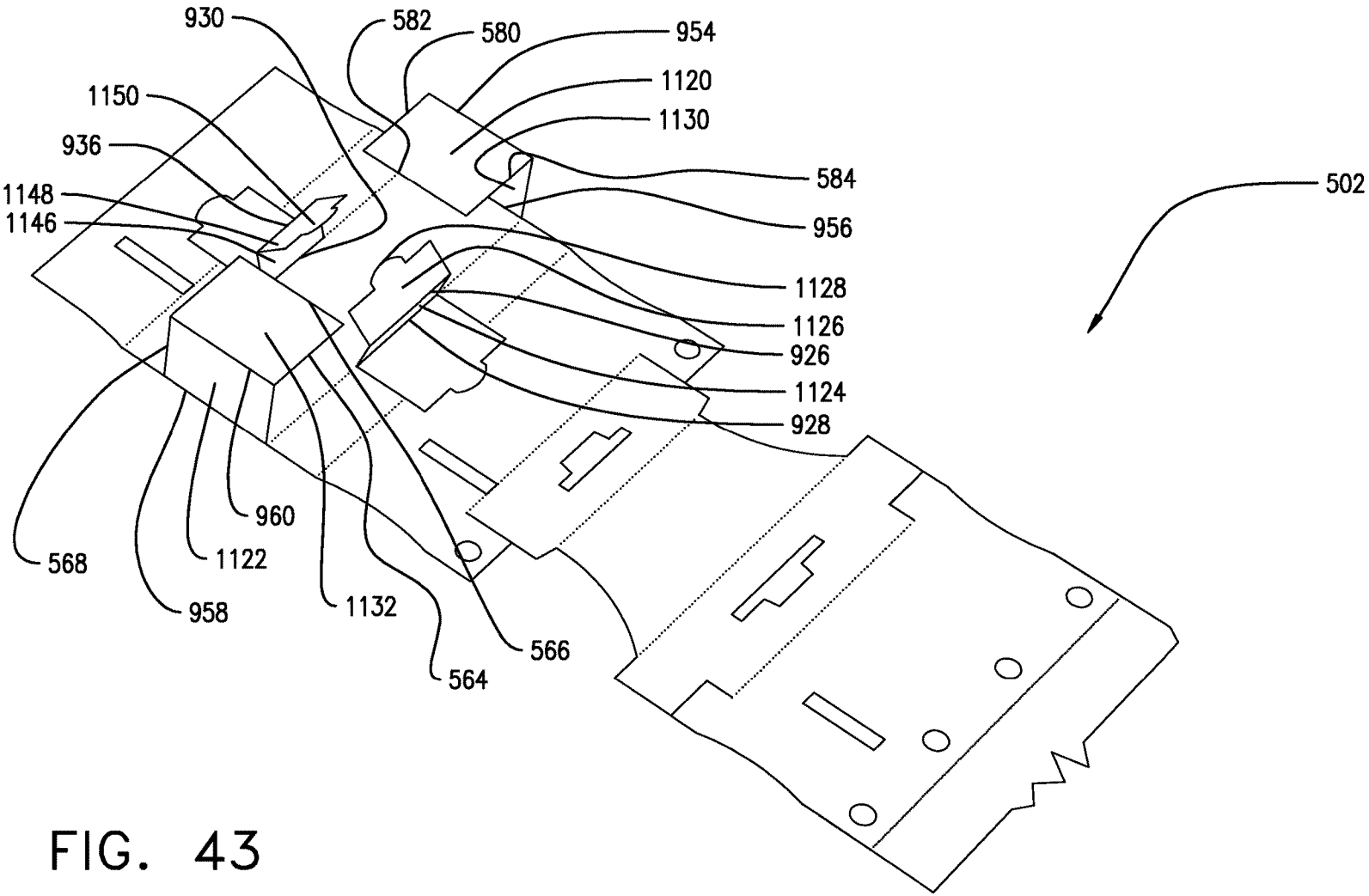
FIG. 43 is a simplified illustration of a partial folding of additional flap portions of an internal structural portion about further respective internal fold lines.

Reference is now made to FIG. 43, which illustrates partial folding of flap portions 778 and 780 about respective internal fold lines 928 and 930 as well as partial internal folding of each of flap portions 1124, 1126, 1148 & 1150 defined by flap defining cuts 778, 780, 782 and 784 about respective internal fold lines 926 and 936.

Figure 44:
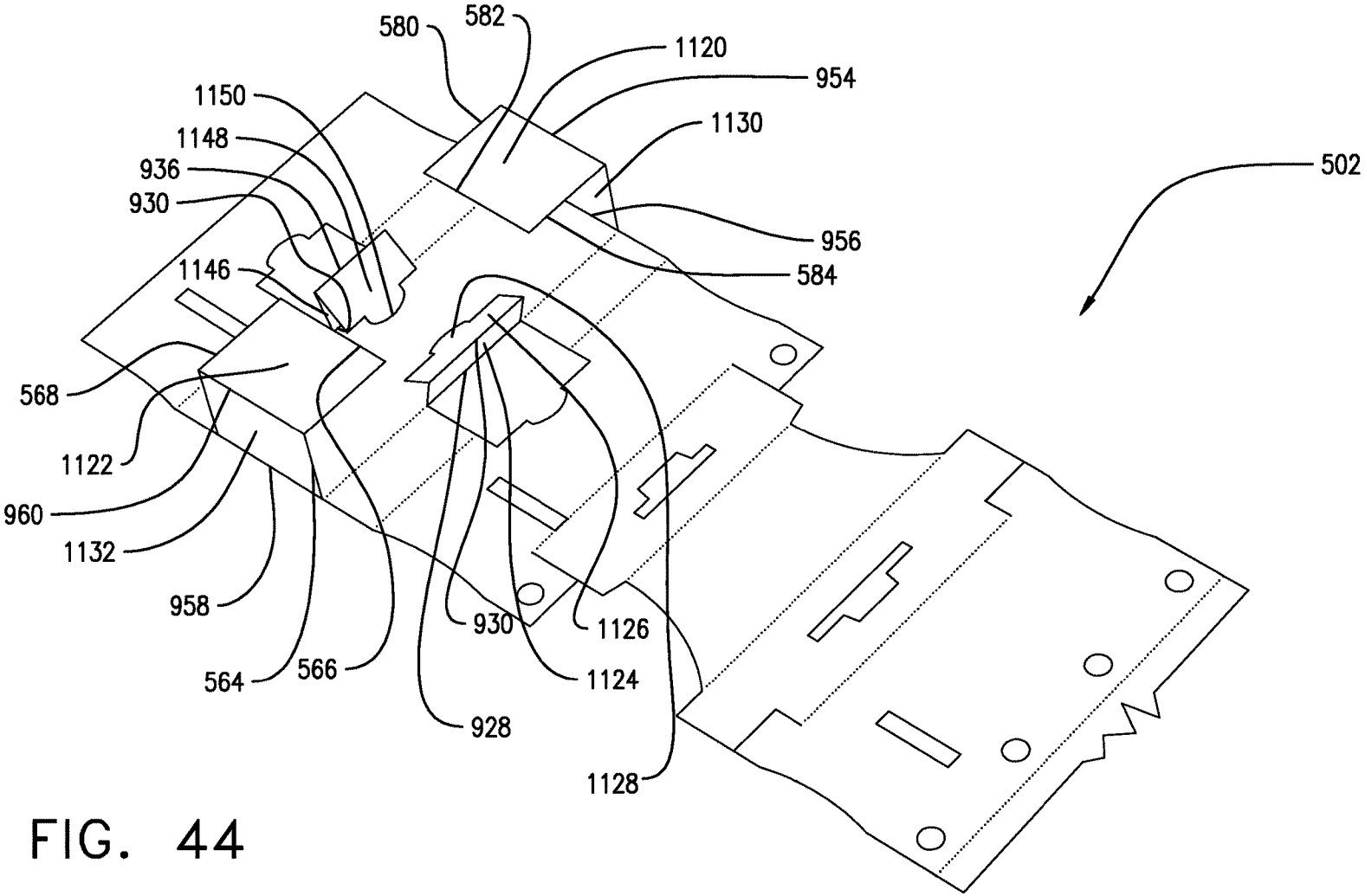
FIG. 44 is a simplified illustration of a partial folding of additional flap portions of an internal structural portion about yet further respective internal fold lines.

Reference is now made to FIG. 44, which illustrates nearly complete internal folding of each of flaps 1124 & 1126 and 1146 & 1148 about respective internal fold lines 926 & 928 and 930 & 936. FIG. 44 shows that flap portions 1124 and 126 defined by flap defining cuts 778 is folded on itself through approximately 135 degrees about internal fold line 926. It is noted that flap portion 1126 includes an end tab portion 1128. It is also noted that flap portion 1148 includes an end tab portion 1150.

Figure 45:
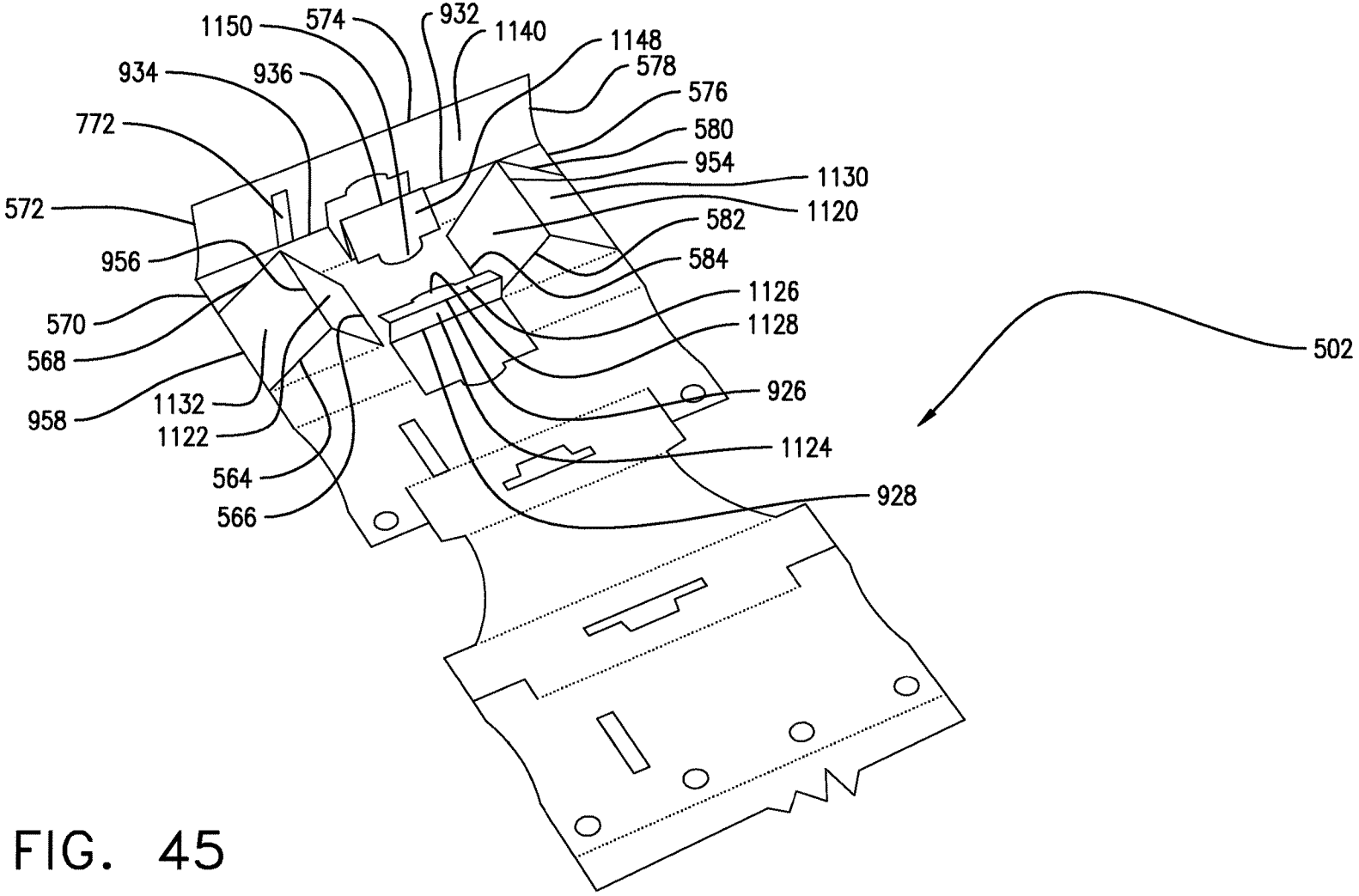
FIG. 45 is a simplified illustration of a partial folding of additional flap portions of an internal structural portion about still further respective internal fold lines.

Reference is now made to FIG. 45, which illustrate folding of an end flap 1140, defined by line portions 572, 574 and 578, about mutually coaxial internal fold lines 932 and 934 to lie at an angle of approximately 90 degrees with respect to the plane of internal structural portion 502. FIG. 45 also illustrates further folding of flaps 1120 & 1130 and 1122 & 1132 about respective internal fold lines 954 and 956 and partial unfolding of flaps 1130 and 1132 with respect to flaps 1120 and 1120 about respective internal fold lines 958 and 960.

Figure 46:
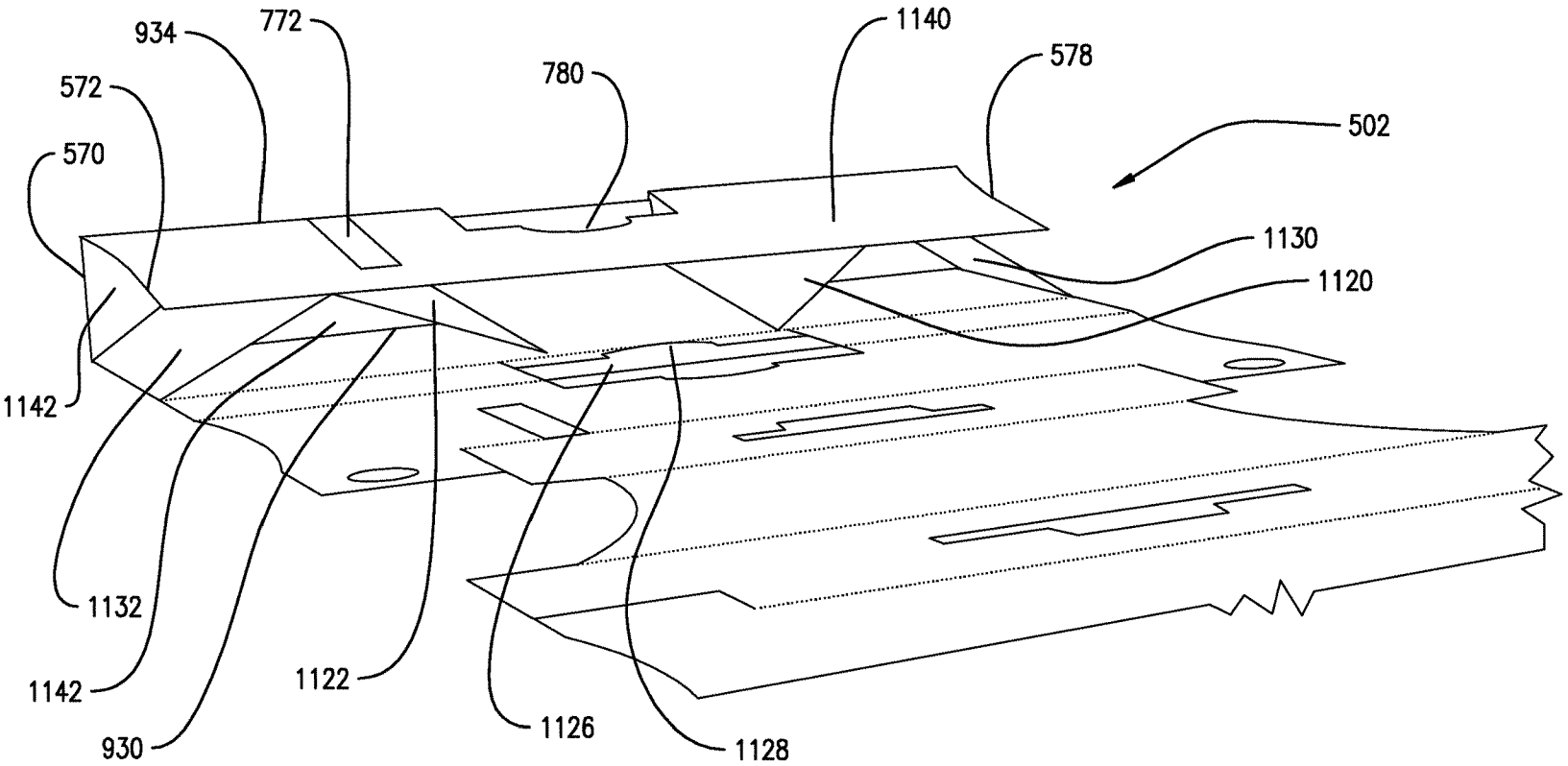
FIG. 46 is a simplified illustration the folding of part of the internal structural portion about an internal fold line such that the portion lies generally perpendicular to the plane of an internal structural portion; further folding of flaps about internal fold lines and partial unfolding of other flap portions about respective internal fold lines.

Reference is now made to FIG. 46, which shows folding of a portion 1142 to which is attached end flap 1140, about an internal fold line 930, such that portion 1142 lies generally perpendicular to end flap 1140 and generally parallel to the plane of internal structural portion 502. FIG. 46 also shows further folding of flaps 1120 & 1130 and 1122 & 1132 about respective internal fold lines 954 and 956 and partial unfolding of flaps 1130 and 1132 with respect to flaps 1120 and 1120 about respective internal fold lines 958 and 960 so that flaps 1120, 1122, 1130 and 1132 each line at about 30 degrees with respect to the plane of internal structural portion 502.

Figure 47:
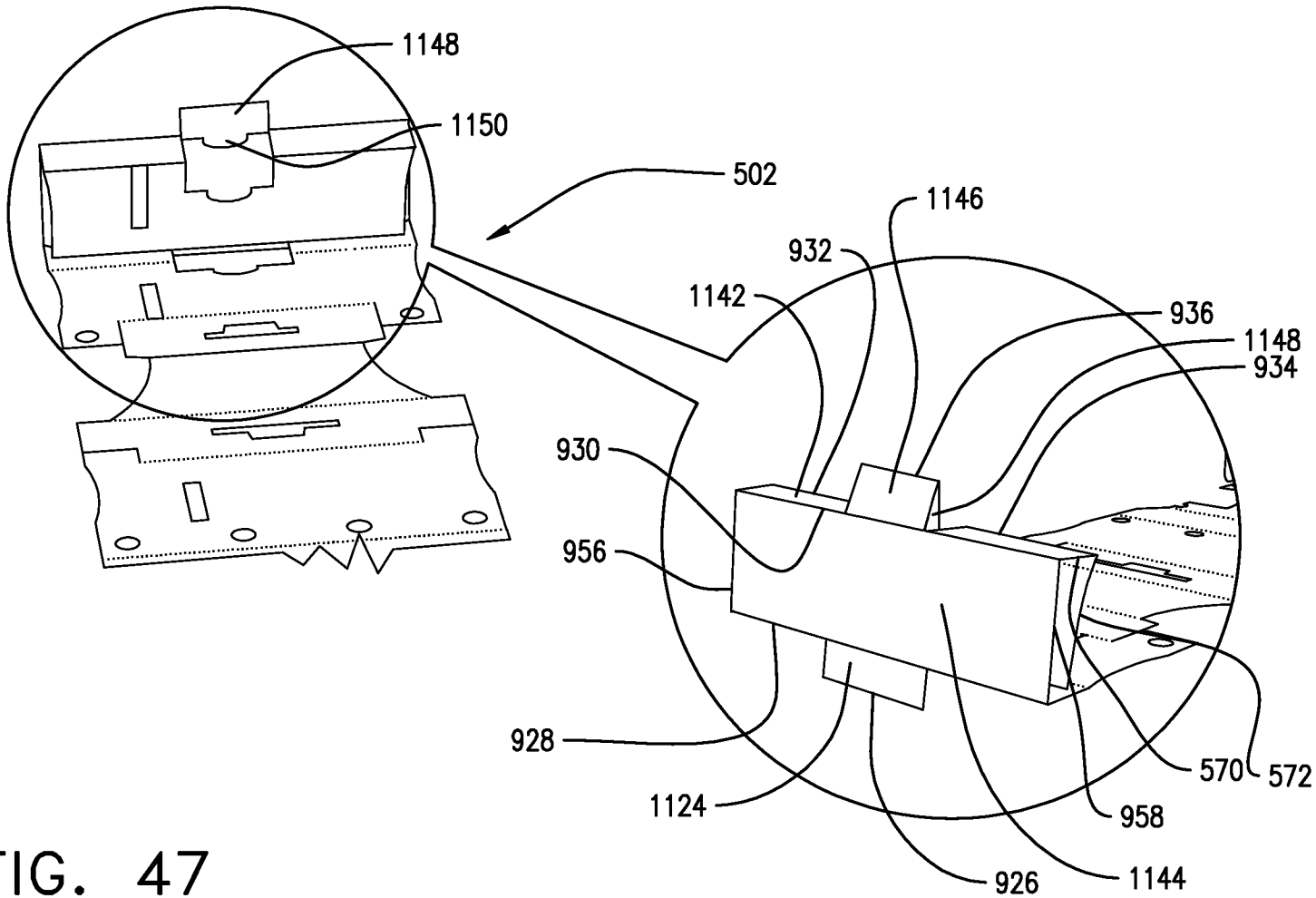
FIG. 47 is a simplified illustration of the folding of an additional part of the internal structural portion about an internal fold line such that the portion lies generally perpendicular to the plane of an internal structural portion.

FIG. 47 illustrates folding of a portion 1144 about internal fold line 928 such that portion 1144 lies generally perpendicular to the plane of internal structural portion 502. FIG. 47 also shows folding of a portion 1146 through 135 degrees about internal fold line 936 relative to a portion 1148. It is noted that portion 1146 includes an end tab portion 1150.

Figure 48:
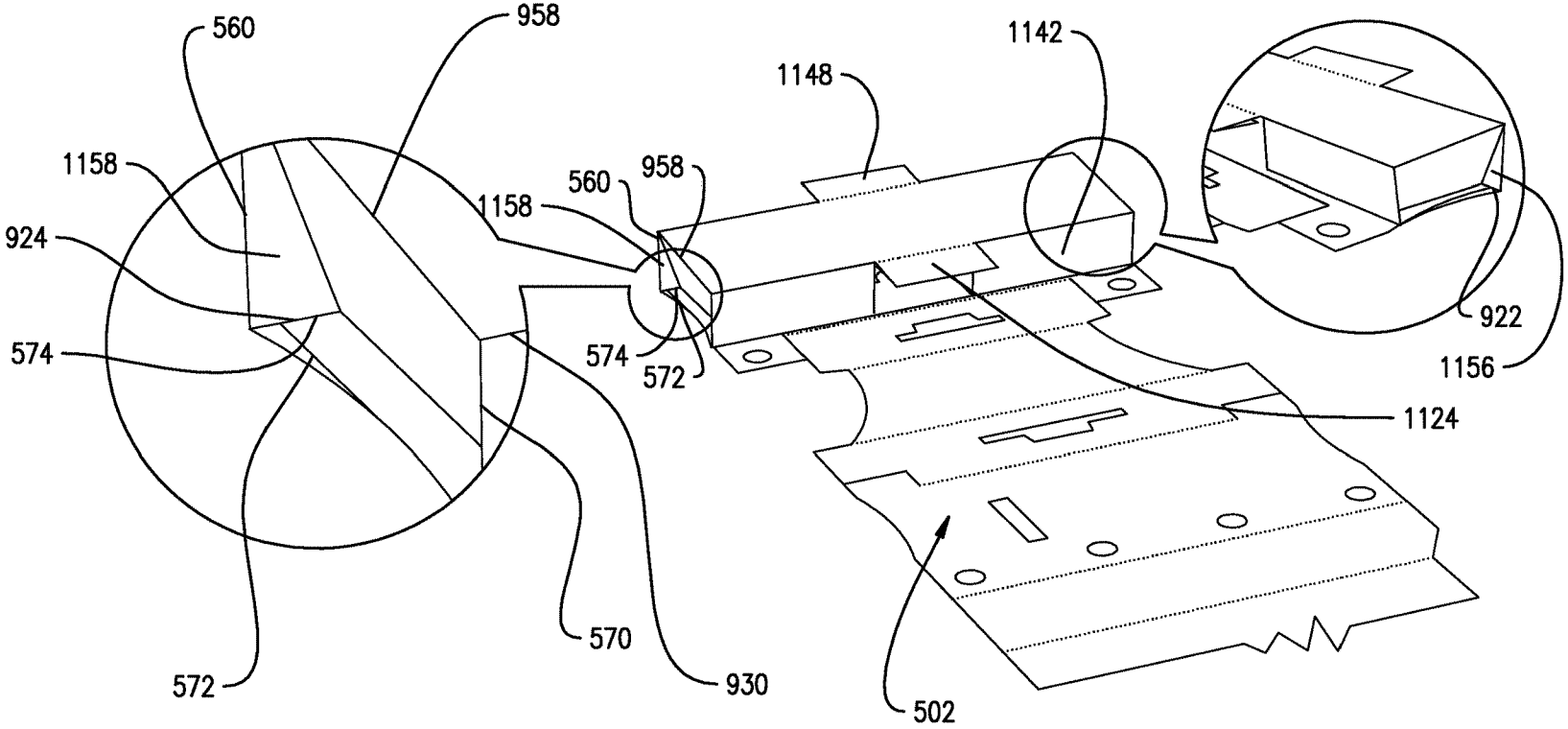
FIG. 48 is a simplified illustration of folding of yet additional parts of the internal structural portion about respective internal fold lines such that the portions lie generally perpendicular to the plane of the internal structural portion.

FIG. 48 illustrates folding of portions 1156 and 1158 about respective internal fold lines 922 and 924 such that portion 1156 and 1158 lie generally perpendicular to the plane of internal structural portion 502.

Figure 49:
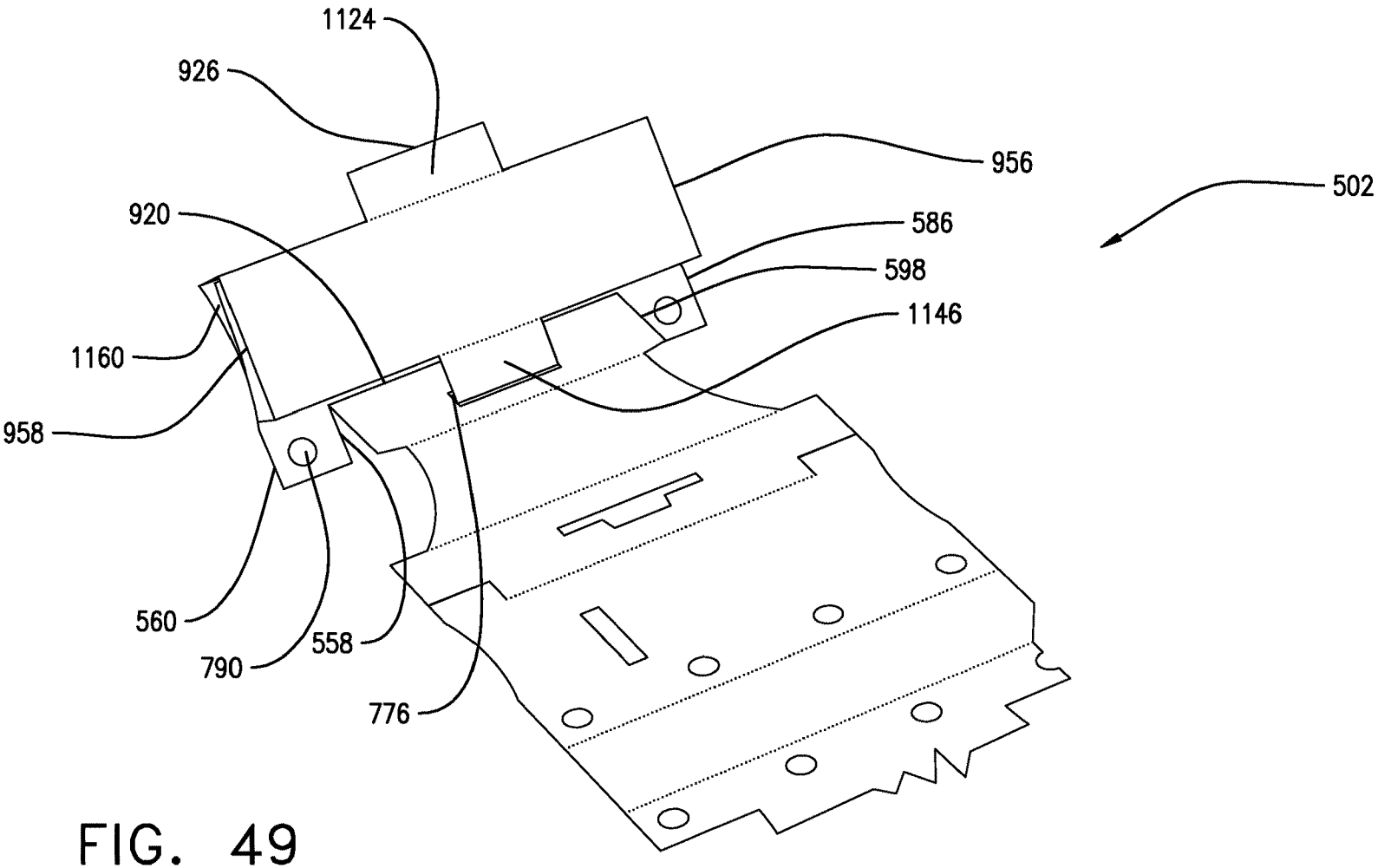
FIG. 49 is a simplified illustration of an initial stage in folding a part of the internal structural portion about an internal fold line.

FIG. 49 illustrates an initial stage in folding a portion 1160 about internal fold line 920. It is seen that flap portions 1146 & 1148 (not seen) are partially inserted into aperture 776.

Figure 50:
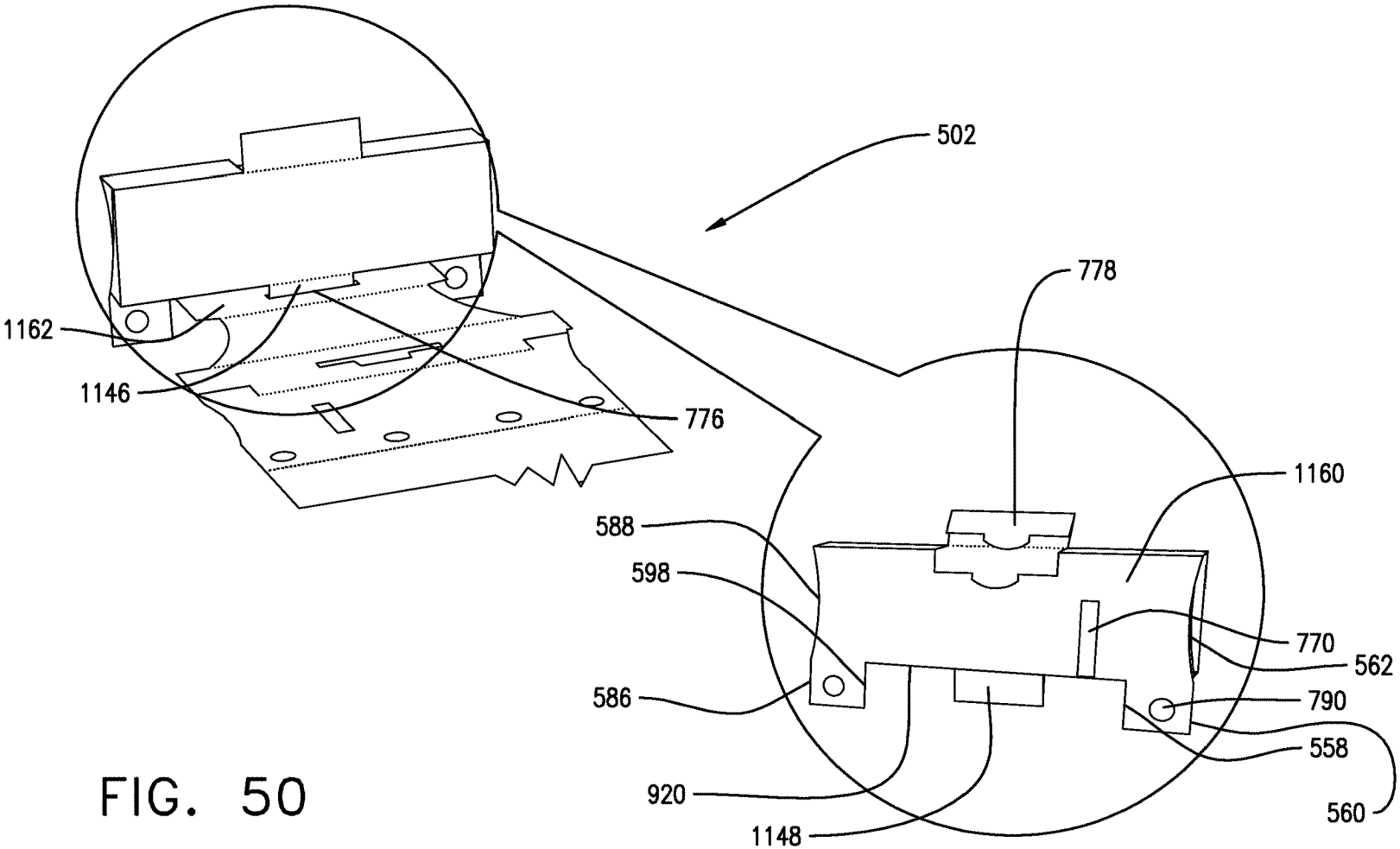
FIG. 50 is a simplified illustration of a final stage in folding a portion about an internal fold line.

FIG. 50 shows a final stage in folding portion 1160 about internal fold line 920. It is seen that portion 1160 lies generally perpendicular to the plane of internal structural portion 502 and that flap portions 1146 & 1148 are fully inserted into aperture 776.

Figure 51:
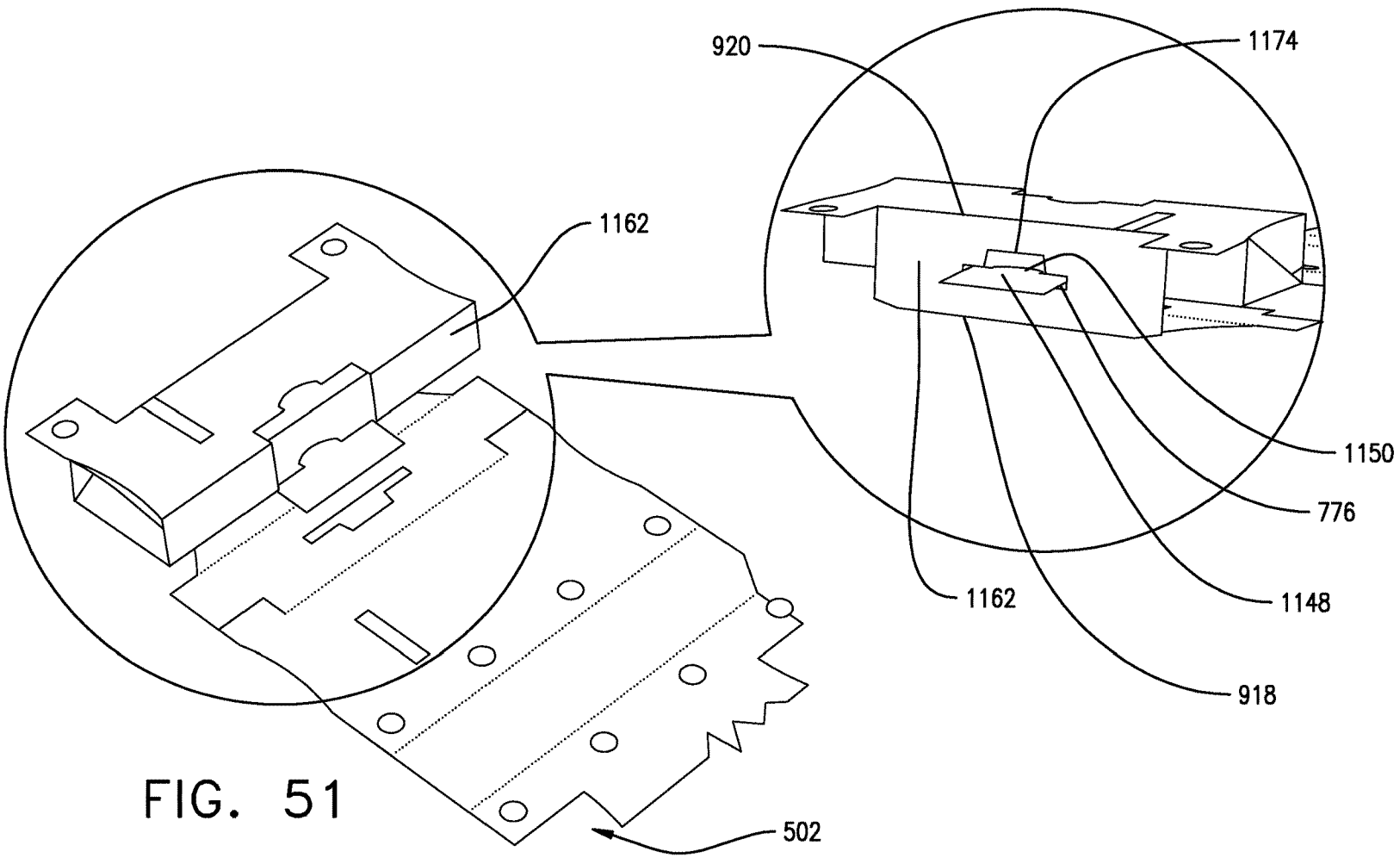
FIG. 51 is a simplified illustration of a folding of an additional portion about an additional internal fold line such that the portion lies generally perpendicular to the plane of an internal structural portion.

FIG. 51 shows folding of a portion 1162 about internal fold line 918 such that portion 1162 lies generally parallel to the plane of internal structural portion 502.

Figure 52:
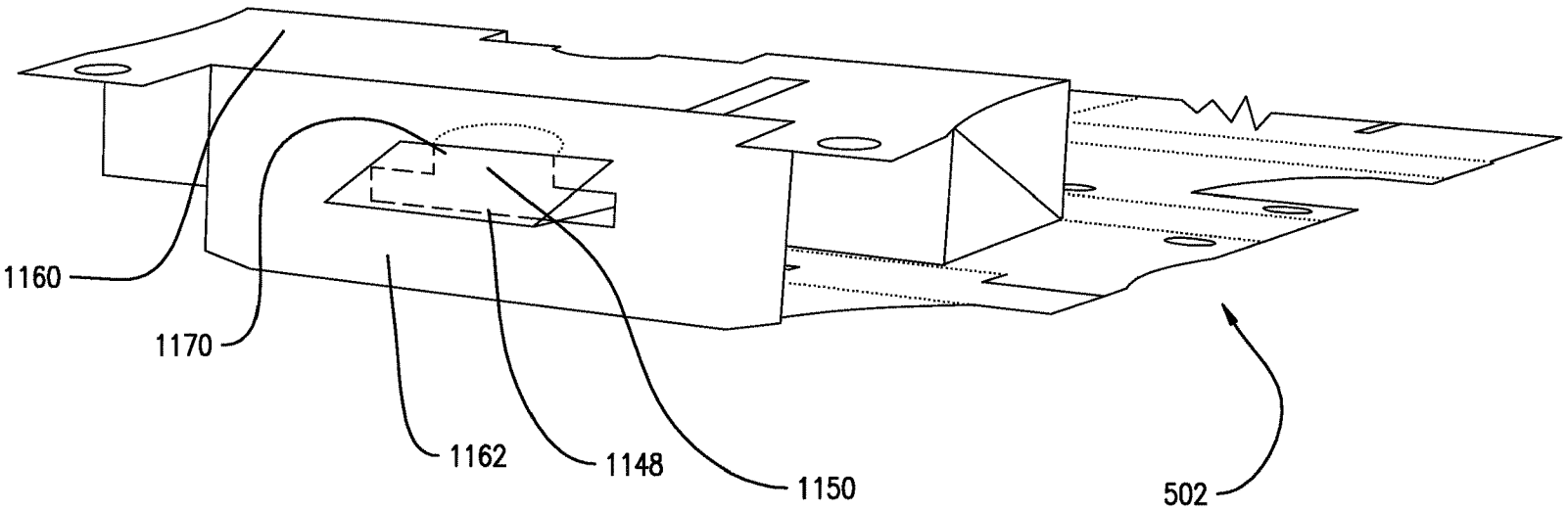
FIG. 52 is a simplified illustration of a slight mutual unfolding of flap portions about an internal fold line so that they engage in a tab socket portion defined in mesa shaped slot.

FIG. 52 shows slight mutual unfolding of portions 1146 and 1148 about internal fold line 936 so that they lie at about 20 degrees with respect to each other and so that end tab portion 1150 engages a tab socket portion 1170 defined in mesa shaped slot 776.

Figure 53:
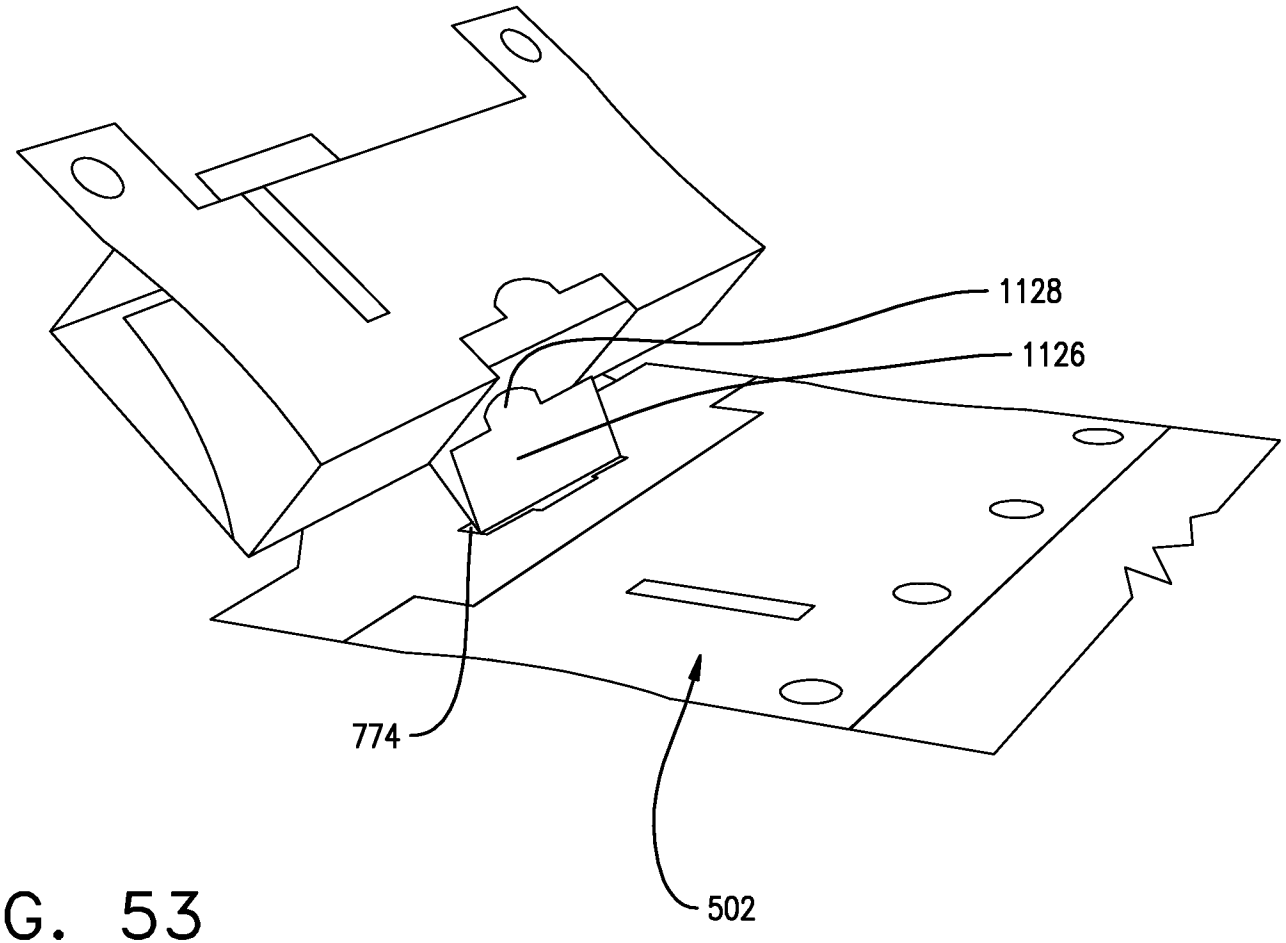
FIG. 53 is a simplified illustration showing partial insertion of additional folded over flap portions in a mesa shaped slot.

FIG. 53 shows partial insertion of folded over flap portions 1124 & 1126 in mesa shaped slot 774.

Figure 54:
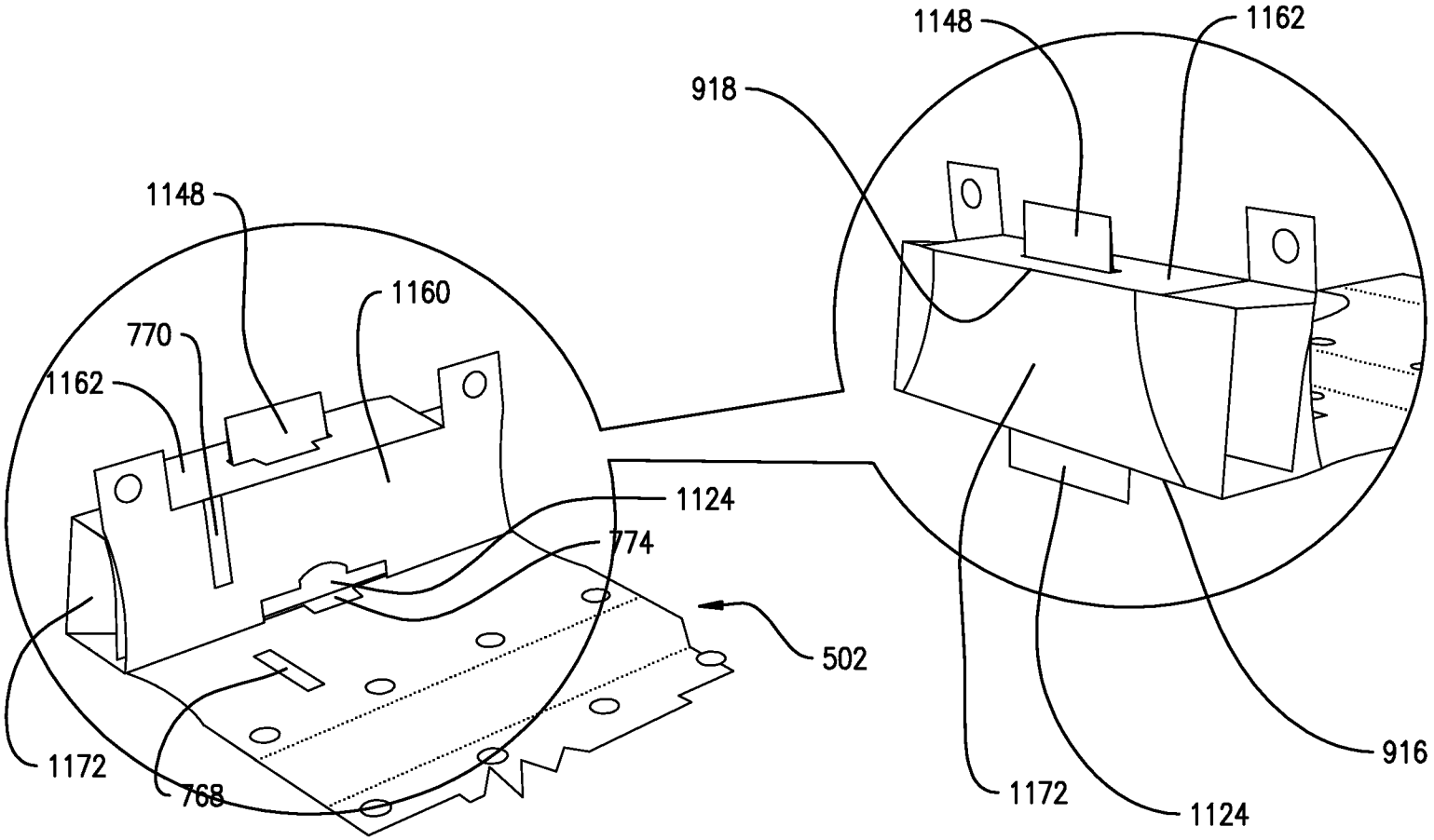
FIG. 54 is a simplified illustration showing folding of a portion about an internal fold line such that the portion lies generally perpendicular to the plane of an internal structural portion.

FIG. 54 shows folding of a portion 1172 about an internal fold line 916 such that portion 1172 lines generally perpendicular to the plane of internal structural portion 502. FIG. 54 also shows complete insertion of folded over flap portions 1124 and 1126 in mesa shaped slot 774.

Figure 55:
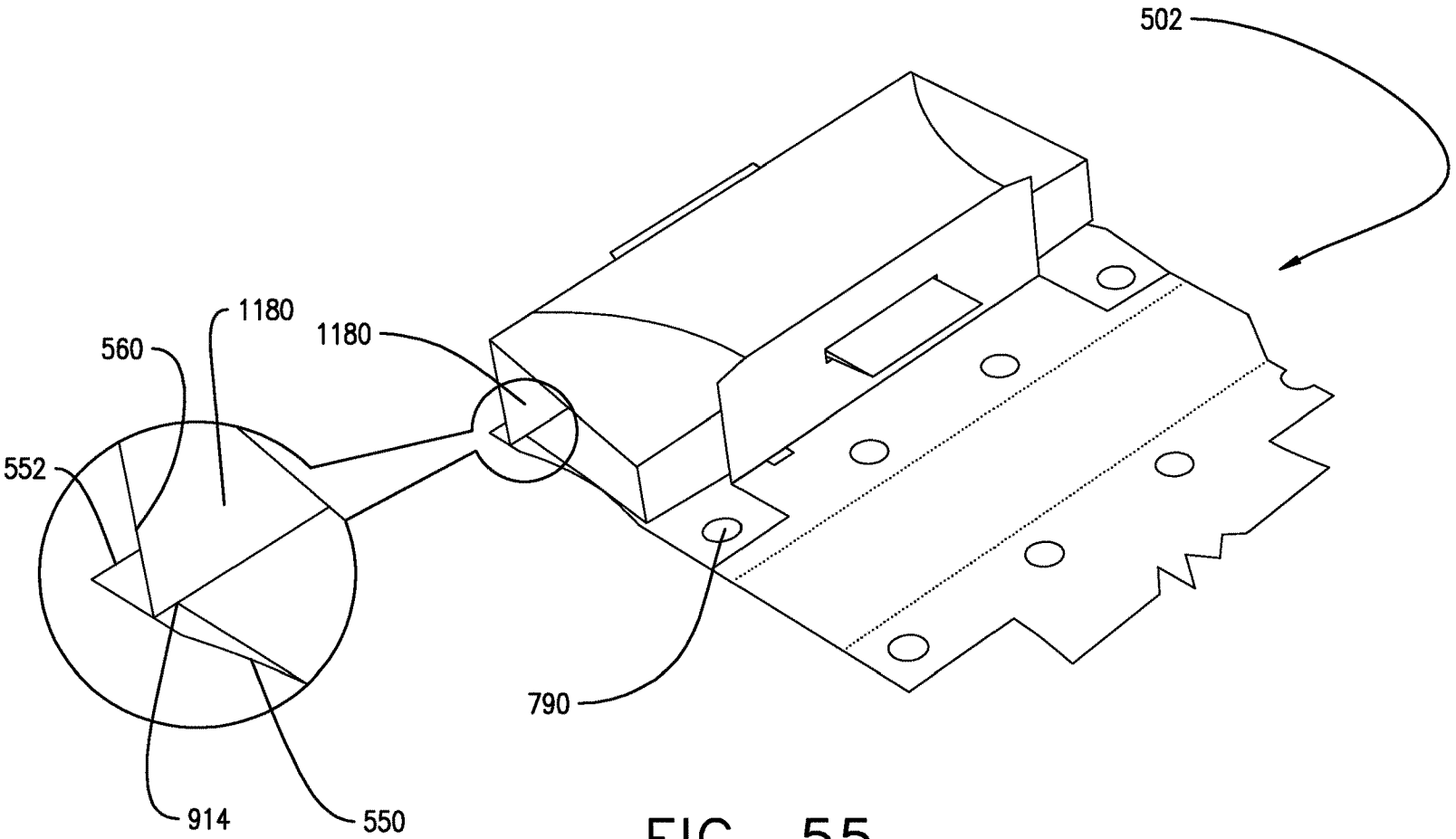
FIG. 55 is a simplified illustration showing the folding of a part of the internal structural portion about an internal fold line such that the portion lines generally perpendicular to the plane of an internal structural portion.

FIG. 55 shows folding of a portion 1180 about internal fold line 914 such that portion 1180 lies generally perpendicular to the plane of internal structural portion 502.

Figure 56:
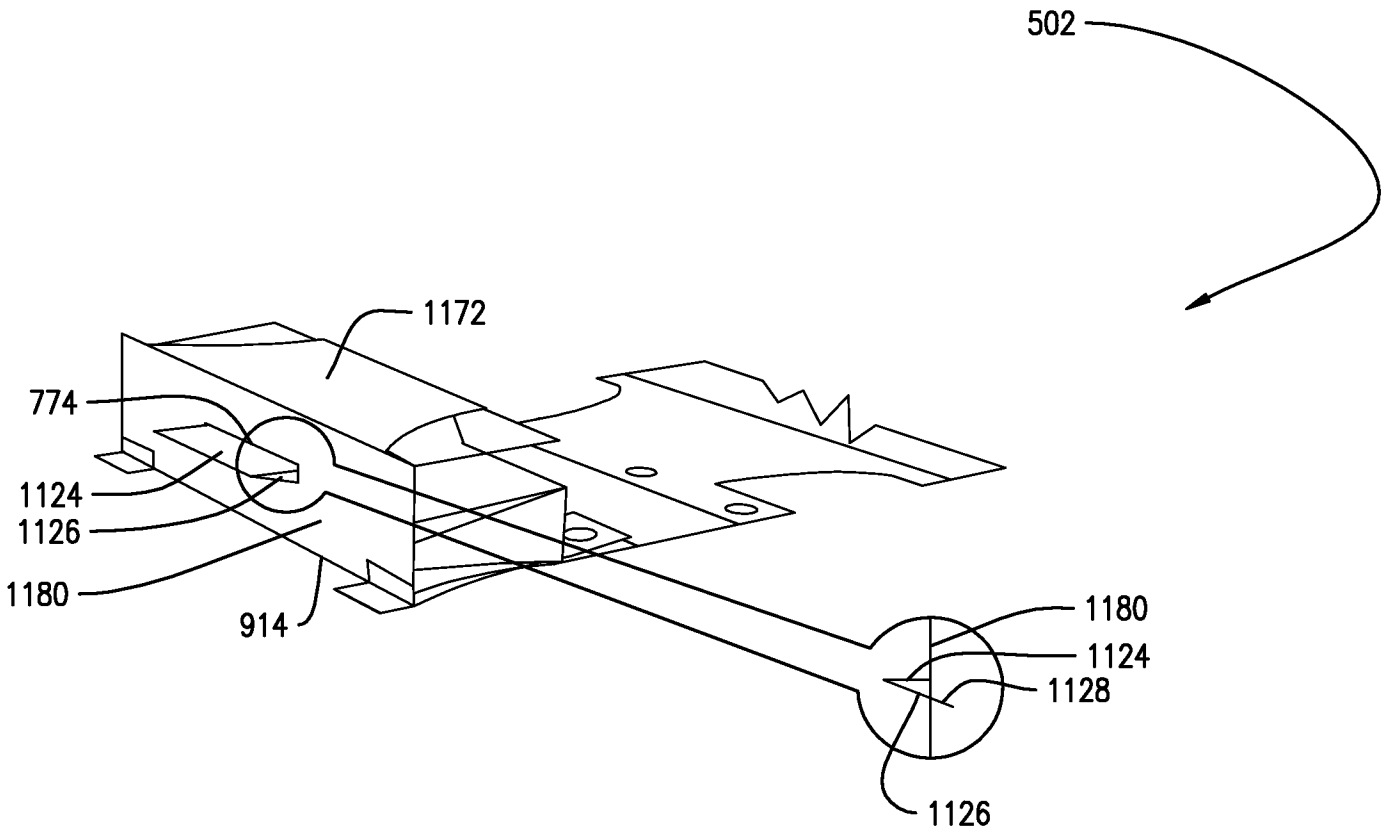
FIG. 56 is a simplified illustration showing slight mutual unfolding of flap portions about internal fold lines so that end tab portions engage respective tab socket portions defined in respective mesa shaped slots.

FIG. 56 shows slight mutual unfolding of flap portions 1124 and 1126 about internal fold line 926 so that they lie at about 20 degrees with respect to each other and so that end tab portion 1128 engages a tab socket portion 1174 defined in mesa shaped slot 774.

Figure 57:
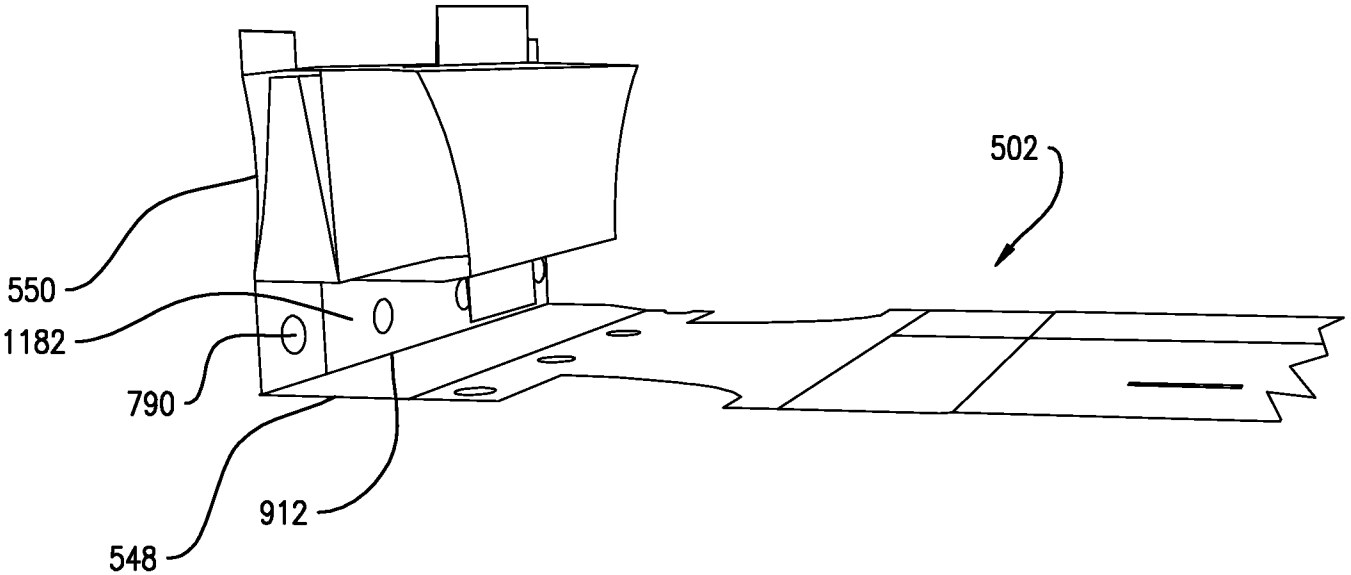
FIG. 57 is a simplified illustration showing the folding of another part of the internal structural portion about an internal fold line such that the portion lies generally perpendicular to the plane of an internal structural portion.

FIG. 57 shows folding of a portion 1182 about internal fold line 912 such that portion 1182 lies generally perpendicular to the plane of internal structural portion 502.

Figure 58:
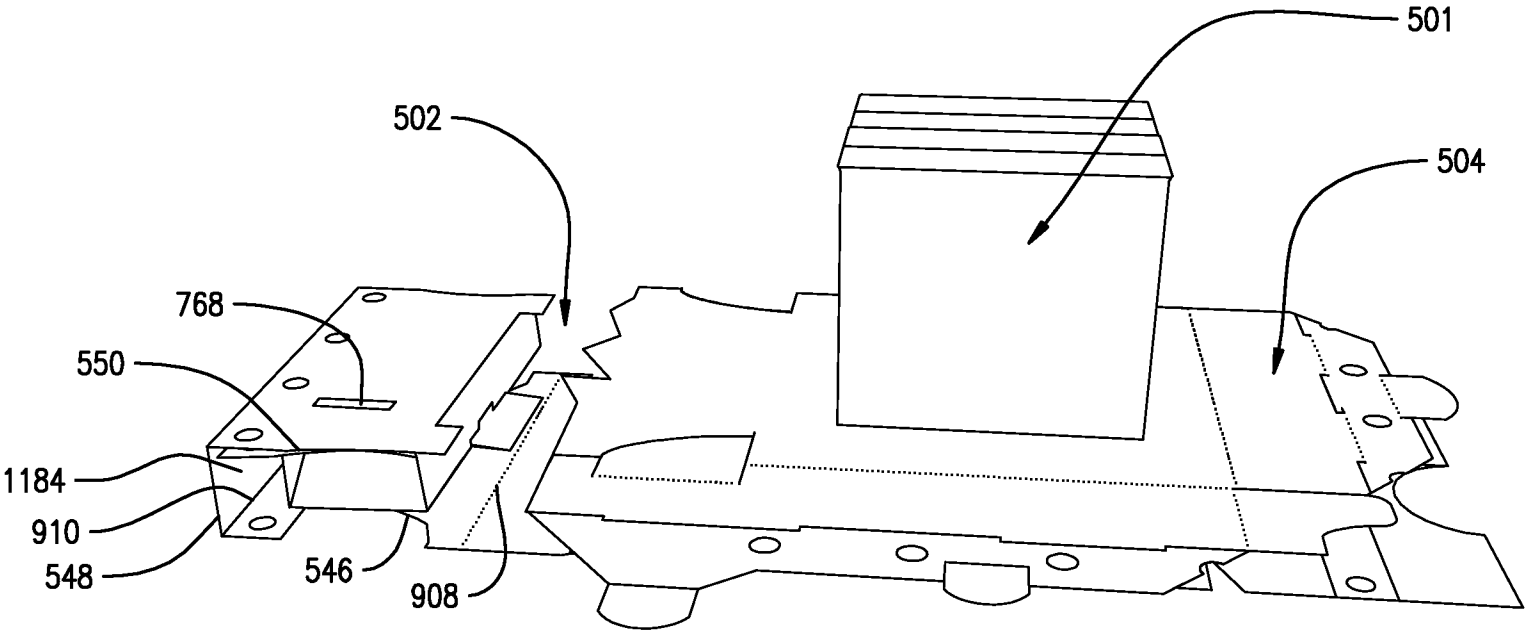
FIG. 58 is a simplified illustration showing the folding of a yet another part of the internal structural portion about an internal fold line such that the portion lies generally perpendicular to the plane of an internal structural portion.

FIG. 58 shows folding of a portion 1184 about internal fold line 910 such that portion 1184 lies generally perpendicular to the plane of internal structural portion 502.

Figure 59:
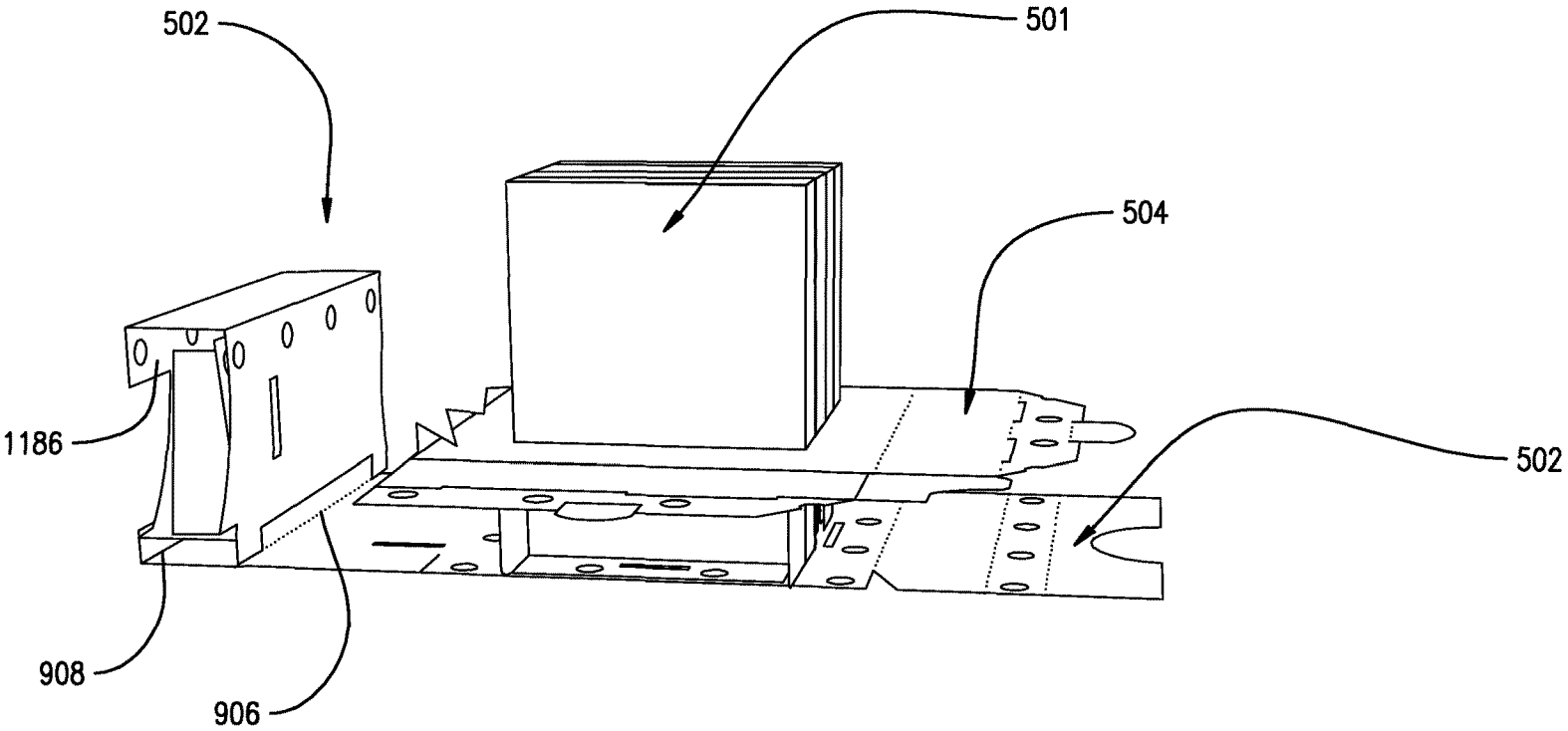
FIG. 59 is a simplified illustration showing the folding of a further part of the internal structural portion about an internal fold line such that the portion lies generally perpendicular to the plane of an internal structural portion.

FIG. 59 shows folding of a portion 1186 about internal fold line 908 such that portion 1186 lies generally perpendicular to the plane of internal structural portion 502.

Figure 60:
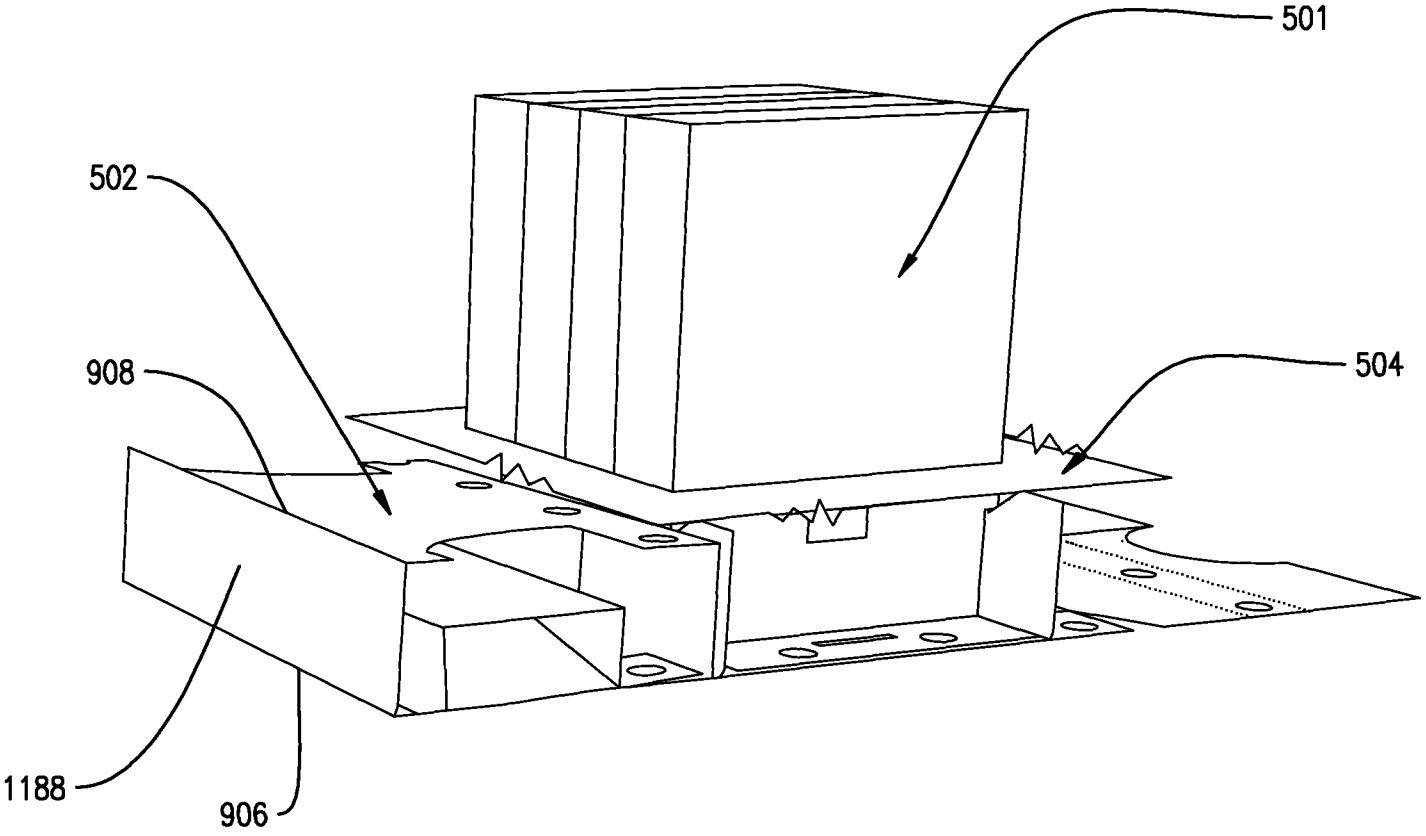
FIG. 60 is a simplified illustration showing the folding of yet a further part of the internal structural portion about an internal fold line such that the portion lies generally perpendicular to the plane of an internal structural portion.

FIG. 60 shows folding of a portion 1188 about internal fold line 906 such that portion 1188 lies generally perpendicular to the plane of internal structural portion 502.

Figure 61:
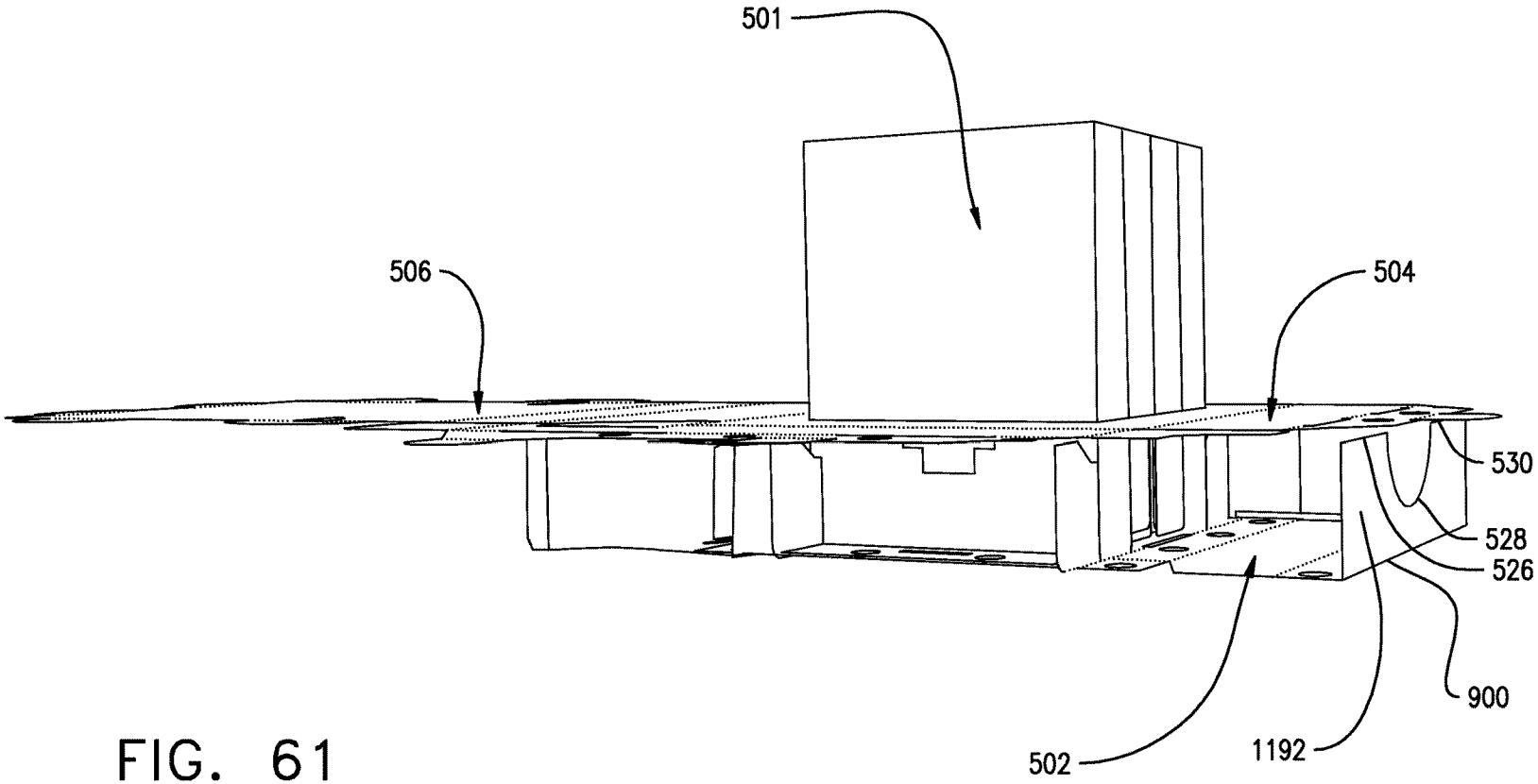
FIG. 61 is a simplified illustration showing the folding of still a further part of the internal structural portion about an internal fold line such that the portion lies generally perpendicular to the plane of an internal structural portion.

FIG. 61 shows folding of a portion 1192 about internal fold line 900 such that portion 1192 lies generally perpendicular to the plane of internal structural portion 502.

Figure 62:
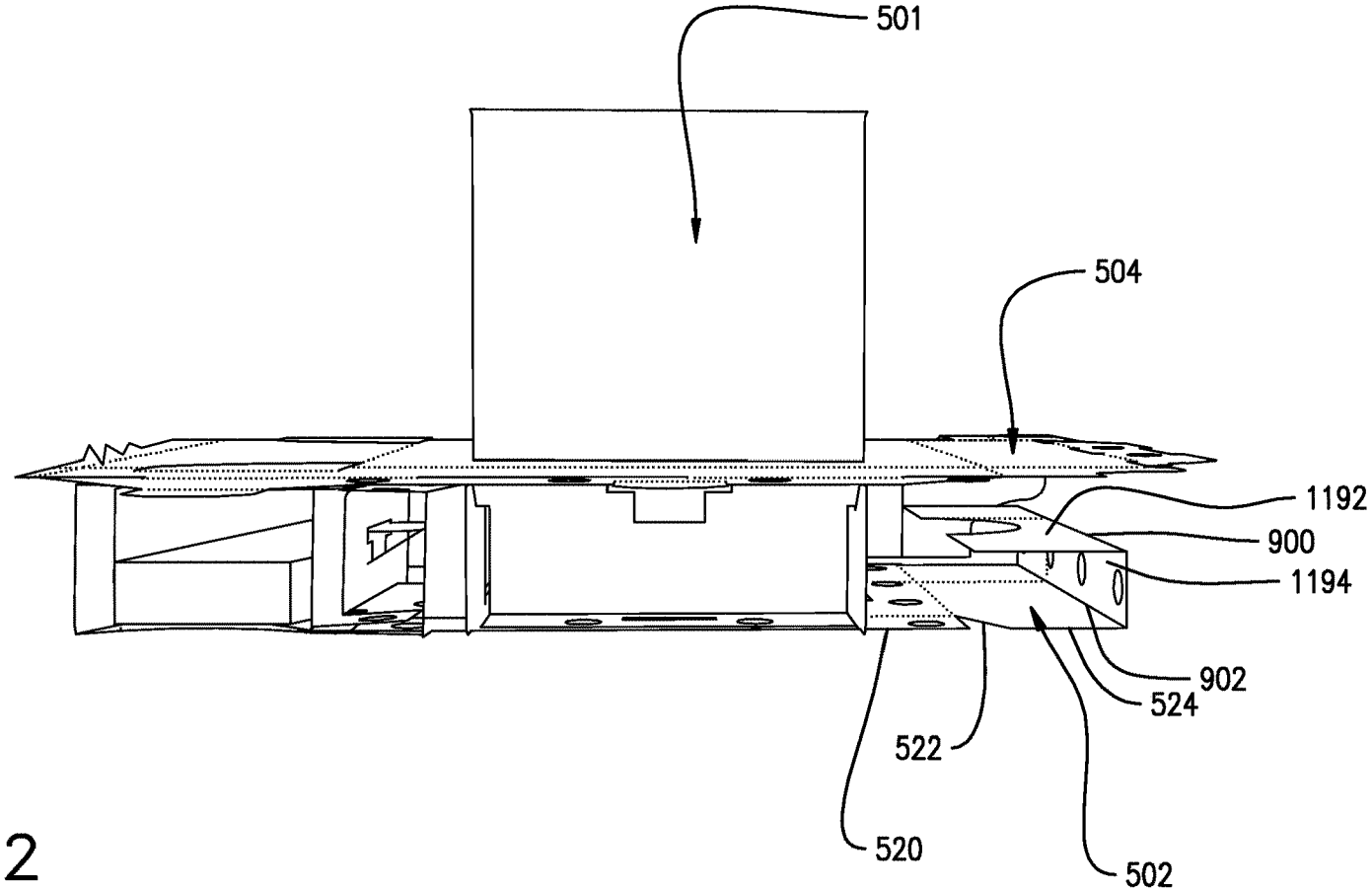
FIG. 62 is a simplified illustration showing the folding of still another part of the internal structural portion about an internal fold line such that the portion lies generally perpendicular to the plane of an internal structural portion.

FIG. 62 shows folding of a portion 1194 about internal fold line 902 such that portion 1194 lies generally perpendicular to the plane of internal structural portion 502.

Figure 63:
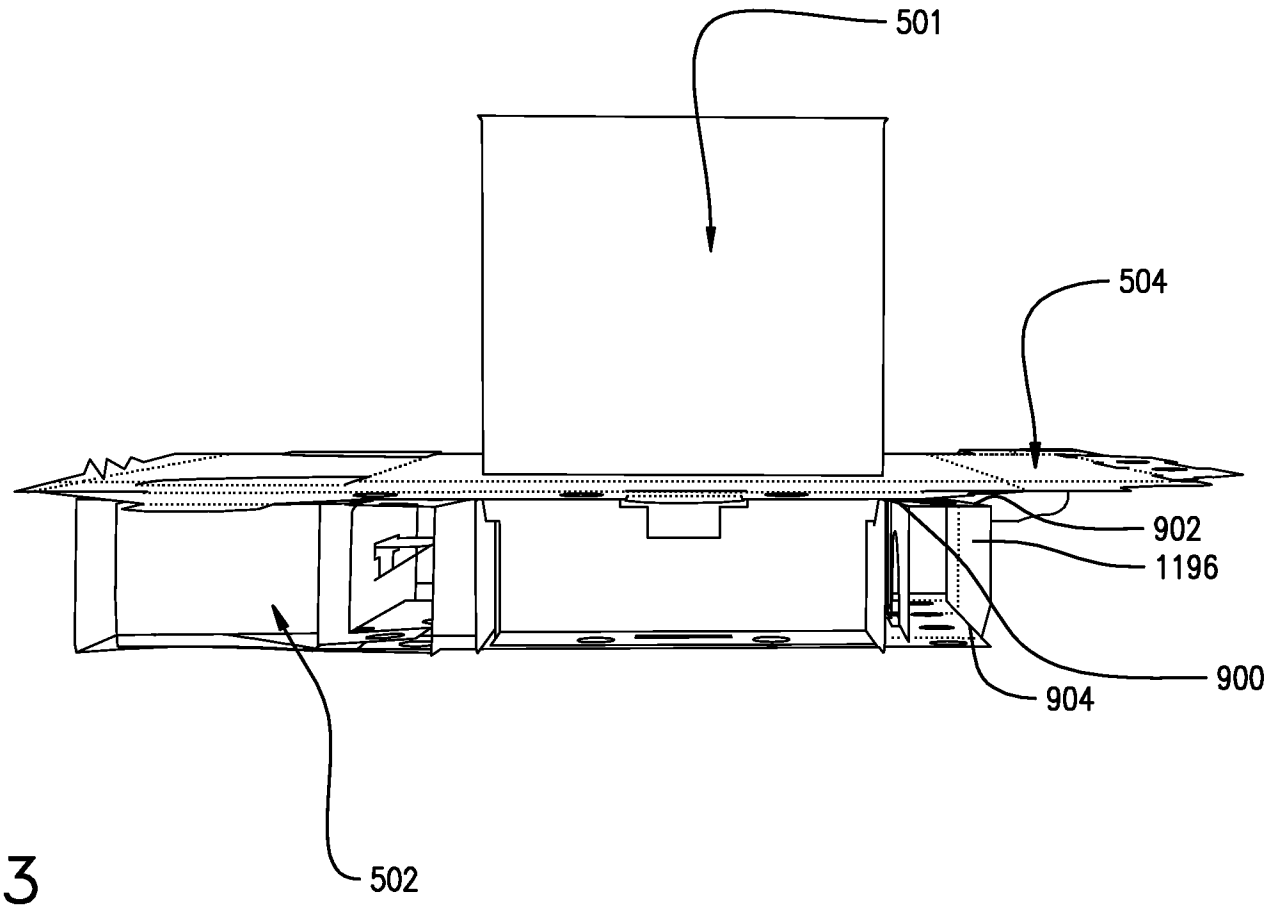
FIG. 63 is a simplified illustration showing the folding of yet another part of the internal structural portion about internal fold line such that the portion lies generally perpendicular to the plane of internal structural portion.

FIG. 63 shows folding of a portion 1196 about internal fold line 904 such that portion 1196 lies generally perpendicular to the plane of internal structural portion 502.

Figure 64:
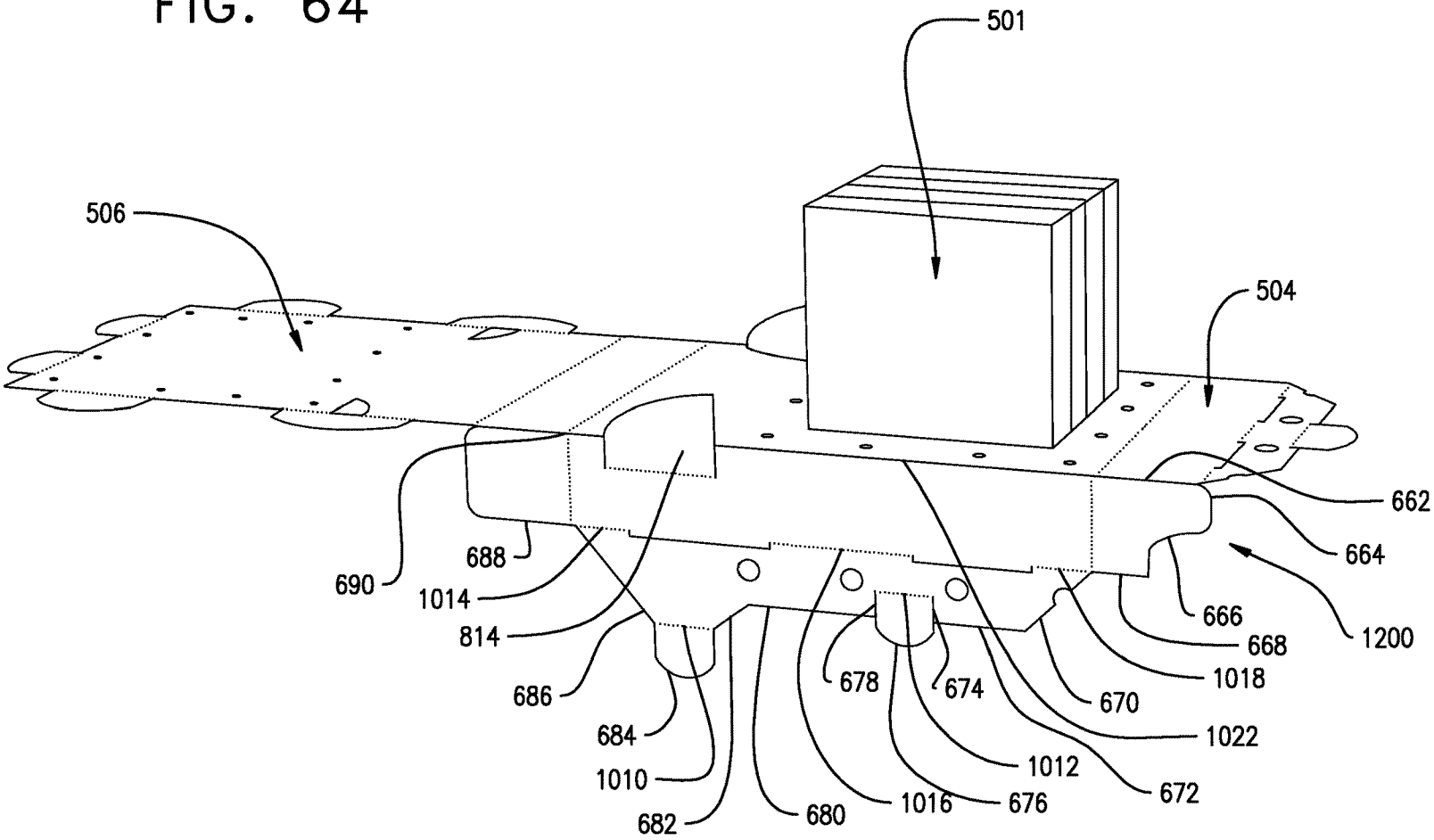
FIG. 64 is a simplified illustration showing the folding of a side section, which forms part of a top and side portion, about an internal fold line such that a side section lies generally perpendicular to the plane of the remainder of the top and side portion.

FIG. 64 shows folding of a side section 1200, which is part of top and side portion 504, about internal fold line 1022 such that side section 1200 lies generally perpendicular to the plane of the remainder of top and side portion 504.

Figure 65:
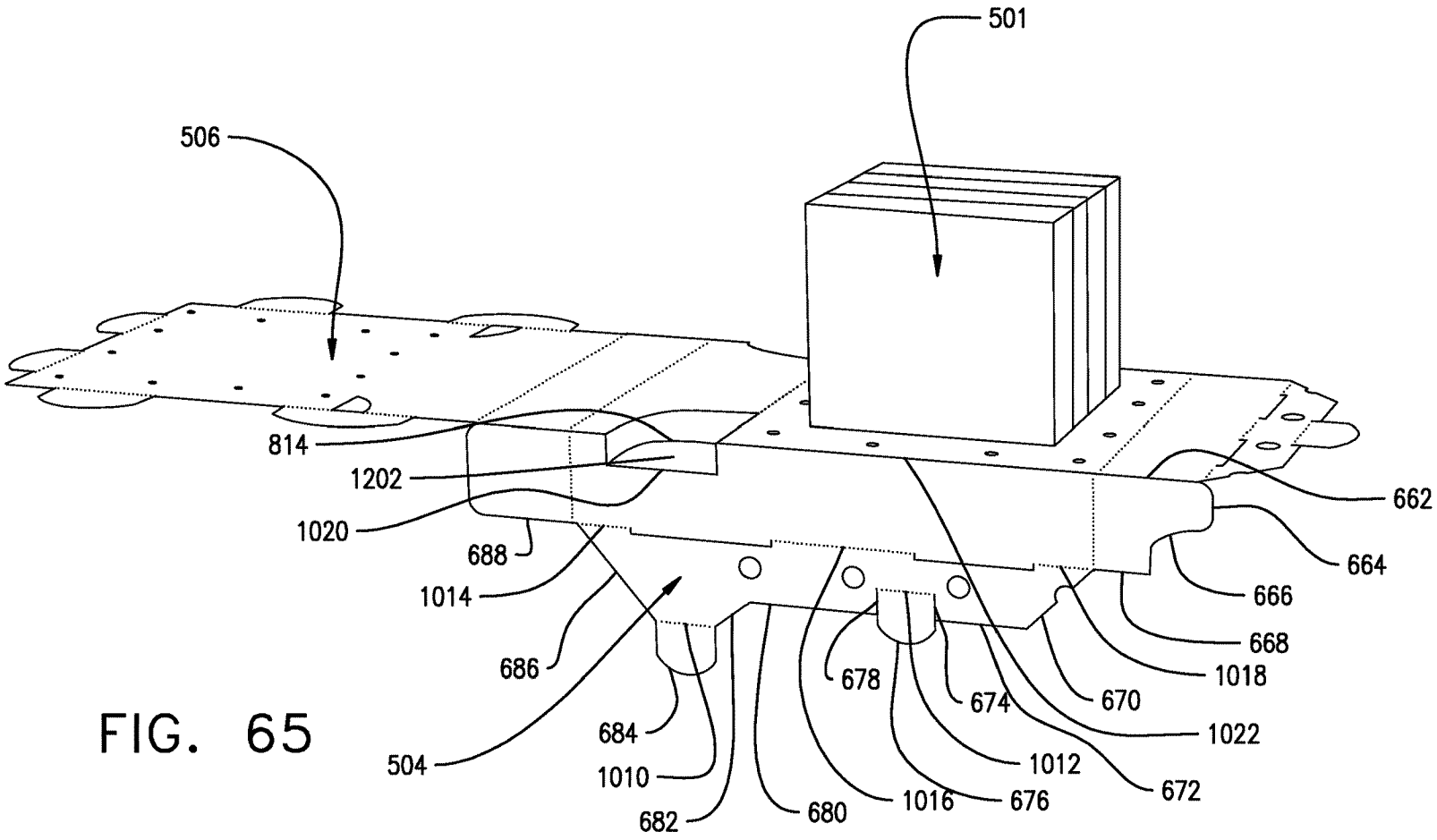
FIG. 65 is a simplified illustration showing the folding of flaps about respective internal fold lines so that the flaps lie generally parallel to the plane of the remainder of the top and side portion.

FIG. 65 shows folding of flaps 1202 and 1204, defined by respective cuts 812 and 814, about respective internal fold lines 1020 and 1034 (not seen in FIG. 65) so that flaps 1202 and 1204 lie generally parallel to the plane of the remainder of top and side portion 504.

Figure 66:
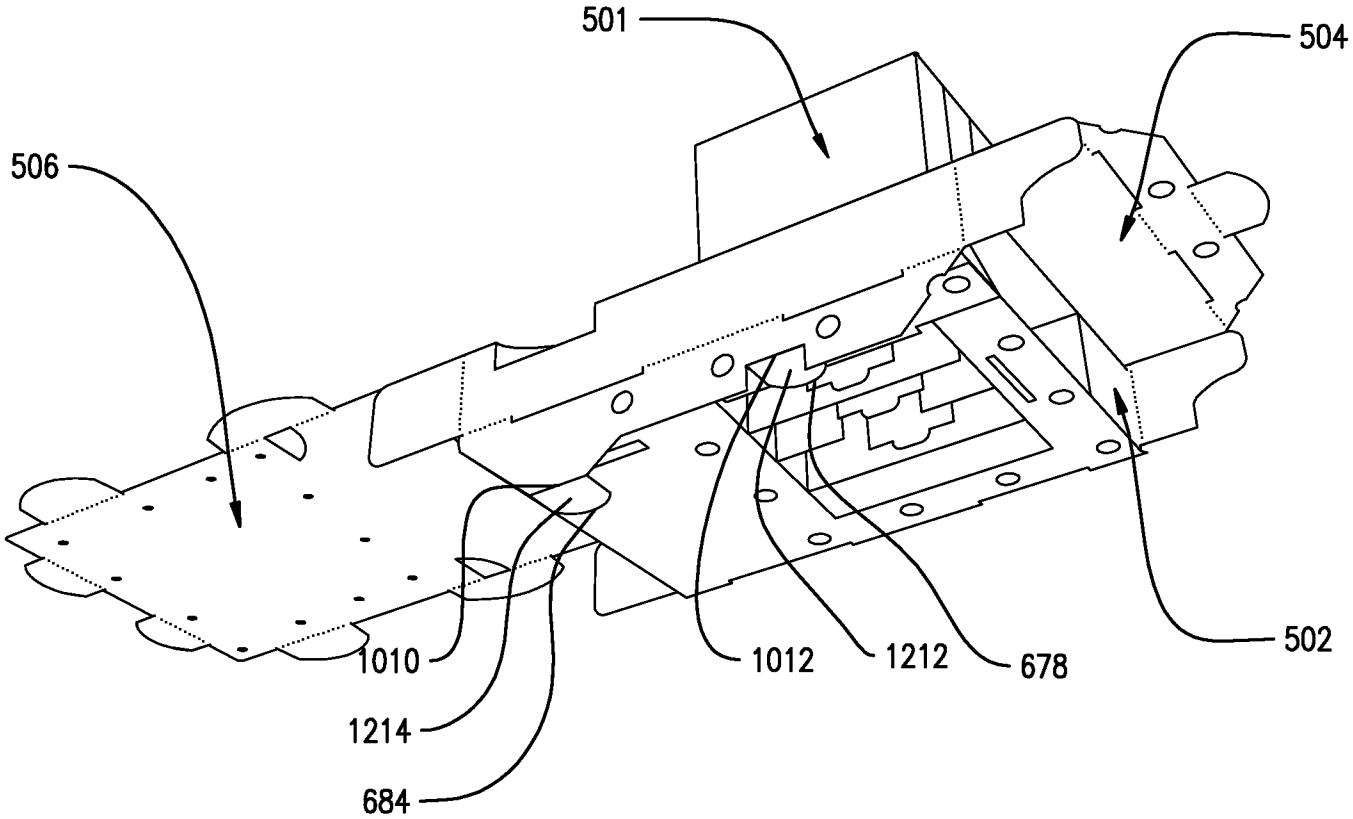
FIG. 66 is a simplified illustration showing the folding of tabs about respective internal fold lines so as to lie generally perpendicular to the plane of the remainder of top and side portion.

FIG. 66 shows folding of tabs 1212 and 1214, defined by respective cuts 678 and 684, about respective internal fold lines 1012 and 1010 so as to lie generally parallel to the plane of the remainder of top and side portion 504.

Figure 67:
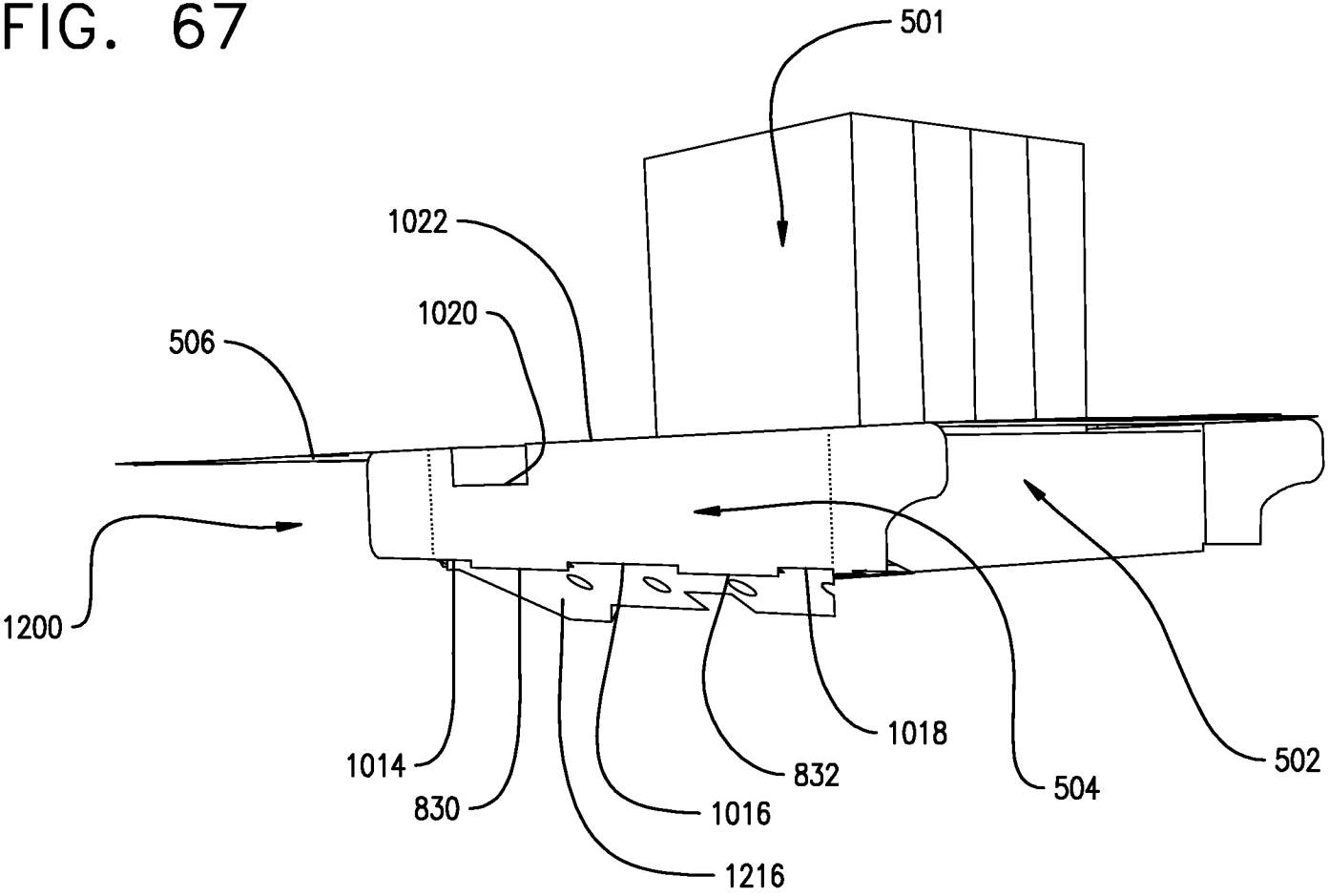
FIG. 67 is a simplified illustration showing the initial folding of a portion forming part of a side section about mutually coaxial internal fold lines such that the portion lies generally at an angle with respect to the plane of the remainder of the side section.

FIG. 67 shows initial folding of a portion 1216, forming part of side section 1200, about mutually coaxial internal fold lines 1014, 1016 and 1018 such that portion 1216 lies generally at a 45 degree angle with respect to the plane of the remainder of side section 1200.

Figure 68:
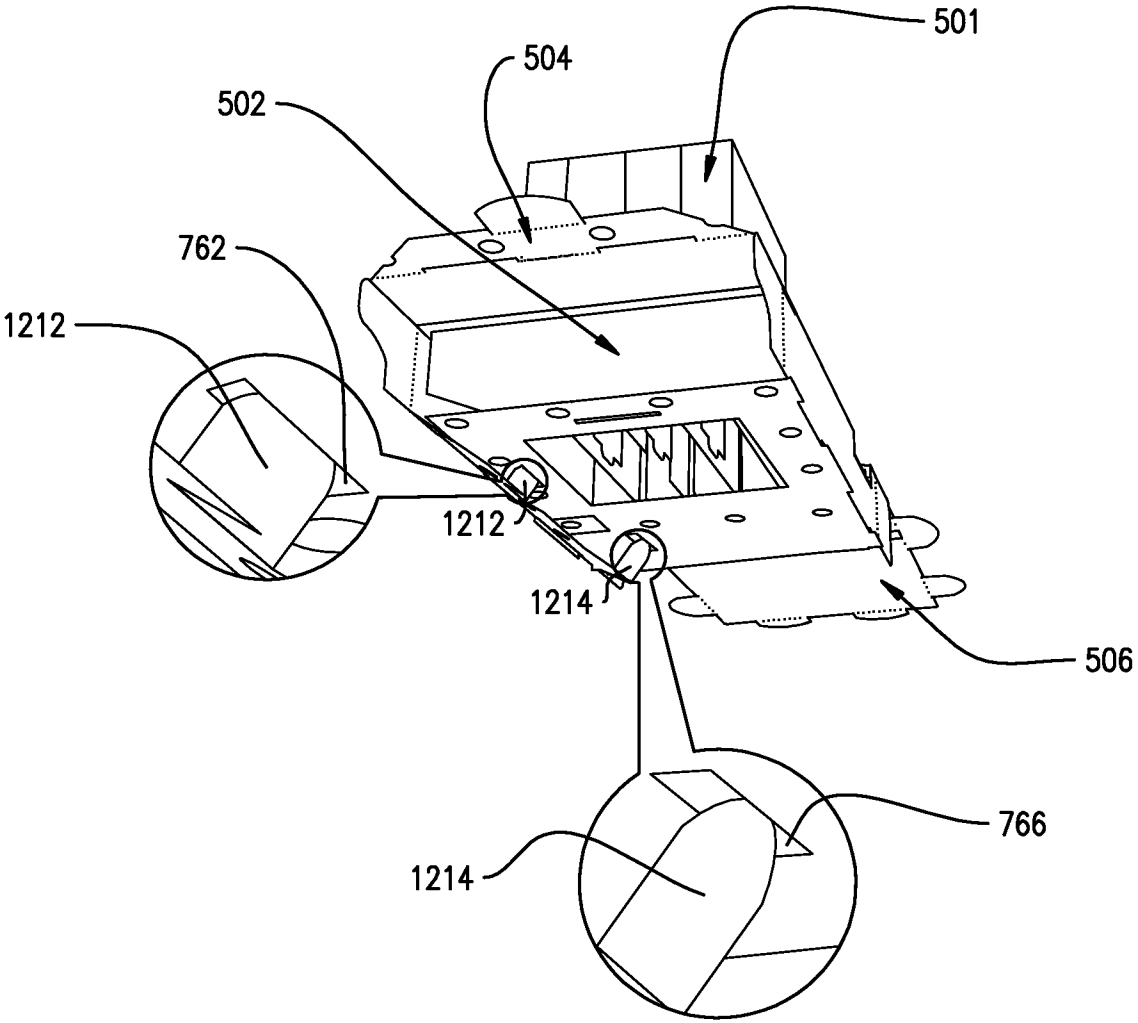
FIG. 68 is a simplified illustration showing the further folding of a part of the side section about mutually coaxial internal fold lines such that the portion lies generally at a more acute angle with respect to the plane of the remainder of the side section.

FIG. 68 shows further folding of portion 1216, forming part of side section 1200, about mutually coaxial internal fold lines 1014, 1016 and 1018 such that portion 1216 lies generally at a 60 degree angle with respect to the plane of the remainder of side section 1200. It is further seen that tabs 1212 and 1214 are partially inserted into respective slots 762 and 766.

Figure 69:
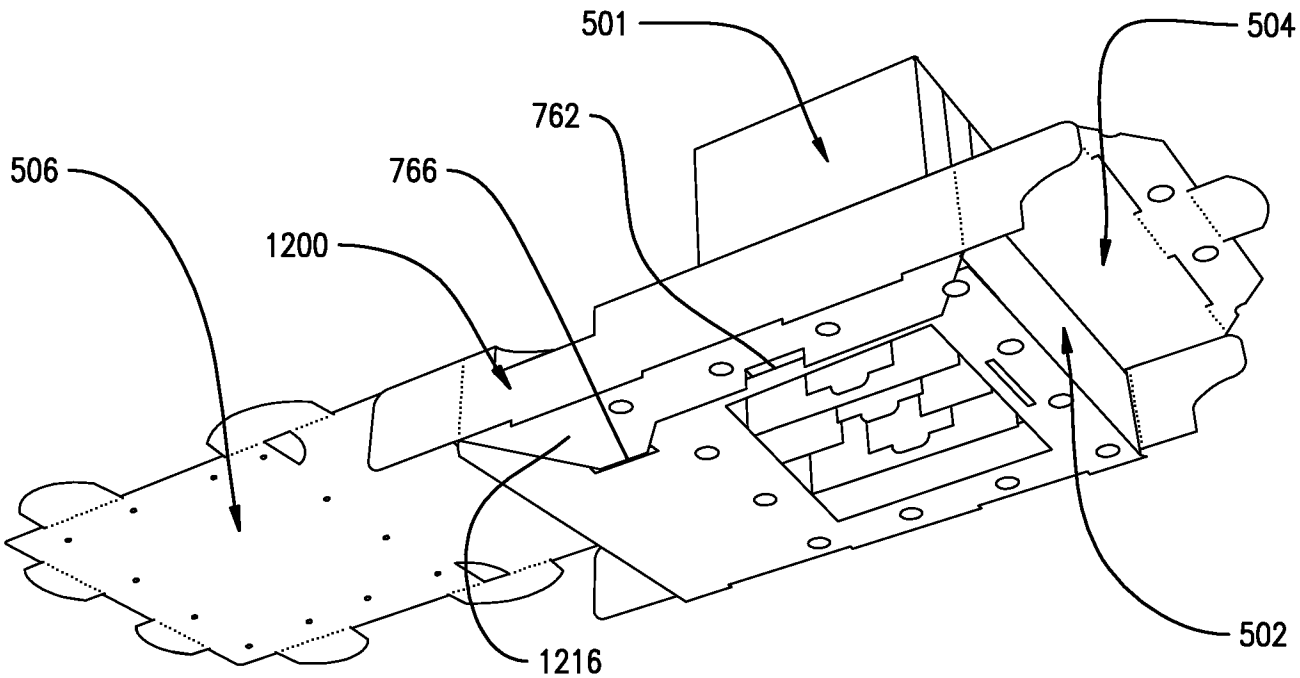
FIG. 69 is a simplified illustration showing the showing final folding of the portion forming part of the side section about mutually coaxial internal fold lines such that the portion lies generally perpendicular to the plane of the remainder of the side section.

FIG. 69 shows final folding of portion 1216, forming part of side section 1200, about mutually coaxial internal fold lines 1014, 1016 and 1018 such that portion 1216 lies generally perpendicular to the plane of the remainder of side section 1200. It is further seen that tabs 1212 and 1214 are fully inserted into respective slots 762 and 766.

Figure 70:
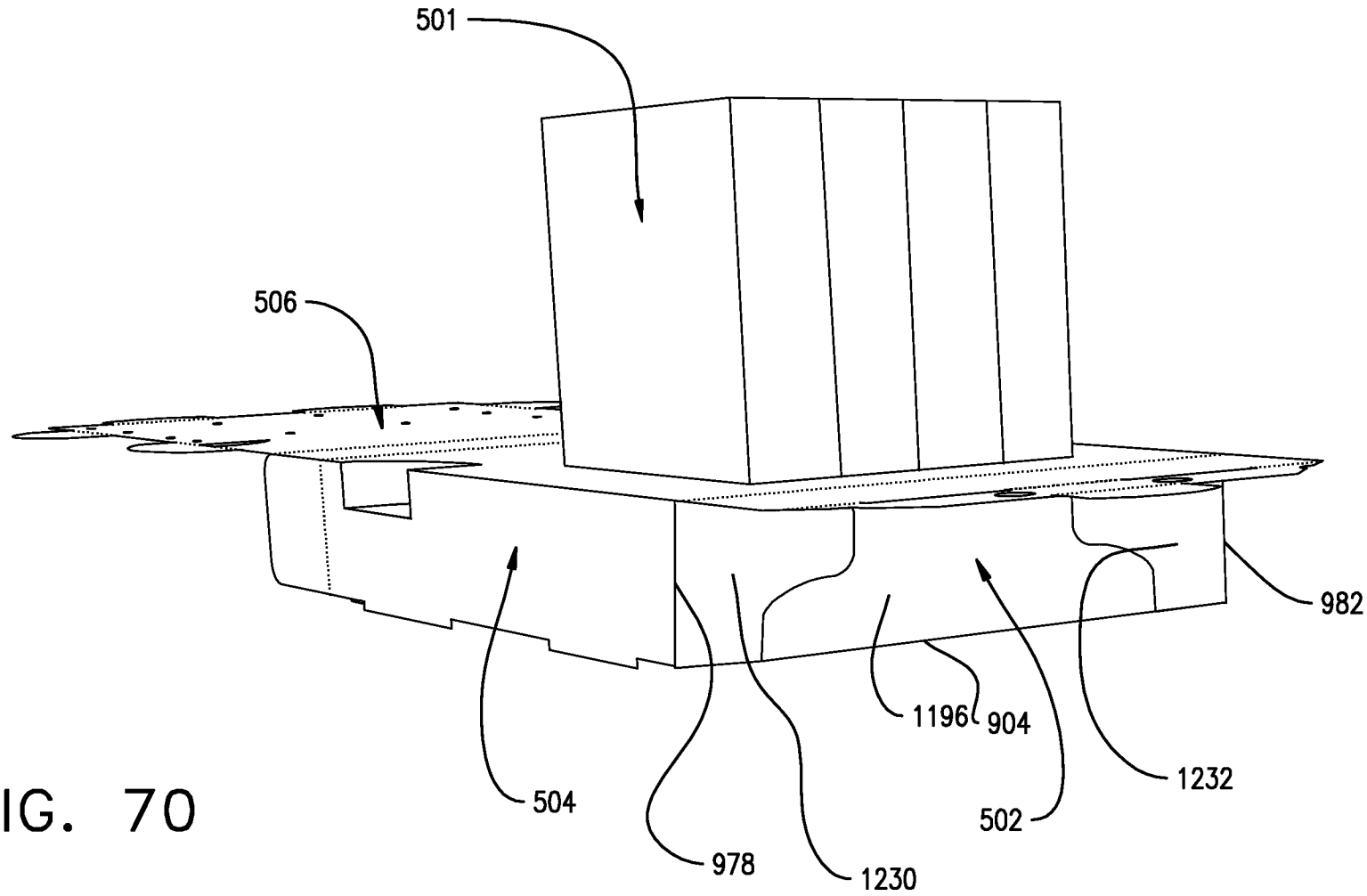
FIG. 70 is a simplified illustration showing the folding of flaps about respective internal fold lines to lie adjacent and parallel to a part of the internal structural portion.

FIG. 70 shows folding of flaps 1230 and 1232 defined by respective cuts 662, 664, 666, & 668 and 640, 642, 644 & 646 about respective internal fold lines 978 and 982 to lie adjacent and generally parallel to portion 1196.

Figure 71:
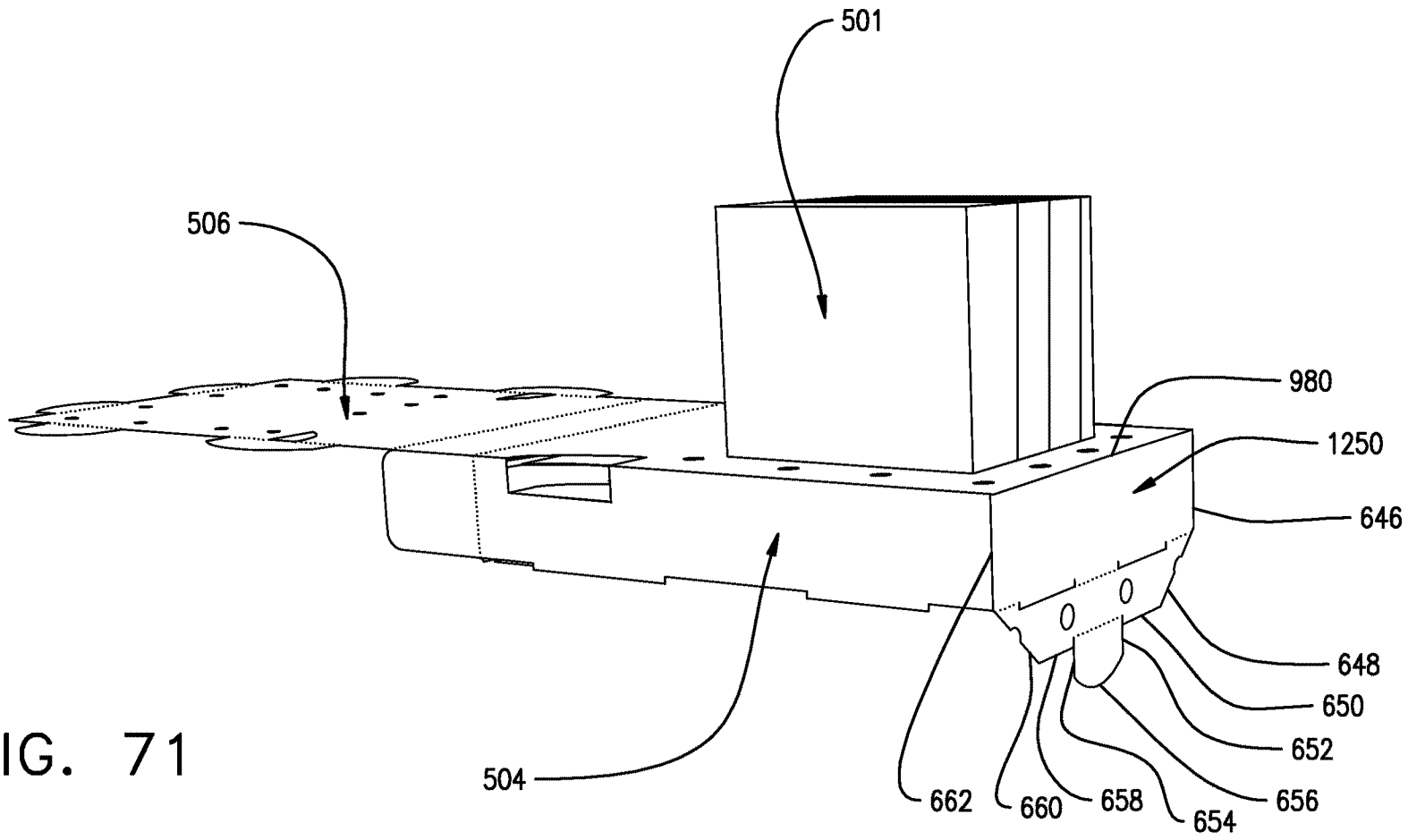
FIG. 71 is a simplified illustration showing the folding of an end section, forming part of top and side portion about an internal fold line, such that the end section lies generally perpendicular to the plane of the remainder of the top and side portion.

FIG. 71 shows folding of an end section 1250, forming part of top and side portion 504, about internal fold line 980, such that end section 1250 lies generally perpendicular to the plane of the remainder of top and side portion 504.

Figure 72:
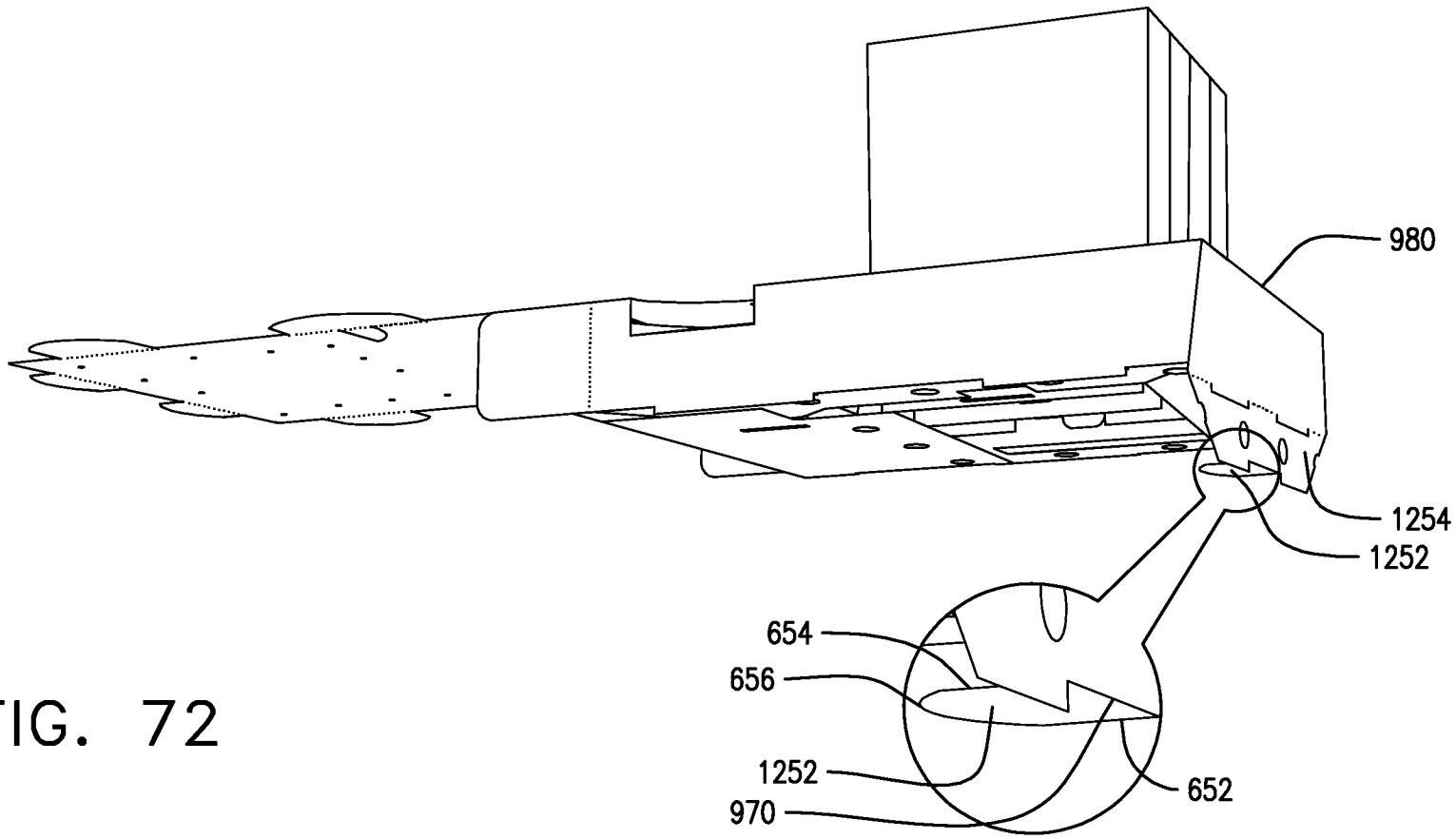
FIG. 72 is a simplified illustration showing the folding of a tab about an internal fold line so as to lie generally parallel to the plane of the remainder of the top and side portion.

FIG. 72 shows folding of a tab 1252, defined by respective cuts 652, 654 and 656, about internal fold line 970 so as to lie generally parallel to the plane of the remainder of top and side portion 504.

Figure 73:
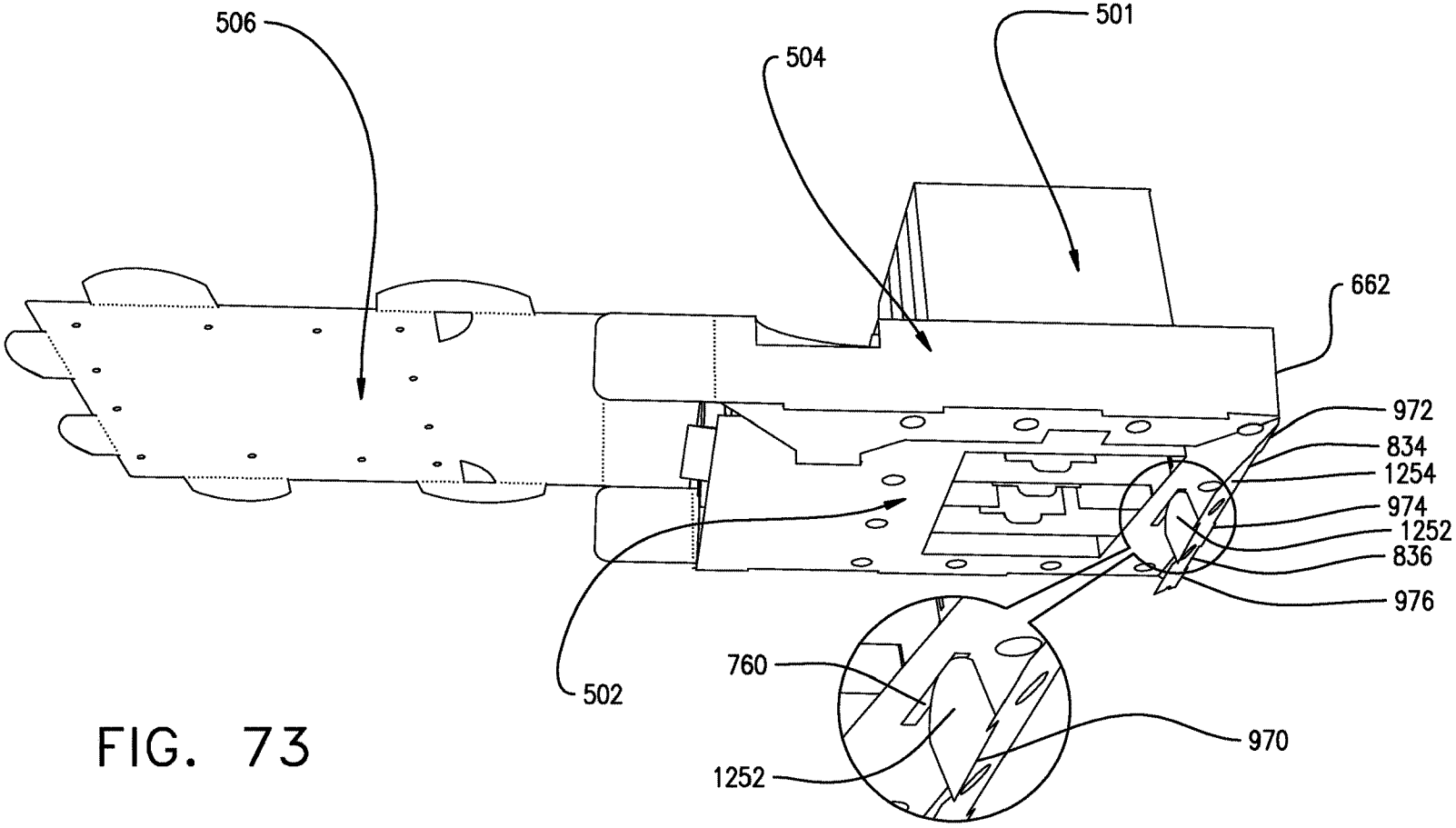
FIG. 73 is a simplified illustration showing initial folding of a portion forming part of an end section about mutually coaxial internal fold lines, such that the portion lies generally at an angle with respect to the plane of the remainder of end section.

FIG. 73 shows initial folding of a portion 1254, forming part of end section 1250, about mutually coaxial internal fold lines 972, 974 and 976, such that portion 1254 lies generally at a 45 degree angle with respect to the plane of the remainder of end section 1250. It is seen that tab 1252 is partially inserted into slot 760.

FIG. 74 shows final folding of portion 1254, forming part of end section 1250, about mutually coaxial internal fold lines 972, 974 and 976, such that portion 1254 lies generally perpendicular to the plane of the remainder of end section 1250. It is noted that tab 1252 is fully inserted into slot 760.

Figure 75:
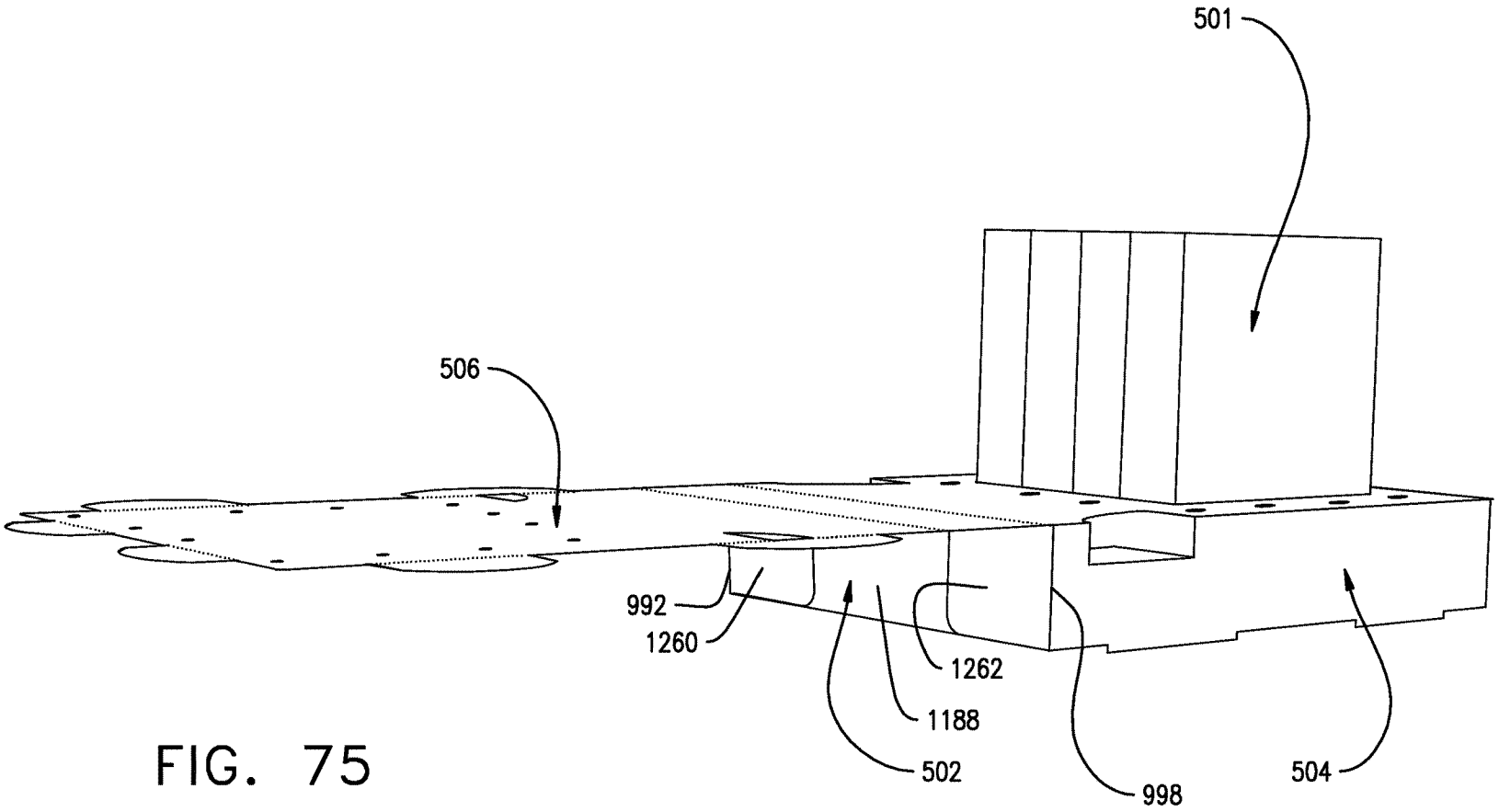
FIG. 75 is a simplified illustration showing the folding of flaps about respective internal fold lines to lie adjacent and parallel to a portion.

FIG. 75 shows folding of flaps 1260 and 1262 about respective internal fold lines 992 and 998 to lie adjacent and generally parallel to portion 1188.

Figure 76:
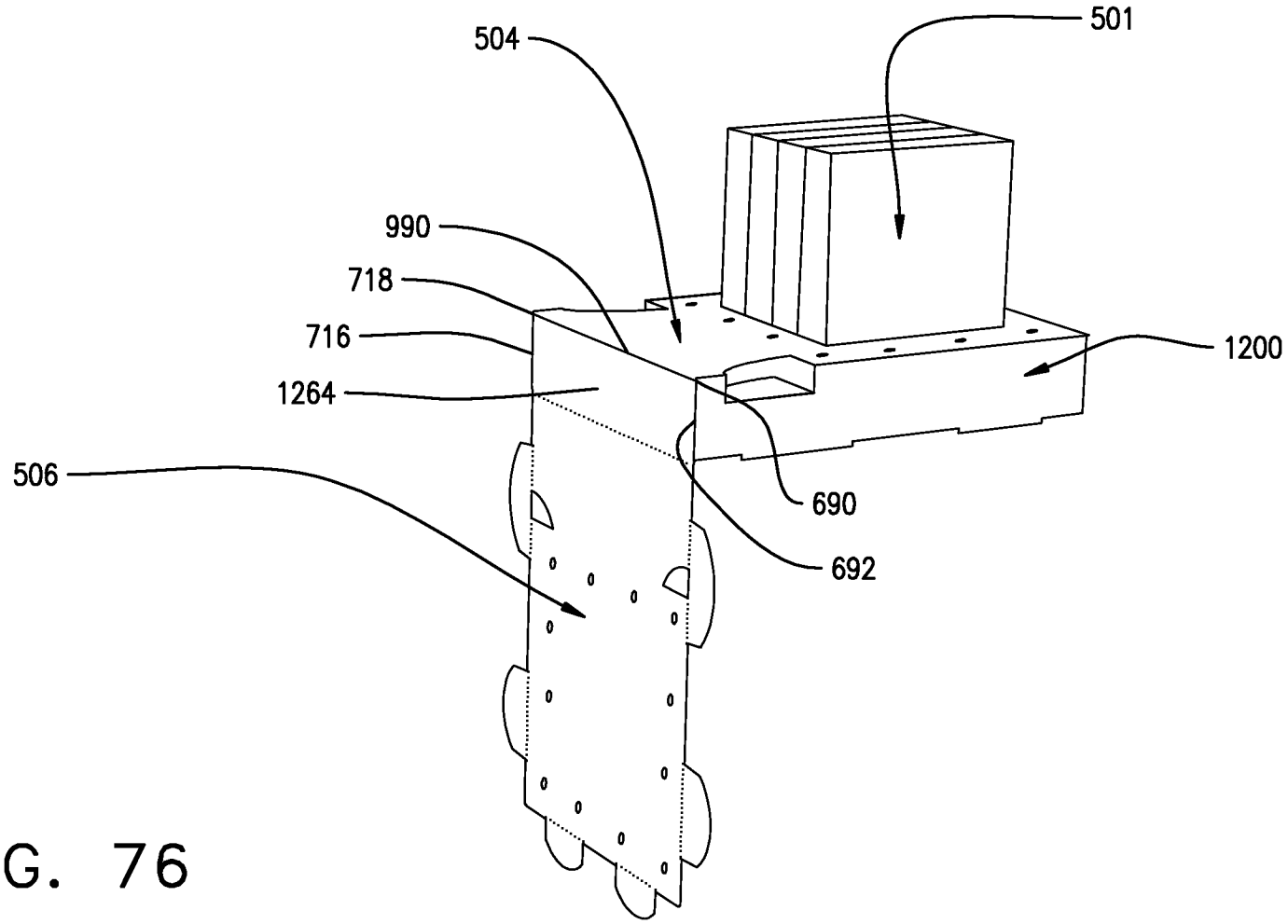
FIG. 76 is a simplified illustration showing the folding of a bottom portion about internal fold line such that a portion thereof lies adjacent and generally parallel to another portion and generally perpendicular to a top and side portion.

FIG. 76 shows folding of bottom portion 506 about internal fold line 990 such that a portion 1264 thereof lies adjacent and generally parallel to portion 1188 (not shown) and generally perpendicular to a top and side portion 504.

Figure 77:
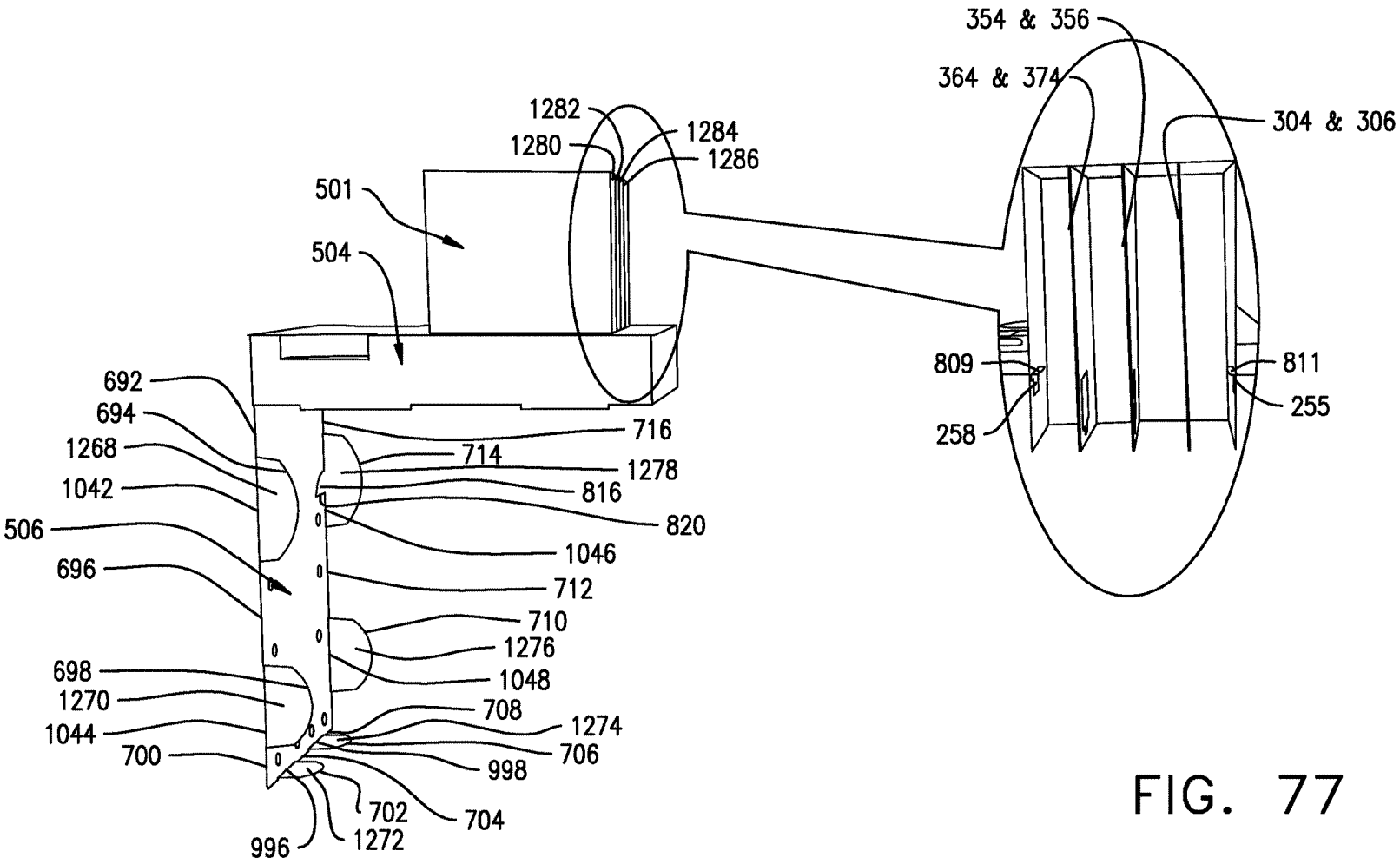
FIG. 77 is a simplified illustration showing folding of tabs about respective internal fold lines so as to each lie generally perpendicular to the plane of the remainder of bottom portion.

FIG. 77 shows folding of respective tabs 1268, 1270, 1272, 1274, 1276 and 1278, defined by respective cuts 694, 698, 702, 706, 710 and 714 (FIG. 31), about respective internal fold lines 1042, 1044, 996, 998, 1048 and 1046 so as to each lie generally perpendicular to the plane of the remainder of bottom portion 506.

It may be appreciated that FIG. 77 shows a partially completed head phylactery including subassembly 501, which includes a plurality of adjacent generally rectangular, mutually parallel compartments 1280, 1282, 1284 and 1286, separated by partitions defined by respective double panel surfaces 364 & 374, 354 & 356, 304 & 306.

Figure 78:
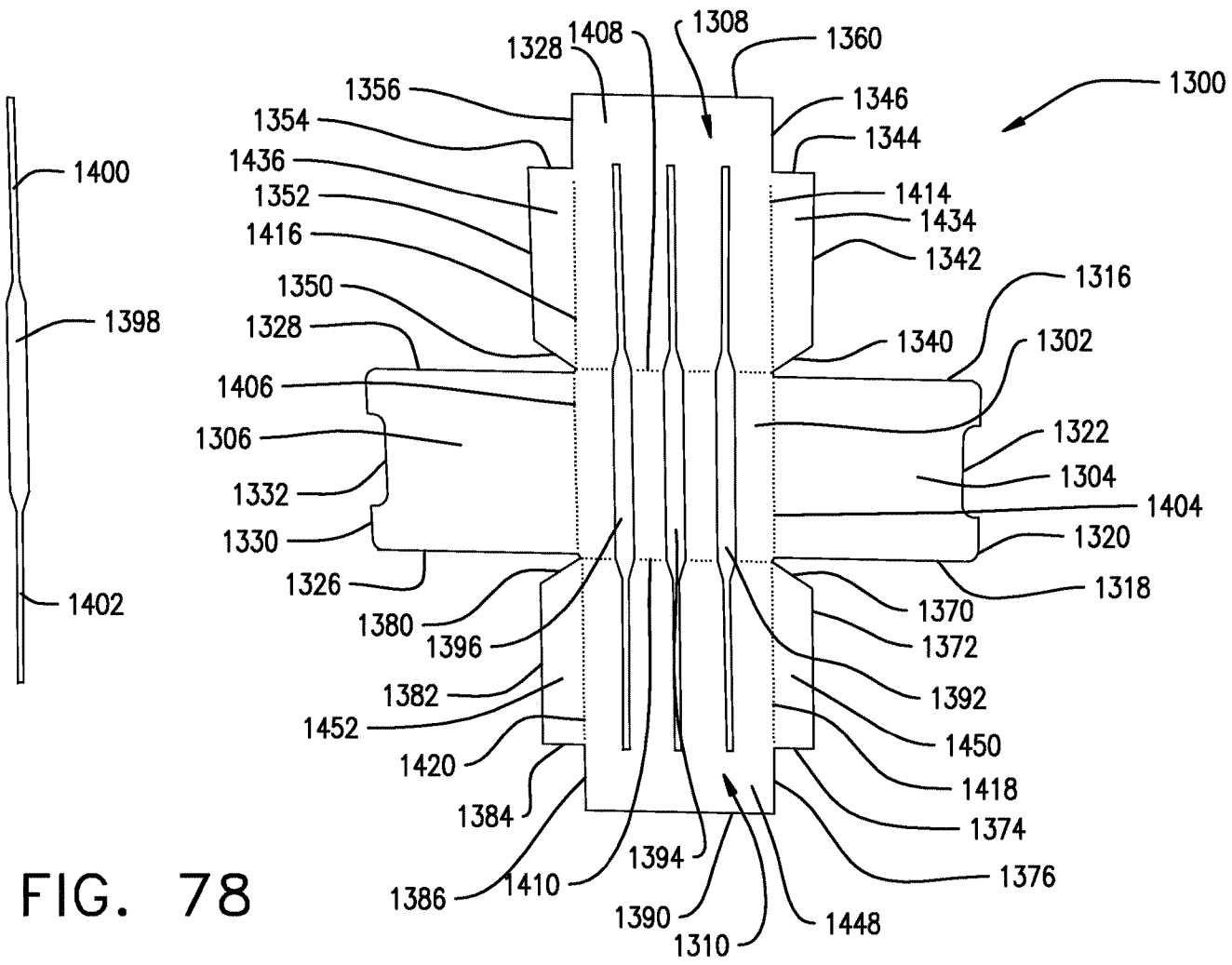
FIG. 78 is a simplified illustration of a structural insert, which is preferably die cut from animal skin.

Reference is now made to FIG. 78, which is a simplified illustration of a structural insert 1300, which is preferably die cut from animal skin, preferably parchment. The structural insert 1300 preferably includes a central, square portion 1302, having flaps 1304, 1306, 1308 and 1310 extending outwardly therefrom.

Flap 1304 preferably includes a pair of mutually parallel side edges 1316 and 1318 and an end edge 1320 having a generally rounded rectangular recess 1322 formed therein.

Flap 1306 preferably includes a pair of mutually parallel side edges 1326 and 1328 and an end edge 1330 having a generally rounded rectangular recess 1332 formed therein.

Flap 1308 includes a first side edge including an inclined edge portion 1340, a straight edge portion 1342, a perpendicular edge portion 1344, which extends perpendicular to straight edge portion 1342 and a further straight edge portion 1346. Flap 1308 also includes a second side edge including an inclined edge portion 1350, a straight edge portion 1352, a perpendicular edge portion 1354, which extends perpendicular to straight edge portion 1352 and a further straight edge portion 1356. A straight end edge 1360 joins first and second side edges.

Flap 1310 includes a first side edge including an inclined edge portion 1370, a straight edge portion 1372, a perpendicular edge portion 1374, which extends perpendicular to straight edge portion 1372 and a further straight edge portion 1376. Flap 1310 also includes a second side edge including an inclined edge portion 1380, a straight edge portion 1382, a perpendicular edge portion 1384, which extends perpendicular to straight edge portion 1382 and a further straight edge portion 1386. A straight end edge 1390 joins first and second side edges.

Structural insert 1300 is preferably formed with 3 identical, mutually spaced, mutually parallel slots designated by reference numerals 1392, 1394 and 1396 and extending through central portion 1302 and flaps 1308 and 1310. Each of slots 1392, 1394 and 1396 preferably includes a widened center portion 1398 and a pair of narrowed end portions 1400 and 1402.

Four internal fold lines 1404, 1406, 1408 and 1410 are defined, as shown, between central portion 1302 and respective flaps 1304, 1306, 1308 and 1310. Two additional internal fold lines 1414 and 1416 are defined in flap 1308 between a main portion 1328 of flap 1308 and respective side tabs thereof 1434 and 1436. Two additional internal fold lines 1418 and 1420 are defined in flap 1310 between a main portion 1448 of flap 1310 and respective side tabs thereof 1450 and 1452.

Figure 79:
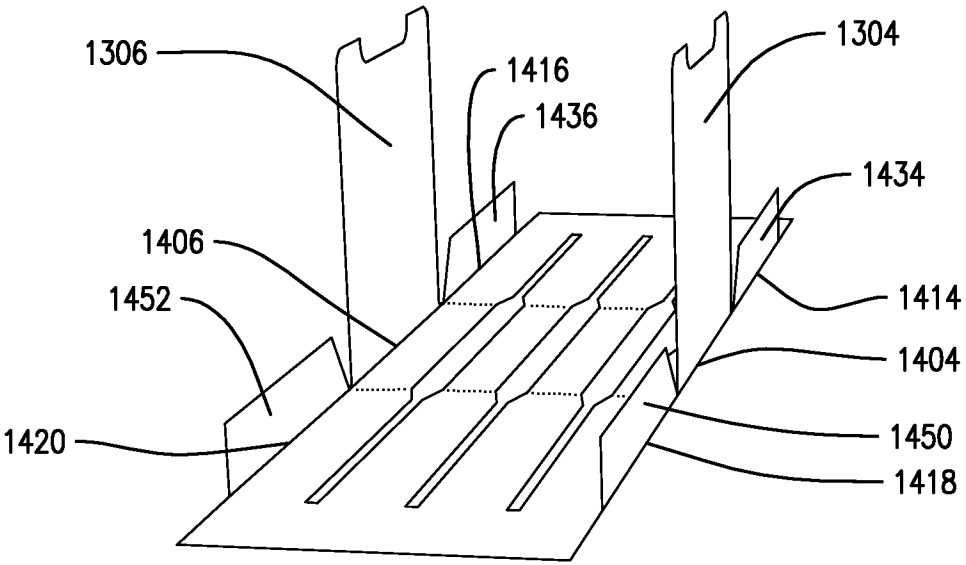
FIG. 79 is a simplified illustration showing folding of flaps and tabs about respective internal fold lines to lie generally perpendicular to the plane of the remainder of the structural insert.

FIG. 79 shows folding of flaps 1304 and 1306 and tabs 1434, 1436 and 1450 and 1452 about respective internal fold lines 1404, 1406, 1414, 1416, 1418 and 1420 to lie generally perpendicular to the plane of the remainder of the structural insert 1300.

Figure 80:
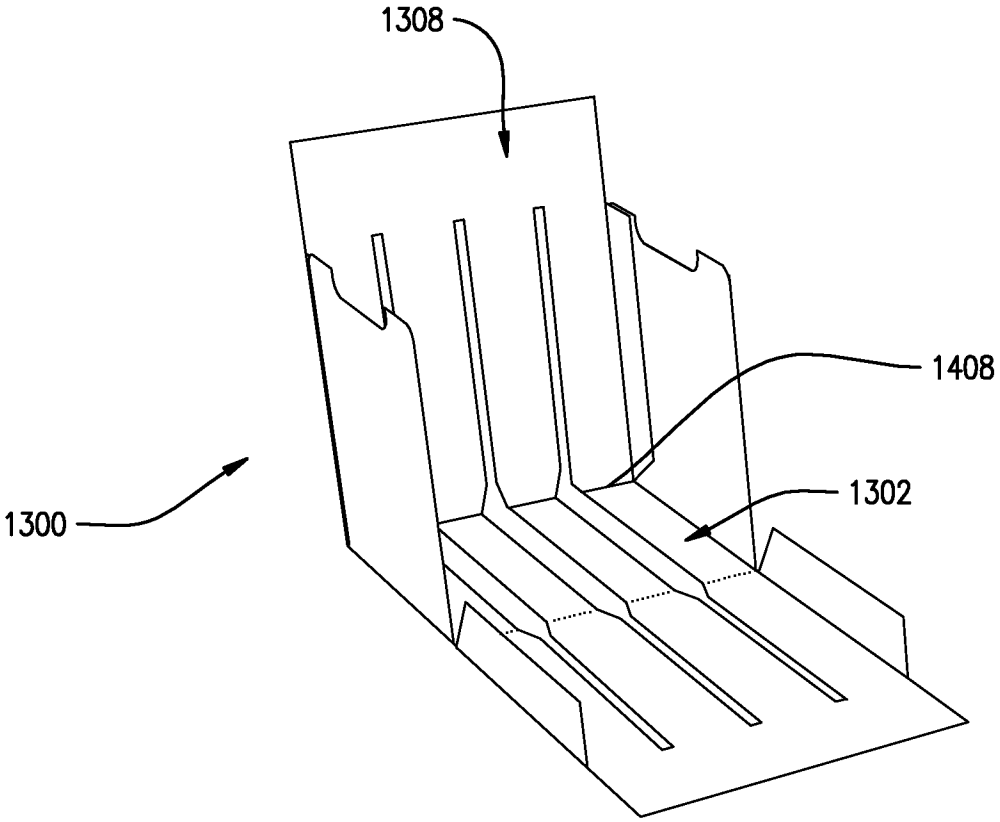
FIG. 80 is a simplified illustration showing the folding of an additional flap about internal fold line to lie generally perpendicular to the plane of the remainder of the structural insert.

FIG. 80 shows folding of flap 1308 about internal fold line 1408 to lie generally perpendicular to the plane of the remainder of the structural insert 1300.

Figure 81:
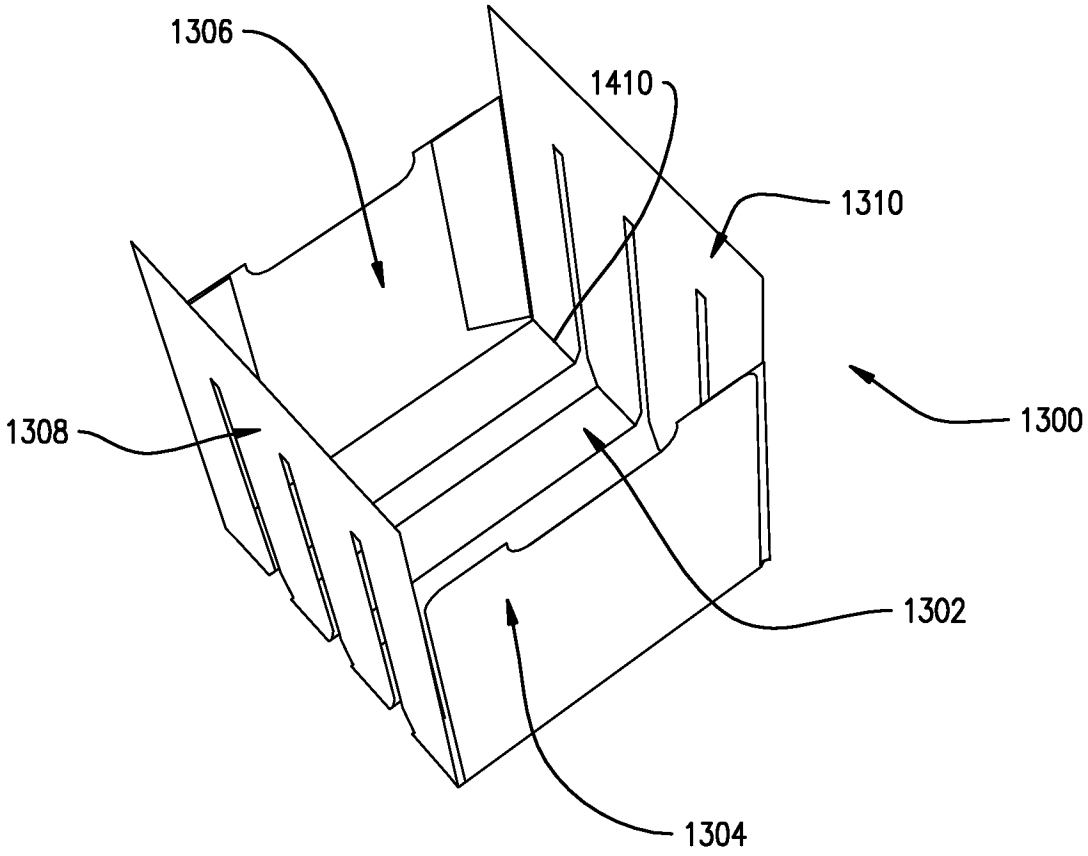
FIG. 81 is a simplified illustration showing folding of yet an additional flap about an internal fold line to lie generally perpendicular to the plane of the remainder of the structural insert.

FIG. 81 shows folding of flap 1310 about internal fold line 1410 to lie generally perpendicular to the plane of the remainder of the structural insert 1300.

Figure 82:
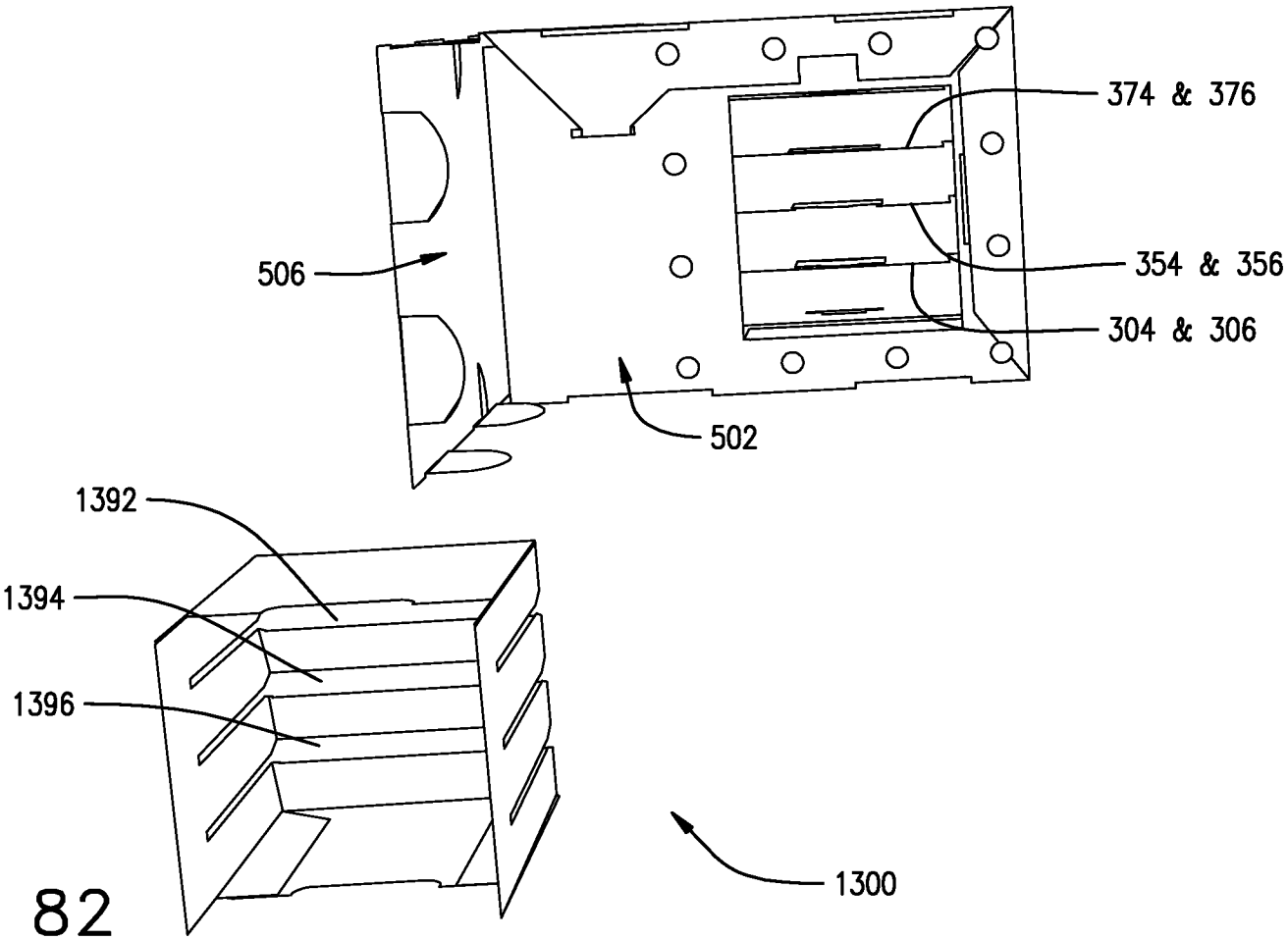
FIG. 82 is a simplified illustration which shows the structural insert having mutually spaced, mutually parallel slots and the corresponding interior of head phylactery subassembly having adjacent generally rectangular, mutually parallel compartments separated by partitions defined by respective double panels.

FIG. 82 shows the structural insert 1300 as fully external to the corresponding interior compartment of subassembly 501.

Reference is now made to FIGS. 82-85, which illustrate insertion of structural insert 1300 into the interior of subassembly 501.

FIG. 82 shows the structural insert 1300 having mutually spaced, mutually parallel slots 1392, 1394 and 1396 and the corresponding interior of subassembly 501 having adjacent generally rectangular, mutually parallel compartments 1280, 1282, 1284 and 1286, separated by partitions defined by respective double panels 364 & 374, 354 & 356, 304 & 306.

Figure 83:
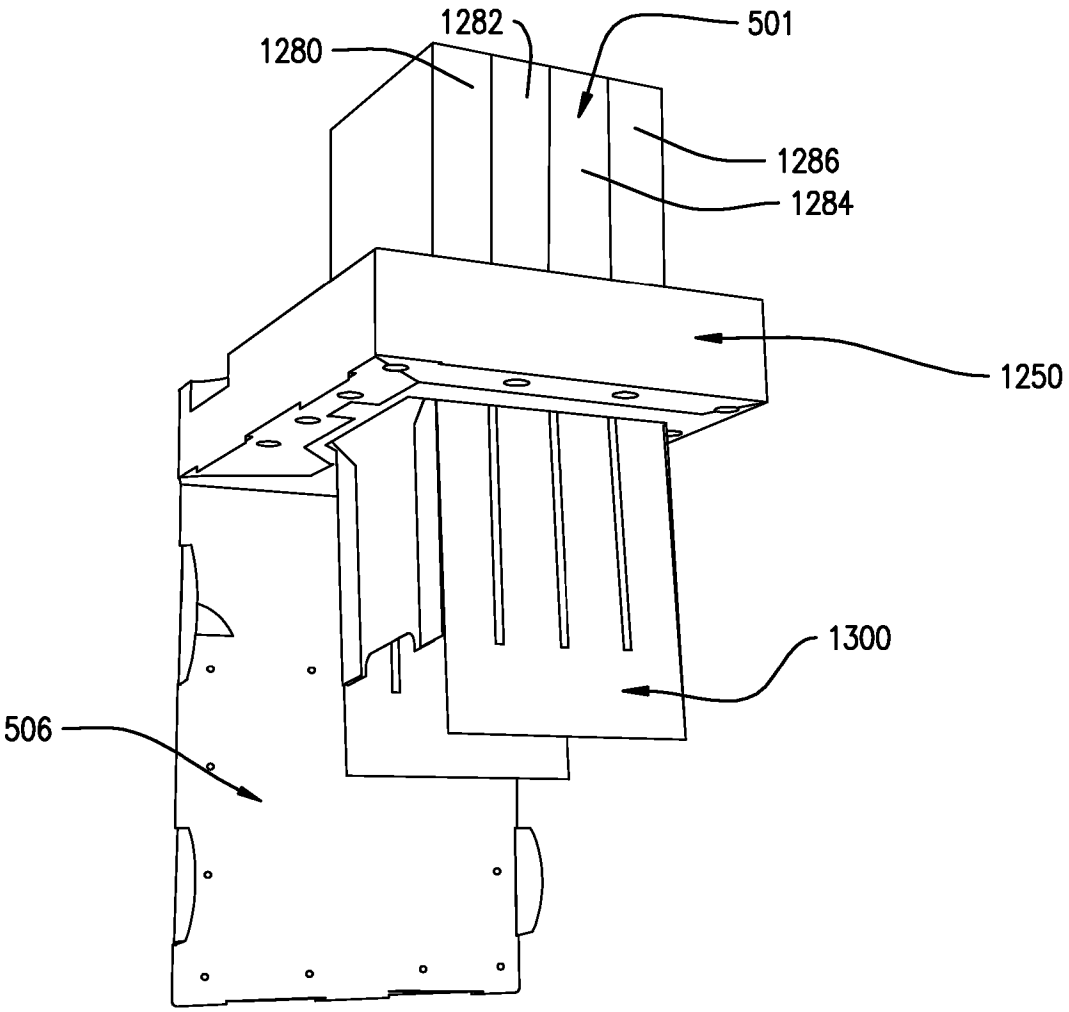
FIGS. 83 and 84 are simplified illustrations which illustrate two stages of insertion of a structural insert into the interior of the subassembly wherein partitions defined by respective double panels are inserted into mutually spaced, mutually parallel slots.
Figure 84:
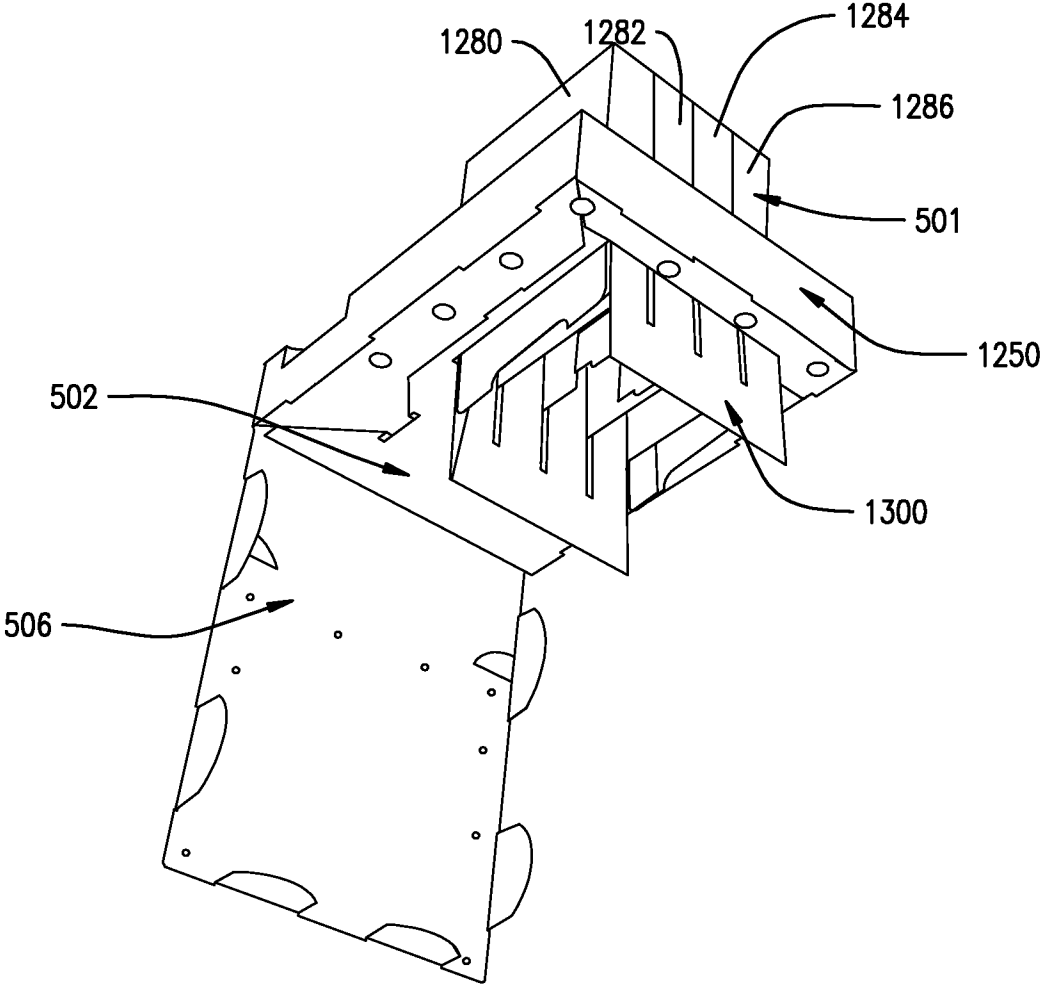

FIGS. 83 and 84 show two stages of insertion of structural insert 1300 into the interior of subassembly 501 wherein effectively partitions defined by respective double panels 364 & 374, 354 & 356, 304 & 306 are inserted into mutually spaced, mutually parallel slots 1392, 1394 and 1396.

Figure 85:
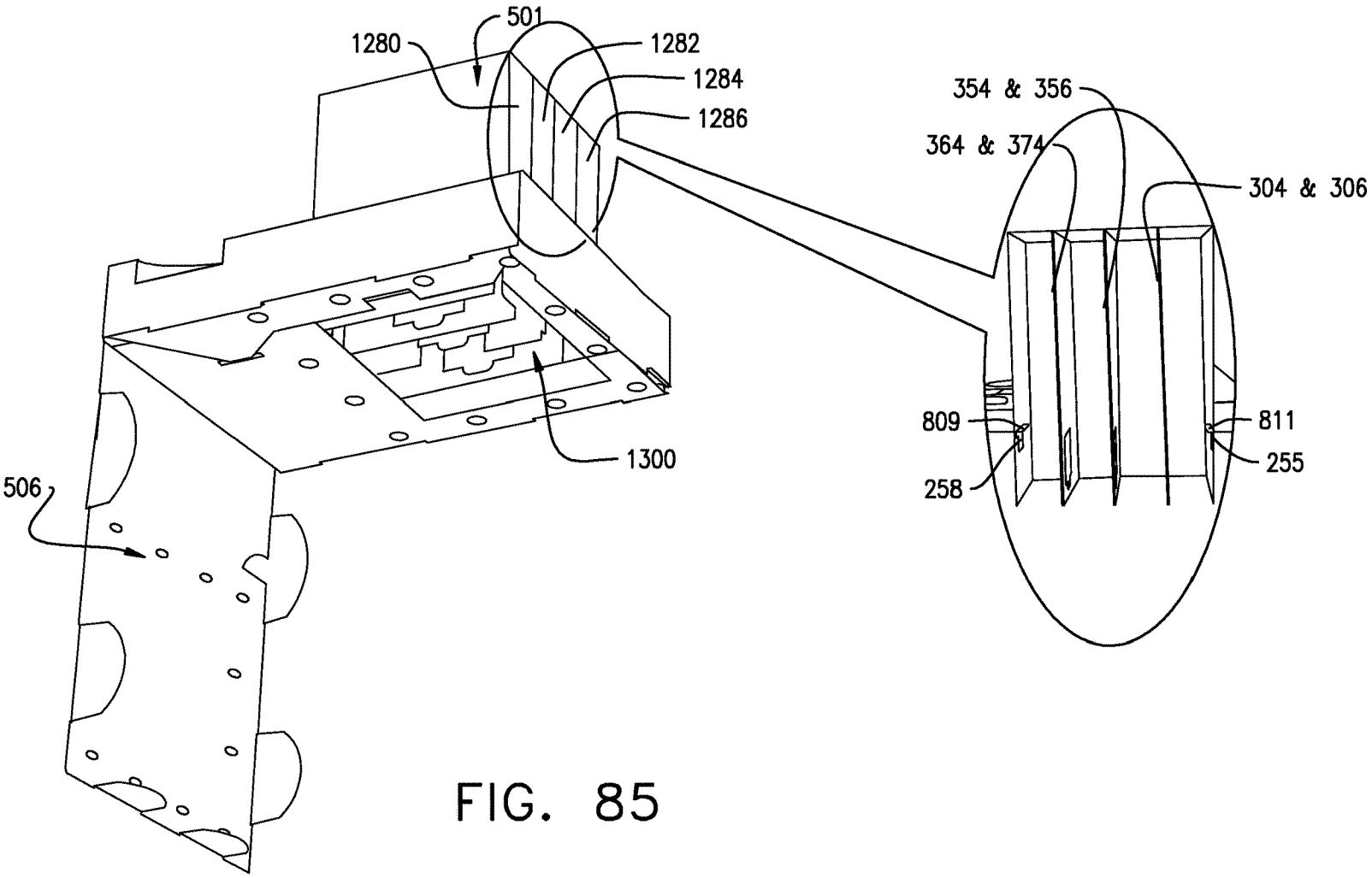
FIG. 85 is a simplified illustration showing the structural insert fully inserted into the interior of subassembly.

FIG. 85 shows the structural insert 1300 fully inserted into the interior of subassembly 501.

Figure 86:
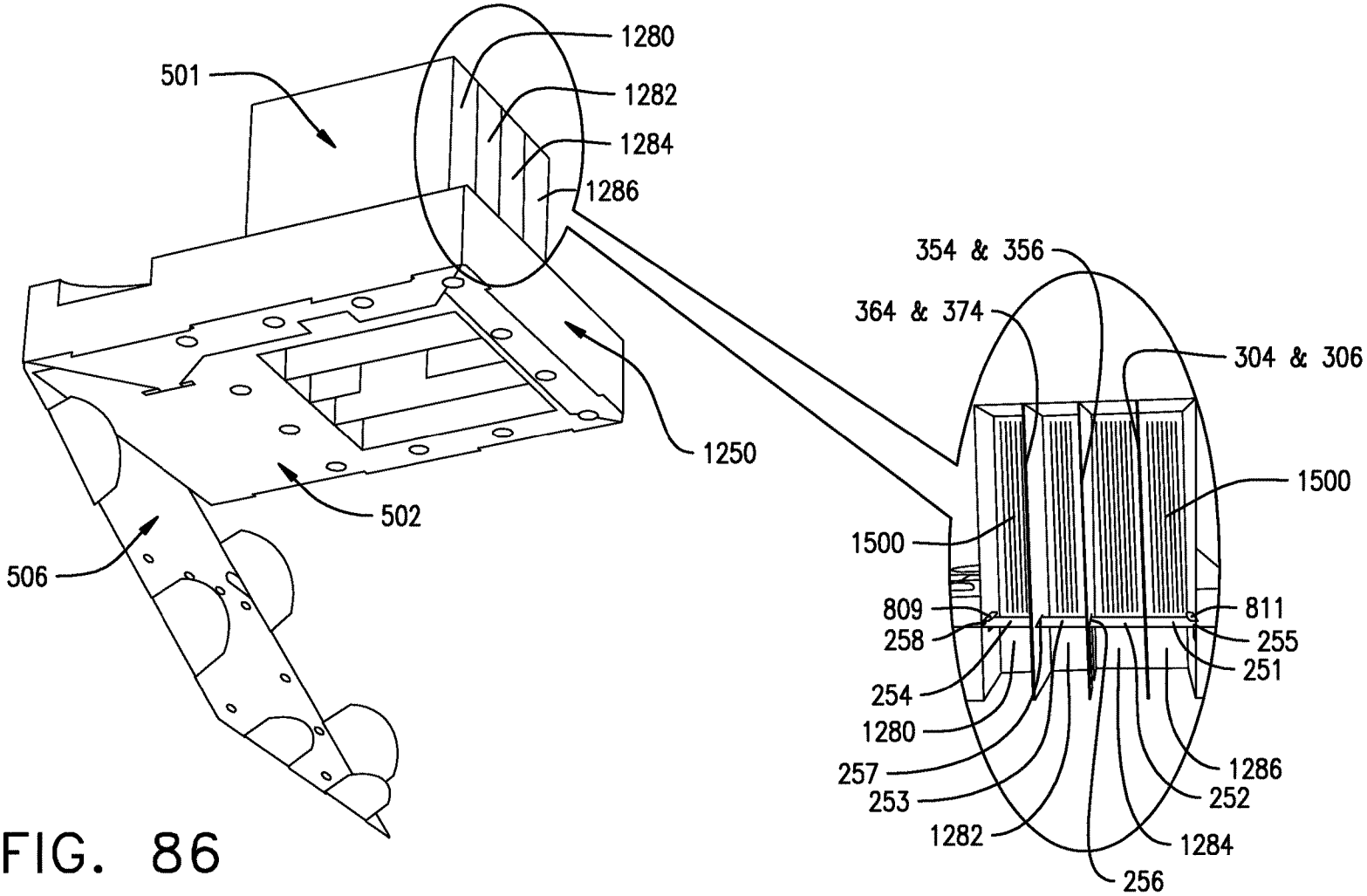
FIG. 86 is a simplified illustration showing the insertion of a phylactery parchment scroll into each of mutually parallel compartments and securing them by folding respective retaining flaps into retaining engagement with respective slots.

Reference is now made to FIG. 86, which shows insertion of a phylactery parchment scroll 1500 into each of mutually parallel compartments 1280, 1282, 1284 and 1286 and securing them by folding respective retaining flaps 251, 252, 253 and 254 into retaining engagement with respective slots 255, 256, 257 and 258. It is a particular feature of an embodiment of the present invention that when retaining flaps and tabs 251, 252, 253 and 254 engage respective slots 255, 256, 257 and 258 the transverse dimension of subassembly 501 is defined and reinforced.

Figure 87:
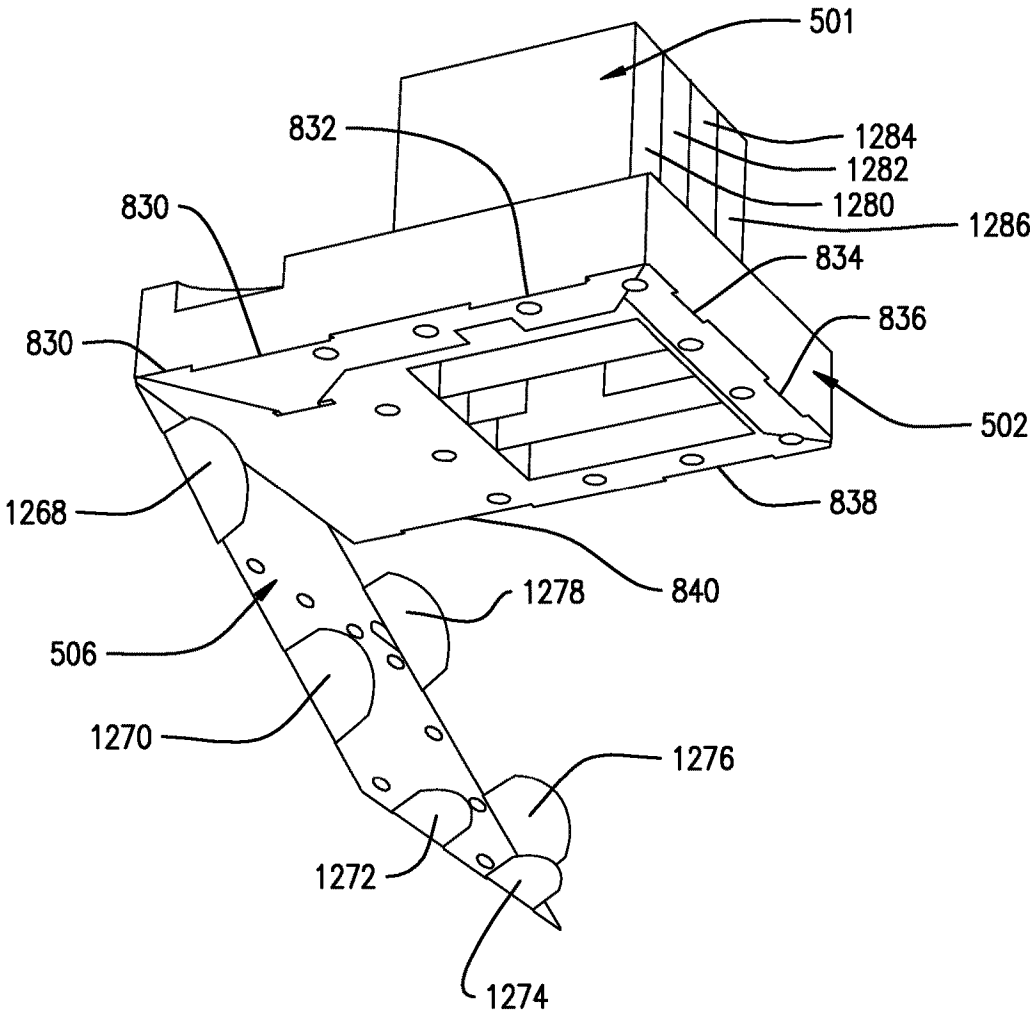
FIGS. 87 and 88 are simplified illustrations which show two stages in folding of a bottom portion having formed thereon flaps and insertion of the flaps into respective slots formed in top and side portion.
Figure 88:
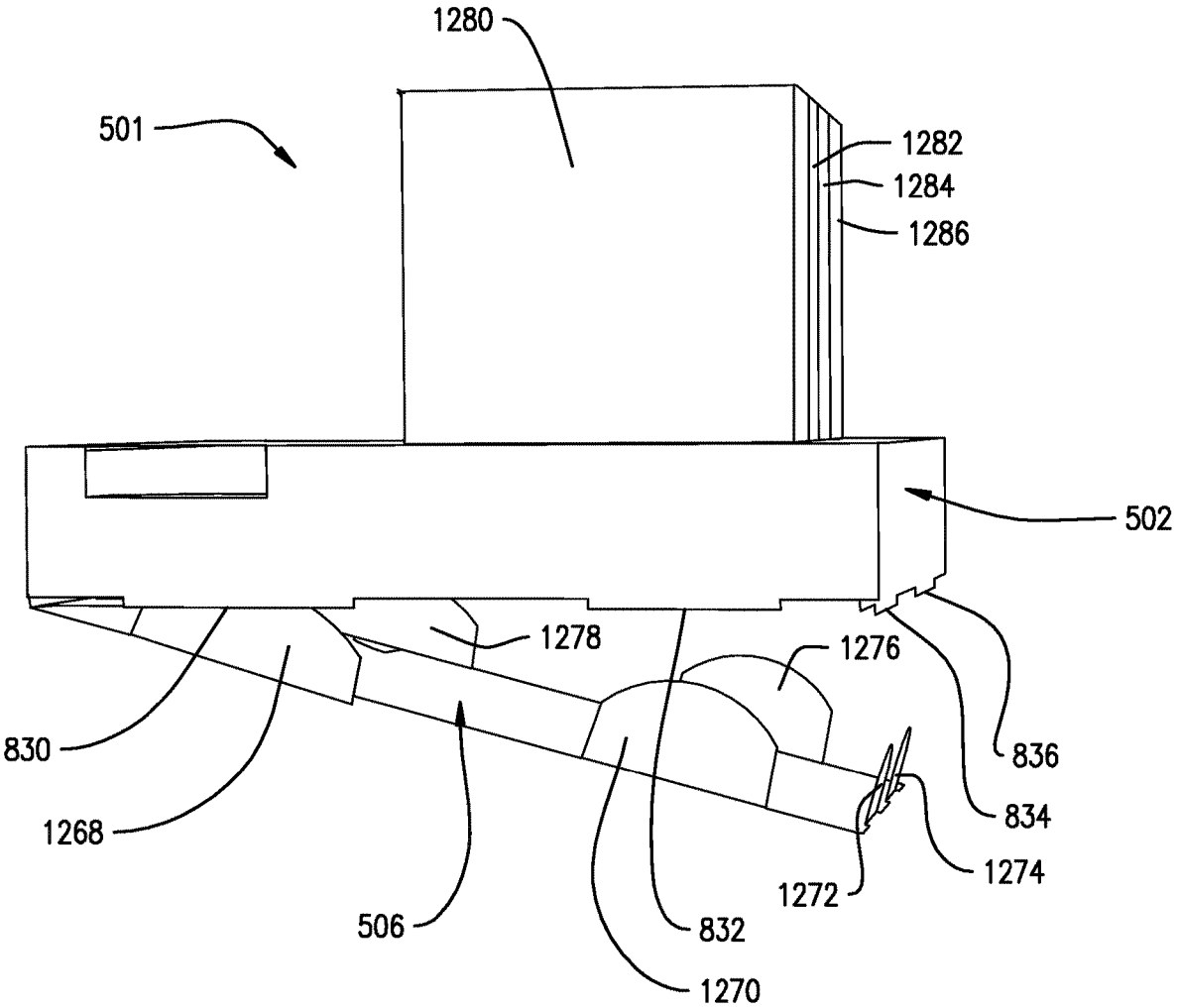
Figure 89A:
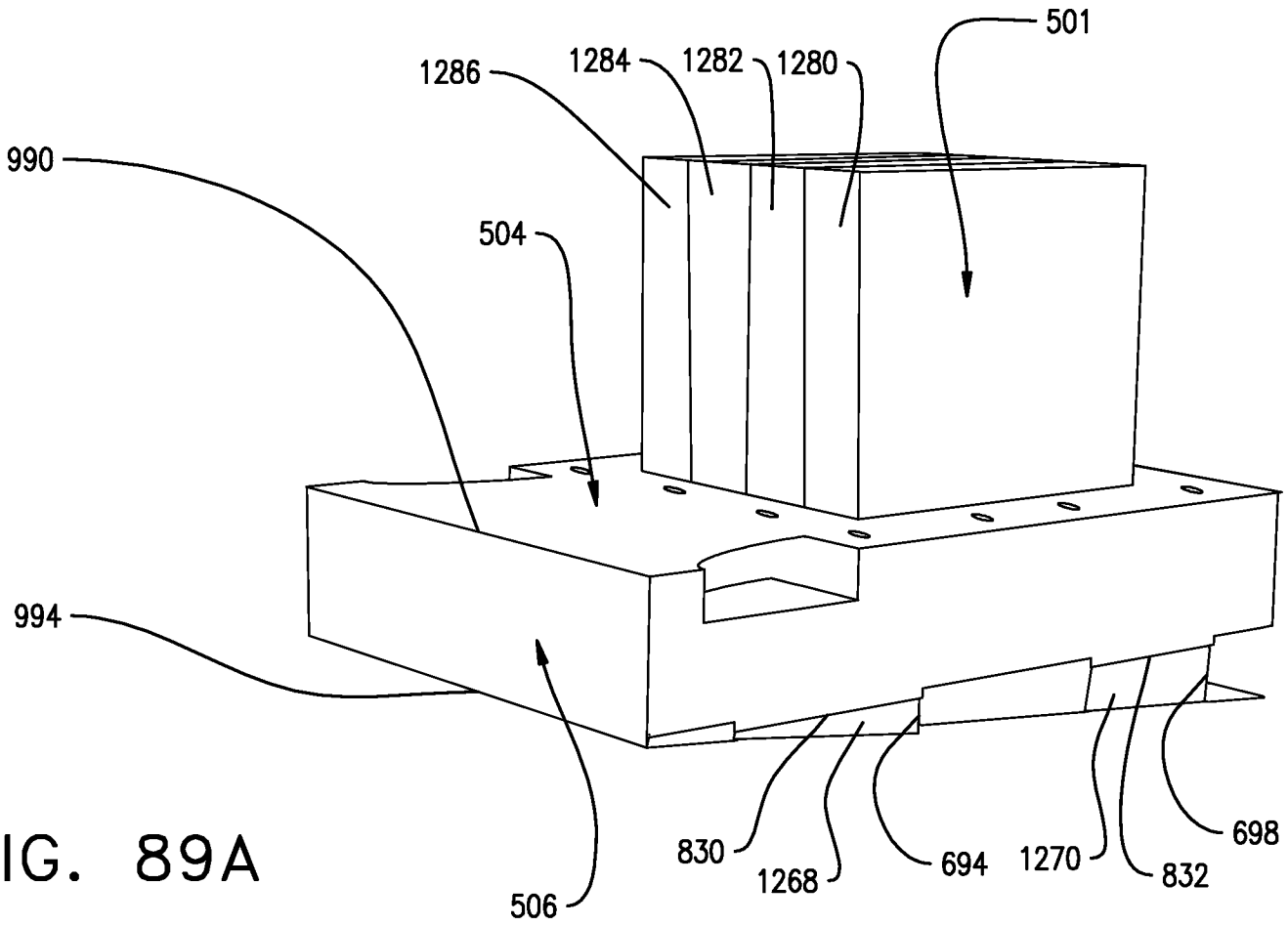
FIGS. 89A, 89B and 89C are simplified drawings which illustrate partial insertion of flaps into respective slots formed in top and side portion from three different directions.
Figure 89B:
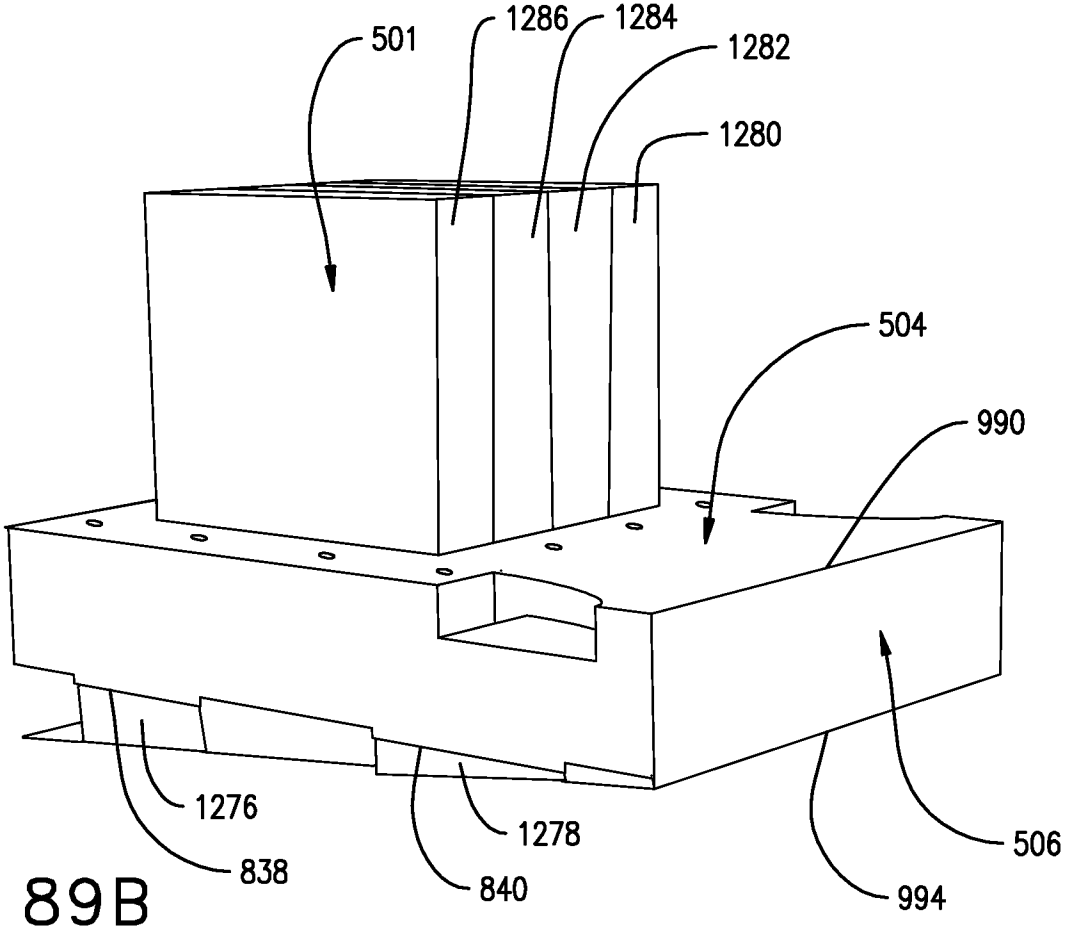
Figure 89C:
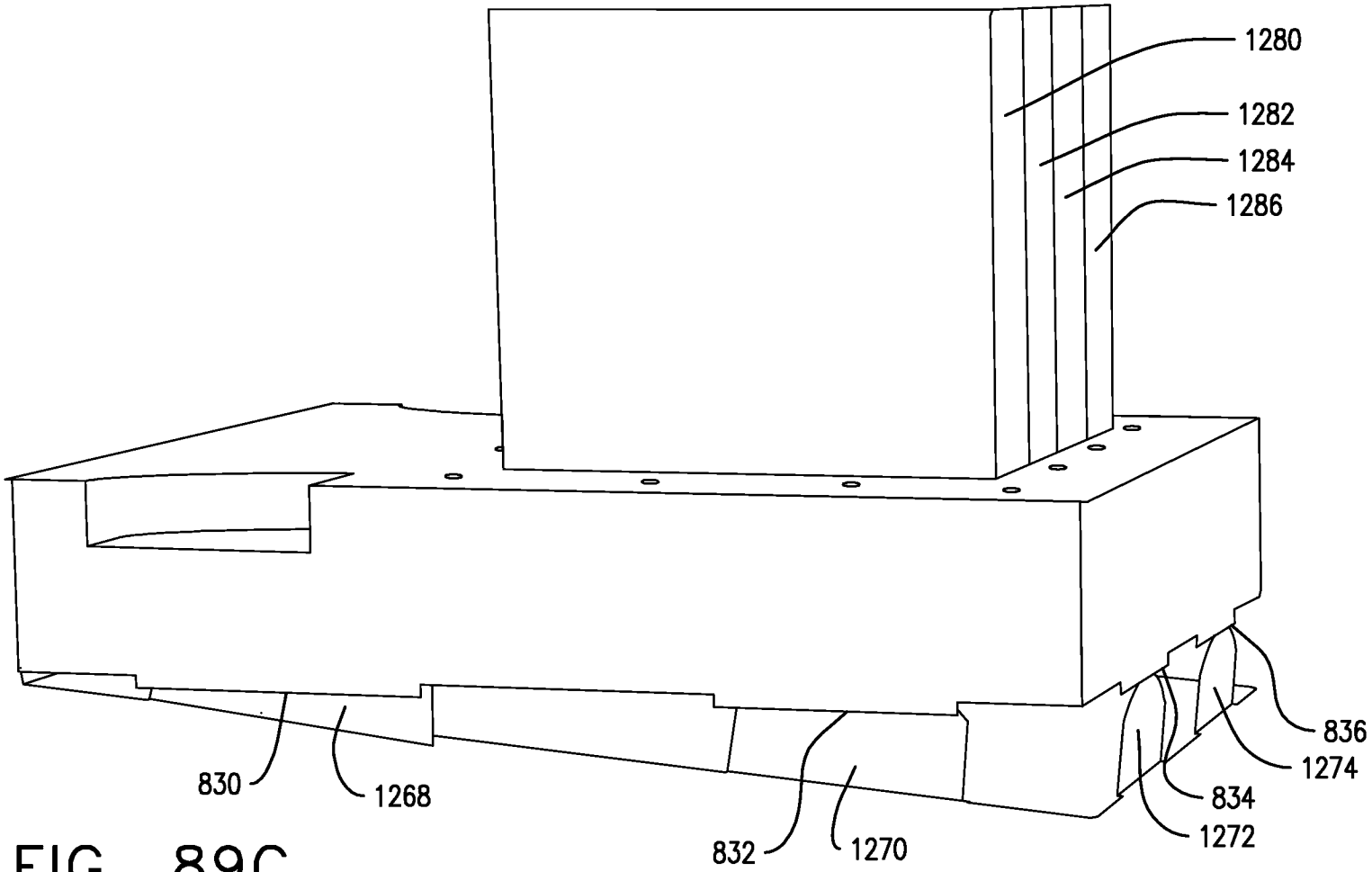

Reference is now made to FIGS. 87-89C, which illustrate closure of the base of the head phylactery. FIGS. 87 and 88 show two stages in folding of bottom portion 506 having formed thereon flaps 1268, 1270, 1272, 1274, 1276 and 1278 and insertion of flaps 1268, 1270, 1272, 1274, 1276 and 1278 into respective slots defined by respective flap receiving cuts 830, 832, 834, 836, 838 and 840, formed in top and side portion 504. FIGS. 89A, 89B and 89C show partial insertion of flaps 1268, 1270, 1272, 1274, 1276 and 1278 into respective slots defined by respective flap receiving cuts 830, 832, 834, 836, 838 and 840, formed in top and side portion 504 from three different directions.

Figure 90:
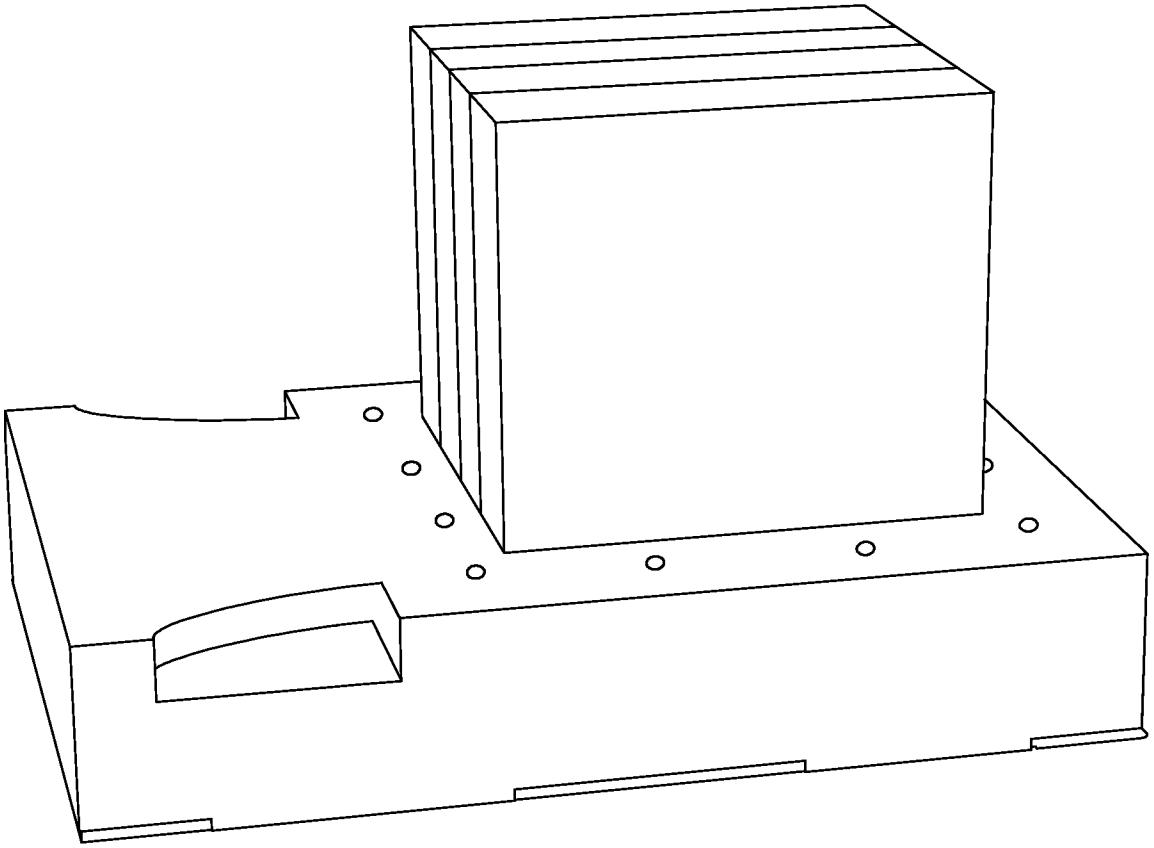
FIG. 90 is a simplified illustration showing a complete head phylactery which is ready to be sewn and associated with leather straps.

FIG. 90 shows a complete head phylactery which is then sewn together and associated with leather straps.

Figure 91:
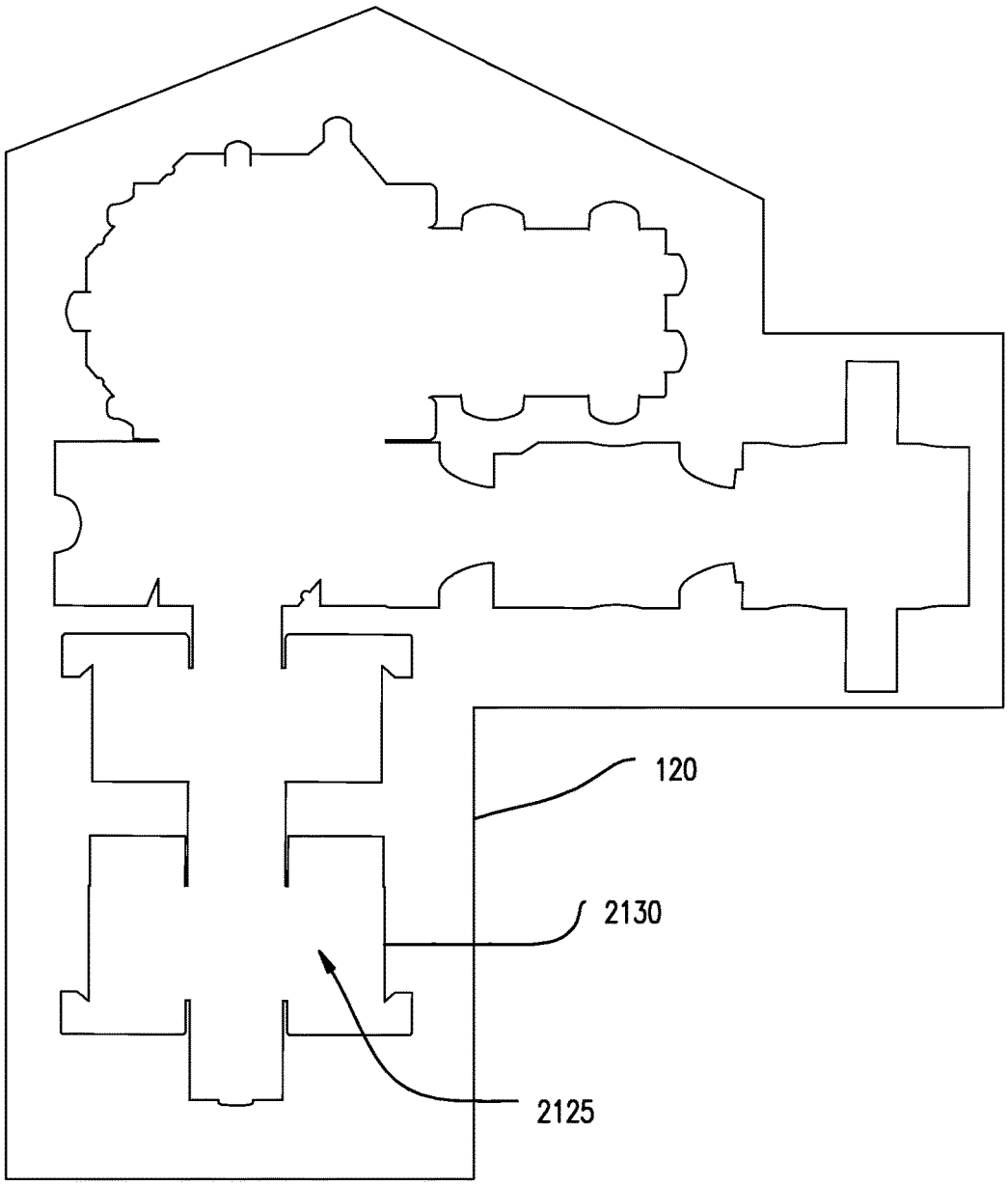
FIG. 91 is a simplified illustration of a second stage hand phylactery workpiece following cutting, preferably but not necessarily, die cutting, thereof from the initial stage hand phylactery workpiece and showing, for simplicity only the outline cut lines.

Reference is now made to FIG. 91, which is a simplified illustration of a second stage hand phylactery workpiece 2125 following cutting, preferably but not necessarily, die cutting, thereof from the initial stage hand phylactery workpiece 120 and showing, for simplicity only outline cut lines 2130, which correspond to outline cut lines 130 (FIG. 2).

Figure 92:
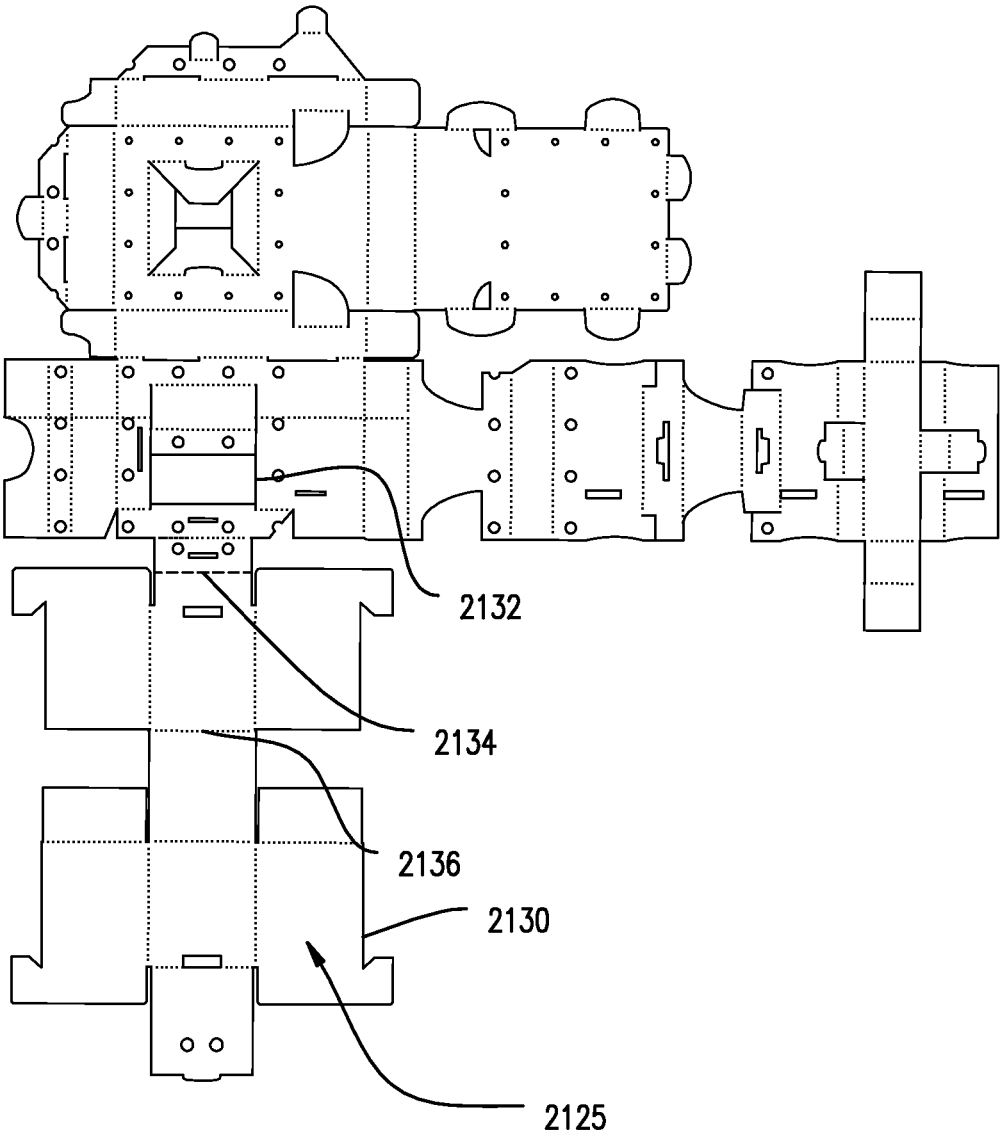
FIG. 92 is a simplified illustration of an exterior side of the secondary stage hand phylactery workpiece separated from the remainder of the initial stage hand phylactery workpiece.

Reference is also made to FIG. 92, which is a simplified illustration of an exterior side of the secondary stage hand phylactery workpiece 2125 of FIG. 91, separated from the remainder of the initial stage hand phylactery workpiece 120.

It is a particular feature of an embodiment of the present invention that cutting, preferably die cutting, of the second stage hand phylactery workpiece 2125 from the initial stage hand phylactery workpiece 120 provides in the same die cutting step not only outline cut lines 2130 but also interior cut lines 2132, perforated lines 2134 and incised lines 2136 which are formed in an exterior surface of the second stage hand phylactery workpiece 2125, normally corresponding to the exterior-facing surface of the animal skin from which the parchment was made.

The outline cut lines 2130 and the interior cut lines 2132 are shown throughout as solid lines, while the perforated lines 2134 are shown throughout as dashed lines, until they are folded, and the incised lines 2136 are shown throughout as dotted lines, until they are folded. After folding, both the perforated lines 2134 and the incised lines 2136 are shown as solid lines.

The perforated lines 2134 are designed for exterior folds, while the incised lines 2136, which are partially cut into the second stage hand phylactery workpiece 2125 from the exterior and typically extend through about two thirds of the thickness of the second stage hand phylactery workpiece 2125, are designed for interior folds. It is appreciated that the incised lines 2136 are only foldable as interior folds. It is also appreciated that perforated lines 2134 are foldable as interior or exterior folds.

It is a particular feature of an embodiment of the present invention that incised lines 2136 are employed only for interior folds rather than scribed, perforated, stamped, marked, embossed or otherwise designated lines, which may be folded in both directions.

Figure 93:
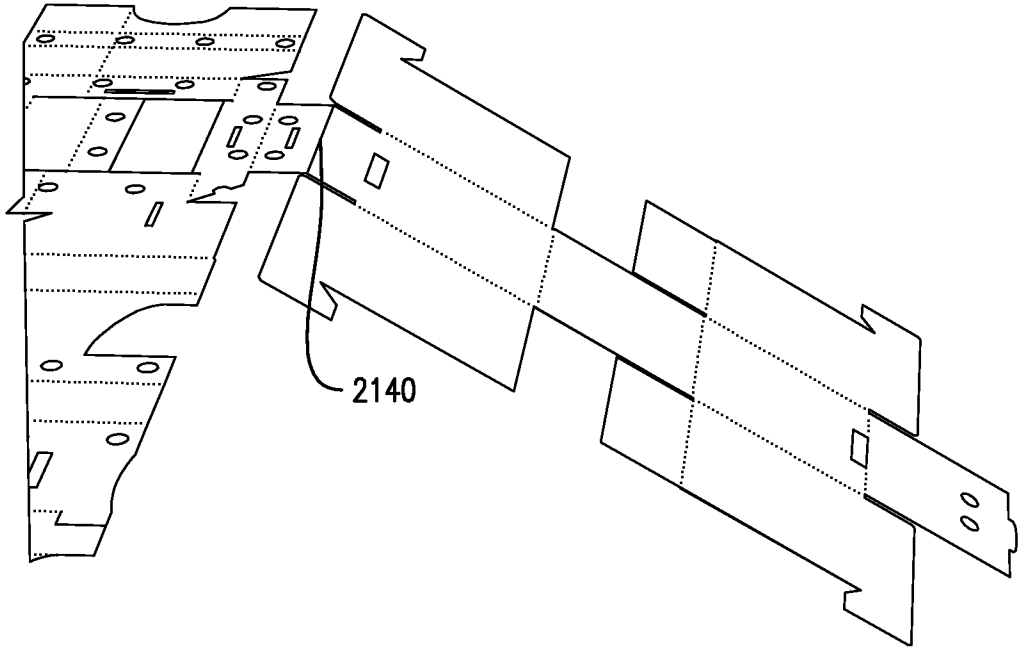
FIG. 93 is a simplified illustration of an initial exterior crease along a perforated line.

Reference is now made to FIG. 93, which is a simplified illustration of an initial exterior crease along a perforated line, here designated by reference numeral 2140. It is noted that this crease is produced by a temporary fold along line 2140. In FIGS. 93-101, the perforated line 2134 is seen and shown throughout as a dashed line and the incised lines 2136 are not seen and are nevertheless shown throughout as dotted lines.

Figure 94:
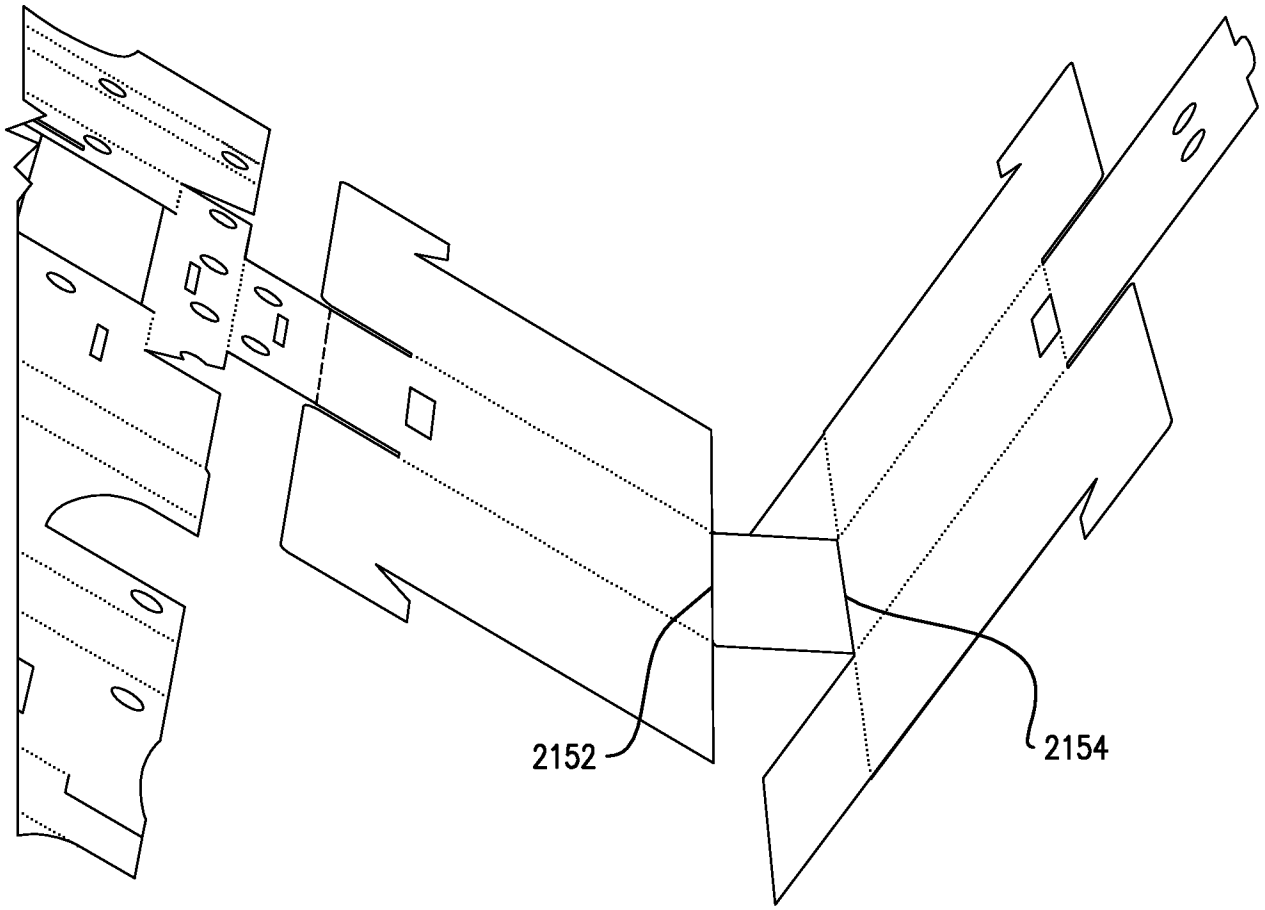
FIG. 94 is a simplified illustration of a temporary folding of two interior folds, each along respective incised lines.

Reference is now made to FIG. 94, which is a simplified illustration of a temporary folding of two interior folds, each along respective incised lines. The two interior folds are designated by respective reference numerals 2152 and 2154.

Figure 95:
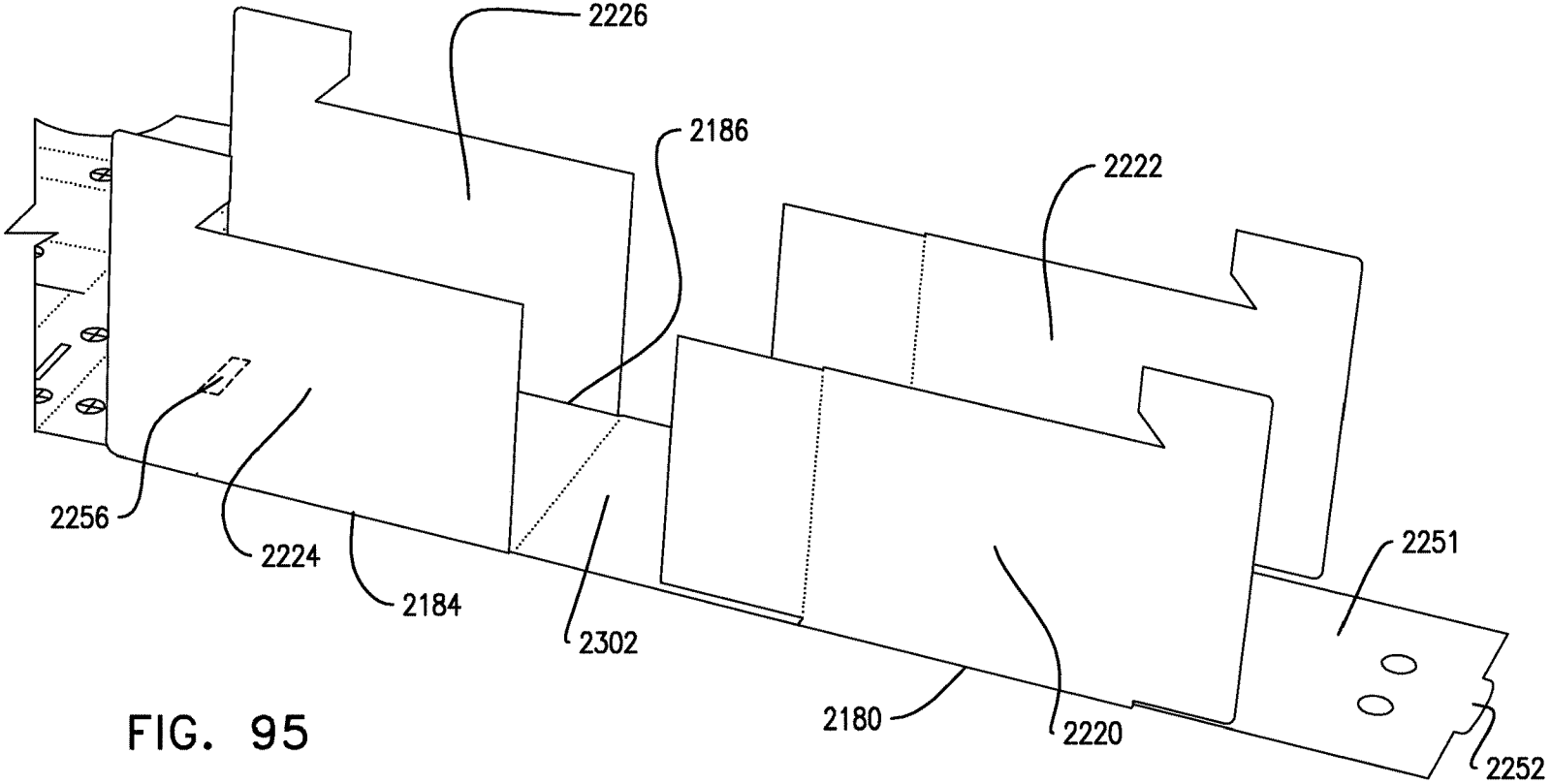
FIG. 95 is a simplified illustration of the temporary unfolding of the two interior folds and the folding of four side interior folds.

It is appreciated that following formation of the two interior folds 2152 and 2154, the two interior folds are temporarily unfolded and four side interior folds are formed as illustrated in FIG. 95. The four side interior folds are formed along incised lines 2180, 2182 (not seen), 2184 and 2186, and define respective side flaps 2220, 2222, 2224 and 2226 such that the side flaps are generally perpendicular to the remainder of interior surface of the second stage hand phylactery workpiece 2125. Additionally, a retaining flap 2251 is defined, as is corresponding rectangular flap end tab 2252 and tab receiving slot 2256 (shown as a dashed line).

Figure 96:
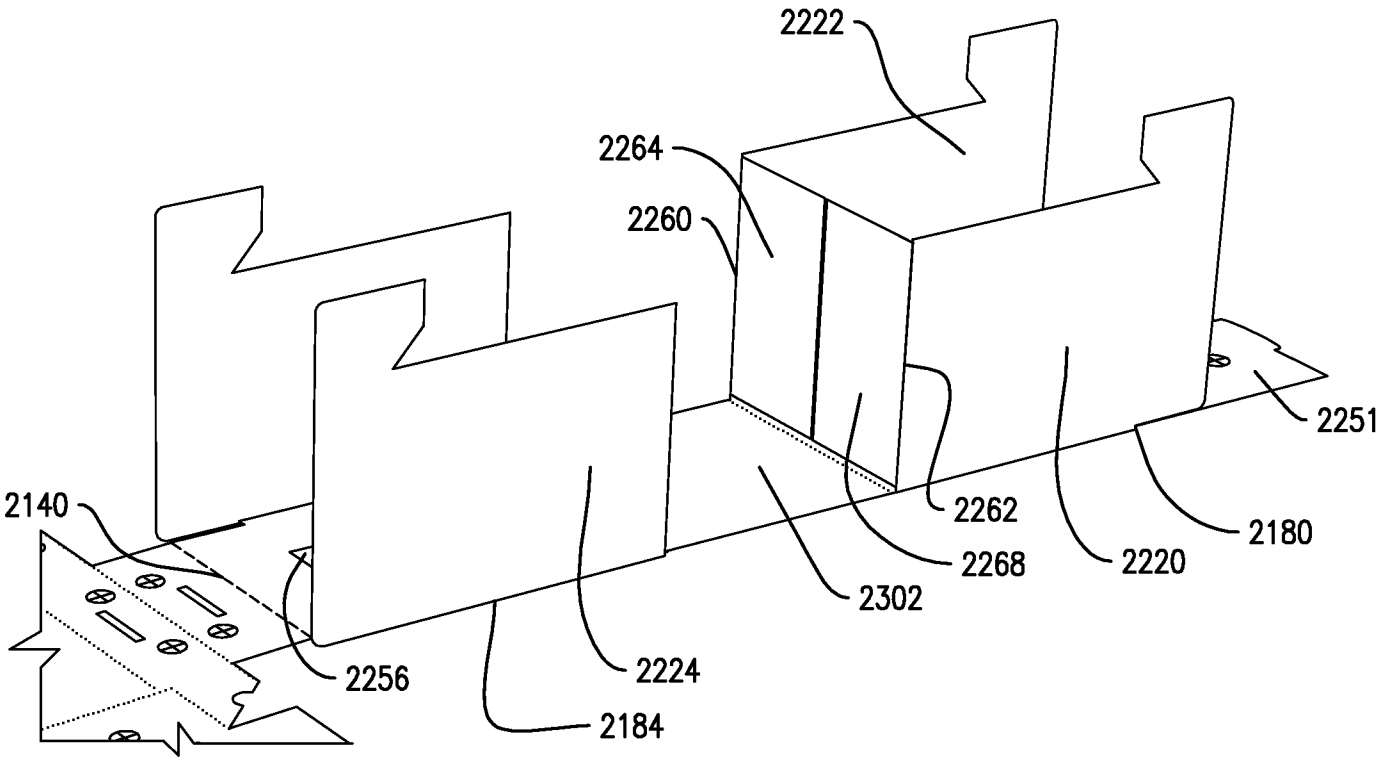
FIG. 96 is a simplified illustration of two interior flap folds.

It is further appreciated that following formation of the four side flaps 2220, 2222, 2224 and 2226, two interior flap folds 2264 and 2268 are formed as illustrated in FIG. 96. The two interior flap folds are formed along respective incised lines 2260 and 2262 such that the two interior flap folds are generally perpendicular to both the four side flaps 2220, 2222, 2224 and 2226 and also to the remainder of interior surface of the second stage hand phylactery workpiece 2125.

Figure 97:
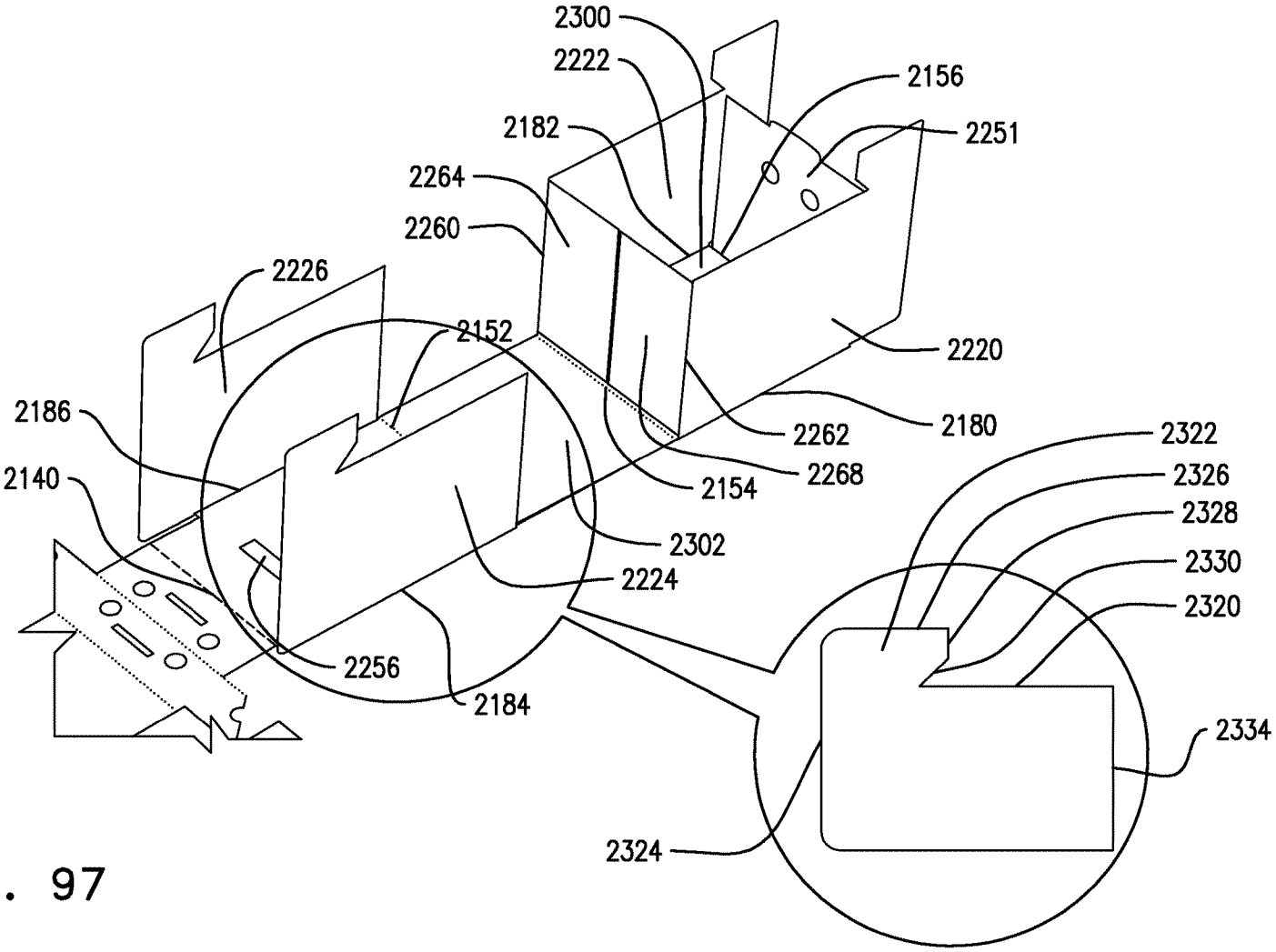
FIG. 97 is a simplified illustration of the folding of a retaining flap on incised interior fold line.

It is further appreciated that following formation of the four side flaps 2220, 2222, 2224 and 2226 and two interior flap folds 2264 and 2268, a retaining flap 2251 is folded on incised interior fold line 2156, as illustrated in FIG. 97, such that the retaining flap 2251 is generally perpendicular to both the four side flaps 2220, 2222, 2224 and 2226 and to the remainder of interior surface of the second stage hand phylactery workpiece 2125 and generally parallel to the two interior flap folds 2264 and 2268.

In an enlargement on FIG. 97, it is seen that side flaps 2220, 2222, 2224 and 2226 are each formed with a rectangular portion 2320 and a widened end portion 2322. Widened end portion 2322 includes an end edge 2324 a top edge 2326 generally perpendicular to end edge 2324, a upper side edge 2328 generally parallel to end edge 2324 and an inclined edge 2330 extending from upper side edge 2328 to a top edge 332 of elongate portion 320. Elongate portion 2320 also has an end edge 2334.

Figure 98:
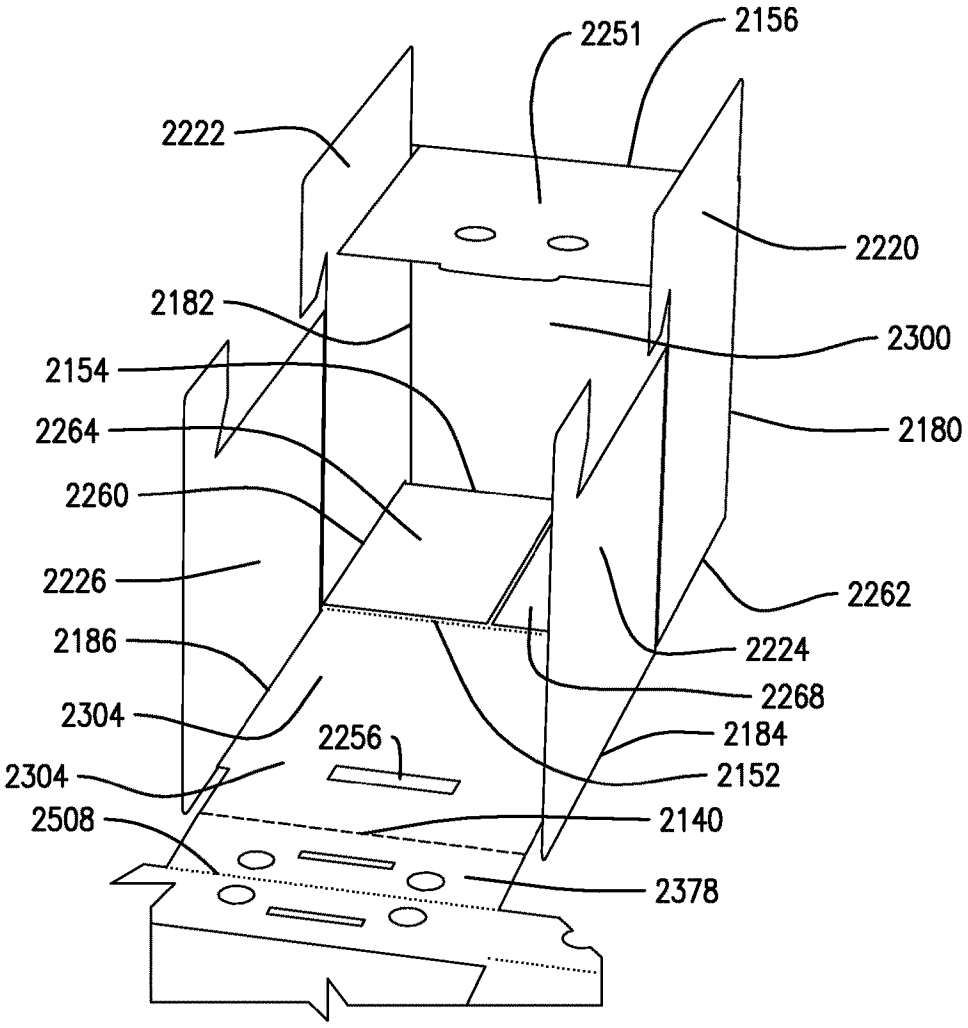
FIG. 98 is a simplified illustration of a first interior fold is formed along an incised line such that a first interior panel surface lies generally at 90 degrees with respect to a an interior intermediate surface which is adjacent and exterior to two interior flap folds.

It is additionally appreciated that following formation of the two interior flap folds and the interior retaining flap fold, a first interior fold is formed along incised line 2154 as illustrated in FIG. 98. As seen in FIG. 98, a first interior panel surface 2300 lies generally at 90 degrees with respect to a first interior intermediate surface 2302 (not seen) which is adjacent and exterior to two interior flap folds 2264 and 2268. A first interior panel surface 2300 also lies generally at 90 degrees with respect to a second interior panel surface 2304.

Figure 99:
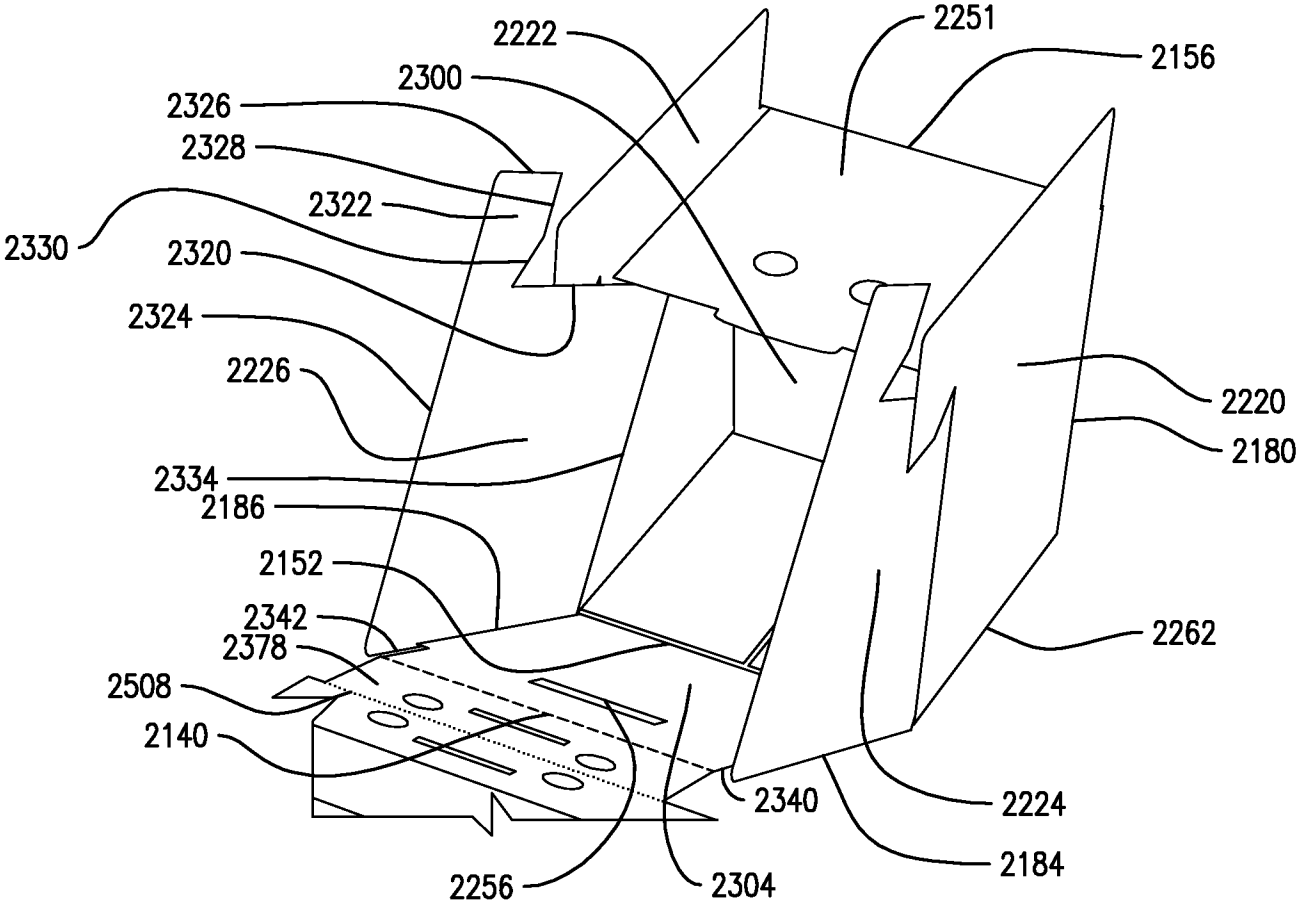
FIG. 99 is a simplified illustration of a partial second interior fold along incised line and shows first interior intermediate surface angled at about 150 degrees with respect to second interior panel surface.

FIG. 99 is a simplified illustration of a partial second interior fold along incised line 2152 and shows first interior intermediate surface 2302 angled at about 150 degrees with respect to second interior panel surface 2304, such that first interior panel surface 2300 is angled at about 30 degrees with respect to the second interior panel surface 2304. It is appreciated that side flaps 2224 and 2226 are positioned adjacent and interior of corresponding side flaps 2222 and 2220.

Figure 100:
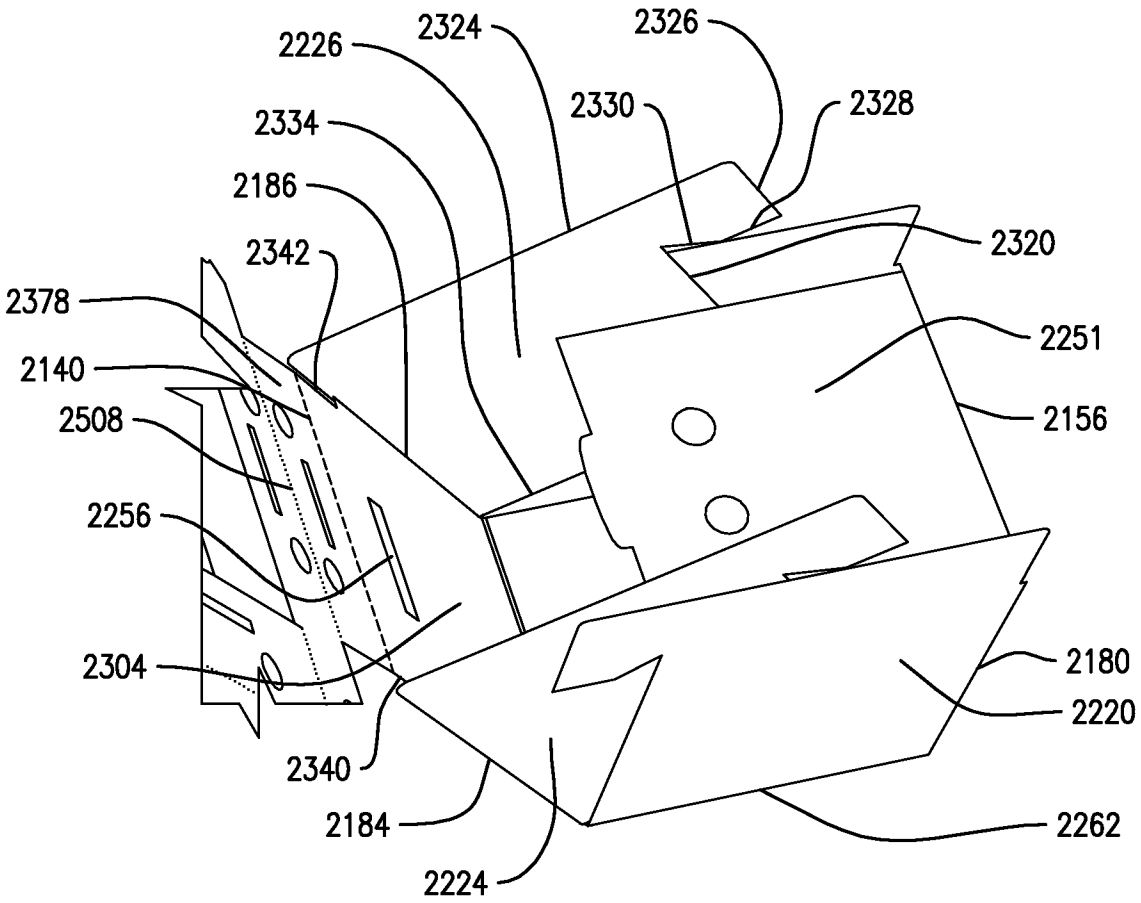
FIG. 100 is a simplified illustration of the partial second interior fold further but not completely folded.

Reference is now made to FIG. 100, which is a simplified illustration of the partial second interior fold further, but not completely, folded. FIG. 100 shows first interior intermediate surface 2302, angled at about 120 degrees with respect to second interior panel surface 2304, such that first interior panel surface 2300 is angled at about 15 degrees with respect to the second interior panel surface 2304.

Figure 101:
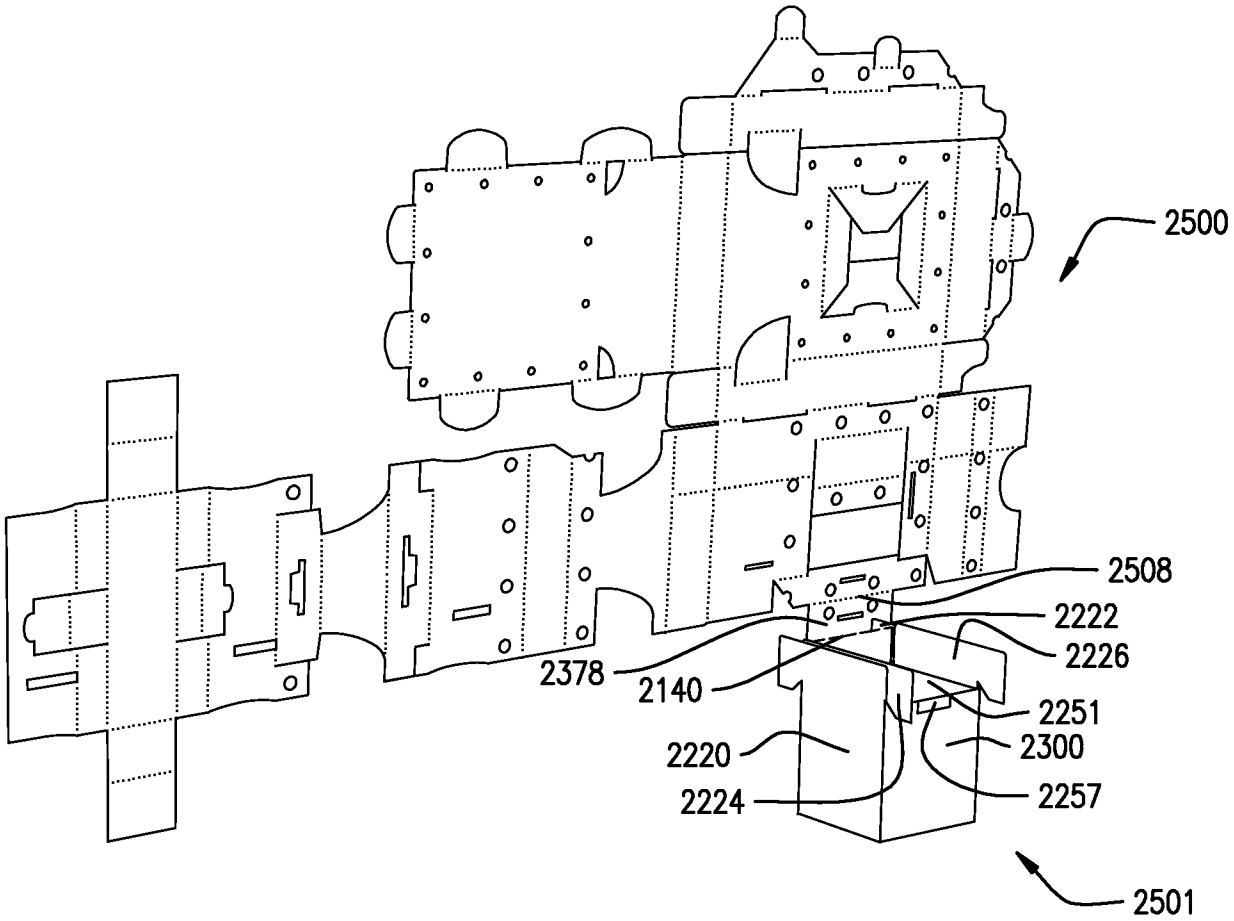
FIG. 101 is a simplified illustration of the second interior fold completely folded such at the first and second interior panel surfaces are generally mutually parallel and perpendicular to an interior intermediate surface.

Reference is now made to FIG. 101, which is a simplified illustration of the second interior fold, completely folded, such that the first and second interior panel surfaces 2300 and 2304 (not seen) are generally mutually parallel and perpendicular to interior intermediate surface 2302 (not seen).

Returning briefly to FIGS. 93-101, it is noted that side flaps 2224 and 2226 are each formed with a rectangular portion 2320 and a widened end portion 2322. Widened end portion 2322 includes an end edge 2324 a top edge 2326 generally perpendicular to end edge 2324, a upper side edge 2328 generally parallel to end edge 2324 and an inclined edge 2330 extending from upper side edge 2328 to a top edge 332 of elongate portion 320. Elongate portion 2320 also has an end edge 2334.

It is further noted with reference to FIGS. 93-101 that various interior cut lines 132 define, inter alia, slits 2340 and 2342 extending partially along fold lines 2184 and 2186 respectively between first interior panel surface 2304 and respective side flaps 2224 and 2226.

Considering FIGS. 93-101, it is seen that elongate portions 2320 of side flaps 2224 and 2226 are positioned adjacently and interiorly of corresponding side flaps 2220 and 2222. It is a particular feature of an embodiment of the present invention that a dimension of widened end portions 2322 have a dimension which is generally the same as the interior dimension of the space between the top portion of top and side portion 2504 and the bottom portions of internal structural portion 2502, when they are fully folded as shown in FIG. 146.

Figure 102:
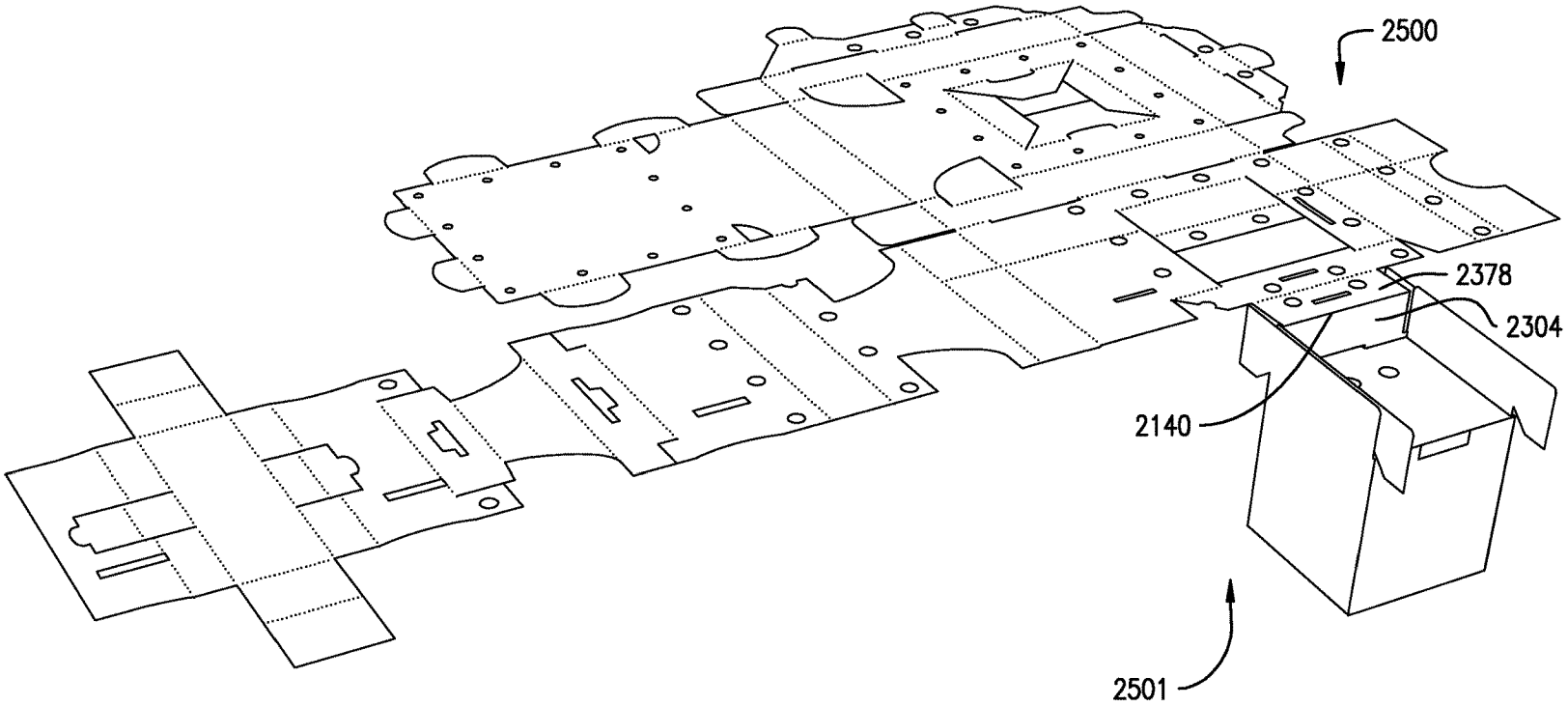
FIG. 102 is a simplified illustration which shows an exterior fold completely folded in a 90 degree fold along a perforated exterior fold line such that interior intermediate surface lies generally perpendicular to an interior panel surface.

Reference is made to FIG. 102, which shows an exterior fold completely folded in a 90 degree fold along a perforated exterior fold line 2140 such that interior intermediate surface 2378 lies generally perpendicular to interior panel surface 2304.

Figure 103A:
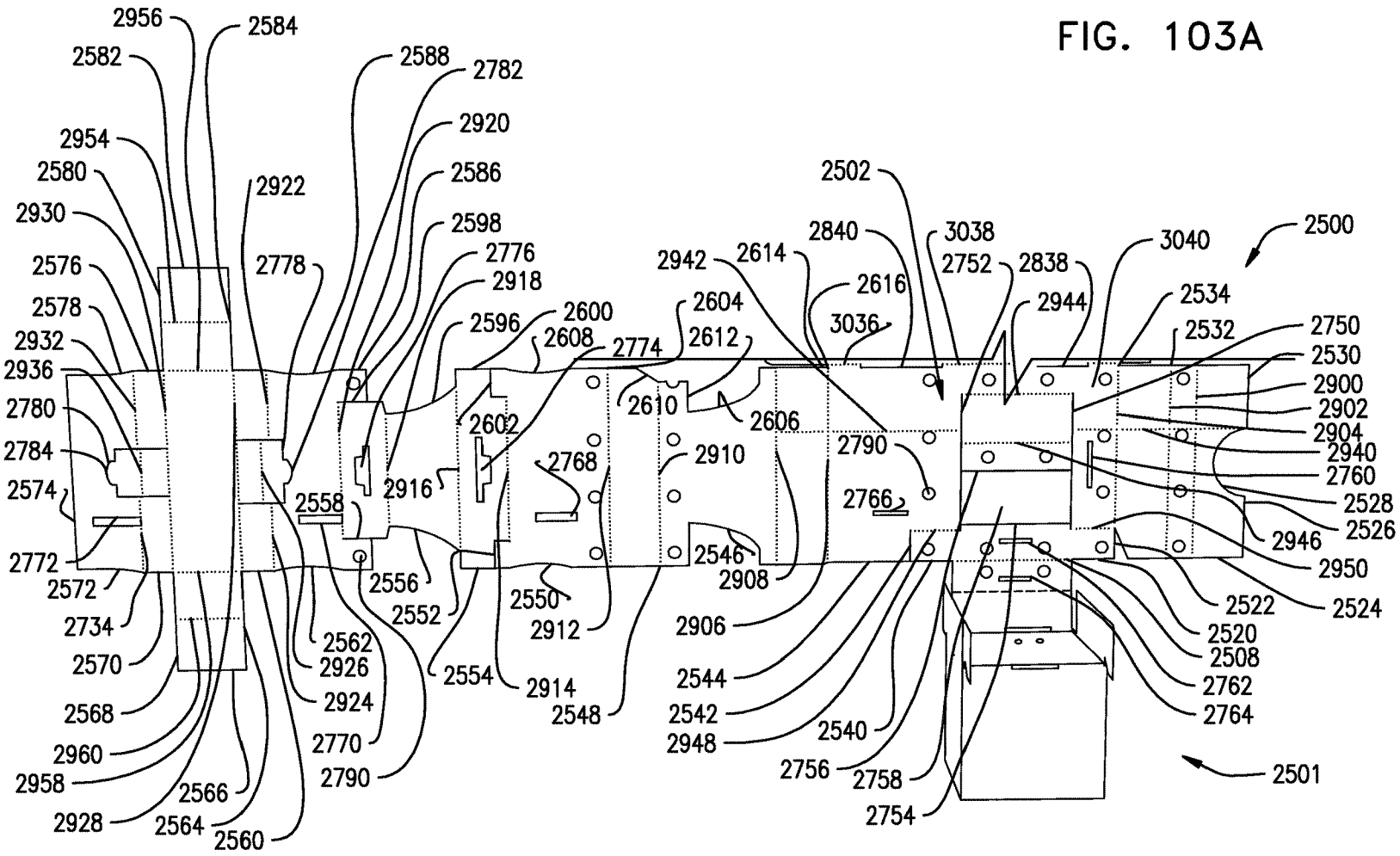
FIGS. 103A and 103B are together a simplified illustration of a partially assembled hand phylactery including a subpattern, which, when suitably folded and assembled, defines a base for the subassembly, whose assembly is shown in FIGS. 92-102.
Figure 103B:
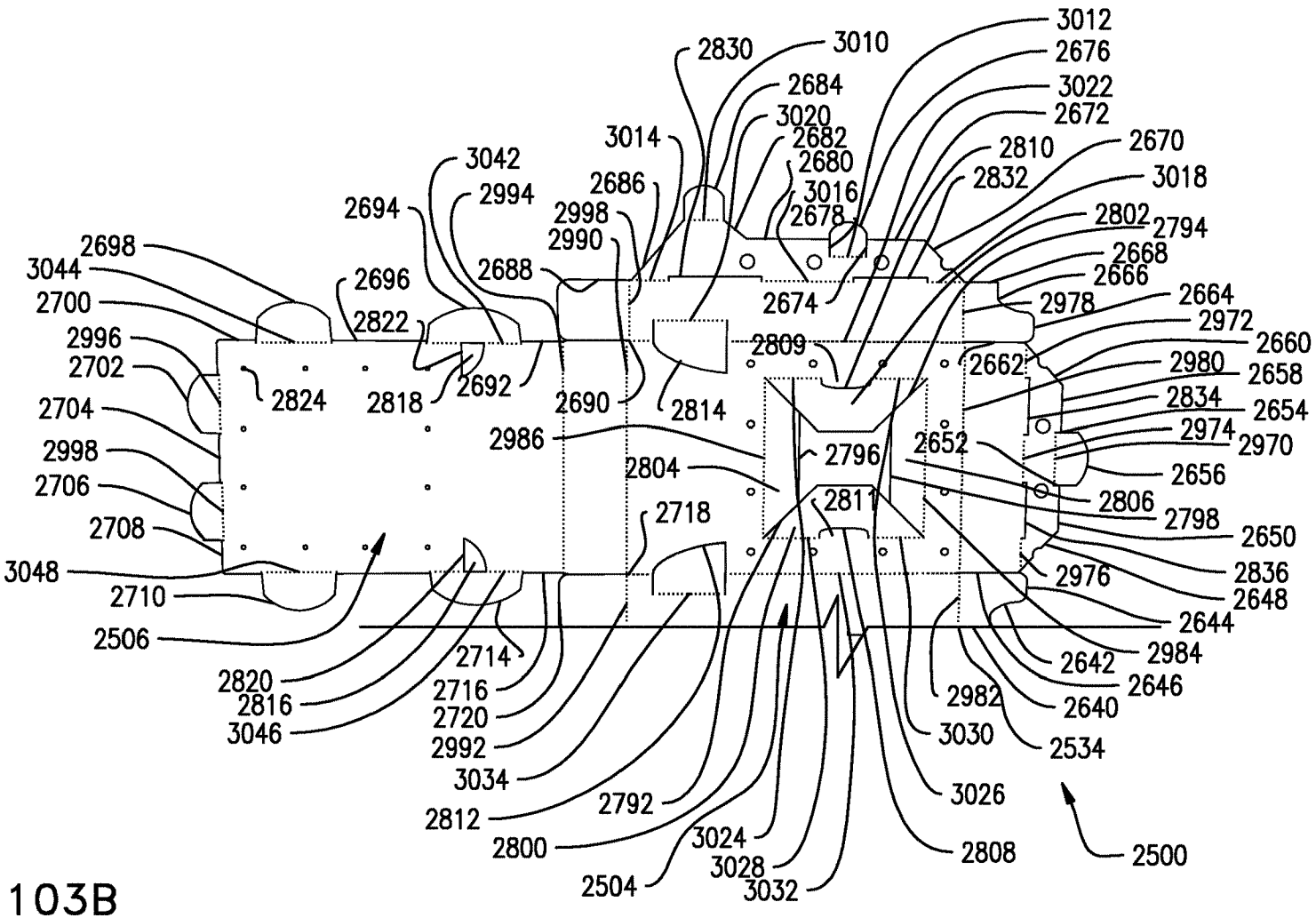

Reference is now made to FIGS. 103A and 103B, which together illustrate a partially assembled hand phylactery in which pattern 2125 (FIG. 92) also includes a subpattern 2500, which, when suitably folded and assembled, defines a base for the subassembly described hereinabove with reference to FIGS. 92-102, which subassembly is hereinafter designated by reference numeral 2501.

Subpattern 2500 includes an internal structural portion 2502, a top and side portion 2504, a bottom portion 2506. Internal structural portion 2502 is joined to an interior intermediate surface 2378 at an incised interior fold line 2508.

It is seen that the outer dimensions of internal structural portion 2502 are defined by outline cut lines 130 (FIG. 2) including the following outline cut line portions which will be described in a generally counterclockwise order beginning from the right end of incised interior fold line 2508, as seen in FIG. 103A:

The outline cut line portions include a first coaxial cut line portion 2520, extending coaxially with incised interior fold line 2508 and to the right thereof, as seen in FIG. 103A. First portion 2520 extends to a notch cut line portion 2522 and thence to a second coaxial cut line portion 2524, which, in turn extends to a 90 degree corner. Extending perpendicularly to cut line portions 2520 and 2524 is a first perpendicular cut line portion 2530, which in turn extends to a 90 degree corner. A parallel cut line portion 2532 extends perpendicularly to cut line portions 2526 and 2530 to a termination point 2534, which lies generally opposite notch cut line portion 2522.

Internal structural portion 2502 is also defined by outline cut lines 2130 (FIG. 92) including the following outline cut line portions which will be described in a generally clockwise order beginning from the left end of incised interior fold line 2508, as seen in FIG. 103A:

The outline cut line portions include a third coaxial cut line portion 2540, extending coaxially with incised interior fold line 2508 and to the left thereof, as seen in FIG. 103A Third cut line portion 2540 extends to a perpendicular cut line portion 2542 and thence to a fourth coaxial cut line portion 2544, which, in turn extends to a partially curved cut out portion 2546. A fifth generally coaxial cut line portion 2548 extends to the left of partially curved cut out portion 2546 and includes a very slight concave cut line portion 2550. Fifth coaxial portion cut line 2548 extends to a generally L-shaped perpendicular cut line portion 2552.

A sixth coaxial cut line portion 2554 extends from cut line portion 2552 to a partially curved, partially stepped cut out portion 2556, which includes a cut line portion 2558. A seventh generally coaxial cut line portion 2560 extends to the left of partially curved, partially stepped cut out portion 2556 and includes a very slight concave cut line portion 2562. Seventh generally coaxial cut line portion 2560 extends to a perpendicular cut line portion 2564, which terminates in a 90 degree corner, from which extends a cut line portion 2566. Cut line portion 2566 terminates in a 90 degree corner, from which extends a cut line portion 568. An eighth generally coaxial cut line portion 2570 extends to the left of cut line portion 2568 and includes a very slight concave cut line portion 2572.

Eighth generally coaxial cut line portion 2570 terminates at a 90 degree corner from which extends a perpendicular cut line portion 2574. Perpendicular cut line portion 2574 terminates at a 90 degree corner from which extends a cut line portion 2576 and includes a very slight concave cut line portion 2578. Cut line portion 2576 extends to a perpendicular cut line portion 2580, which terminates in a 90 degree corner, from which extends a cut line portion 2582. Cut line portion 2582 terminates in a 90 degree corner, from which extends a cut line portion 2584. A cut line portion 2586 extends to the right of cut line portion 2584 and includes a very slight concave portion 2588.

Cut line portion 2586 extends to a partially curved, partially stepped cut out portion 2596, which corresponds in shape to partially curved, partially stepped cut out portion 2556 and includes a cut line portion 2598. A cut line portion 2600 extends from partially curved, partially stepped cut out portion 2596 to a generally L-shaped perpendicular cut line portion 2602. A cut line portion 2604 extends from cut line portion 2602 to a partially curved, cut out portion 2606 and includes a very slight concave cut line portion 2608, an inclined cut line portion 2610 and a short cut line portion 2612 which connects the inclined cut line portion 2610 and partially curved cut out portion 2606. A notch cut line 2614 extends to the right of partially curved cut out portion 2606 to a termination point 2616.

It is seen in FIG. 103B that the outer dimensions of top and side portion 2504 and bottom portion 2506 are defined by outline cut lines 2130 (FIG. 92) including the following outline cut line portions, which will be described in a generally counterclockwise order beginning from termination point 2534:

A cut line portion 2640 extends to a concave corner portion 2642 and thence to a slightly convex cut line portion 2644 and a cut line portion 2646. An inclined cut line portion 2648 extends to a cut line portion 2650, which extends to a cut line portion 2652. An additional cut line portion 2654 defines together with cut line portion 2652 part of a convex cut line portion 2656 located therebetween. A cut line portion 2658 extends from cut line portion 2654 to an inclined cut line portion 2660, which extends to a cut line portion 2662. A slightly convex cut line portion 2664 extends to concave corner cut line portion 2666. A cut line portion 2668 extends from concave corner cut line portion 2666 to an inclined cut line portion 2670. Inclined cut line portion 2670 extends to a cut line portion 2672, which extends to a cut line portion 2674. An additional cut line portion 2676 defines together with cut line portion 2674 part of a convex cut line portion 2675 located therebetween.

A cut line portion 2680 extends to the left of cut line portion 2676 to an inclined cut line portion 2682. Cut line portion 2682 extends to a convex cut line portion 2684 and thence to an inclined cut line portion 2686. Inclined cut line portion 2686 extends to a slightly rounded 90 degree corner convex cut line portion 2688, terminating at a termination point 2690.

A cut line portion 2692 extends to the left from termination point 2690 to a first convex cut line portion 2694. A cut line portion 2696 extends from first convex cut line portion 2694 to a second convex cut line portion 2698. A cut line portion 2700 extends around a 90 degree corner to a third convex cut line portion 2702. A cut line portion 2704 extends from third convex cut line portion 2702 to a fourth convex cut line portion 2706. A cut line portion 2708 extends around a 90 degree corner to a fifth convex cut line portion 2710. A cut line portion 2712 extends from fifth convex cut line portion 2710 to a sixth convex cut line portion 2714. A cut line portion 2716 extends from sixth convex cut line portion 2714 to a termination point 2718. A slightly rounded 90 degree corner convex cut line portion 2720 is defined between termination point 2718 and termination point 2616.

Returning to FIG. 103A, it is seen that internal structural portion 2502 is also defined by a plurality of internal cut lines 132 (FIG. 3). A pair of generally parallel internal cut lines 2750 and 2752 are joined at one end thereof by a generally perpendicular internal cut line 2754 and intermediately therealong by a generally perpendicular internal cut line 2756. It is appreciated that internal cut lines 2754 & 2756 and part of internal cut lines 2750 and 2752 define a cut out 2758.

A slot 2760 is defined alongside of internal cut line 2750. An additional slot 2762 is defined below cut out 2758. It is noted that a corresponding slot 2764 is formed in fifth interior intermediate surface 2378. A further slot 2766 is defined alongside of internal cut line 2752. Three additional slots, designated by reference numerals 2768, 2770 and 2772 are defined to correspond to slot 2766.

First and second generally mesa shaped slots 2774 and 2776 are also provided. First and second flap defining cuts 2778 and 2780, having respective convex flap portion defining parts 2782 and 2784 are also provided. A plurality of sewing apertures, all designated by reference numeral 2790, are formed in internal structural portion 2502.

Returning to FIG. 103B, it is seen that top and side portion 2504 and bottom portion 2506 are also defined by a plurality of internal cut lines 132 (FIG. 3). A set of four mutually intersecting and partially overlapping generally partially trapezoidal cuts 2792, 2794, 2796 and 2798 define two mutually facing and perpendicularly arranged sets of mutually facing flaps, designated by reference numerals 2800, 2802, 2804 and 2806. Flaps 2800 and 2802 are formed with convex cuts respectively designated by reference numerals 2808 and 2810. It is noted that generally trapezoidal flaps 2800 and 2802 are generally longer than generally trapezoidal flaps 2804 and 2806.

First and second cut out flap defining cuts 2812 and 2814 are also formed in top and side portion 2504. First and second partially curved cut outs 2816 and 2818 are defined by respective internal cut lines 2820 and 2822 in bottom portion 2506. A plurality of sewing apertures, all designated by reference numeral 2824, are formed in top and side portion 2504 and bottom portion 2506. Additionally six flap receiving cuts 2830, 2832, 2834, 2836, 2838 and 2840 are formed in top and side portion 2504.

Returning to FIG. 103A, it is seen that internal structural portion 2502 is also defined by a plurality of incised lines 2136 (FIG. 92) which, as noted above, are formed in an exterior surface of the second stage hand phylactery workpiece 2125, normally corresponding to the exterior-facing surface of the animal skin from which the parchment was made. As mentioned above, the incised lines 2136 are shown throughout as dotted lines and are partially cut into the second stage hand phylactery workpiece 2125 from the exterior and typically extend through about two thirds of the thickness of the second stage hand phylactery workpiece 2125. The incised lines are designed for interior folds and are only foldable as interior folds. After folding, the incised lines 2136 are shown as solid lines.

A plurality of mutually parallel incised lines, designated by reference numerals 2900, 2902, 2904, 2906, 2908, 2910, 2912, 2914, 2916, 2918, 2920, 2922, 2924, 2926, 2928 are provided and a plurality of mutually parallel incised lines, which extend generally perpendicularly to incised lines 2900-2928 are provided and are designated by reference numerals 2940, 2942, 2944, 2946, 2948, 2950, 2952, 2954, 2956, 2958, 2960 & 2962.

Returning to FIG. 103B, it is seen that top and side portion 2504 and bottom portion 2506 are also defined by a plurality of incised lines 2136 (FIG. 92).

A plurality of mutually parallel incised lines, designated by reference numerals 2970, 2972, 2974, 2976, 2978, 2980, 2982, 2984, 2986, 2988, 2990, 2992, 2994, 2996, 2998 and 3000 provided and a plurality of mutually parallel incised lines, which extend generally perpendicularly to incised lines 2970-3002 are provided and are designated by reference numerals 3010, 3012, 3014, 3016, 3018, 3020, 3022, 3024, 3026, 3028, 3030, 3032, 3034, 3036, 3038, 3040, 3042, 3044, 3046 & 3048.

Reference is now made to FIG. 104, which illustrates folding four generally trapezoidal flaps 2800, 2802, 2804 and 2806 about respective interior fold lines 3028 & 3030, 3024 & 3026, 2986 and 2984 to lie at approximately 90 degrees with respect to a plane of top and side portion 2504 and to define an aperture 3100 bordered by folded flaps 2800, 2802, 2804 and 2806.

Figure 105:
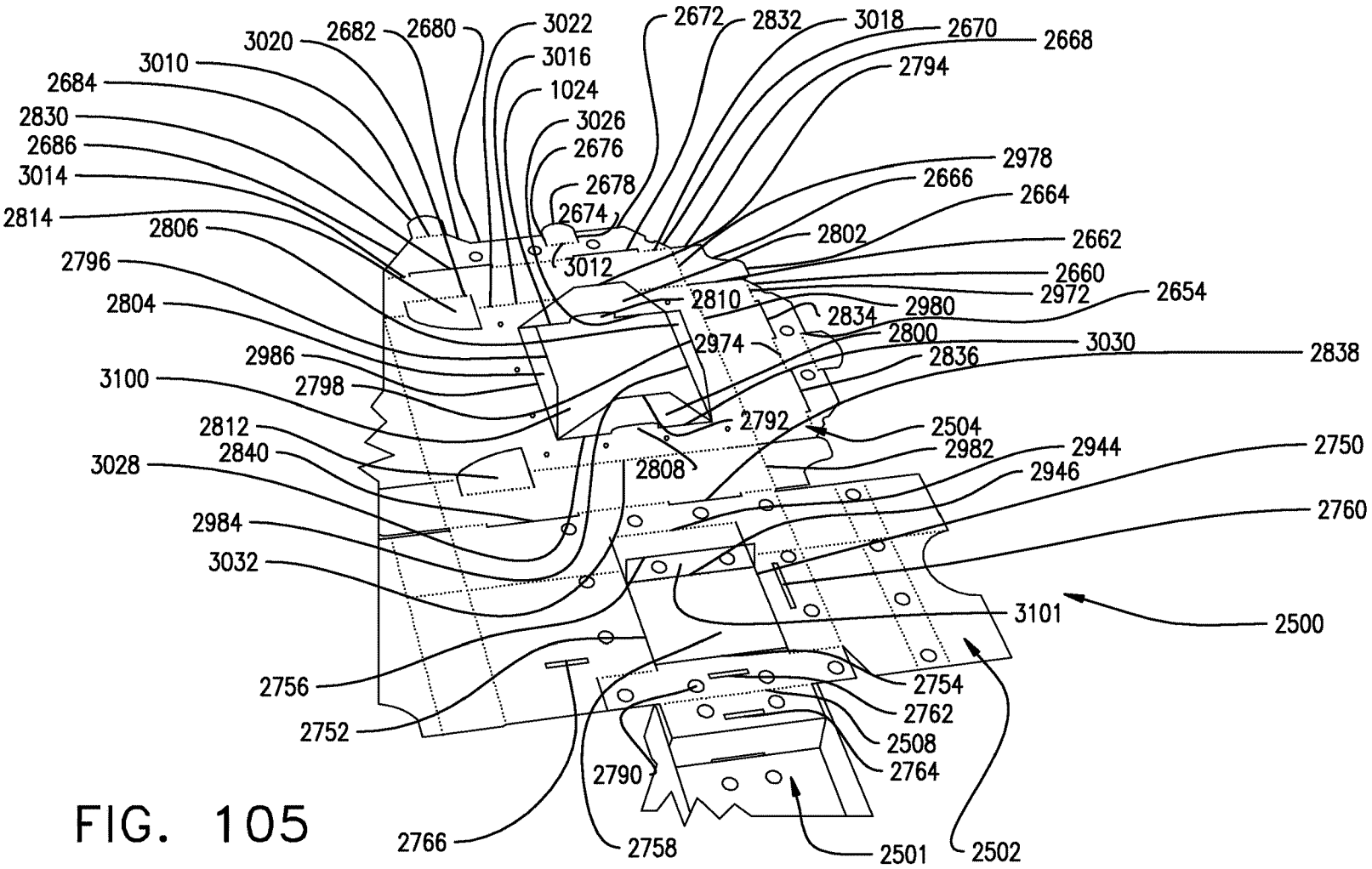
FIG. 105 is a simplified illustration which illustrates folding of a flap portion about an interior fold line.

Reference is now made to FIG. 105, which illustrates folding of a flap portion 3101 about an interior fold line 2946 to lie at approximately 90 degrees with respect to a plane of top and side portion 2504.

Figure 106:
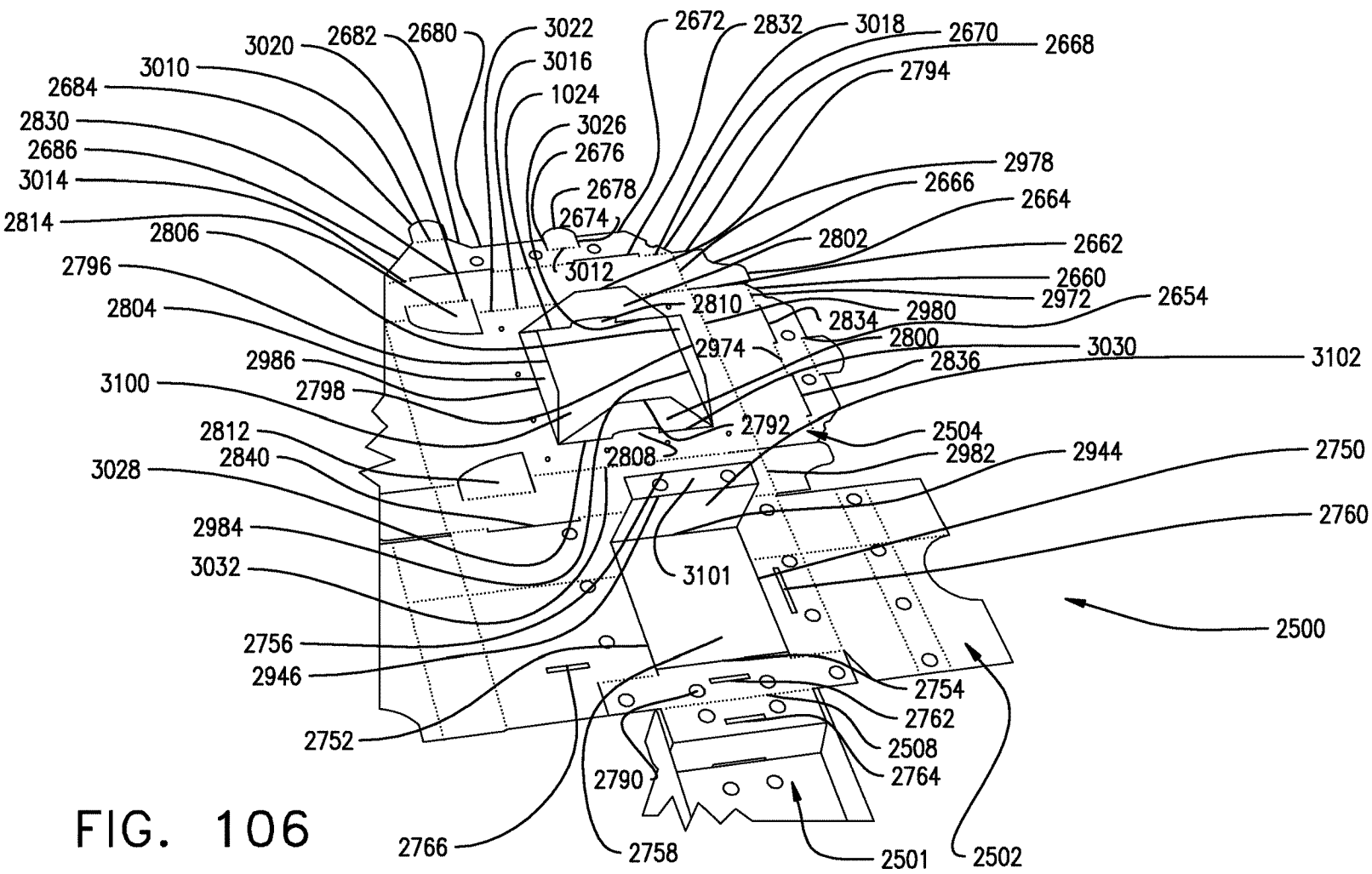
FIG. 106 is a simplified illustration which illustrates folding of an intermediate flap portion to which is attached a flap about internal fold line.

Reference is now made to FIG. 106, which illustrates folding of an intermediate flap portion 3102, to which is attached flap 3101, about internal fold line 2944, such that intermediate flap portion 3102 lies at approximately 90 degrees with respect to a plane of internal structural portion 2502 and flap 3101, which lies generally perpendicular to intermediate flap portion 3102, is generally parallel to plane of internal structural portion 2502.

Figure 107:
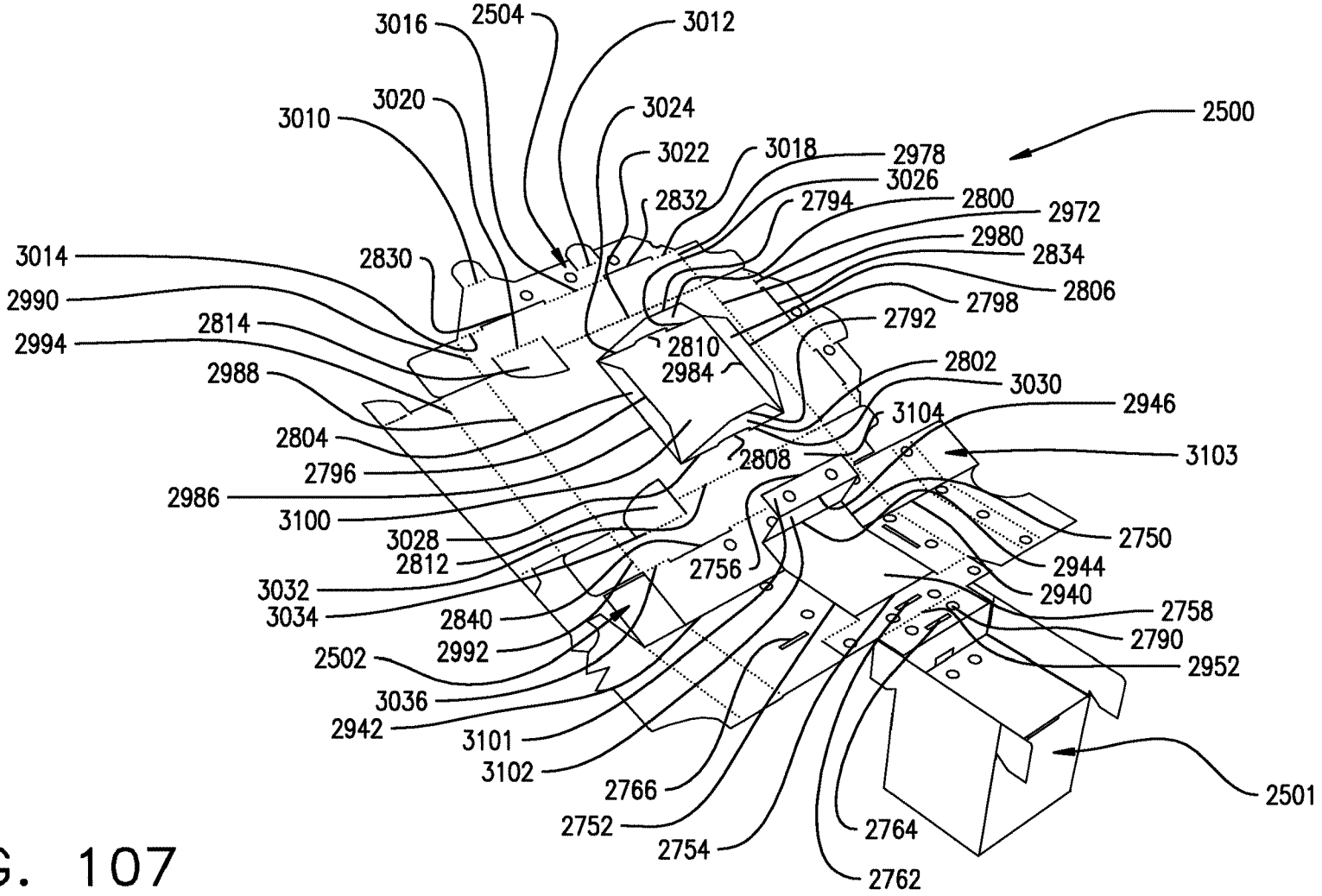
FIG. 107 is a simplified illustration which illustrates temporary folding of a top and side portion and a part of an internal structural portion about internal fold lines.

Reference is now made to FIG. 107, which illustrates temporary folding of top and side portion 2504 and a part 3104 of internal structural portion 2502 about internal fold lines 2940 and 2942 to lie generally at about 30 degrees relative to the plane of the remainder of internal structural portion 2502.

Figure 108:
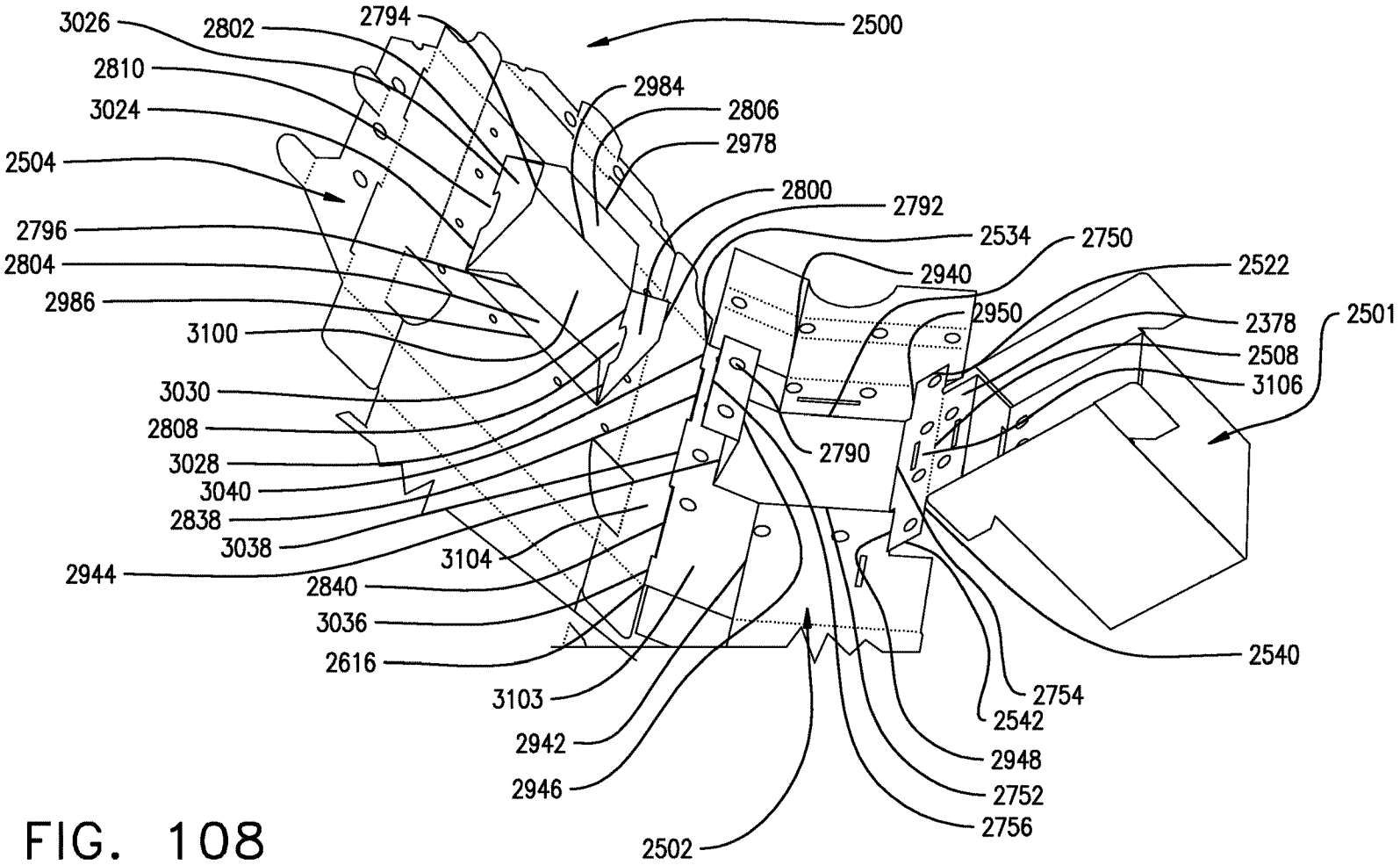
FIG. 108 is a simplified illustration which illustrates partial folding of a top and side portion about mutually coaxial internal fold lines.

Reference is now made to FIG. 108, which illustrates partial folding of top and side portion 2504 about mutually coaxial internal fold lines 3036, 3038 and 3040 to lie generally at about 30 degrees relative to the plane of part 3104 of internal structural portion 2502. FIG. 108 also shows a temporary folding of internal structural portion 2502 about internal fold lines 2948 and 2950 to lie generally at about 30 degrees relative to the plane of an intermediate connecting surface portion 3106, which is joined to interior intermediate surface 2378 via an internal fold line 2508.

Figure 109:
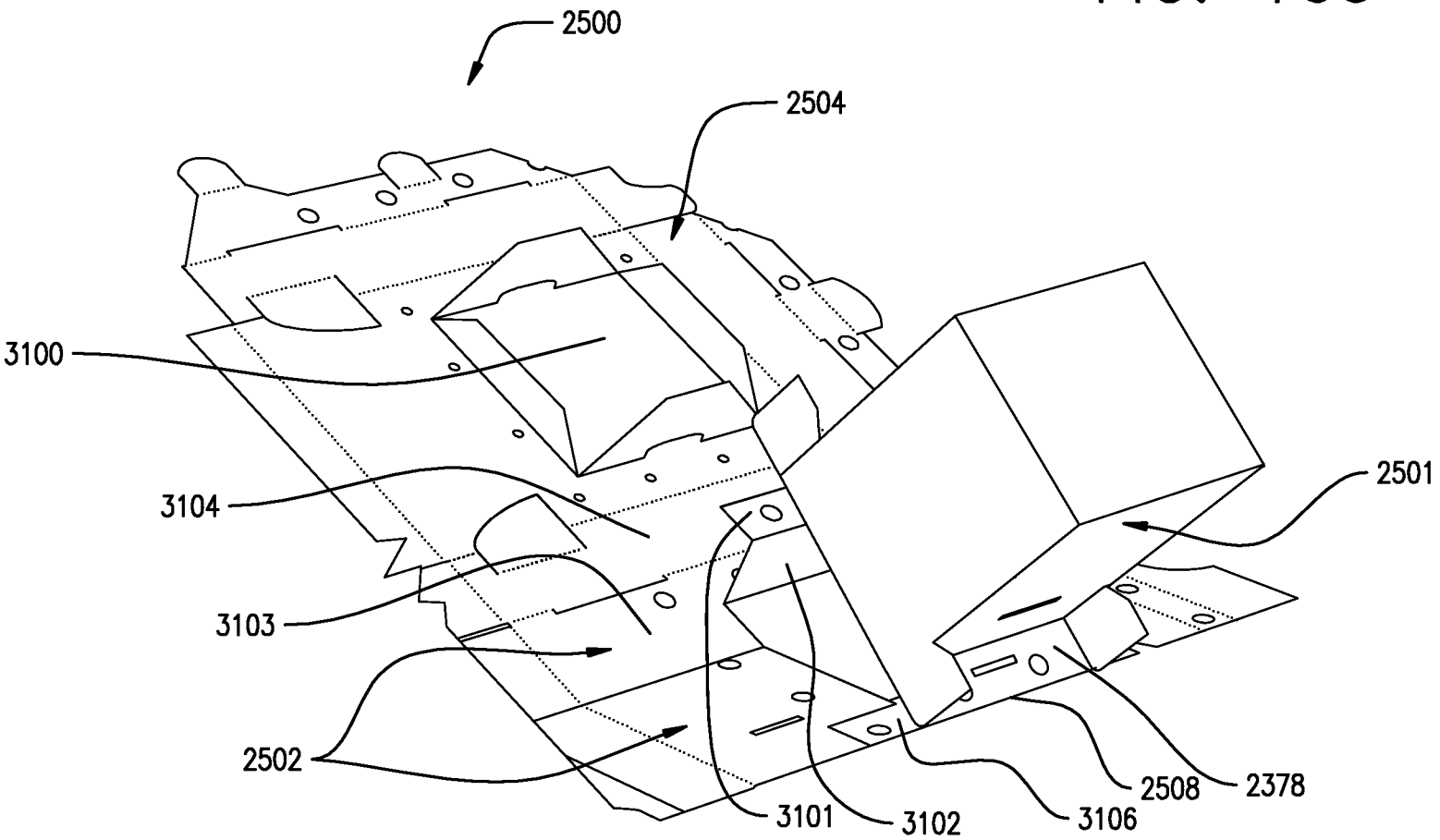
FIG. 109 is a simplified illustration which illustrates partial folding of a subassembly about an internal fold line.

Reference is now made to FIG. 109, which illustrates partial folding of subassembly 2501 about internal fold line 2508 to lie generally at about 120 degrees relative to the plane of internal structural portion 2502. It is noted that generally trapezoidal flaps 2800 and 2802 are generally longer than generally trapezoidal flaps 2804 and 2806.

Figure 110:
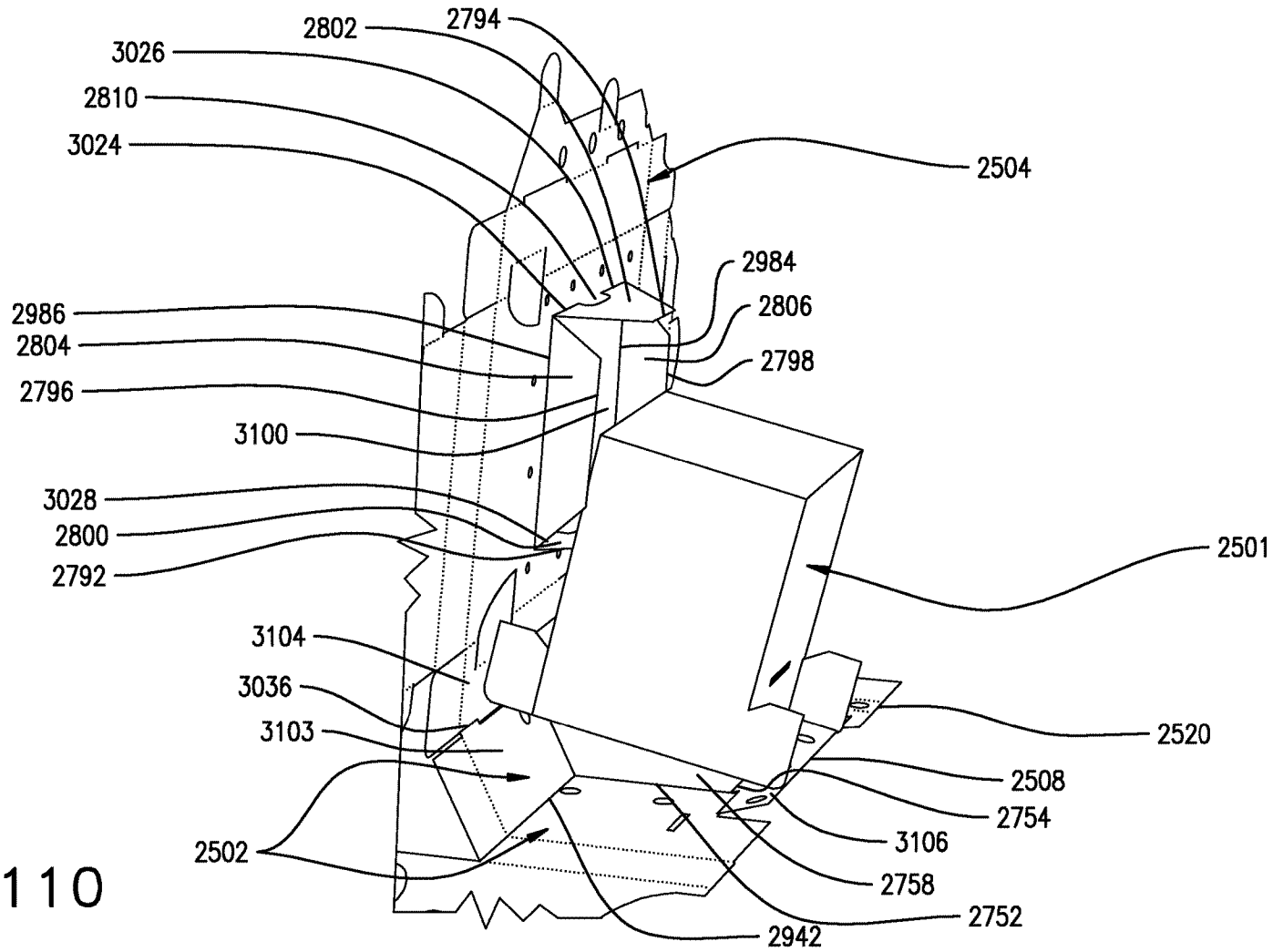
FIG. 110 is a simplified illustration which illustrates further folding of a subassembly about an internal fold line such that an intermediate flap portion and a flap are mutually positioned between widened end portions of respective side flaps and extending from a subassembly.

Reference is now made to FIG. 110, which illustrates further folding of subassembly 2501 about internal fold line 2508 to lie generally at about 160 degrees relative to the plane of internal structural portion 2502. It is seen that some of subassembly 2501 lies between upstanding flaps 2804 and 2806. It is also noted that the temporary fold about mutually coaxial internal fold lines 2940 & 2942 is further folded. It is also noted that intermediate flap portion 3102 and flap 3101 (not seen) are mutually positioned between widened end portions 2322 of respective side flaps 2224 and 2226 extending from subassembly 2501.

Figure 111:
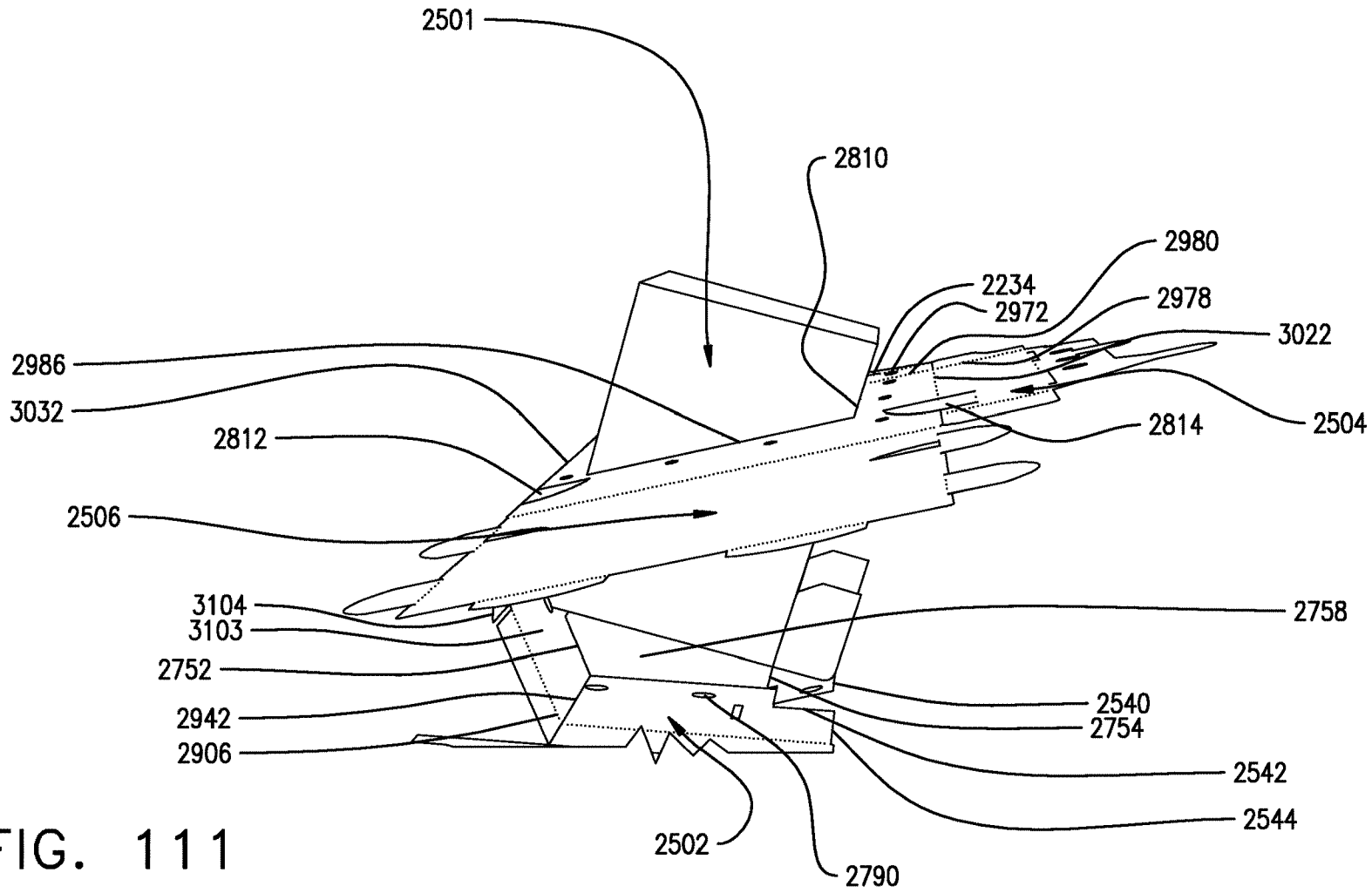
FIG. 111 is a simplified illustration which illustrates further folding of a top and side portion about mutually coaxial internal fold lines.

Reference is now made to FIG. 111, which illustrates further folding of top and side portion 2504 about mutually coaxial internal fold lines 3036, 3038 and 3040 to lie generally at about 75 degrees relative to the plane of part 3104 of internal structural portion 2502. It is seen that subassembly 2501 partially extends through aperture 3100 defined by folding of flaps 2800, 2802, 2804 & 2806 and bordered thereby. It is noted that generally trapezoidal flaps 2800 and 2802 (not seen) are generally longer than generally trapezoidal flaps 2804 and 2806 (not seen).

Figure 112:
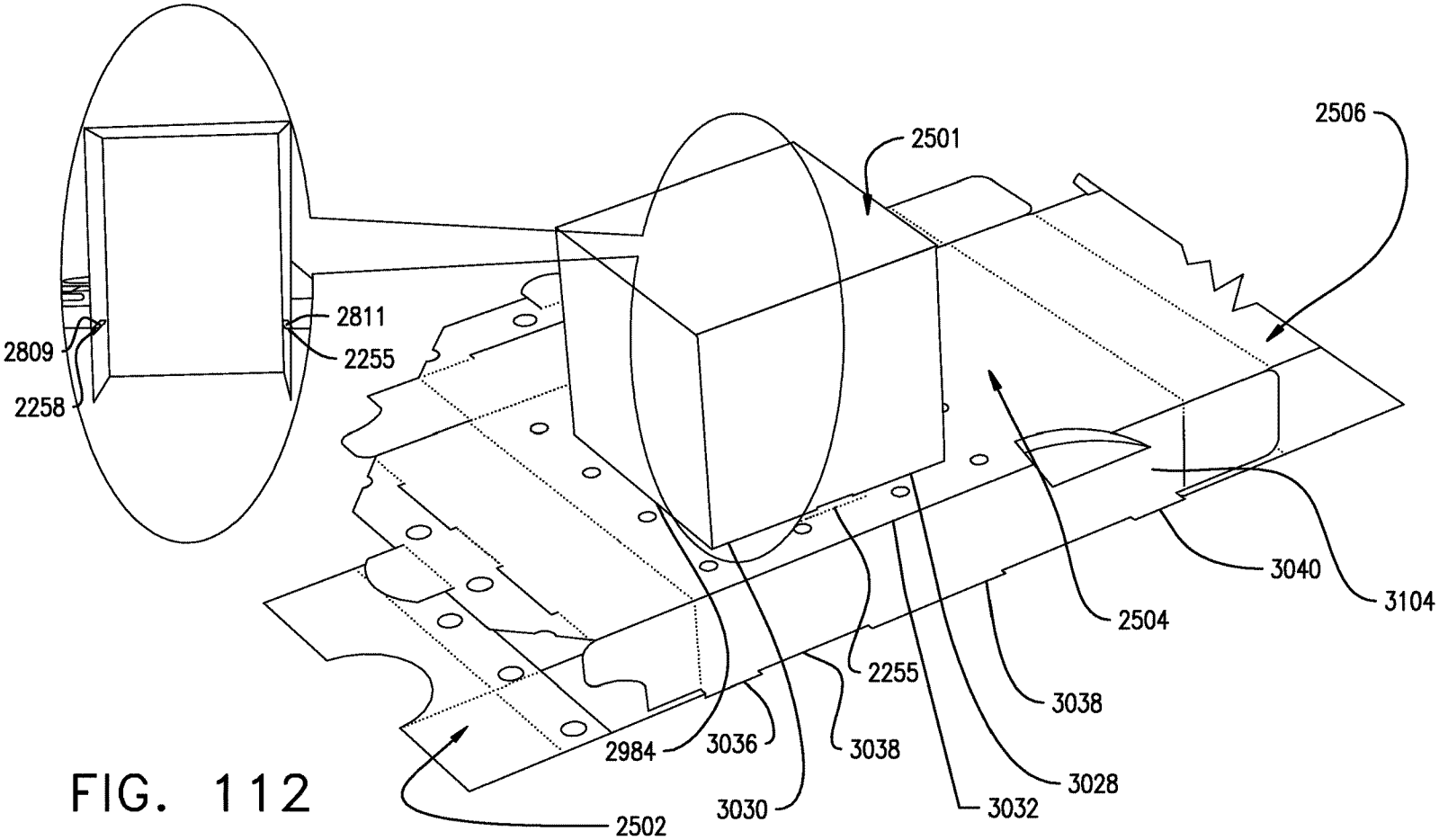
FIG. 112 is a simplified illustration which illustrates complete folding of the top and side portion about an internal fold line.

Reference is now made to FIG. 112, which illustrates complete folding of top and side portion 2504 about internal fold line 3032 to lie generally at about 90 degrees relative to the plane of part 3104 of internal structural portion 2502. It is seen that subassembly 2501 fully extends through aperture 3100 defined by folding of flaps 2800, 2802, 2804 & 2806 and bordered thereby.

It is a particular feature of an embodiment of the present invention that a dimension of generally trapezoidal flaps 2800 and 2802 and intermediate flap portion 3102 is generally the same as the interior dimension of the space between the top portion of top and side portion 2504 and the bottom portions of internal structural portion 2502, when they are fully folded as shown in FIG. 146. It is a further particular feature of an embodiment of the present invention that tabs 2809 and 2811, defined by convex cuts respectively designated by reference numerals 2810 & 2808 engage respective mesa shaped slots 2258 & 2255. It is an additional particular feature of an embodiment of the present invention that when tabs 2808 & 2810 respectively engage mesa shaped slots 2255 & 2258, the dimension between the respective planes of the top portion of top and side portion 2504 and the bottom portion of internal structural portion 2502 when fully folded is defined and maintained as shown in FIG. 146.

Figure 113:
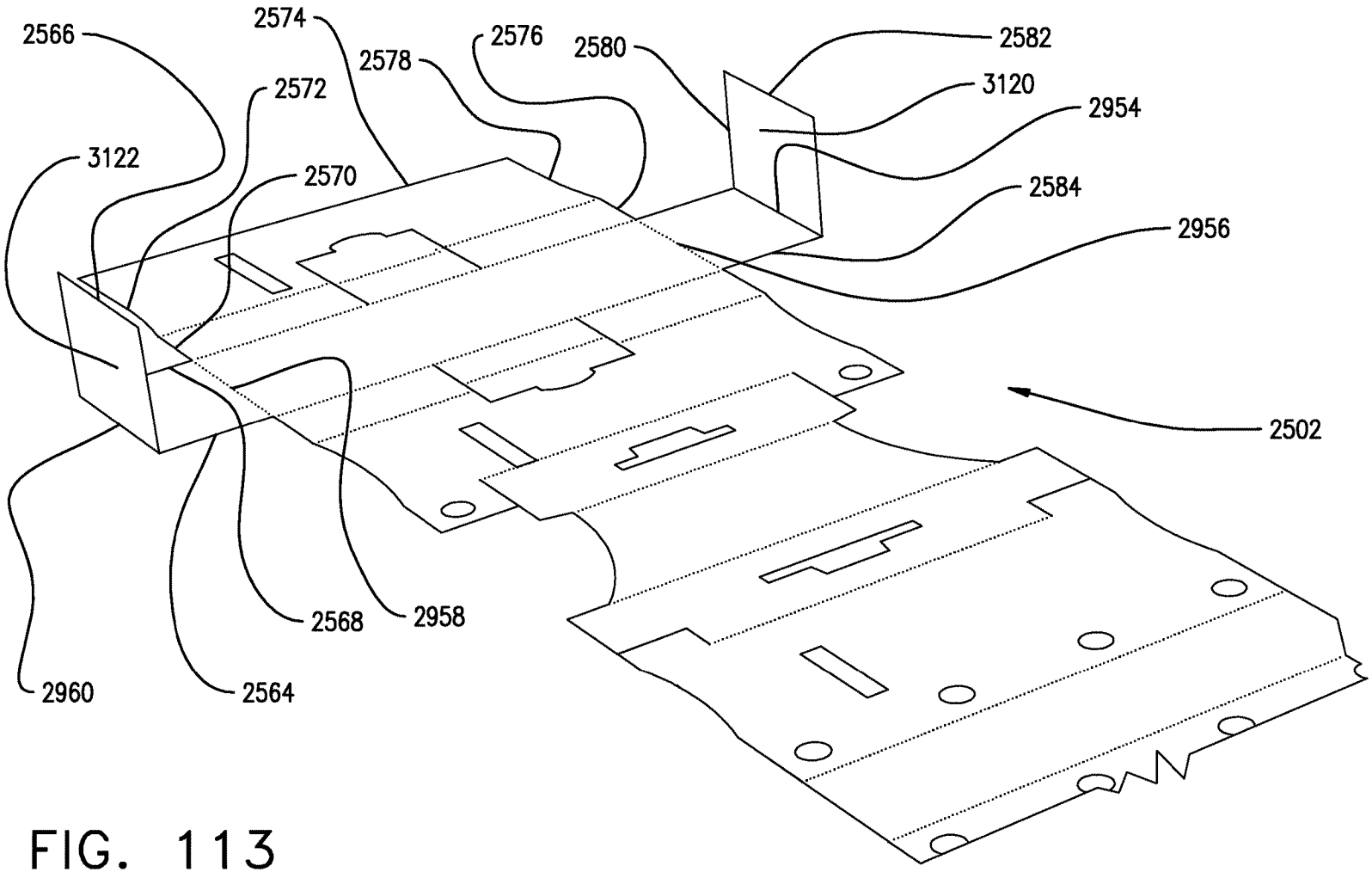
FIG. 113 is a simplified illustration of a partial folding of flap portions of an internal structural portion about respective internal fold lines.

Reference is now made to FIG. 113, which illustrates partial folding of flap portions 3120 and 3122 of internal structural portion 2502 about respective internal fold lines 2954 and 2960 to lie generally at about 90 degrees relative to the plane of internal structural portion 2502.

Figure 114:
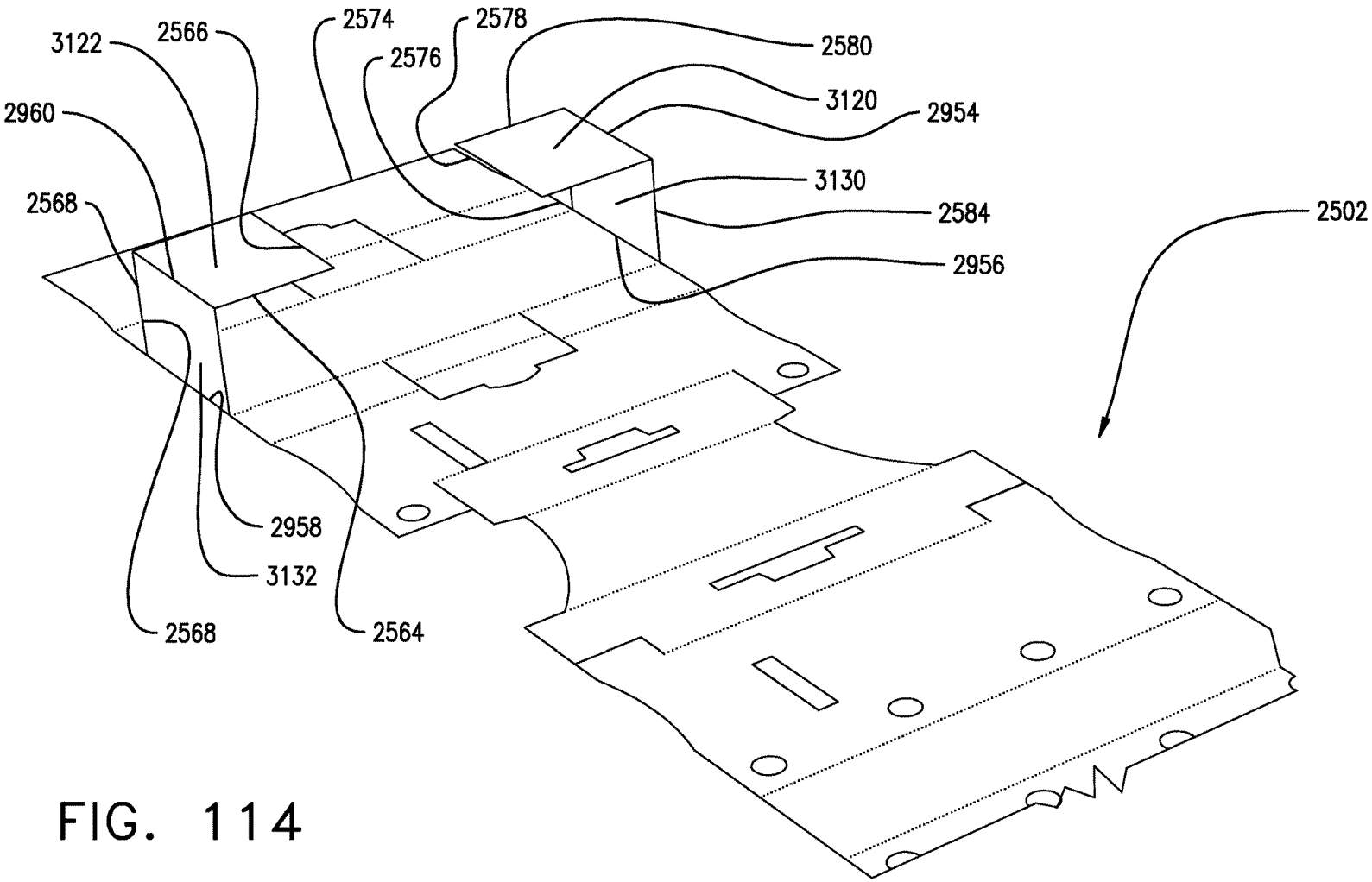
FIG. 114 is a simplified illustration of a partial folding of additional flap portions of an internal structural portion about additional respective internal fold lines.

Reference is now made to FIG. 114, which illustrates partial folding of flap portions 3130 and 3132 to which are attached respective flap portions 3120 and 3122, about respective internal fold lines 2956 and 2958, such that flaps 3130 and 3132 lie at approximately 90 degrees with respect to the plane of internal structural portion 2502 and flaps 3120 and 3122.

Figure 115:
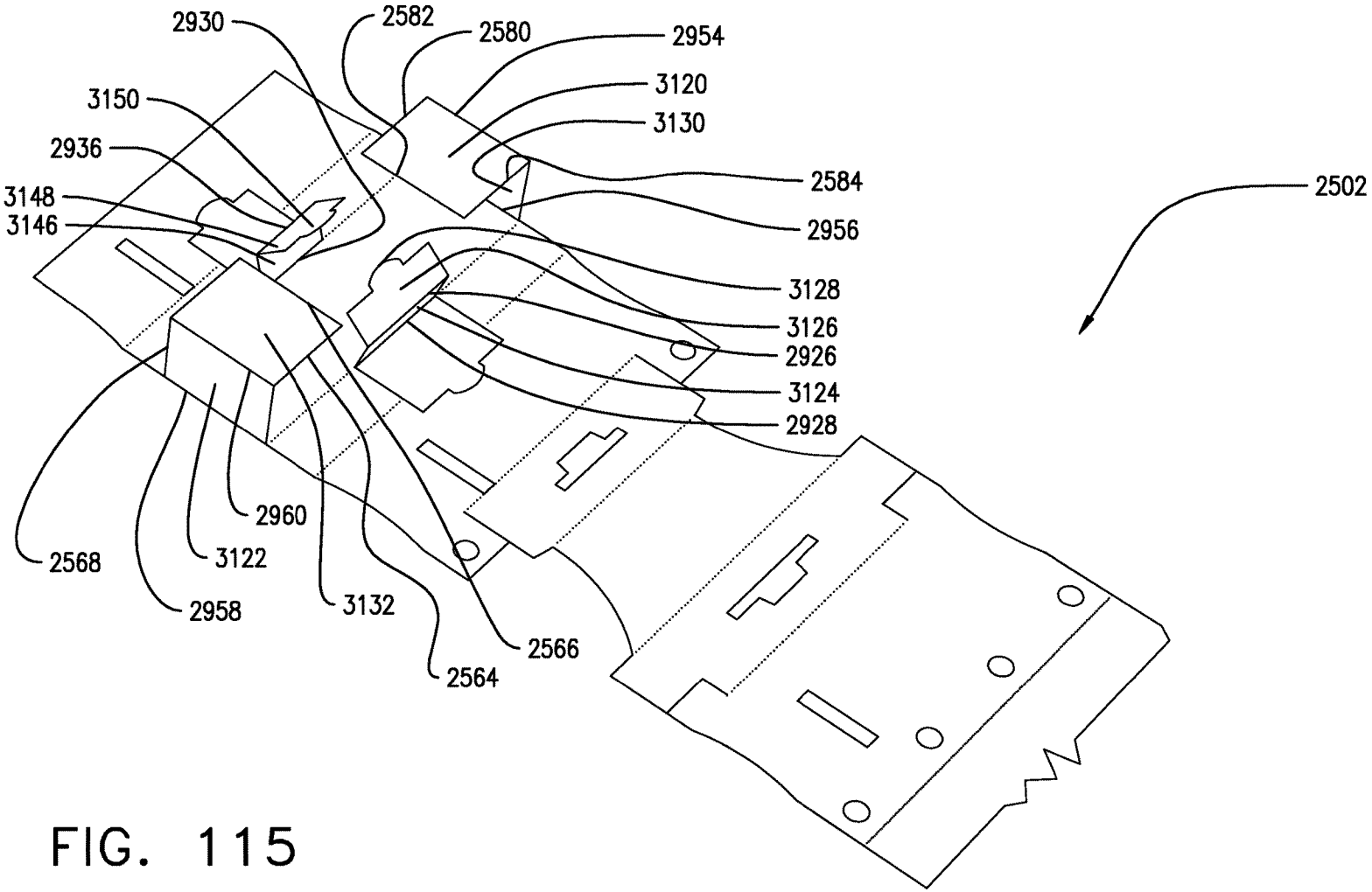
FIG. 115 is a simplified illustration of a partial folding of further flap portions of an internal structural portion about additional respective internal fold lines.

Reference is now made to FIG. 115, which illustrates partial folding of flap portions 2778 and 2780 about respective internal fold lines 2928 and 2930 as well as partial internal folding of each of flap portions 3124, 3126, 3148 & 3150 defined by flap defining cuts 2778, 2780, 2782 and 2784 about respective internal fold lines 2926 and 2936.

Figure 116:
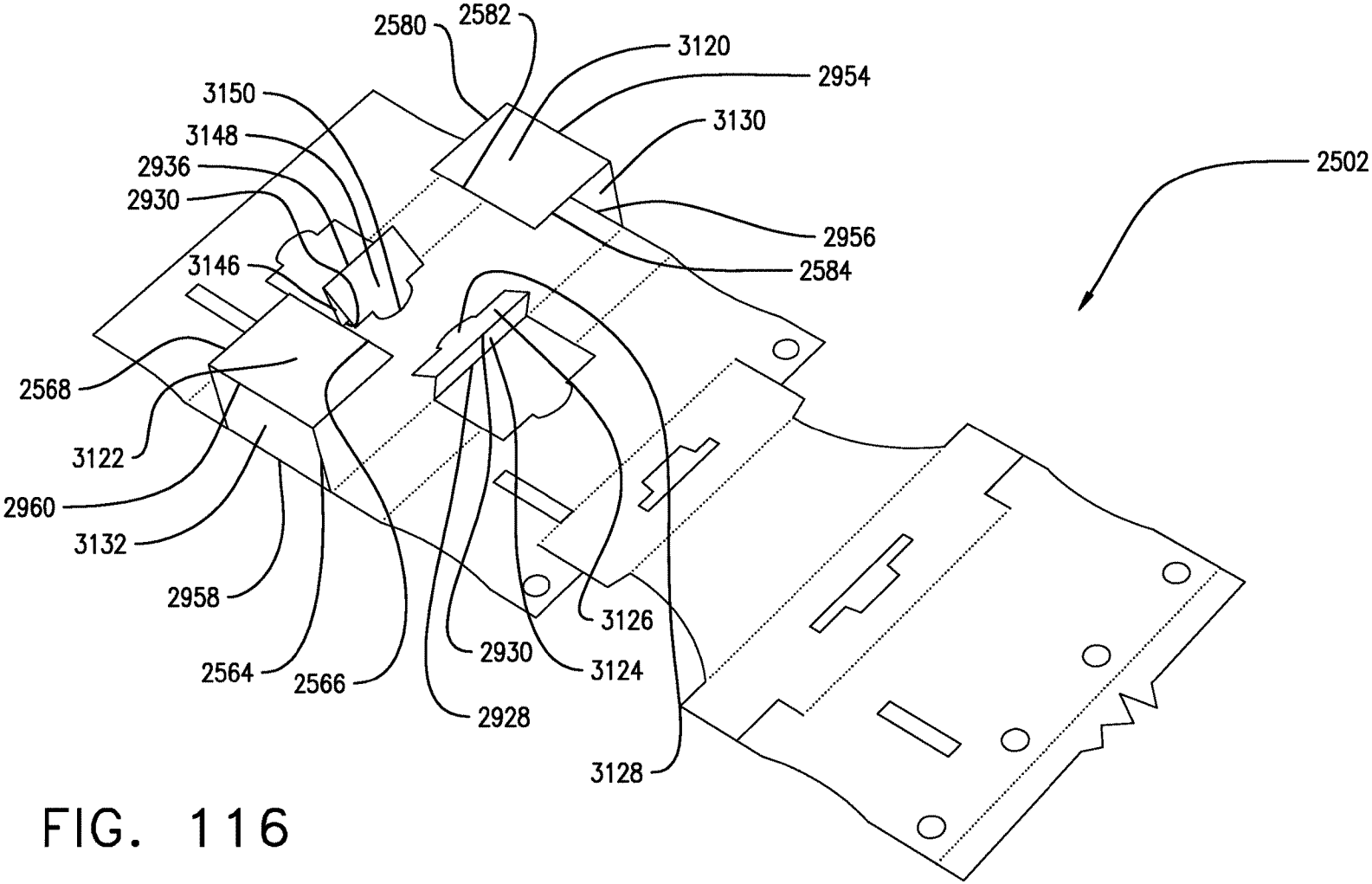
FIG. 116 is a simplified illustration of additional partial folding of the further flap portions of an internal structural portion.

Reference is now made to FIG. 116, which illustrates nearly complete internal folding of each of flaps 3124 & 3126 and 3146 & 3148 about respective internal fold lines 2926 (not seen) & 2928 and 2930 & 2936. FIG. 116 shows that flap portions 3124 and 3126 defined by flap defining cuts 2778 is folded on itself through approximately 135 degrees about internal fold line 2926. It is noted that flap portion 3126 includes an end tab portion 3128. It is also noted that flap portion 3148 includes an end tab portion 3150.

Figure 117:
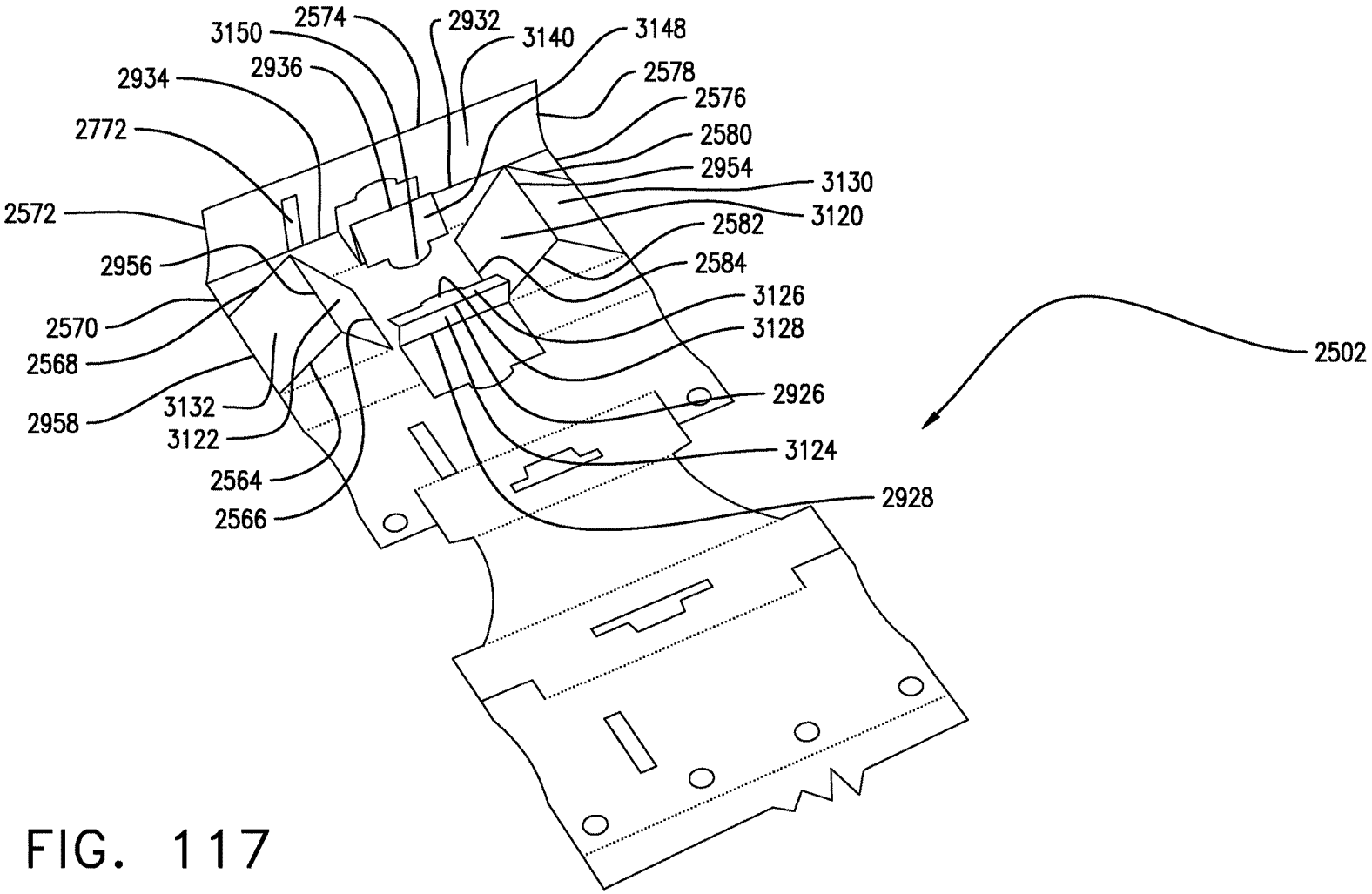
FIG. 117 is a simplified illustration of a partial folding of a still further part of an internal structural portion.

Reference is now made to FIG. 117, which illustrates folding of an end flap 3140, defined by line portions 2572, 2574 and 2578, about mutually coaxial internal fold lines 2932 and 2934 to lie at an angle of approximately 90 degrees with respect to the plane of internal structural portion 2502. FIG. 117 also illustrates further folding of flaps 3120 & 3130 and 3122 & 3132 about respective internal fold lines 2954 and 2956 and partial unfolding of flaps 3130 and 3132 with respect to flaps 3120 and 3120 about respective internal fold lines 2958 and 2960.

Figure 118:
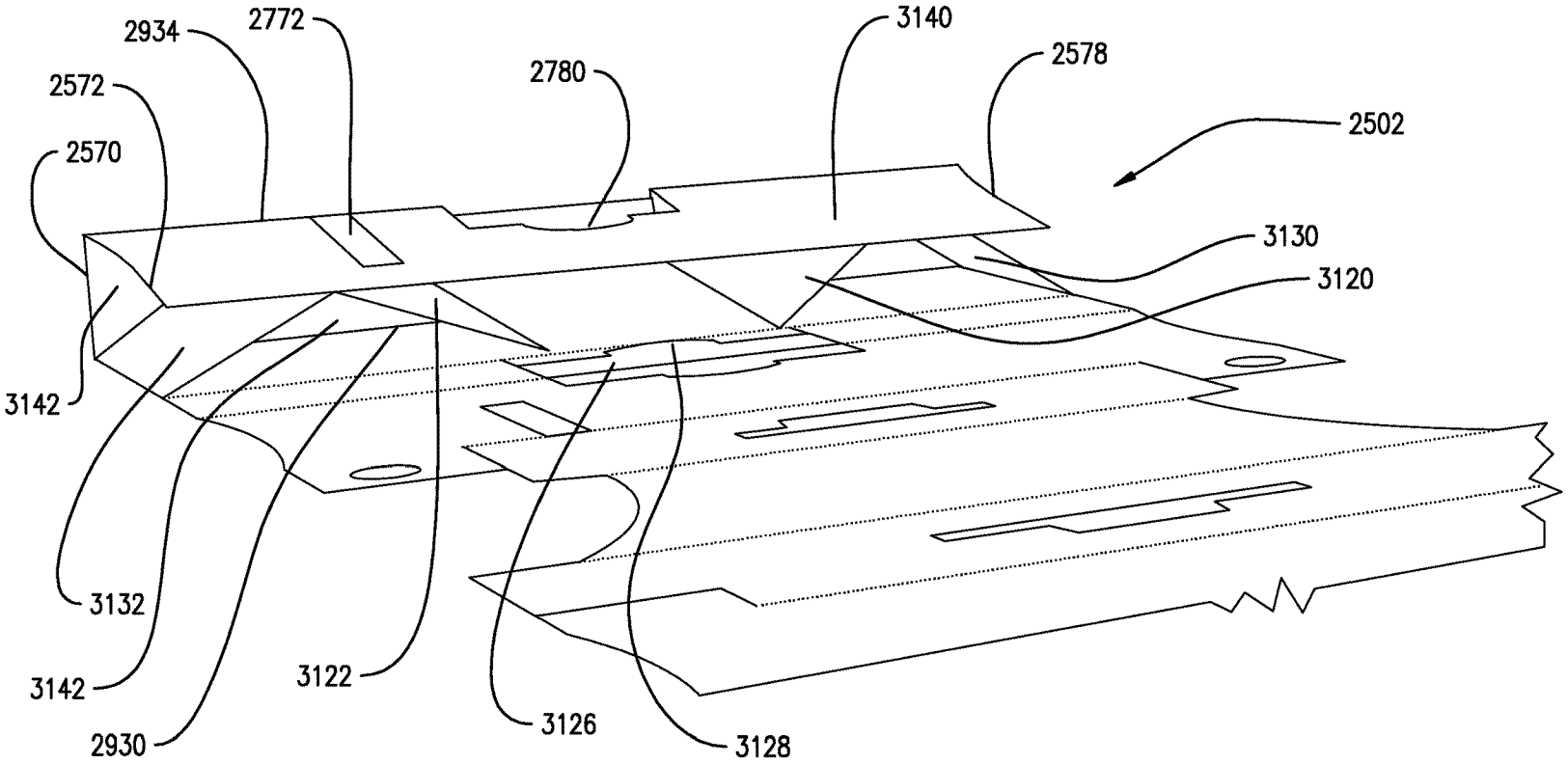
FIG. 118 is a simplified illustration the folding of part of the internal structural portion about an internal fold line such that the portion lies generally perpendicular to the plane of an internal structural portion; further folding of flaps about internal fold lines and partial unfolding of other flap portions about respective internal fold lines.

Reference is now made to FIG. 118, which shows folding of a portion 3142 to which is attached end flap 3140, about an internal fold line 2930, such that portion 3142 lies generally perpendicular to end flap 3140 and generally parallel to the plane of internal structural portion 2502.

FIG. 118 also shows further folding of flaps 3120 & 3130 and 3122 & 3132 about respective internal fold lines 2954 and 2956 and partial unfolding of flaps 3130 and 3132 with respect to flaps 3120 and 3120 about respective internal fold lines 2958 and 2960 so that flaps 3120, 3122, 3130 and 3132 each line at about 30 degrees with respect to the plane of internal structural portion 2502.

Figure 119:
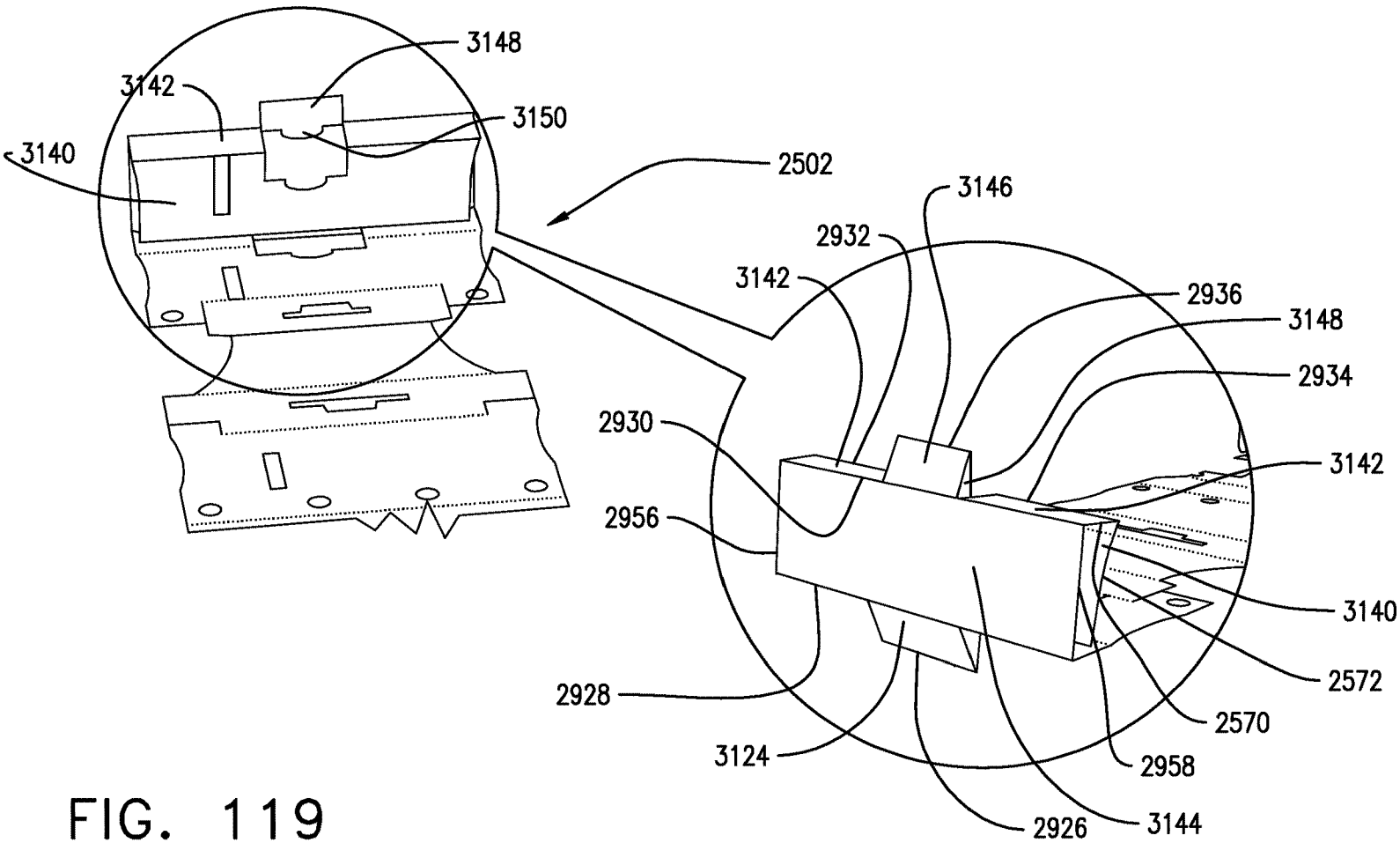
FIG. 119 is a simplified illustration of the folding of an additional part of the internal structural portion about an internal fold line such that the portion lies generally perpendicular to the plane of an internal structural portion.

FIG. 119 illustrates folding of a portion 3144 about internal fold line 2928 such that portion 3144 lies generally perpendicular to the plane of internal structural portion 2502. FIG. 119 also shows folding of a portion 3146 through 135 degrees about internal fold line 2936 relative to a portion 3148. It is noted that portion 3146 includes an end tab portion 3150.

Figure 120:
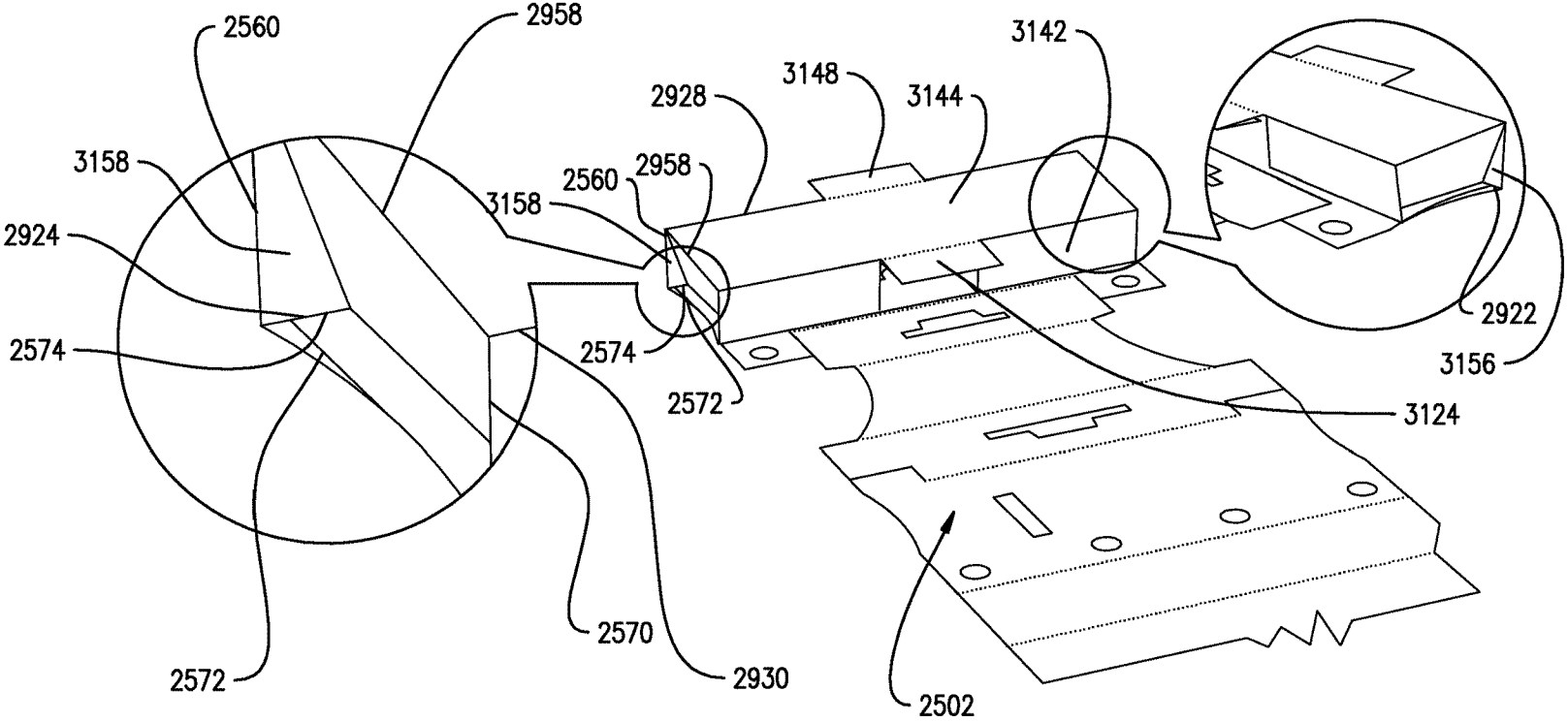
FIG. 120 is a simplified illustration of folding of yet additional parts of the internal structural portion about respective internal fold lines such that the portions lie generally perpendicular to the plane of the internal structural portion.

FIG. 120 illustrates folding of portions 3156 and 3158 about respective internal fold lines 2922 and 2924 such that portion 3156 and 3158 lie generally perpendicular to the plane of internal structural portion 2502.

Figure 121:
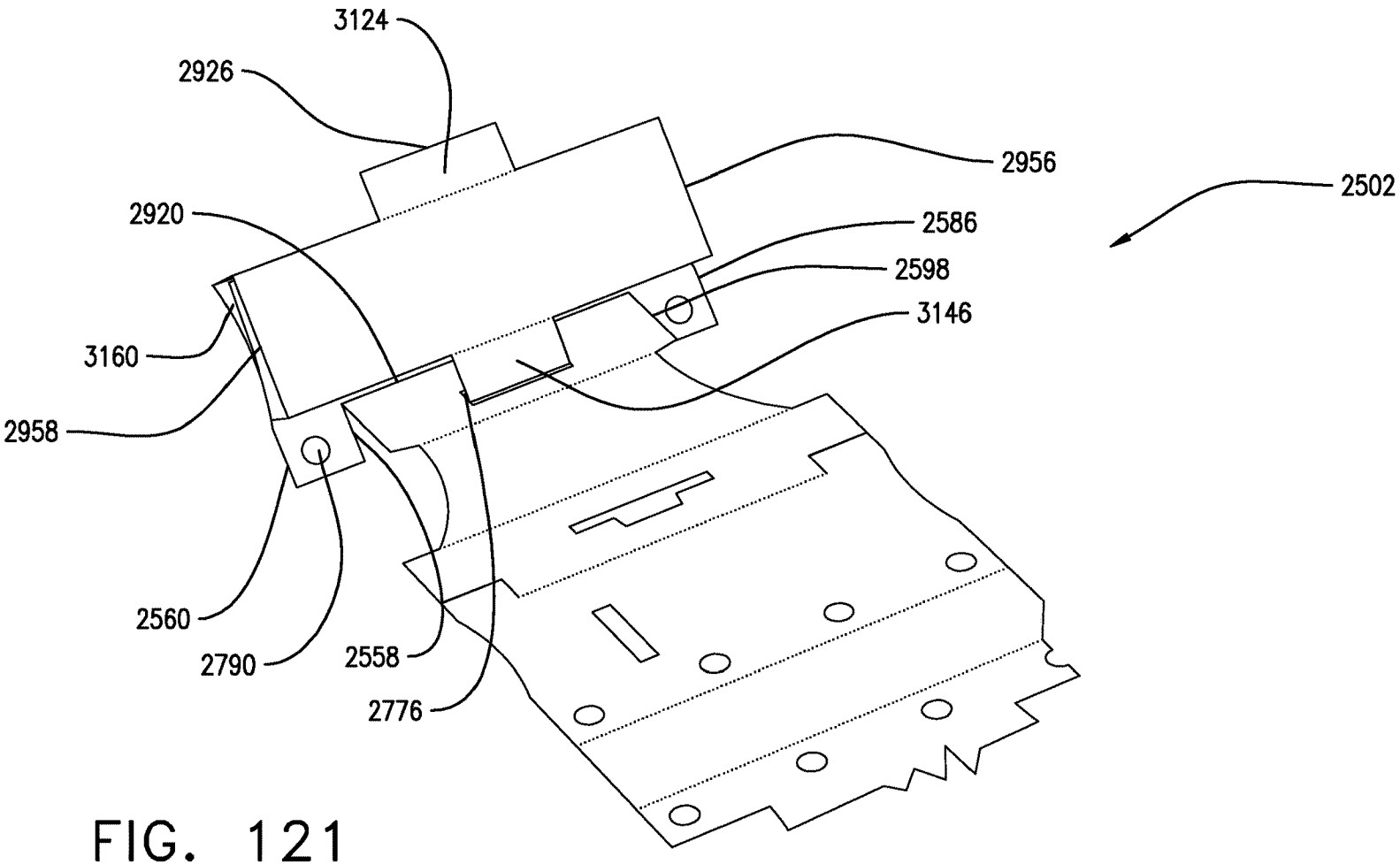

FIG. 121 illustrates an initial stage in folding a portion 3160 about internal fold line 2920. It is seen that flap portions 3146 & 3148 (not seen) are partially inserted into aperture 2776.

Figure 122:
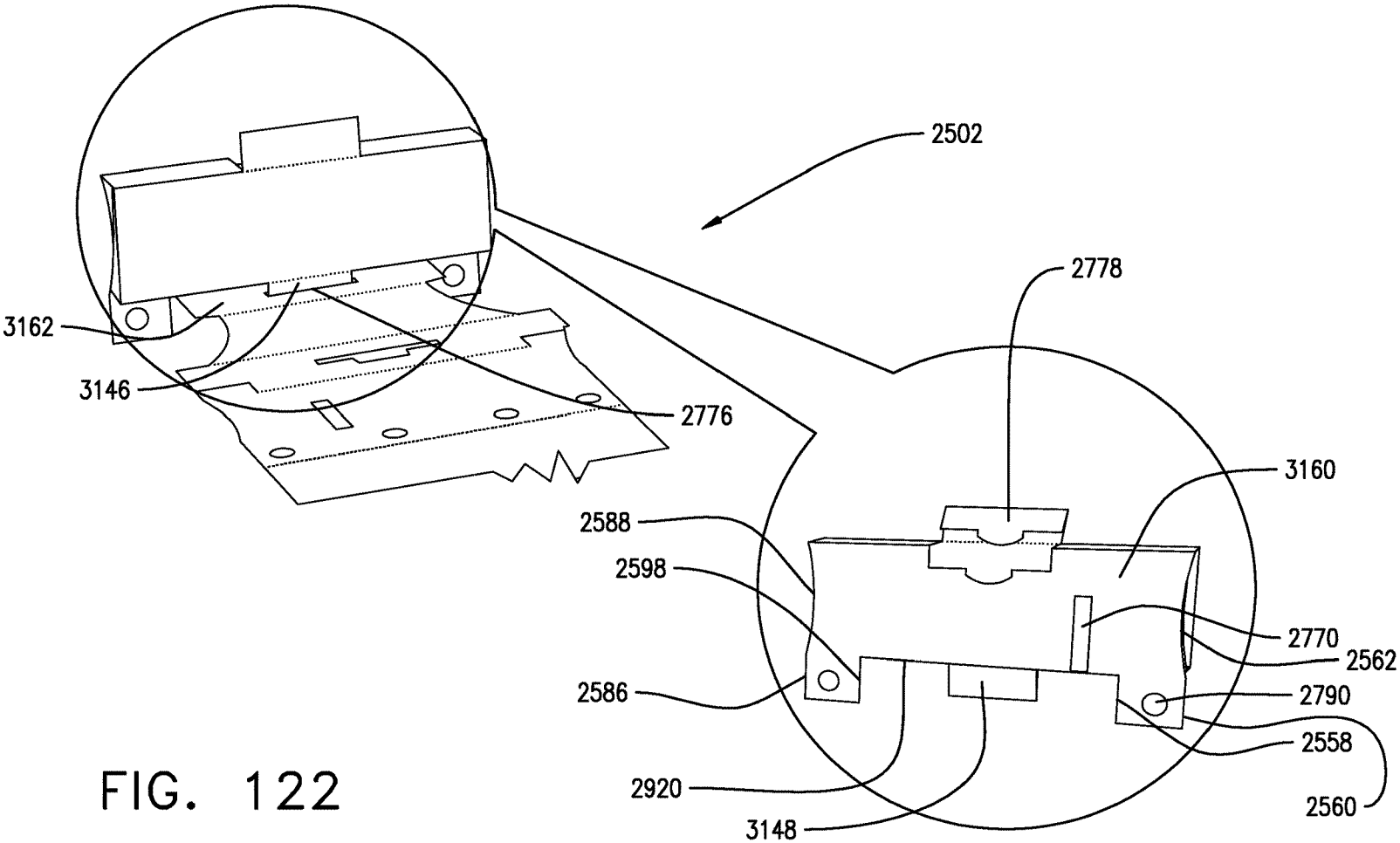

FIG. 122 shows a final stage in folding portion 3160 about internal fold line 2920. It is seen that portion 3160 lies generally perpendicular to the plane of internal structural portion 2502 and that flap portions 3146 & 3148 are fully inserted into aperture 2776.

Figure 123:
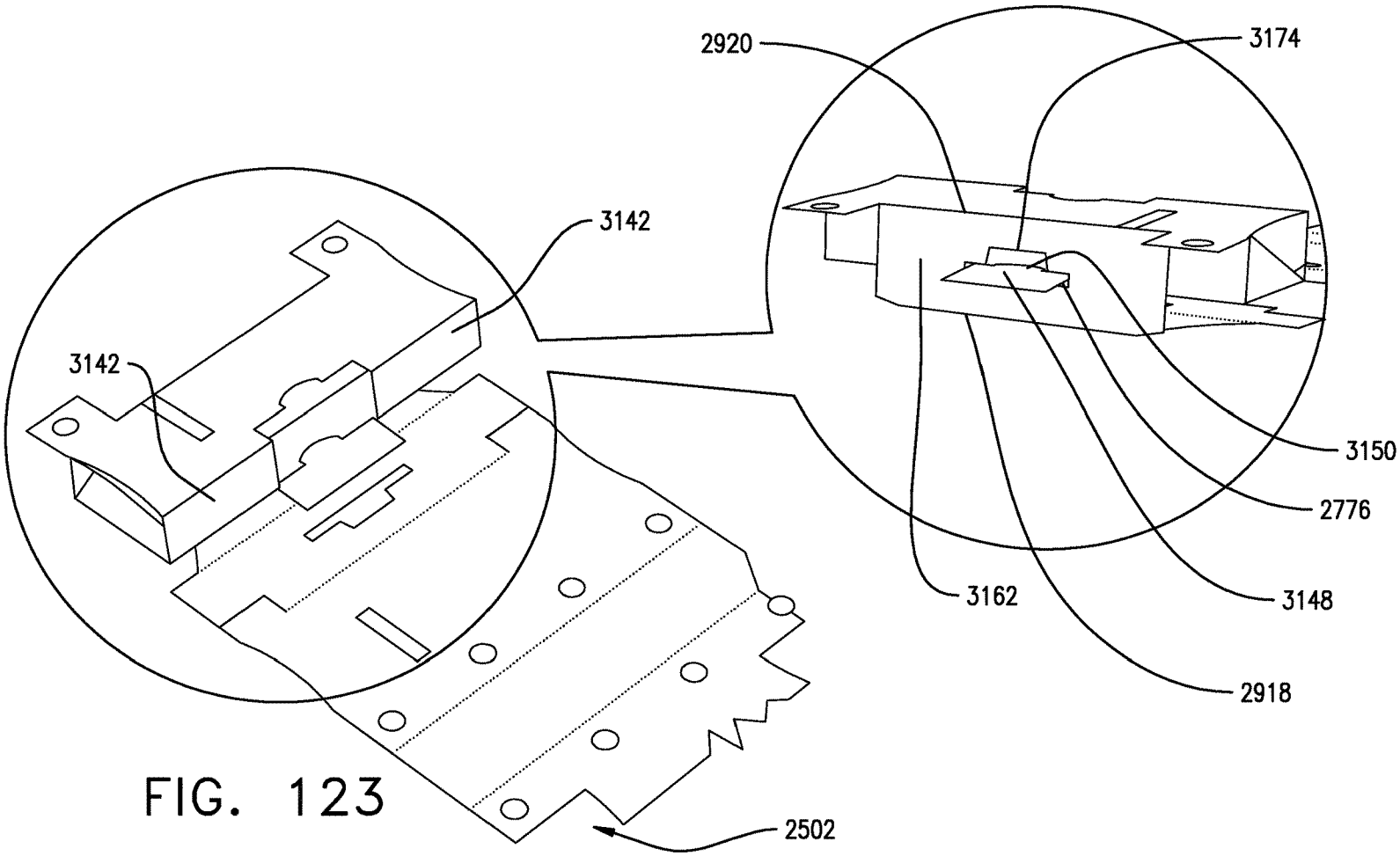

FIG. 123 shows folding of a portion 3162 about internal fold line 2918 such that portion 3162 lies generally perpendicular to the plane of internal structural portion 2502 and generally parallel to portion 3142.

Figure 124:
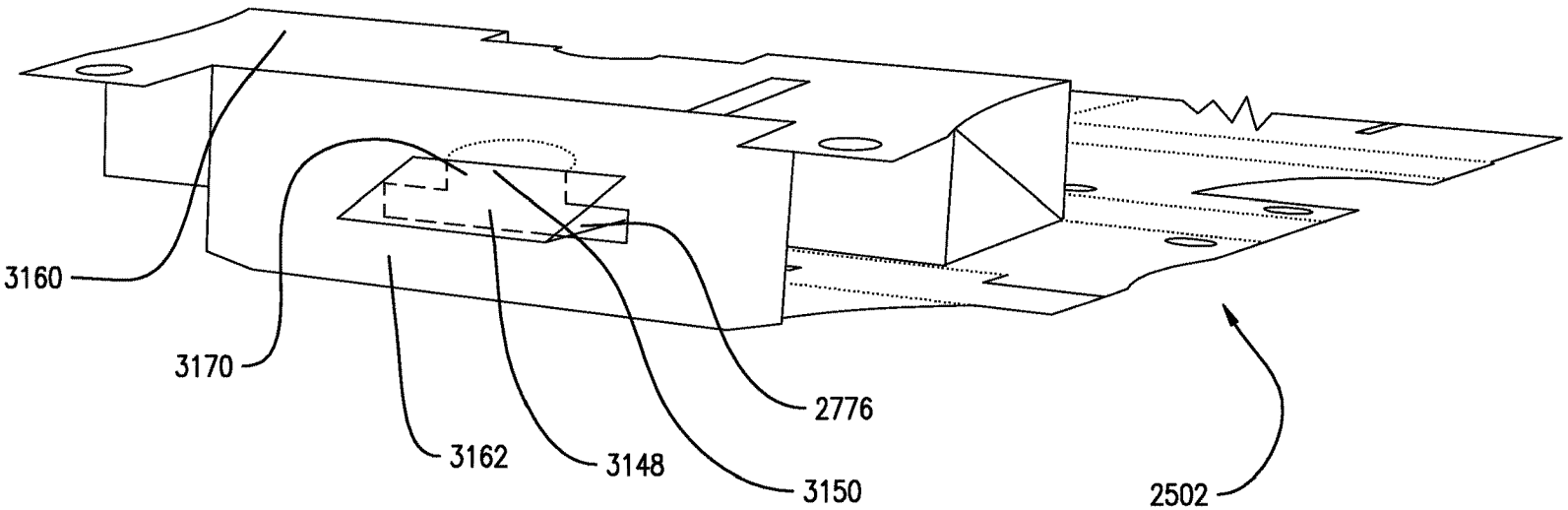

FIG. 124 shows slight mutual unfolding of portions 3146 and 3148 about internal fold line 2936 so that they lie at about 20 degrees with respect to each other and so that end tab portion 3150 engages a tab socket portion 3170 defined in mesa shaped slot 2776.

Figure 125:
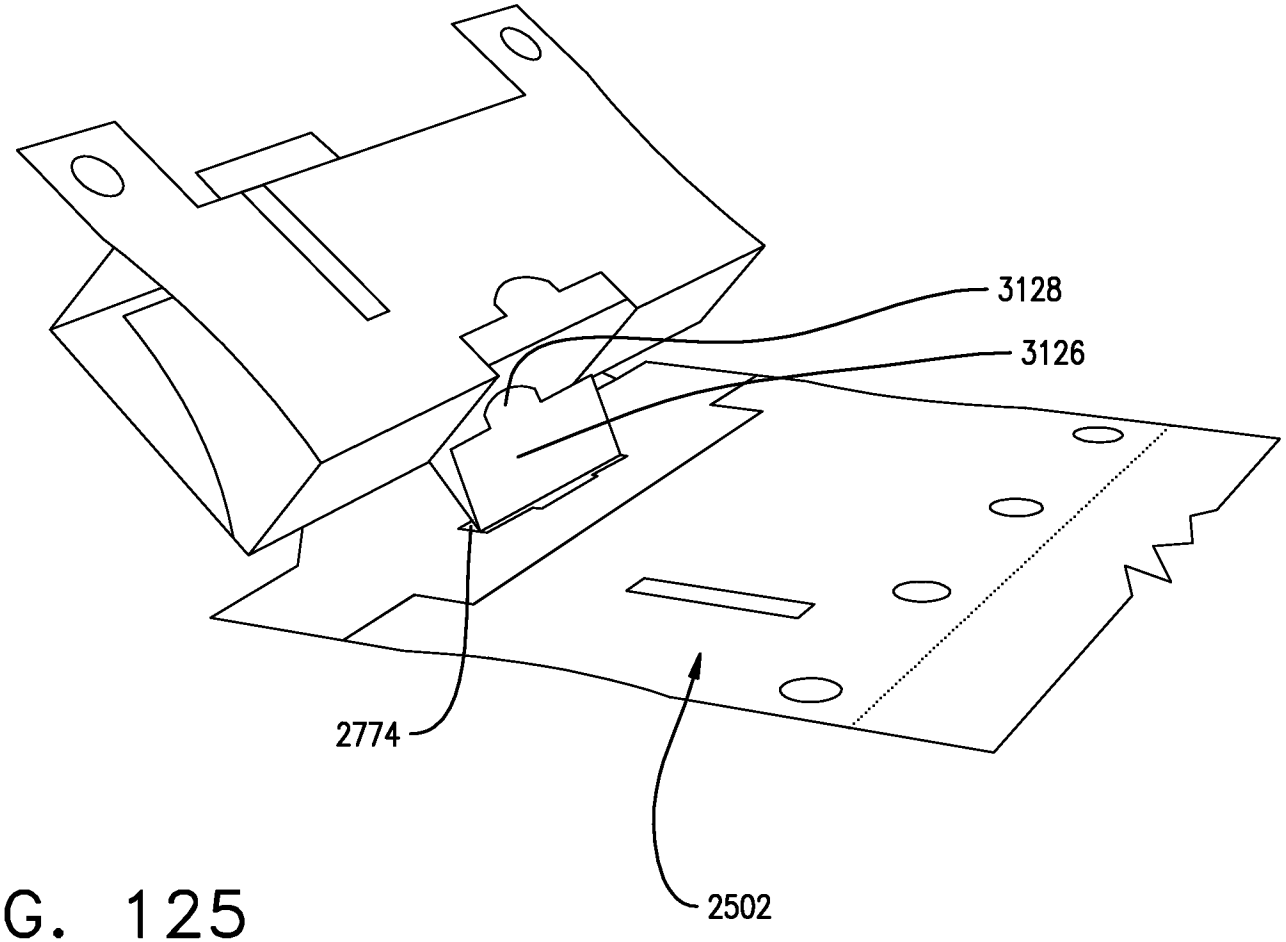

FIG. 125 shows partial insertion of folded over flap portions 3124 & 3126 in mesa shaped slot 2774.

Figure 126:
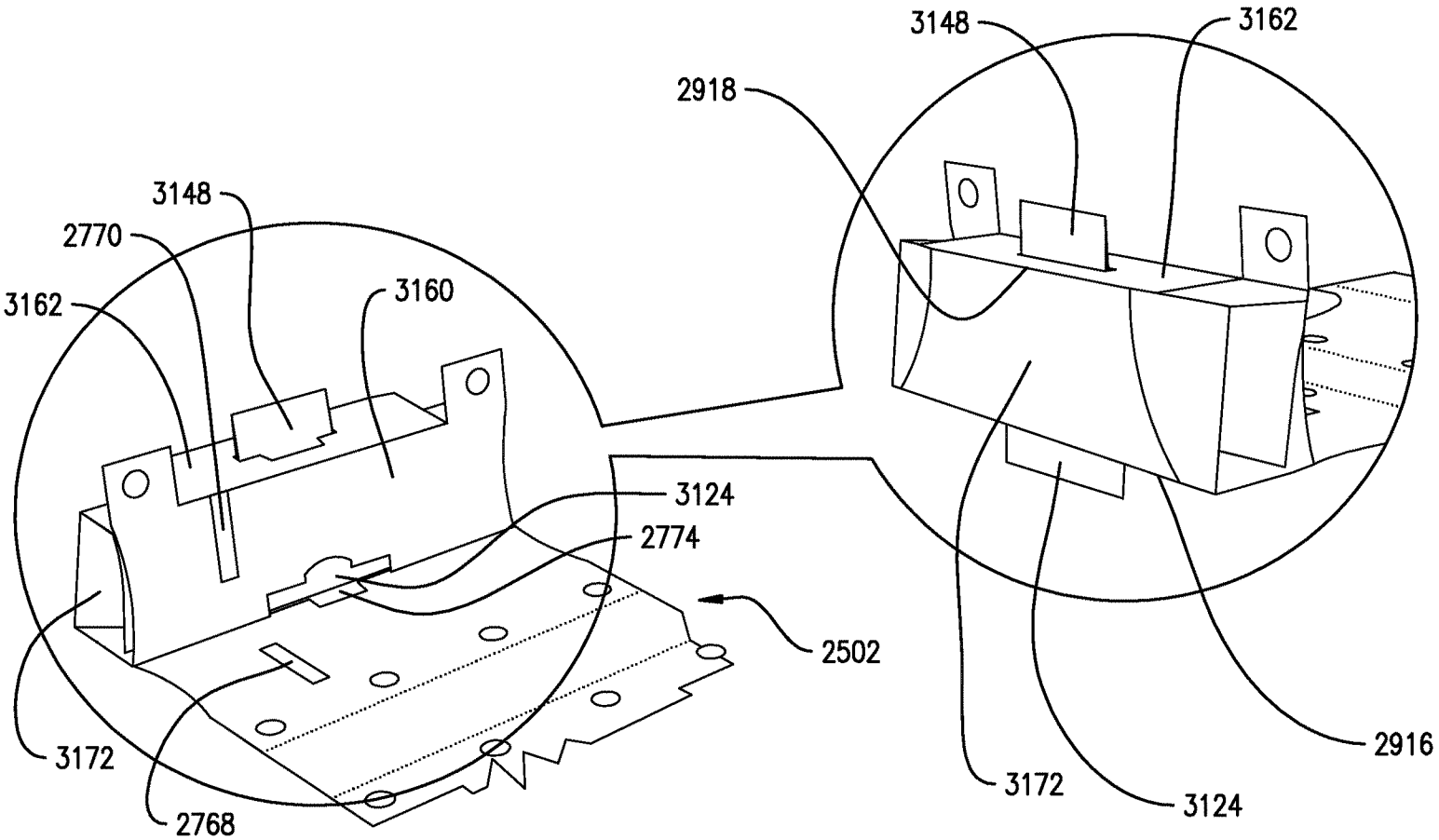
Figure 127:
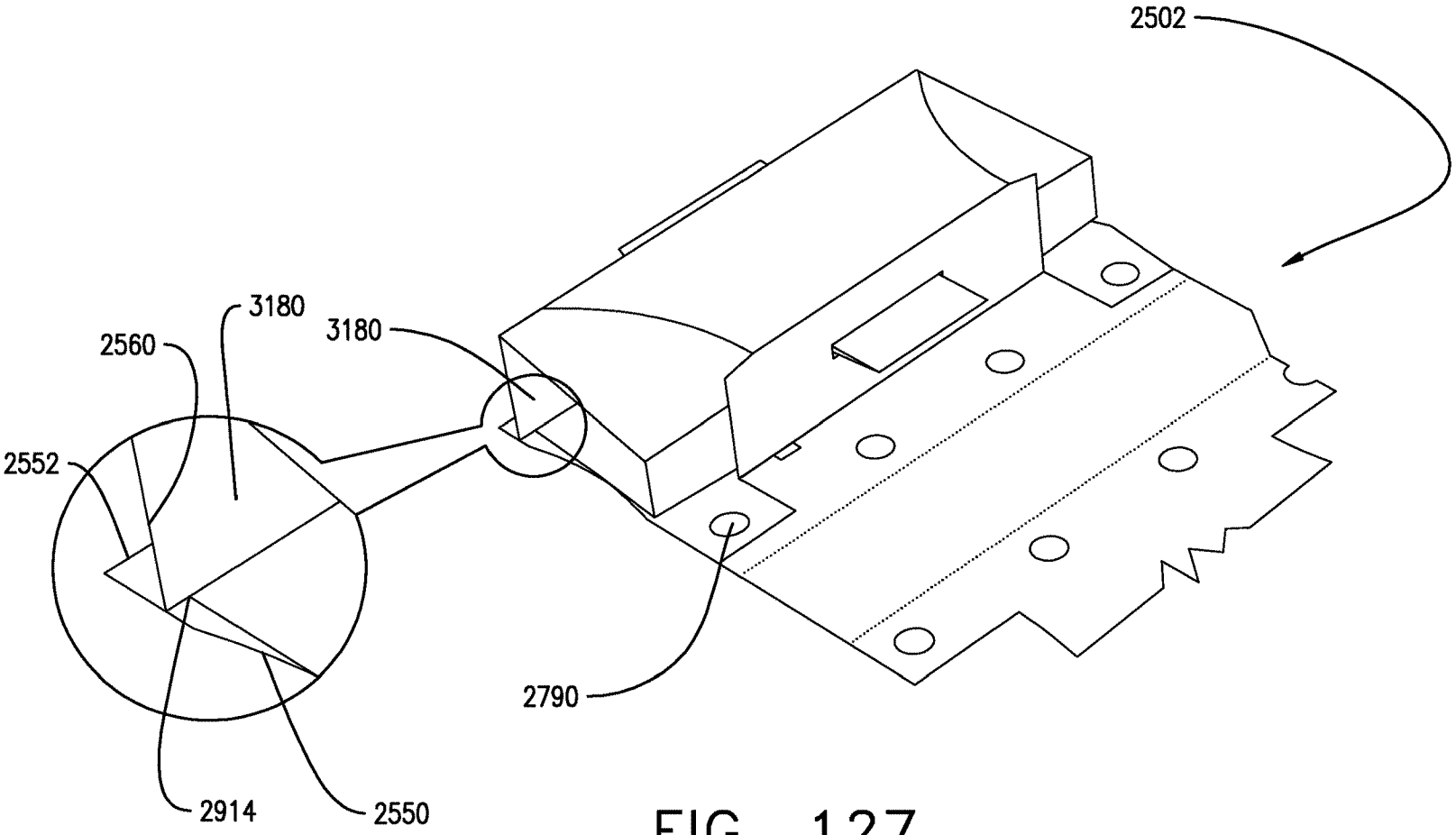

FIG. 126 shows folding of a portion 3172 about an internal fold line 2916 such that portion 3172 lines generally perpendicular to the plane of internal structural portion 2502. FIG. 127 also shows complete insertion of folded over flap portions 3124 and 3126 in mesa shaped slot 2774.

FIG. 127 shows folding of a portion 3180 about internal fold line 2914 such that portion 3180 lines generally perpendicular to the plane of internal structural portion 2502.

Figure 128:
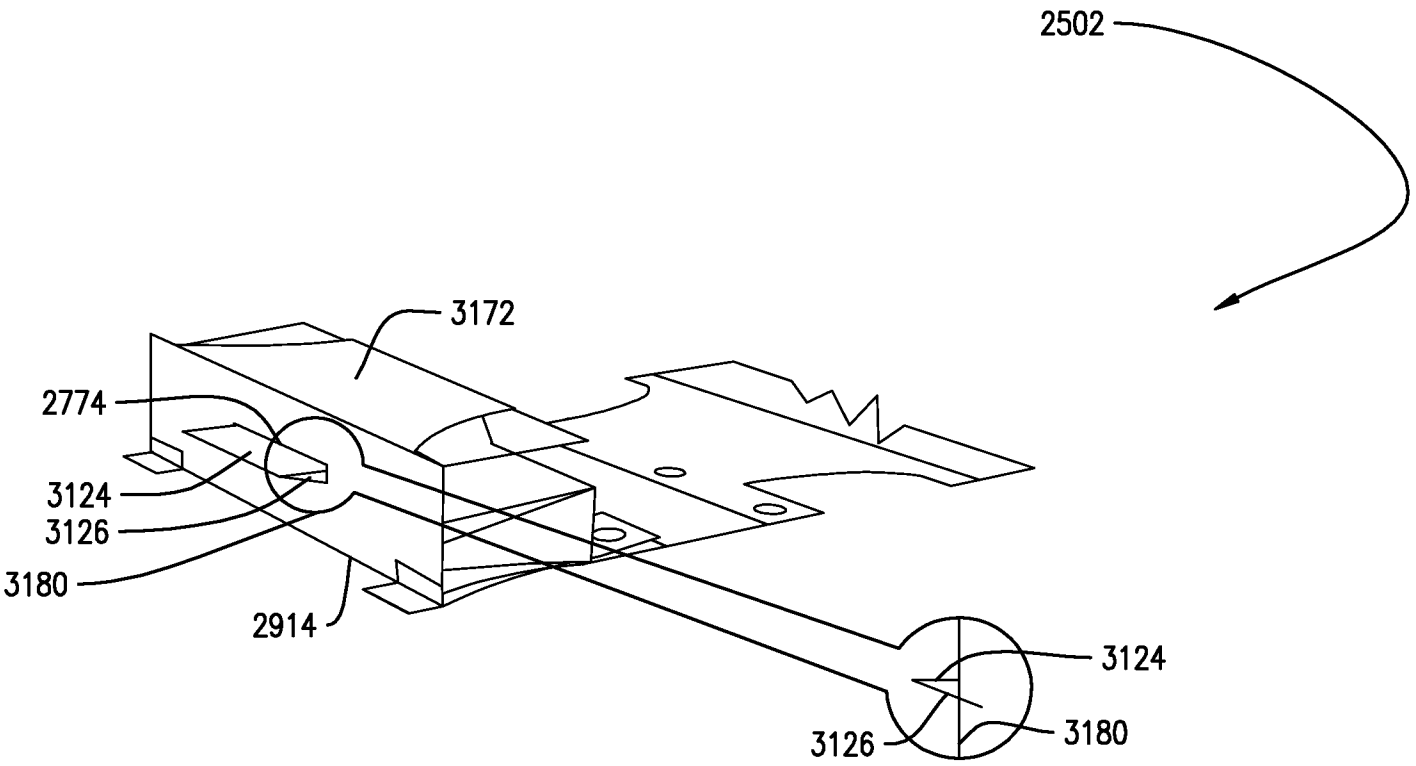

FIG. 128 shows slight mutual unfolding of flap portions 3124 and 3126 about internal fold line 2926 so that they lie at about 20 degrees with respect to each other and so that end tab portion 3128 engages a tab socket portion 3174 defined in mesa shaped slot 2774.

Figure 129:
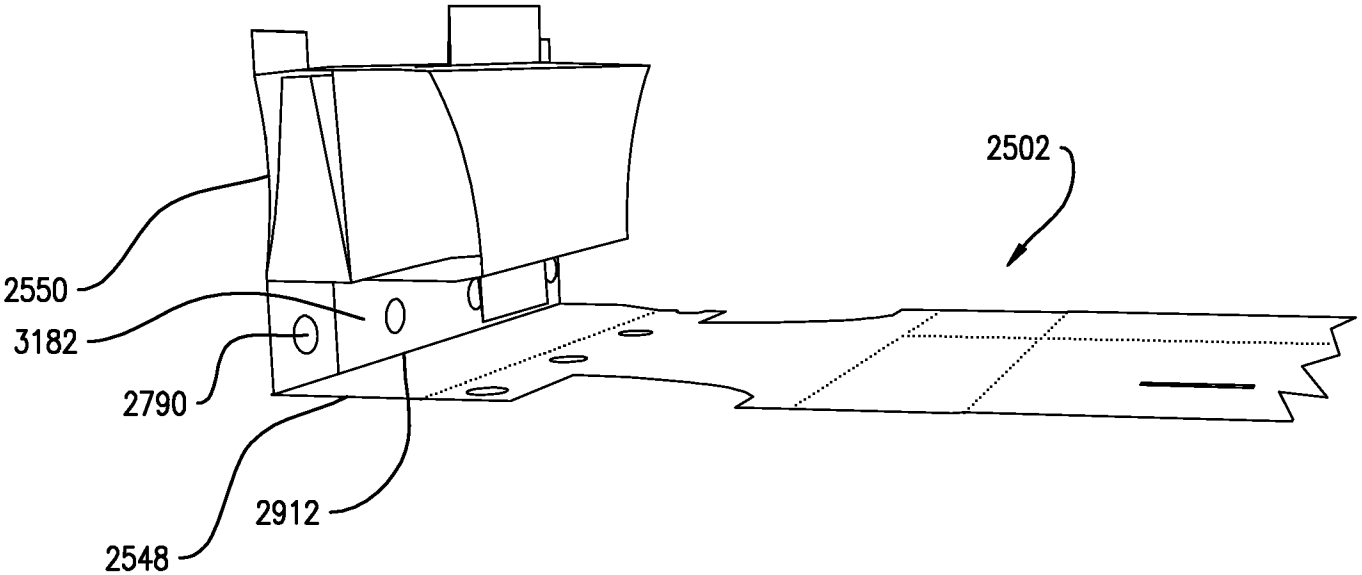

FIG. 129 shows folding of a portion 3182 about internal fold line 2912 such that portion 3182 lies generally perpendicular to the plane of internal structural portion 2502.

Figure 130:
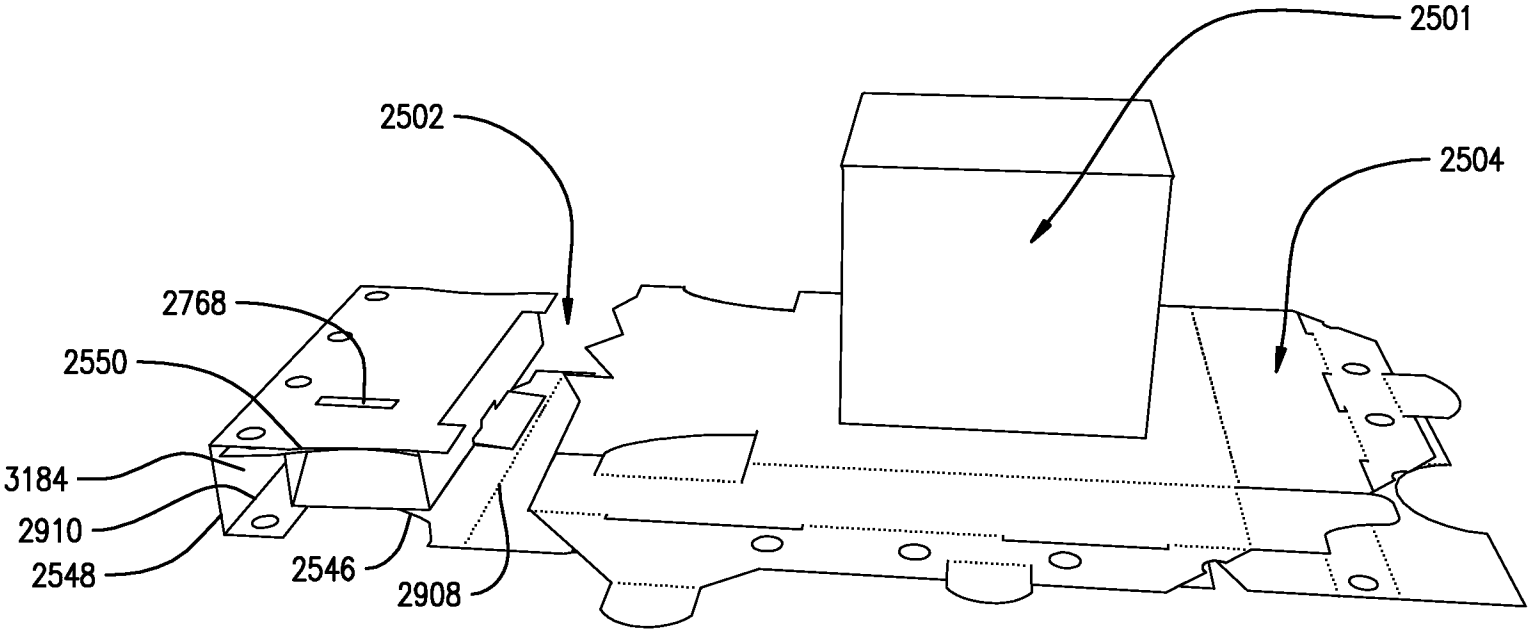

FIG. 130 shows folding of a portion 3184 about internal fold line 2910 such that portion 3184 lies generally perpendicular to the plane of internal structural portion 2502.

Figure 131:
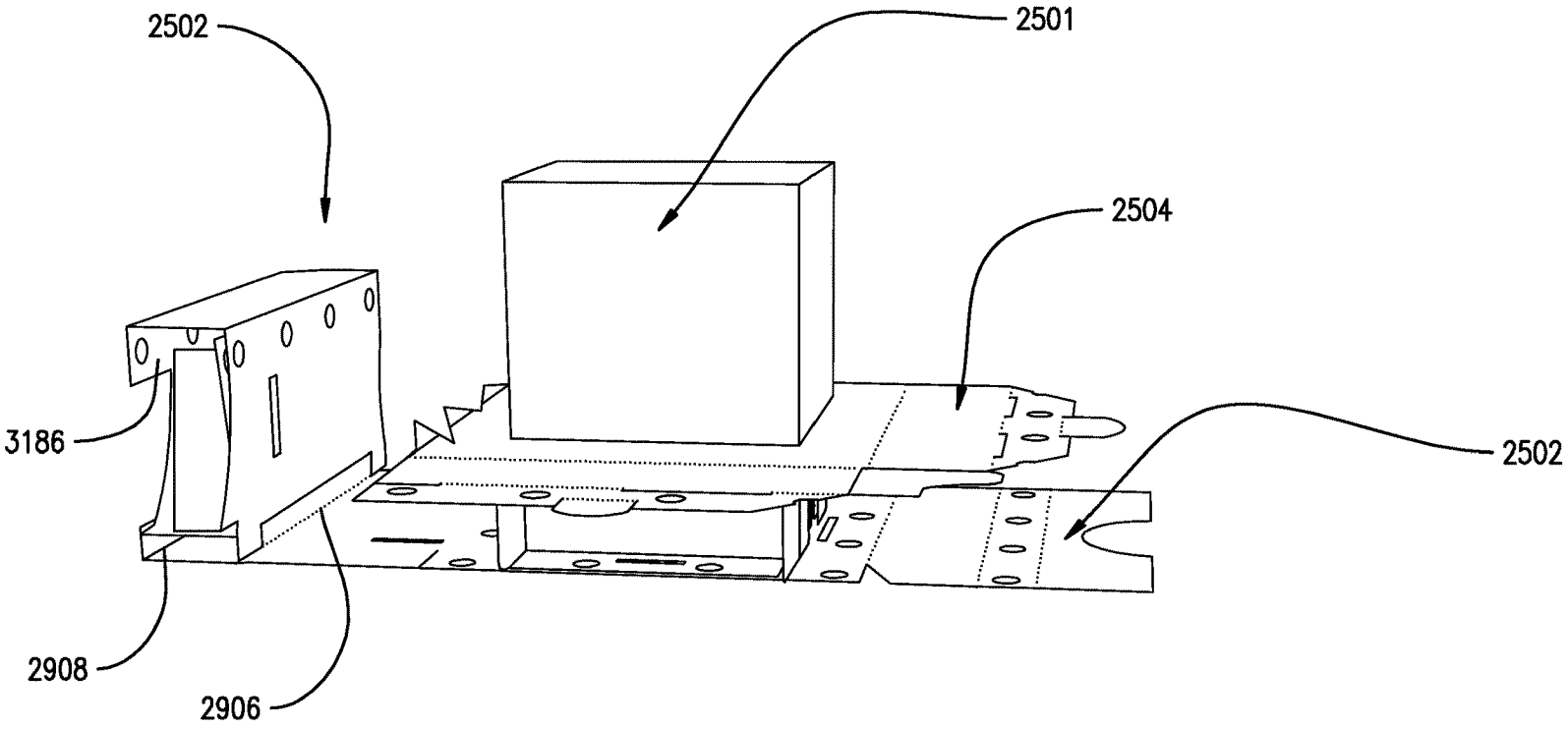

FIG. 131 shows folding of a portion 3186 about internal fold line 2908 such that portion 3186 lies generally perpendicular to the plane of internal structural portion 2502.

Figure 132:
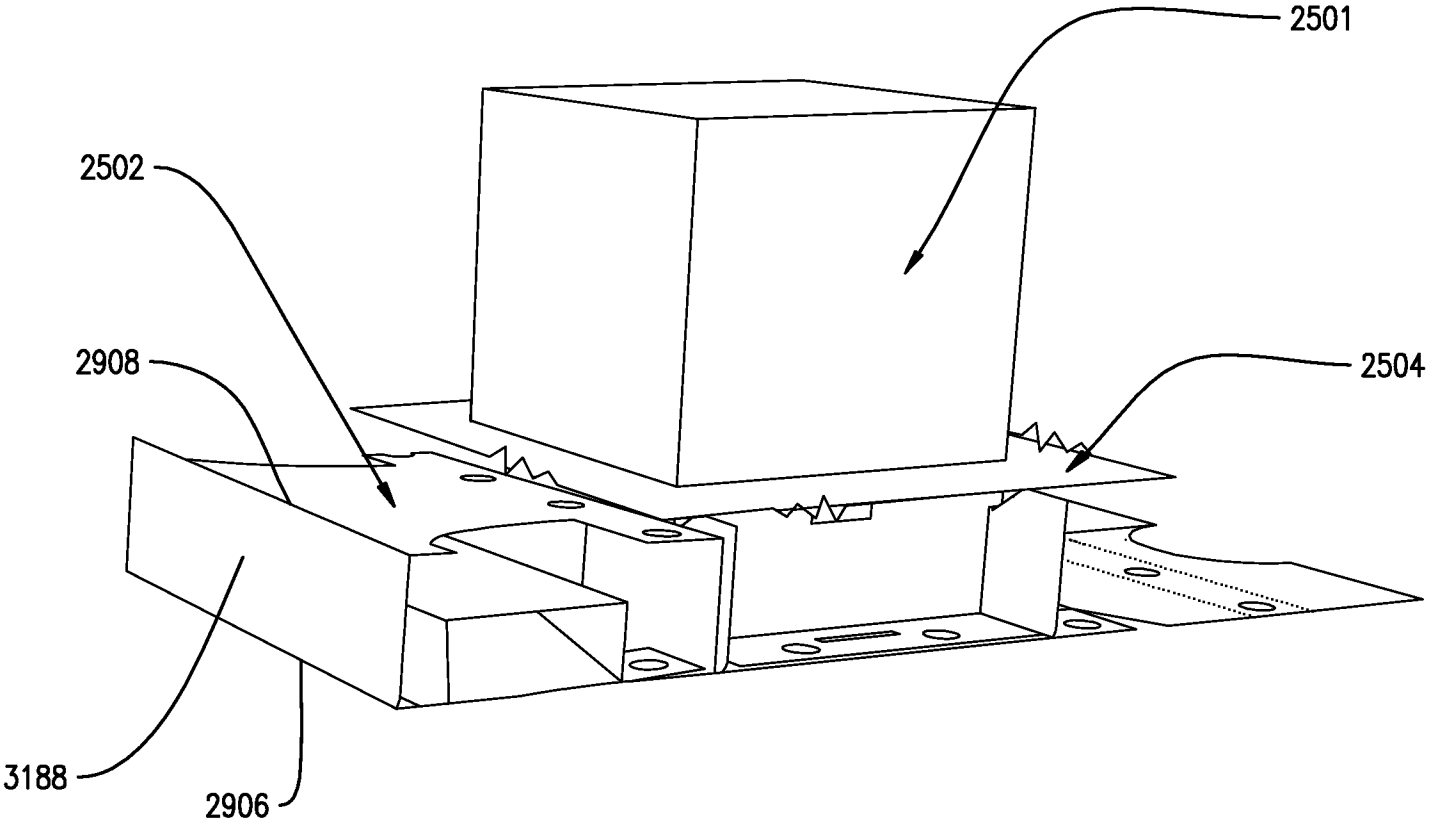

FIG. 132 shows folding of a portion 3188 about internal fold line 2906 such that portion 3188 lies generally perpendicular to the plane of internal structural portion 2502.

FIG. 133 shows folding of a portion 3192 about internal fold line 2900 such that portion 3192 lies generally perpendicular to the plane of internal structural portion 2502.

FIG. 134 shows folding of a portion 3194 about internal fold line 2902 such that portion 3194 lies generally perpendicular to the plane of internal structural portion 2502.

FIG. 135 shows folding of a portion 3196 about internal fold line 2904 such that portion 3196 lies generally perpendicular to the plane of internal structural portion 2502.

FIG. 136 shows folding of a side section 3200, which is part of top and side portion 2504, about internal fold line 3022 such that side section 3200 lies generally perpendicular to the plane of the remainder of top and side portion 2504.

FIG. 137 shows folding of flaps 3202 and 3204, defined by respective cuts 2812 and 2814, about respective internal fold lines 3020 and 3034 (not seen in FIG. 137) so that flaps 3202 and 3204 lie generally parallel to the plane of the remainder of top and side portion 2504.

FIG. 138 shows folding of tabs 3212 and 3214, defined by respective cuts 2678 and 2684, about respective internal fold lines 3012 and 3010 so as to lie generally parallel to the plane of the remainder of top and side portion 2504.

FIG. 139 shows initial folding of a portion 3216, forming part of side section 3200, about mutually coaxial internal fold lines 3014, 3016 and 3018 such that portion 3216 lies generally at a 45 degree angle with respect to the plane of the remainder of side section 3200.

FIG. 140 shows further folding of portion 3216, forming part of side section 3200, about mutually coaxial internal fold lines 3014, 3016 and 3018 such that portion 3216 lies generally at a 60 degree angle with respect to the plane of the remainder of side section 3200. It is further seen that tabs 3212 and 3214 are partially inserted into respective slots 2762 and 2766.

FIG. 141 shows final folding of portion 3216, forming part of side section 3200, about mutually coaxial internal fold lines 3014, 3016 and 3018 such that portion 3216 lies generally perpendicular to the plane of the remainder of side section 3200. It is further seen that tabs 3212 and 3214 are fully inserted into respective slots 2762 and 2766.

FIG. 142 shows folding of flaps 3230 and 3232 defined by respective cuts 2662, 2664, 2666, & 2668 and 2640, 2642, 2644 & 2646 about respective internal fold lines 2978 and 2982 to lie adjacent and generally parallel to portion 3196.

FIG. 143 shows folding of an end section 3250, forming part of top and side portion 2504, about internal fold line 2980, such that end section 3250 lies generally perpendicular to the plane of the remainder of top and side portion 2504.

FIG. 144 shows folding of a tab 3252, defined by respective cuts 2652, 2654 and 2656, about internal fold line 2970 so as to lie generally parallel to the plane of the remainder of top and side portion 2504.

FIG. 145 shows initial folding of a portion 3254, forming part of end section 3250, about mutually coaxial internal fold lines 2972, 2974 and 2976, such that portion 3254 lies generally at a 45 degree angle with respect to the plane of the remainder of end section 3250. It is seen that tab 3252 is partially inserted into slot 2760.

FIG. 146 shows final folding of portion 3254, forming part of end section 3250, about mutually coaxial internal fold lines 2972, 2974 and 2976, such that portion 3254 lies generally perpendicular to the plane of the remainder of end section 3250. It is noted that tab 1252 is fully inserted into slot 2760.

FIG. 147 shows folding of flaps 3260 and 3262 about respective internal fold lines 2992 and 2998 to lie adjacent and generally parallel to portion 3188.

FIG. 148 shows folding of bottom portion 2506 about internal fold line 2990 such that a portion 3264 thereof lies adjacent and generally parallel to portion 3188 and generally perpendicular to a top and side portion 2504.

FIG. 149 shows folding of respective tabs 3268, 3270, 3272, 3274, 3276 and 3278, defined by respective cuts 2694, 2698, 2702, 2706, 2710 and 2714 (FIGS. 103A & 103B), about respective internal fold lines 3042, 3044, 2996, 2998, 3048 and 3046 so as to each lie generally perpendicular to the plane of the remainder of bottom portion 2506.

It may be appreciated that FIG. 149 shows a partially completed hand phylactery including subassembly 2501, which includes one compartment.

Reference is now made to FIG. 150, which is a simplified illustration of a structural insert 3300, which is preferably die cut from animal skin, preferably parchment which is compliant with the requirements of Jewish law. The structural insert 3300 preferably includes a central, square portion 3302, having flaps 3304, 3306, 3308 and 3310 extending outwardly therefrom.

Flap 3304 preferably includes a pair of mutually parallel side edges 3316 and 3318 and an end edge 3320 having a generally rounded rectangular recess 3322 formed therein.

Flap 3306 preferably includes a pair of mutually parallel side edges 3326 and 3328 and an end edge 3330 having a generally rounded rectangular recess 3332 formed therein.

Flap 3308 includes a first side edge including an inclined edge portion 3340, a straight edge portion 3342, a perpendicular edge portion 3344, which extends perpendicular to straight edge portion 3342 and a further straight edge portion 3346. Flap 3308 also includes a second side edge including an inclined edge portion 3350, a straight edge portion 3352, a perpendicular edge portion 3354, which extends perpendicular to straight edge portion 3352 and a further straight edge portion 3356. A straight end edge 3360 joins first and second side edges.

Flap 3310 includes a first side edge including an inclined edge portion 3370, a straight edge portion 3372, a perpendicular edge portion 3374, which extends perpendicular to straight edge portion 1372 and a further straight edge portion 3376. Flap 3310 also includes a second side edge including an inclined edge portion 3380, a straight edge portion 3382, a perpendicular edge portion 3384, which extends perpendicular to straight edge portion 3382 and a further straight edge portion 3386. A straight end edge 3390 joins first and second side edges.

Four internal fold lines 3404, 3406, 3408 and 3410 are defined, as shown, between central portion 3302 and respective flaps 3304, 3306, 3308 and 3310. Two additional internal fold lines 3414 and 3416 are defined in flap 3308 between a main portion 3328 of flap 1308 and respective side tabs thereof 3434 and 3436. Two additional internal fold lines 3418 and 3420 are defined in flap 3310 between a main portion 3448 of flap 3310 and respective side tabs thereof 3450 and 3452.

FIG. 151 shows folding of flaps 3304 and 3306 and tabs 3434, 3436 and 3450 and 3452 about respective internal fold lines 3404, 3406, 3414, 3416, 3418 and 3420 to lie generally perpendicular to the plane of the remainder of the structural insert 3300.

FIG. 152 shows folding of flap 3308 about internal fold line 3408 to lie generally perpendicular to the plane of the remainder of the structural insert 3300.

FIG. 153 shows folding of flap 3310 about internal fold line 3410 to lie generally perpendicular to the plane of the remainder of the structural insert 3300.

Reference is now made to FIGS. 154-156, which illustrate insertion of structural insert 3300 into the interior of subassembly 2501.

FIG. 154 shows the structural insert 3300 as fully external to the corresponding interior compartment of subassembly 2501. It is appreciated that FIG. 154 also shows the temporary reopening of retaining flap 2251 to enable insertion of structural insert 3300.

FIGS. 155 and 156 show two stages of insertion of structural insert 3300 into the interior of subassembly 2501.

FIG. 157 shows the structural insert 3300 fully inserted into the interior of subassembly 2501.

Reference is now made to FIG. 158, which shows a phylactery parchment scroll 3400 inserted into the compartment in subassembly 2501 and secured it by refolding retaining flap 2251 to engage with respective slot 2256.

Figure 159:
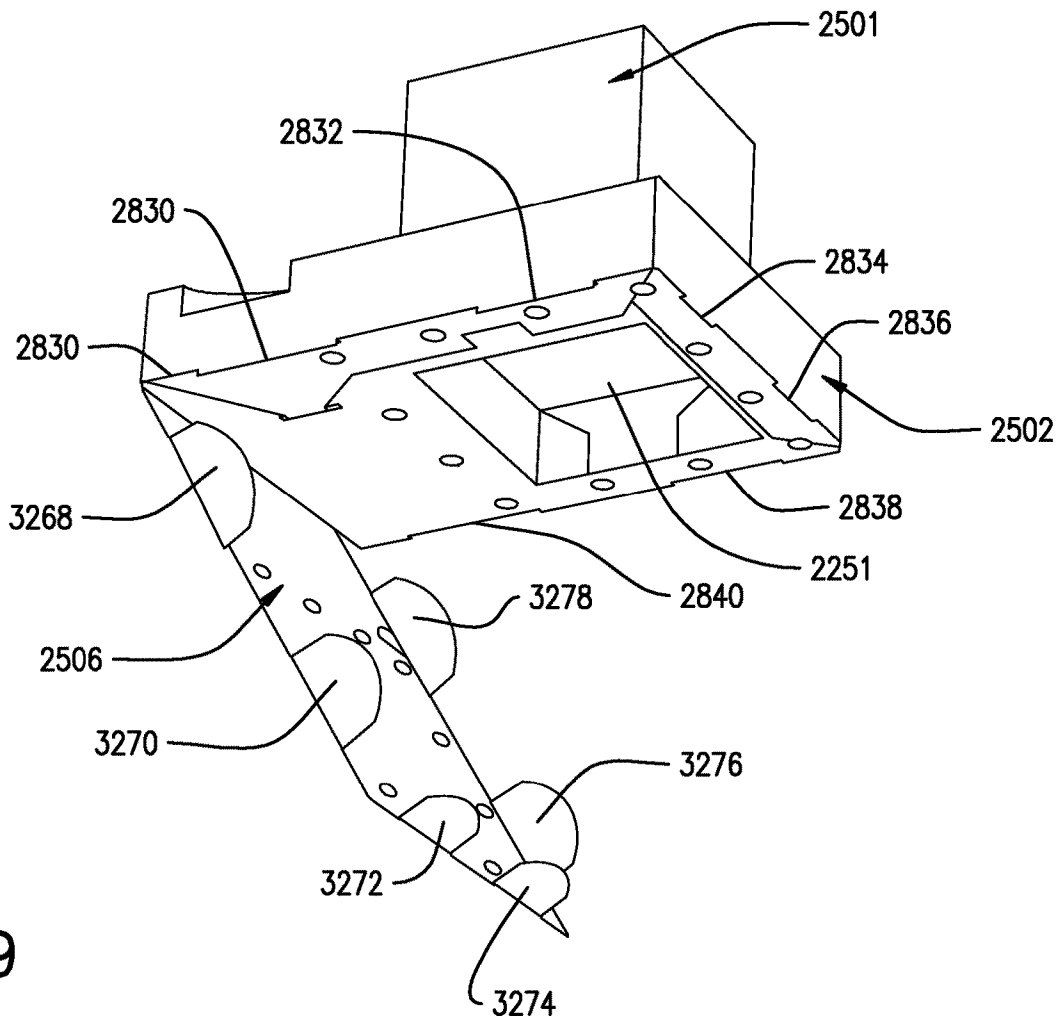

Reference is now made to FIGS. 159-161C, which illustrate closure of the base of the hand phylactery. FIGS. 159 and 160 show two stages in folding of bottom portion 2506 having formed thereon flaps 3268, 3270, 3272, 3274, 3276 and 3278 and insertion of flaps 3268, 3270, 3272, 3274, 3276 and 3278 into respective slots defined by respective flap receiving cuts 2830, 2832, 2834, 2836, 2838 and 2840, formed in top and side portion 2504. FIGS. 161A, 161B and 161C show partial insertion of flaps 3268, 3270, 3272, 3274, 3276 and 3278 into respective slots defined by respective flap receiving cuts 2830, 2832, 2834, 2836, 2838 and 2840, formed in top and side portion 2504 from three different directions.

FIG. 162 shows a complete hand phylactery which is ready to be sewn together and associated with leather straps.

It will be appreciated by persons skilled in the art that the present invention is not limited by what has been particularly described hereinabove. Rather the scope of the present invention includes combinations and subcombinations of the various features described as well as modifications and variations thereof which would occur to persons skilled in the art upon reading the foregoing description and which are not in the prior art.

The invention claimed is:

1. A method of manufacturing a phylactery, the method comprising:

providing an initial stage phylactery workpiece formed of animal skin, said animal skin having a skin outer surface and a skin inner surface, said initial stage phylactery workpiece having a phylactery outer surface corresponding to said skin outer surface and a phylactery inner surface corresponding to said skin inner surface;

cutting said initial stage phylactery workpiece to define a second stage phylactery workpiece, said cutting including forming at least outline cut lines, interior cut lines, perforated lines and incised lines, said incised lines extending only partially through a thickness of said second stage phylactery workpiece from said phylactery outer surface corresponding to said skin outer surface; and folding said second stage phylactery workpiece along at least some of said incised lines, inwardly toward said phylactery inner surface, corresponding to said skin inner surface, about axes defined by said incised lines, and folding said second stage phylactery workpiece along at least some of said perforated lines, outwardly toward said phylactery outer surface, corresponding to said skin outer surface, about axes defined by said perforated lines to define a phylactery housing whose entire outer surface is entirely defined by said phylactery outer surface corresponding to said skin outer surface, said phylactery housing including a generally planar base portion and a parchment compartment portion, said parchment compartment portion extending perpendicularly from said base portion, said parchment compartment portion having a square cross-section and said base portion having a rectangular cross section extending outwardly in a plane from said parchment compartment portion, said parchment compartment portion having an open end communicating with an interior of said base portion and said base portion having an end section, such that:

both said base portion and said parchment compartment portion are formed as a single piece of said animal skin; and said outer skin surface of said animal skin defines all of an outer surface of said base portion and said parchment compartment portion;

attaching a strap to said base portion of said phylactery housing at said end section; and locating a plurality of biblical passages written on at least one animal parchment within said parchment compartment portion of said phylactery housing, said folding defining a plurality of three-dimensional internal structural elements which provide rigidity and maintenance of dimensions and form, said folding defining a plurality of interlocking flaps and slots which provide rigidity, registration and precision of external surfaces of said phylactery, said plurality of interlocking flaps including widened end portions which extend fully through corresponding slots, said plurality of interlocking flaps including flaps formed with cuts to form tabs, and said plurality of interlocking flaps including flap portions which are positioned between widened end portions of other flaps.

2. A method of manufacturing a phylactery according to claim 1 wherein said folding defines a plurality of adjacent generally rectangular, mutually parallel compartments and also comprising inserting a structural insert into engagement with said compartments for maintaining them in mutually parallel adjacent relationship.

3. A method of manufacturing a phylactery according to claim 1 and wherein said animal skin has a thickness exceeding 0.3 mm.

4. A method of manufacturing a phylactery according to claim 1 and wherein said locating a plurality of biblical passages comprises:

inserting a phylactery parchment scroll into each of a plurality of mutually parallel compartments defined by said folding; and thereafter securing said plurality of mutually parallel compartments by folding retaining flaps into engagement with respective slots.

5. A method of manufacturing a phylactery, the method comprising:

providing an initial stage phylactery workpiece formed of animal skin, said animal skin having a skin outer surface and a skin inner surface, said initial stage phylactery workpiece having a phylactery outer surface corresponding to said skin inner surface and a phylactery inner surface corresponding to said skin outer surface;

cutting said initial stage phylactery workpiece to define a second stage phylactery workpiece, said cutting including forming at least outline cut lines, interior cut lines, perforated lines and incised lines, said incised lines extending only partially through a thickness of said second stage phylactery workpiece from said phylactery outer surface corresponding to said skin inner surface; and folding said second stage phylactery workpiece along at least some of said incised lines, inwardly toward said phylactery inner surface, corresponding to said skin outer surface, about axes defined by said incised lines, and folding said second stage phylactery workpiece along at least some of said perforated lines, outwardly toward said phylactery outer surface, corresponding to said skin inner surface, about axes defined by said perforated lines, to define a phylactery housing whose entire outer surface is entirely defined by said phylactery outer surface corresponding to said skin inner surface, said phylactery housing including a generally planar base portion and a parchment compartment portion, said parchment compartment portion extending perpendicularly from said base portion, said parchment compartment portion having a square cross-section and said base portion having a rectangular cross section extending outwardly in a plane from said parchment compartment portion, said parchment compartment portion having an open end communicating with an interior of said base portion and said base portion having an end section, such that:

both said base portion and said parchment compartment portion are formed as a single piece of said animal skin; and said inner skin surface of said animal skin defines all of an outer surface of said base portion and said parchment compartment portion;

attaching a strap to said base portion of said phylactery housing at said end section; and locating a plurality of biblical passages written on at least one animal parchment within said parchment compartment portion of said phylactery housing, said folding defining a plurality of three-dimensional internal structural elements which provide rigidity and maintenance of dimensions and form, said folding defining a plurality of interlocking flaps and slots which provide rigidity, registration and precision of external surfaces of said phylactery, said plurality of interlocking flaps including widened end portions which extend fully through corresponding slots, said plurality of interlocking flaps including flaps formed with cuts to form tabs, and said plurality of interlocking flaps including flap portions which are positioned between widened end portions of other flaps.

6. A method of manufacturing a phylactery according to claim 5 wherein said folding defines a plurality of adjacent generally rectangular, mutually parallel compartments and also comprising inserting a structural insert into engagement with said compartments for maintaining them in mutually parallel adjacent relationship.

7. A method of manufacturing a phylactery according to claim 5 and wherein said animal skin has a thickness exceeding 0.3 mm.

8. A method of manufacturing a phylactery according to claim 5 and wherein said locating a plurality of biblical passages comprises:

inserting a phylactery parchment scroll into each of a plurality of mutually parallel compartments defined by said folding; and thereafter securing said plurality of mutually parallel compartments by folding retaining flaps into engagement with respective slots.

* * * * *